US007635180B2

(12) United States Patent
Hattori et al.

(10) Patent No.: US 7,635,180 B2
(45) **Date of Patent: *Dec. 22, 2009**

(54) INK CARTRIDGE

(75) Inventors: Shingo Hattori, Nagoya (JP); Toyonori Sasaki, Anjo (JP); Tomohiro Kanbe, Bisai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 354 days.

This patent is subject to a terminal disclaimer.

(21) Appl. No.: 11/442,577

(22) Filed: May 30, 2006

(65) Prior Publication Data

US 2007/0070138 A1 Mar. 29, 2007

(30) Foreign Application Priority Data

Sep. 29, 2005 (JP) ..... 2005-284646
Nov. 28, 2005 (JP) ..... 2005-342686

(51) Int. Cl.
*B41J 2/175* (2006.01)

(52) U.S. Cl. ..... 347/86

(58) Field of Classification Search ..... 347/84, 347/85, 86, 87; 141/2, 141
See application file for complete search history.

(56) References Cited

U.S. PATENT DOCUMENTS 5,721,576 A * 2/1998 Barinaga ..... 347/85
6,033,064 A 3/2000 Pawlowski, Jr. et al.
6,170,937 B1 1/2001 Childers et al.
6,243,117 B1 6/2001 Brandon et al.
6,283,588 B1 9/2001 Brandon et al.
6,332,481 B1 * 12/2001 Shinada et al. ..... 141/18
6,477,956 B1 * 11/2002 Rea et al. ..... 101/466
6,786,581 B1 9/2004 Shinada et al.
6,942,327 B2 * 9/2005 Suzuki et al. ..... 347/86
7,278,722 B2 * 10/2007 Sasaki et al. ..... 347/86
7,328,987 B2 2/2008 Katayama et al.
2003/0071874 A1 4/2003 Ishizawa et al.
2005/0088497 A1 4/2005 Katayama et al.
2005/0104942 A1 5/2005 Katayama et al.
2005/0134663 A1 6/2005 Sasaki et al.
2005/0146577 A1 7/2005 Sasaki et al.

(Continued)

FOREIGN PATENT DOCUMENTS

CN 1603122 A 4/2005

(Continued)

*Primary Examiner*—Anh T. N. Vo
(74) *Attorney, Agent, or Firm*—Oliff & Berridge, PLC

(57) ABSTRACT

An ink cartridge includes a cartridge case enclosing an ink chamber; a path extending from the ink chamber to an exterior of the ink cartridge; a valve member provided in the path, the valve member having a first state in which communication between the ink chamber and the exterior of the ink cartridge along the path is permitted and a second state in which communication between the ink chamber and the exterior of the ink cartridge along the path is prevented; and an urging member provided on an ink chamber-side of the valve member in the path, the urging member being capable of urging the valve member along the path toward the exterior of the cartridge. The urging member is formed of a resin or rubber material having elasticity; and when the valve member is in the first state, the urging member is compressed in a direction of the path.

26 Claims, 86 Drawing Sheets

U.S. PATENT DOCUMENTS

| | | | | |
|---|---|---|---|---|
| 2007/0070137 | A1* | 3/2007 | Hattori et al. | 347/86 |
| 2007/0070139 | A1* | 3/2007 | Hattori et al. | 347/86 |

FOREIGN PATENT DOCUMENTS

| | | | |
|---|---|---|---|
| EP | 1 281 897 | A1 | 2/2003 |
| EP | 1 520 711 | A1 | 4/2005 |
| EP | 1 570 995 | A1 | 7/2005 |
| JP | A 08-300688 | | 11/1996 |
| JP | A-11-291516 | | 10/1999 |
| JP | A-2002-192739 | | 7/2002 |
| JP | A-2004-358980 | | 12/2004 |
| JP | A 2005-022198 | | 1/2005 |
| JP | A 2005-103866 | | 4/2005 |
| JP | A-2005-125741 | | 5/2005 |
| JP | A-2005-178348 | | 7/2005 |
| JP | U-311130 | | 7/2005 |
| JP | A-2005-238703 | | 9/2005 |
| JP | A-2005-246782 | | 9/2005 |

* cited by examiner

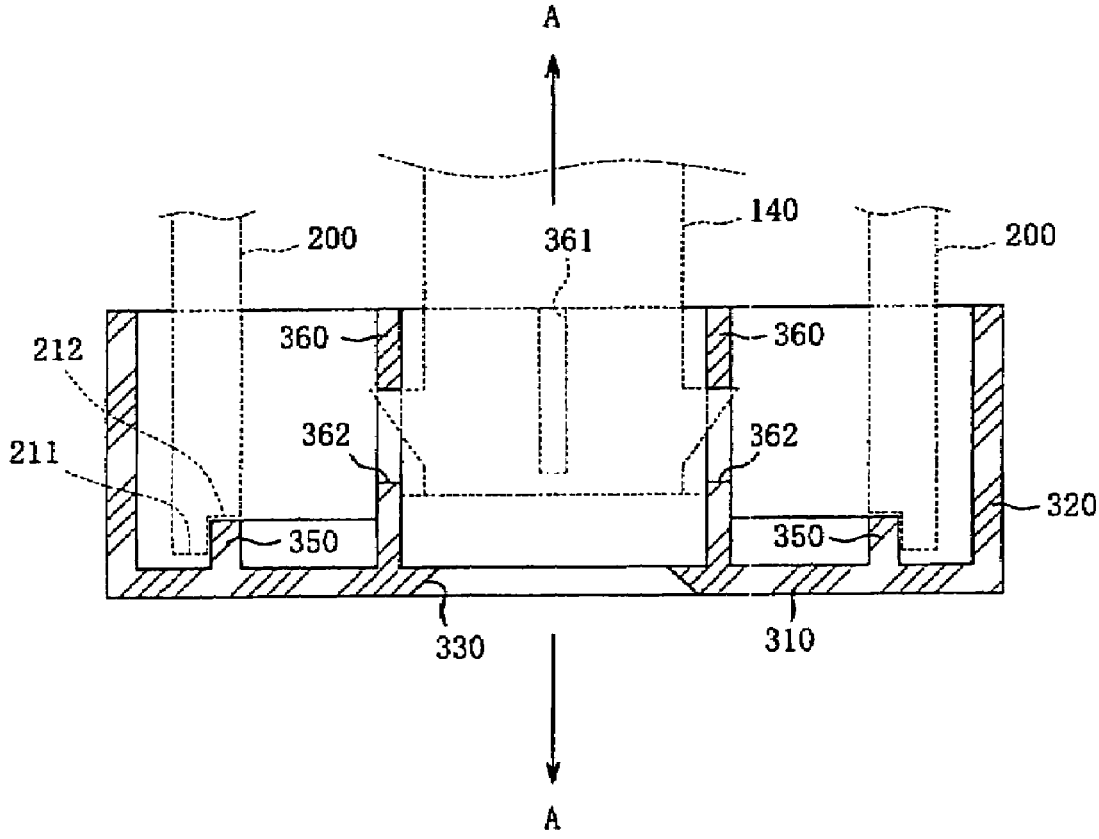
(a)
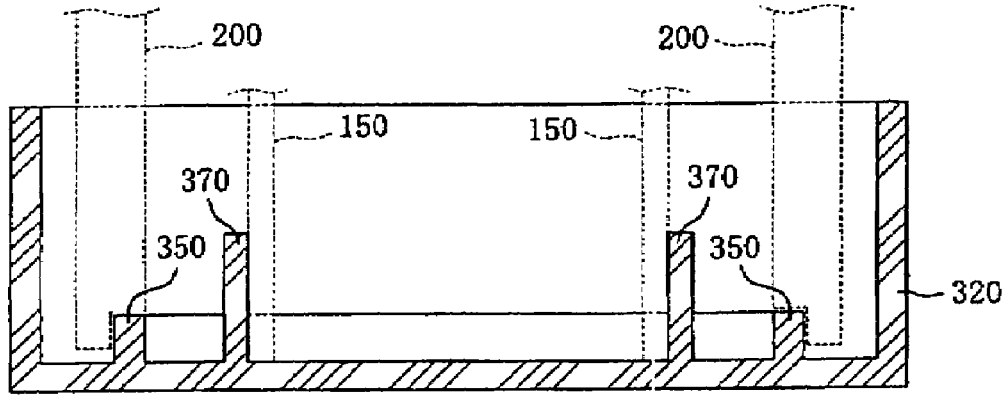
(b)
FIG. 6

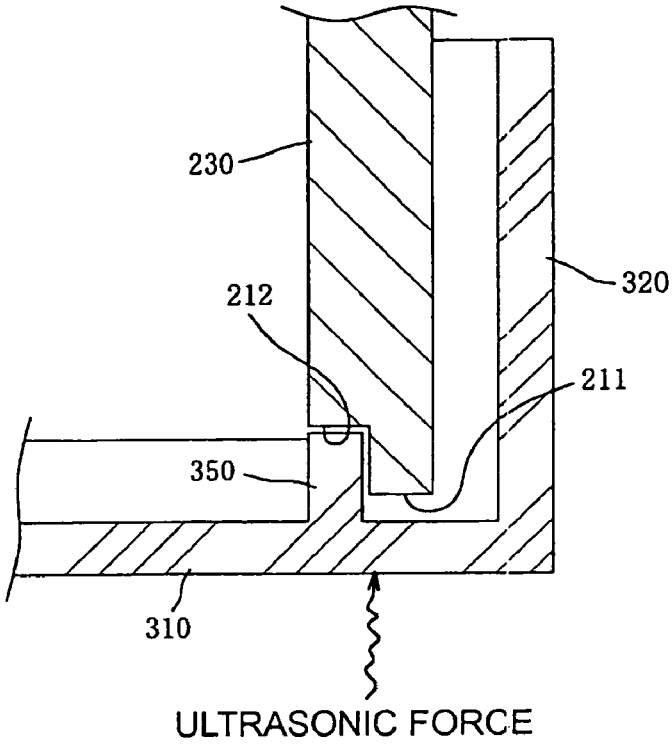
(a)
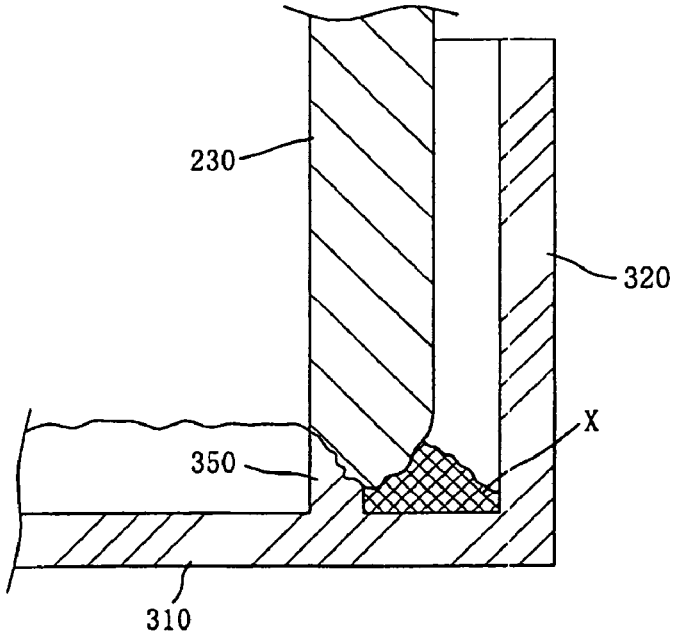
(b)
FIG. 24

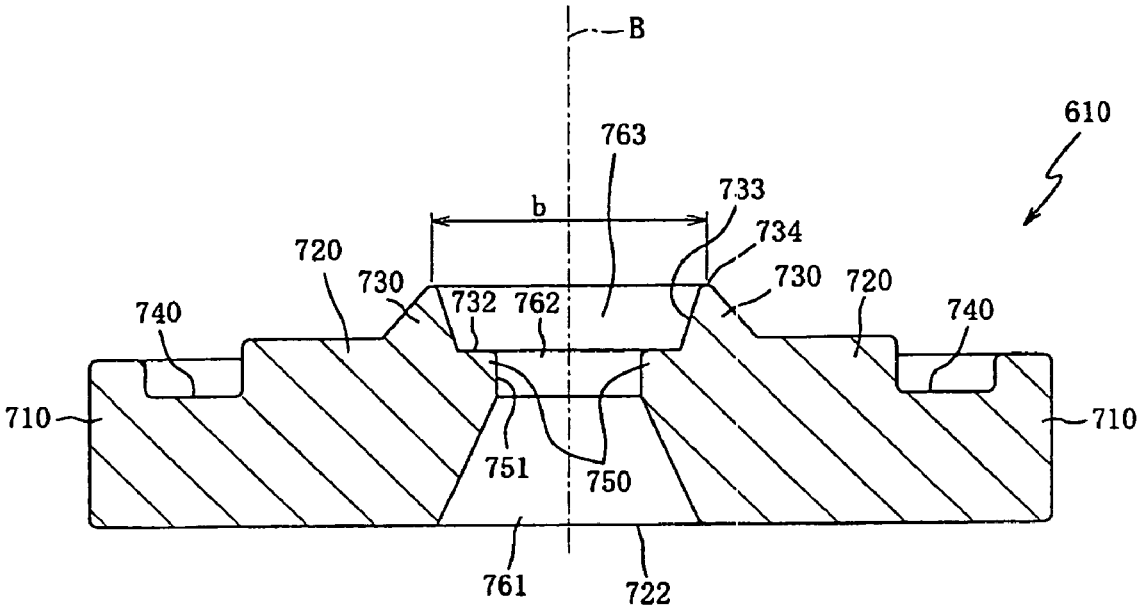
(a)
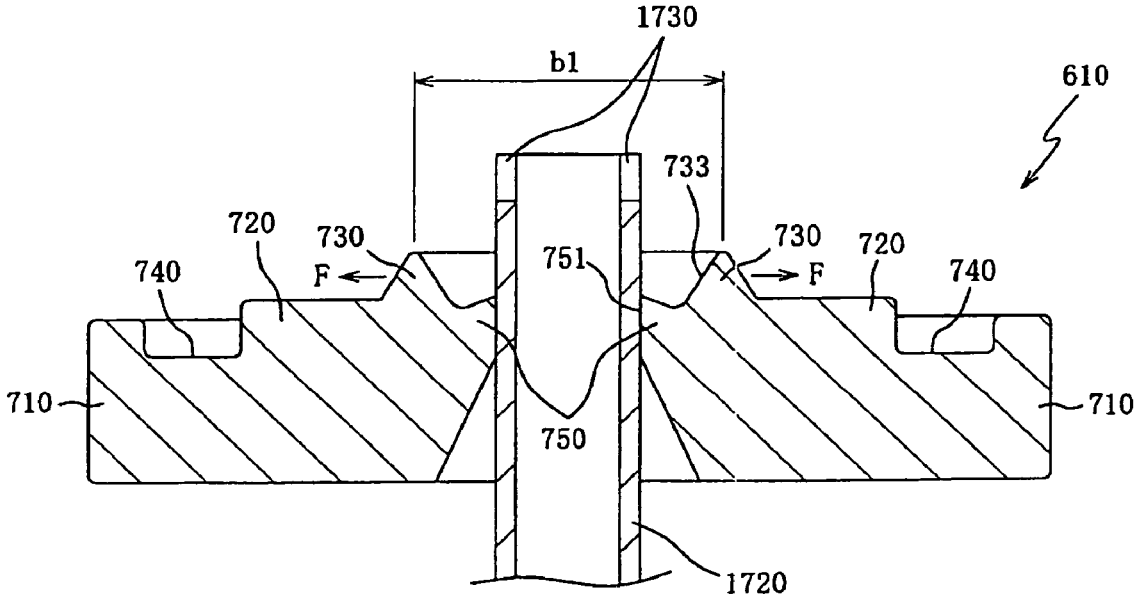
(b)
FIG. 28

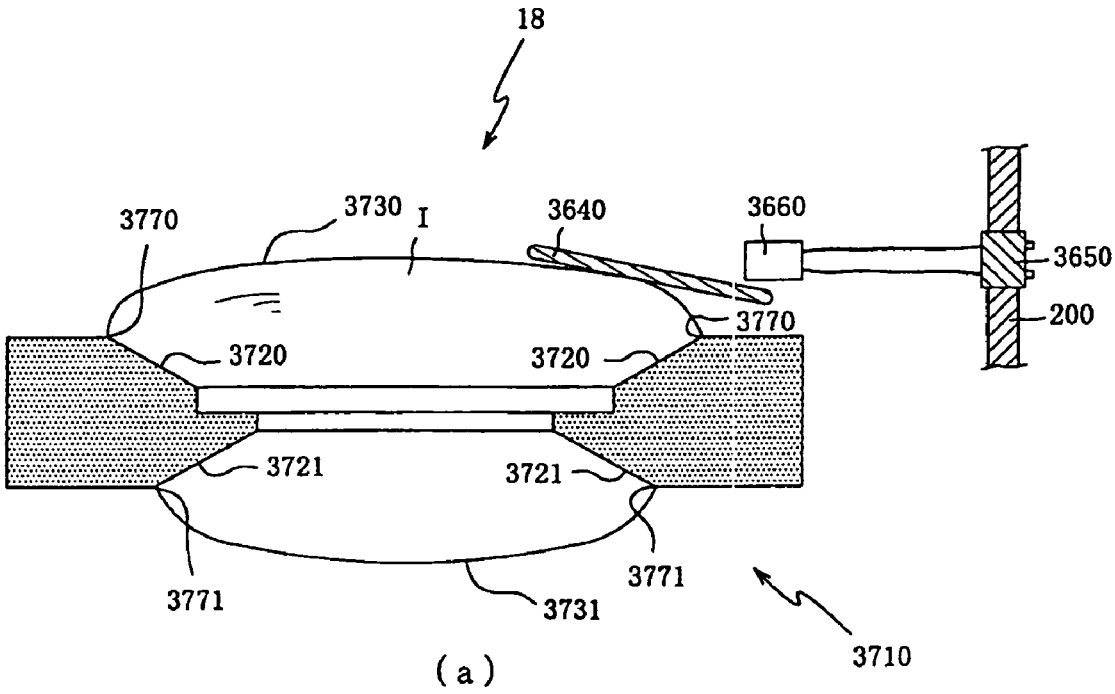
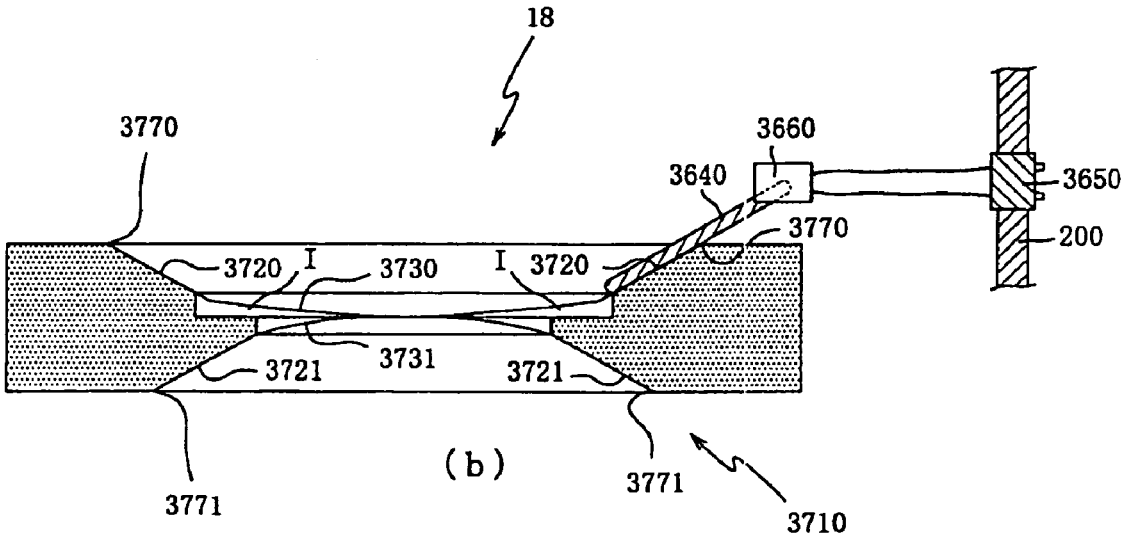
FIG. 48

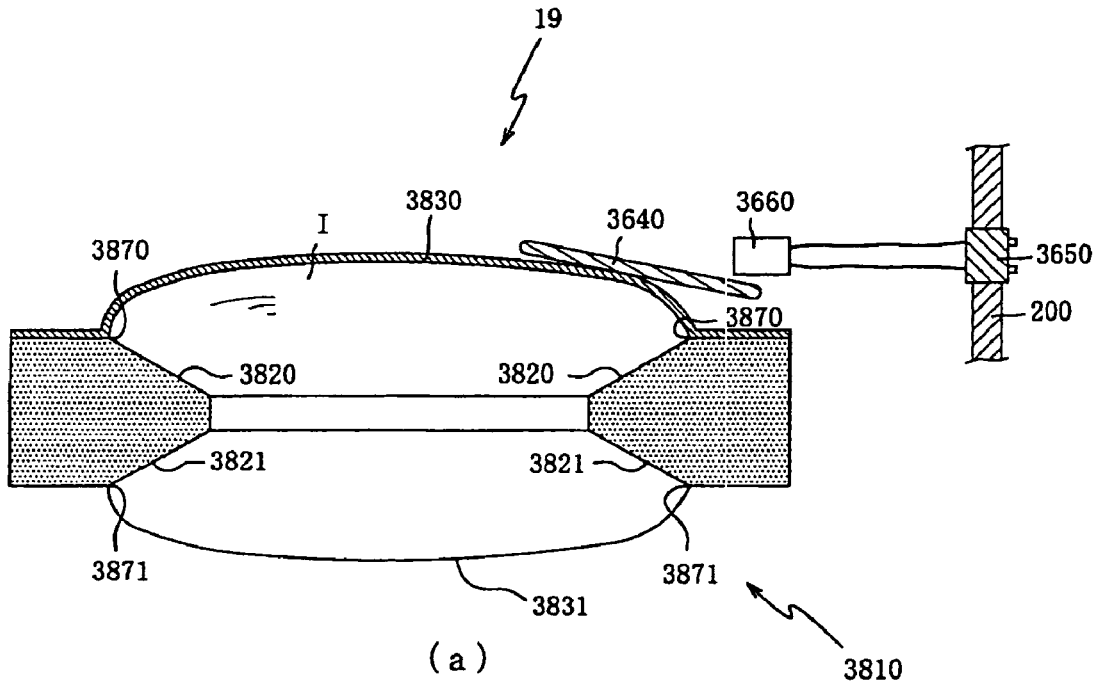
(a)
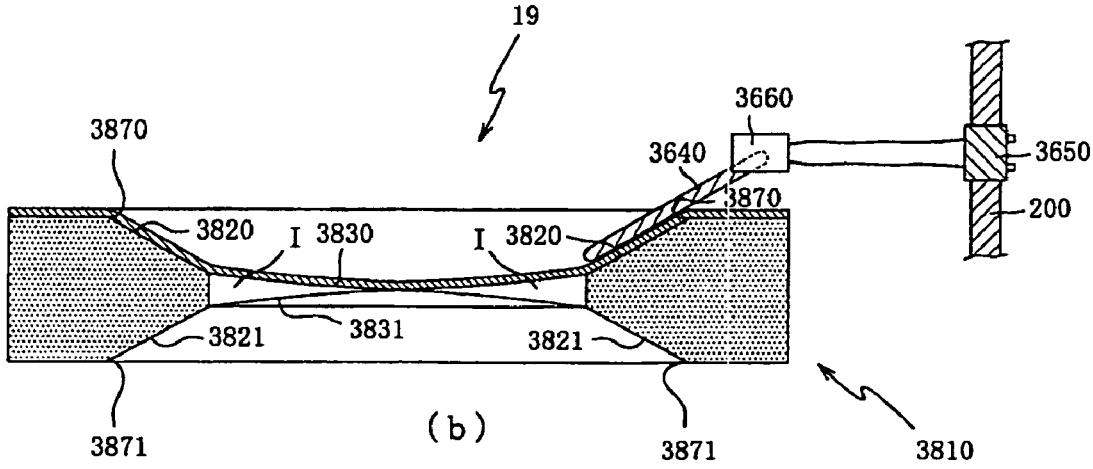
(b)
FIG. 49

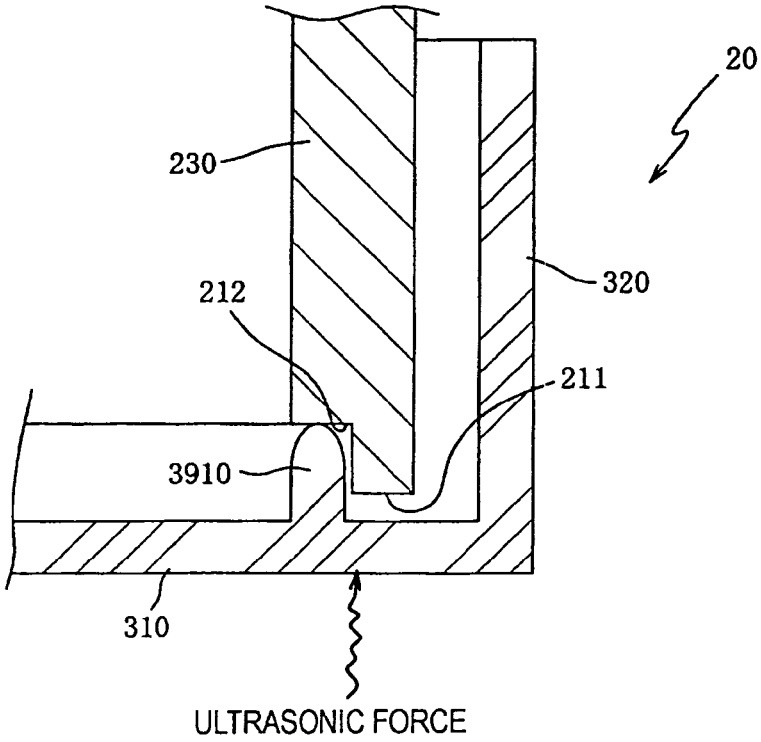
(a)
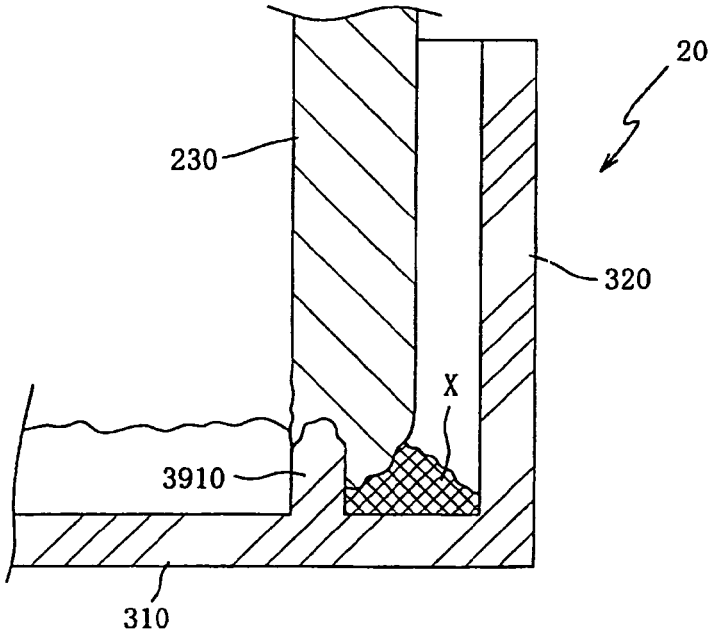
(b)
FIG. 50

(a)
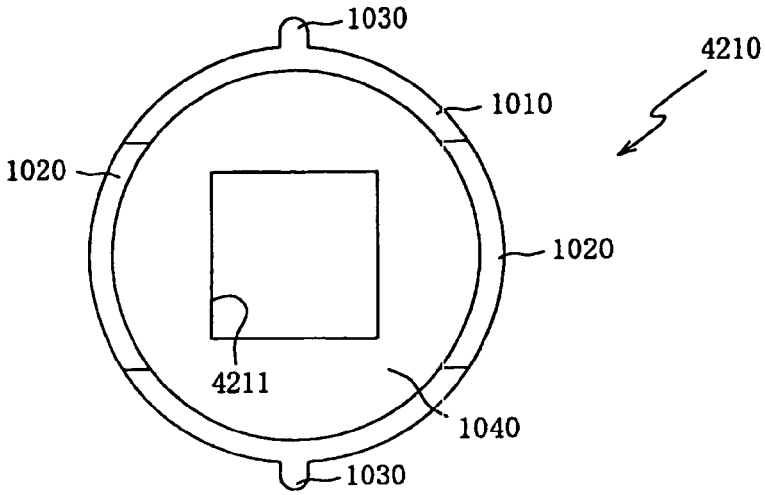
(b)
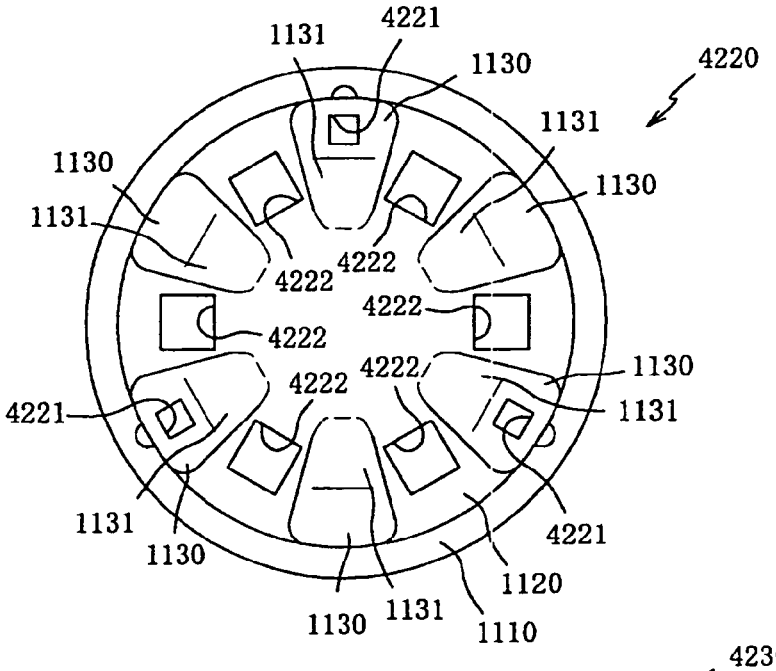
(c)
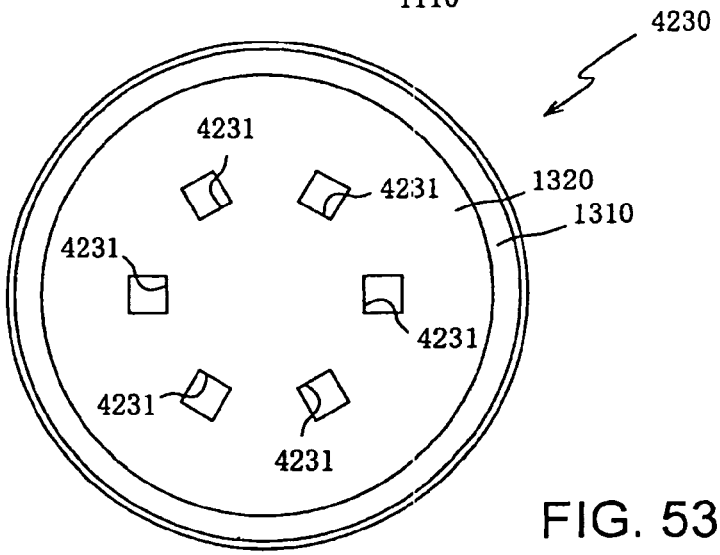
FIG. 53

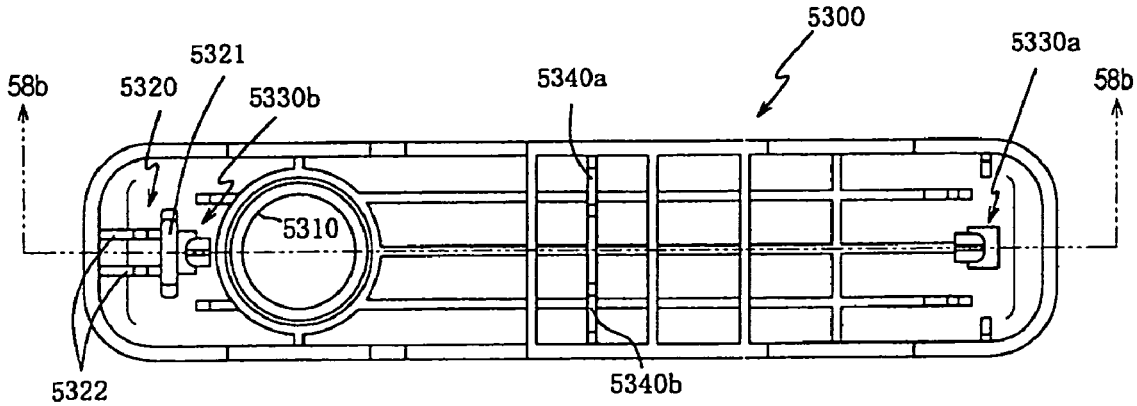
(a)
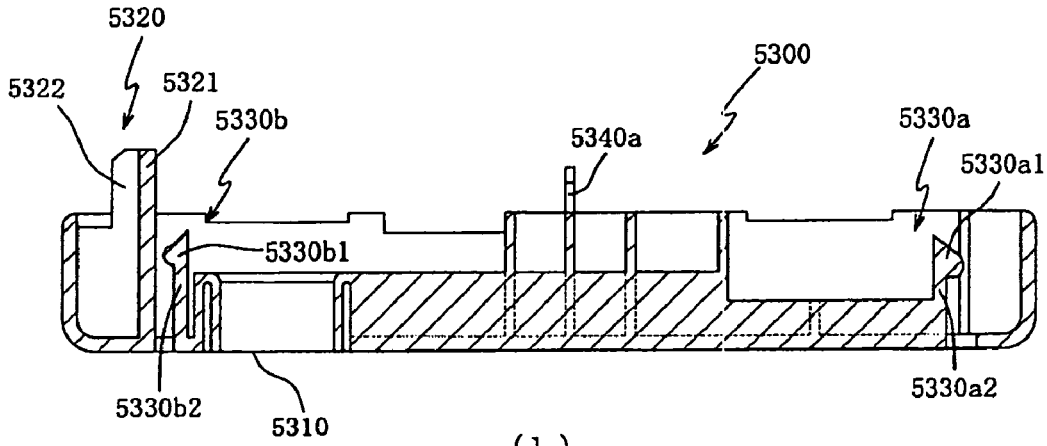
(b)
FIG. 58

5680
5682
5681
(a)
5680
5682
5683
5684
01
5683
5683
5683

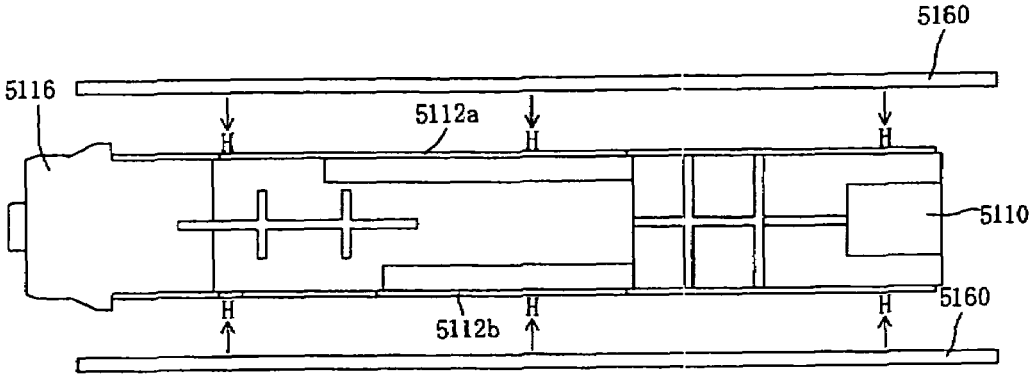
(a)
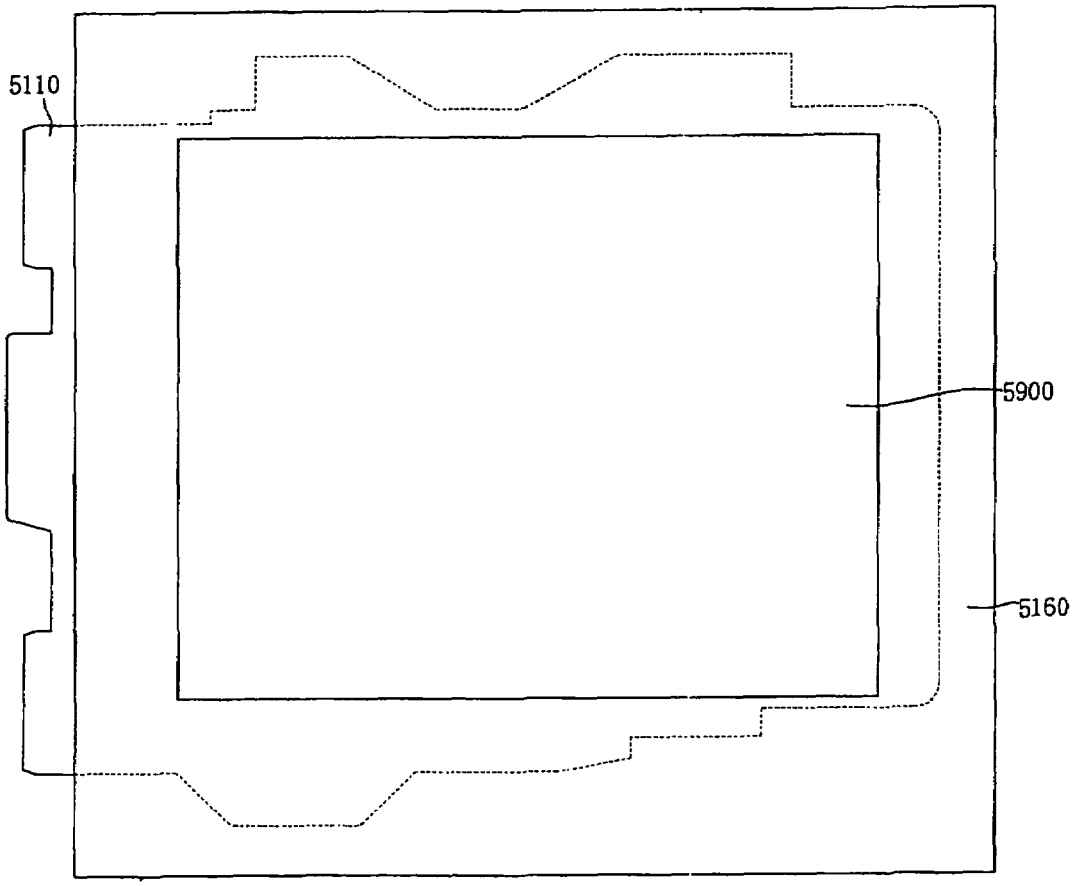
(b)
FIG. 73

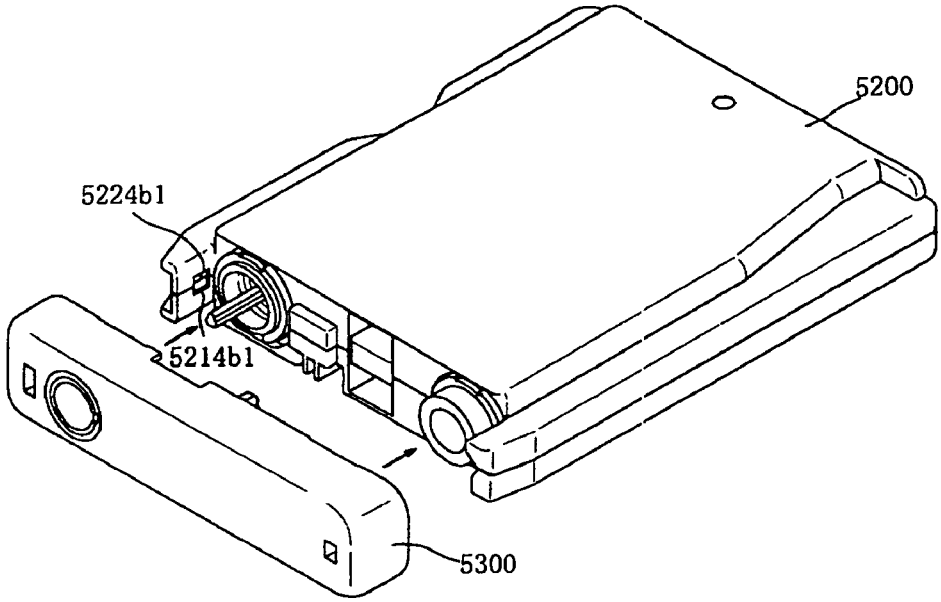
(a)
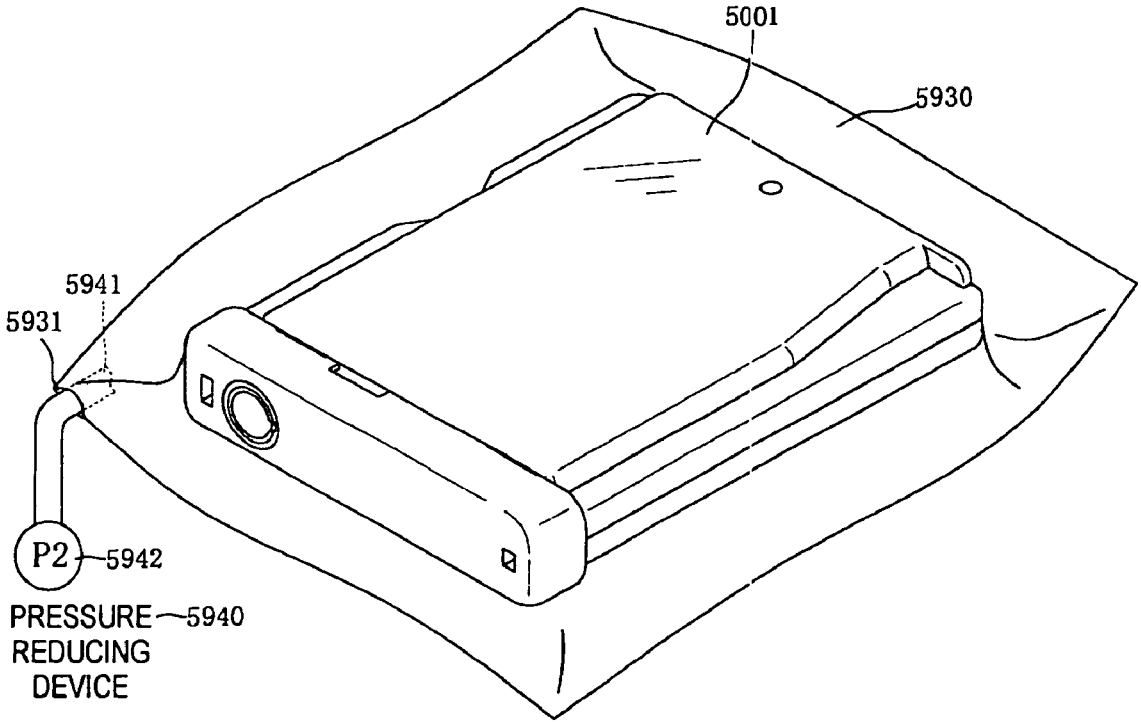
(b)
FIG. 76

(b)

(a)

6000
5714
5700
5711
5710
5712
5713
5713a
5729
5728
5117
5744
5722
5753
5434
L
5110
5715
5721
5731
5751
5811
5732
5733
5752
5745
5754
6013b
5750
5720
5730
5740
5810
5727
5742b
5734
5743
5742a
5110
5140
6014a
6014

5600
5611
5613
5607
5610
5612
5613a
5628
5640
5621
5630
5644
5800
5620
5650
5660
5680
5663
5683
5606b
5605
6013a
5421
5634
5654
5684
K
5632
5653
5645
5801
6015
5423
5615a
5682
5651
5664
5681
5633
5642a
5116
5622
5631
5629
5642b
5643
5614a
5627

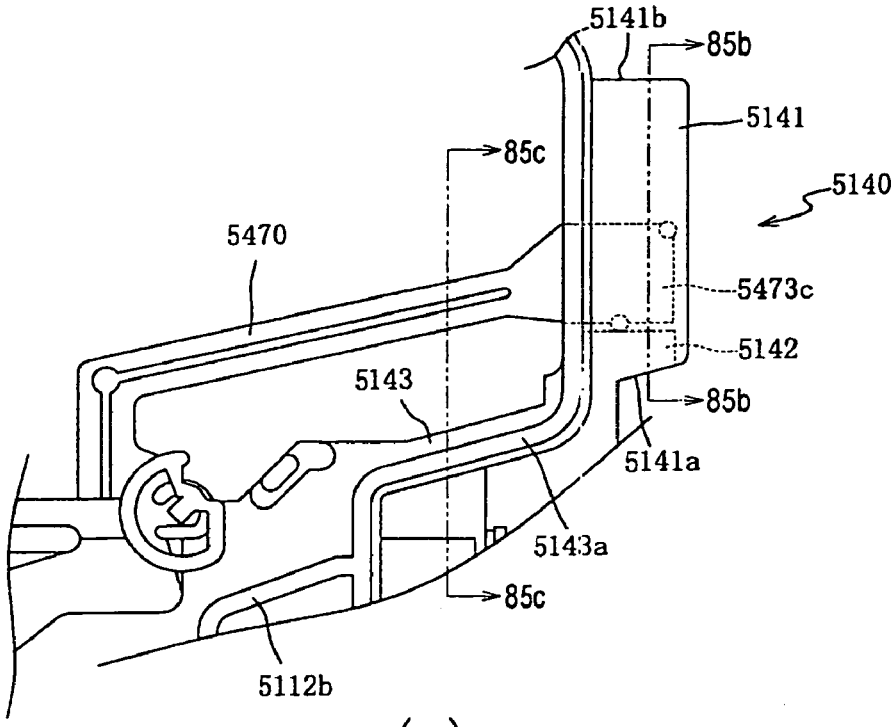
(a)
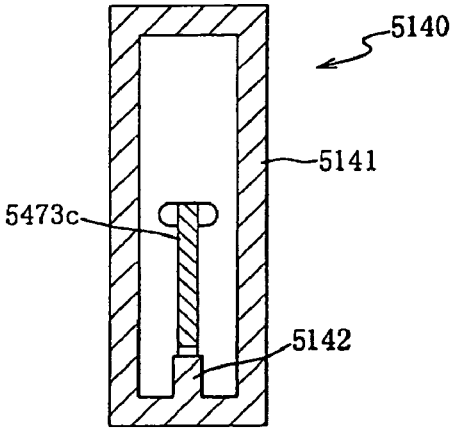
(b)
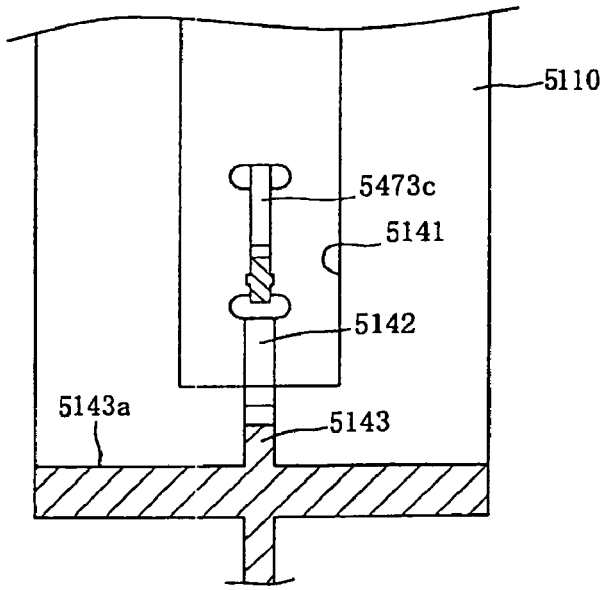
(c)
FIG. 85

(b)

(a)

INK CARTRIDGE

CROSS-REFERENCE TO RELATED APPLICATIONS

This application claims priority benefit of Japanese Applications Nos. 2005-284646, filed on Sep. 29, 2005, and 2005-342686, filed Nov. 28, 2005, the entire disclosures of which are incorporated herein by reference.

BACKGROUND

An ink cartridge stores ink to be supplied to an inkjet recording device (inkjet printer). The ink cartridge is provided with an ink storage chamber that stores ink and an ink supply port that supplies ink from the ink storage chamber to the inkjet printer. The ink supply port may also function as an insertion port for an ink extraction tube. When the ink cartridge is not mounted to the inkjet printer, the ink supply port is closed by a valve so that ink will not leak from the ink cartridge.

Mounting the ink cartridge to the inkjet printer is performed by pressing the ink cartridge toward the inkjet printer. In the inkjet printer, a hollow ink extraction tube is protrudingly arranged. When the ink cartridge is mounted to the inkjet printer, the ink extraction tube engages the valve that closes the ink supply port of the ink cartridge, and the ink supply port is opened. By opening the ink supply port, the ink storage chamber and the ink extraction tube are permitted to communicate with each other, and ink is supplied to the inkjet printer via the ink extraction tube.

JP-A-2005-22198 discloses an ink cartridge including an ink supply port having a valve that is urged into a closed position by a coil spring. The ink supply port is opened when the ink cartridge is mounted to an inkjet printer and an ink extraction tube opens the valve by acting against an urging force of the coil spring. When the valve is opened by the ink extraction needle, the ink supply port can supply ink through the ink extraction needle to the inkjet printer.

JP-A-2005-103866 discloses an ink cartridge including a valve element that does not employ a coil spring. The valve element is constructed so as to be slightly deformed by insertion of an ink extraction tube. The slight deformation opens an ink supply port and permits the supply of ink.

As mentioned above, in the ink cartridge disclosed in JP-A-2005-22198, a metal coil spring is used. Accordingly, if a spent ink cartridge is to be properly disposed of, the cartridge must be taken apart so that combustible and incombustible members can be disposed of separately. This requirement increases the complexity of disposal.

The ink cartridge disclosed in JP-A-2005-103866 does not include metal parts, so a complex disposal procedure is not necessary. However, as mentioned above, the valve member of the disclosed cartridge is opened by only slight deformation of the valve member. Thus, if there are any irregularities in the molded valve member, the ink cartridge may leak when it is not installed in an inkjet printer and/or the valve member may not open when the ink cartridge is mounted to the inkjet printer, preventing ink from being supplied to the inkjet printer.

SUMMARY

Various exemplary embodiments of the present invention address the above-mentioned problems with existing ink cartridges. An object of various exemplary embodiments of this invention is to provide an ink cartridge having an ink supply path that can be reliably opened and closed, and that can be disposed of without the need for a complex disposal procedure.

In various exemplary embodiments, an ink cartridge includes: a cartridge case enclosing an ink chamber; a path extending from the ink chamber to an exterior of the ink cartridge; a valve member provided in the path, the valve member having a first state in which communication between the ink chamber and the exterior of the ink cartridge along the path is permitted and a second state in which communication between the ink chamber and the exterior of the ink cartridge along the path is prevented; and an urging member provided on an ink chamber-side of the valve member in the path, the urging member being capable of urging the valve member along the path toward the exterior of the cartridge. In various exemplary embodiments, the urging member is formed of a resin or rubber material having elasticity; and when the valve member is in the first state, the urging member is compressed in a direction of the path.

In various exemplary embodiments, an ink cartridge, includes: a cartridge case enclosing an ink chamber; a path extending from the ink chamber to an exterior of the ink cartridge; a valve member provided in the path, the valve member having a first state in which communication between the ink chamber and the exterior of the ink cartridge along the path is permitted and a second state in which communication between the ink chamber and the exterior of the ink cartridge along the path is prevented; and an urging member provided on an ink chamber-side of the valve member in the path, the urging member being capable of urging the valve member along the path toward the exterior of the cartridge. In various exemplary embodiments, the urging member is formed of a resin or rubber material having elasticity; and an entirety of the urging member is provided on the ink chamber-side of the valve member on the path.

These and other optional features and possible advantages of various aspects of this invention are described in, or are apparent from, the following detailed description of exemplary embodiments of the present invention.

BRIEF DESCRIPTION OF THE DRAWINGS

Various exemplary embodiments of the invention will be described in detail with reference to the following figures, wherein:

FIG. 2(*b*) is a front view of a frame of an exemplary ink cartridge according to the present invention;

FIG. 2(*c*) is a front view of a cap of an exemplary ink cartridge according to the present invention;

FIG. 3(*b*) is a left side/right side view of a case of an exemplary ink cartridge according to the present invention;

FIG. 3(*c*) is a top view of a case of an exemplary ink cartridge according to the present invention;

FIG. 3(*d*) is a bottom view of a case of an exemplary ink cartridge according to the present invention;

FIG. 5(*b*) is a left side/right side view of a cap of an exemplary ink cartridge according to the present invention;

FIG. 5(*c*) is a top view showing of a cap of an exemplary ink cartridge according to the present invention;

FIG. 5(*d*) is a bottom view of a cap of an exemplary ink cartridge according to the present invention;

FIG. 6(*a*) is a cross sectional view of the cap shown in FIG. 5(*c*);

FIG. 6(*b*) is a cross sectional view of the cap shown in FIG. 5(*c*);

FIG. 7(*b*) is a rear view of a frame of an exemplary ink cartridge according to the present invention;

FIG. 8(*b*) is a right side view of a frame of an exemplary ink cartridge according to the present invention;

FIG. 8(*c*) is a top view of a frame of an exemplary ink cartridge according to the present invention;

FIG. 8(*d*) is a bottom view of a frame of an exemplary ink cartridge according to the present invention;

FIG. 12(*b*) is a top view of a joint member of an exemplary ink cartridge according to the present invention;

FIG. 12(*c*) is a bottom view of a joint member of an exemplary ink cartridge according to the present invention;

FIG. 12(*d*) is a cross sectional view of the joint member shown in FIG. 12(*b*);

FIG. 13(*b*) is a left side/right side view of a valve member of an exemplary ink cartridge according to the present invention;

FIG. 13(*c*) is a top view of a valve member of an exemplary ink cartridge according to the present invention;

FIG. 13(*d*) is a bottom view of a valve member of an exemplary ink cartridge according to the present invention;

FIG. 13(*e*) is a cross sectional view of the valve member shown in FIG. 13(*c*);

FIG. 14(*b*) is a top view of a first spring member of an exemplary ink cartridge according to the present invention;

FIG. 14(*c*) is a bottom view of a first spring member of an exemplary ink cartridge according to the present invention;

FIG. 14(*d*) is a cross sectional view of the first spring member shown in FIG. 14(*b*);

FIG. 15(*b*) is a left side/right side view of a slider member of an exemplary ink cartridge according to the present invention;

FIG. 15(*c*) is a top view of a slider member of an exemplary ink cartridge according to the present invention;

FIG. 15(*d*) is a bottom view of a slider member of an exemplary ink cartridge according to the present invention;

FIG. 15(*e*) is a cross sectional view of the slider member shown in FIG. 15(*c*);

FIG. 16(*b*) is a top view of a support member of an exemplary ink cartridge according to the present invention;

FIG. 16(*c*) is a bottom view of a support member of an exemplary ink cartridge according to the present invention;

FIG. 16(*d*) is a cross sectional view of the support member shown in FIG. 16(*b*);

FIG. 17(*b*) is a top/bottom view of a check valve of an exemplary ink cartridge according to the present invention;

FIG. 17(*c*) is a cross sectional view of the check valve shown in FIG. 17(*b*);

FIG. 18(*b*) is a top view of a cover member of an exemplary ink cartridge according to the present invention;

FIG. 18(*c*) is a bottom view of a cover member of an exemplary ink cartridge according to the present invention;

FIG. 18(*d*) is a cross sectional view of the cover member shown in FIG. 18(*b*);

FIGS. 24(*a*) and 24(*b*) are sequential cross sectional views showing welding of a case and a cap of an exemplary ink cartridge according to the present invention;

FIGS. 28(*a*) and 28(*b*) are sequential cross sectional views showing operation of a joint member of an exemplary ink cartridge according to the present invention upon insertion of an ink extraction tube;

FIG. 38(*b*) is a top view of a valve member of an exemplary ink cartridge according to the present invention;

FIG. 38(*c*) is a bottom view of a valve member of an exemplary ink cartridge according to the present invention;

FIG. 38(*d*) is a cross sectional view of the valve member shown in FIG. 38(*b*);

FIGS. 48(*a*) and 48(*b*) are sequential cross sectional views showing detection of an empty state of an exemplary ink cartridge according to the present invention;

FIGS. 49(*a*) and 49(*b*) are sequential cross sectional views showing detection of an empty state of an exemplary ink cartridge according to the present invention;

FIGS. 50(*a*) and 50(*b*) are sequential cross sectional views showing welding of a case and a cap of an exemplary ink cartridge according to the present invention;

FIG. 53(*a*) is a top view of a slider member of an exemplary ink cartridge according to the present invention;

FIG. 53(*b*) is a top view of a support member of an exemplary ink cartridge according to the present invention;

FIG. 53(*c*) is a top view of a sheet member of an exemplary ink cartridge according to the present invention;

FIG. 58(*a*) is a top view of a cap of an exemplary ink cartridge according to the present invention;

FIG. 58(*b*) is a cross sectional view of the cap shown in FIG. 58(*a*);

FIG. 60(*b*) is a front/rear view of a disassembled ink supply valve mechanism of an exemplary ink cartridge according to the present invention;

FIG. 61(*b*) is a left side/right side view of a supply valve jacket of an exemplary ink cartridge according to the present invention;

FIG. 61(*c*) is a top view of a supply valve jacket of an exemplary ink cartridge according to the present invention;

FIG. 61(*d*) is a bottom view of a supply valve jacket of an exemplary ink cartridge according to the present invention;

FIG. 61(*e*) is a cross sectional view of the supply valve jacket shown in FIG. 61(*c*);

FIG. 62(*b*) is a top view of a joint member of an exemplary ink cartridge according to the present invention;

FIG. 62(*c*) is a bottom view of a joint member of an exemplary ink cartridge according to the present invention;

FIG. 62(*d*) is a cross sectional view of the joint member shown in FIG. 62(*b*);

FIG. 63(*b*) is a left side/right side view of a valve member of an exemplary ink cartridge according to the present invention;

FIG. 63(*c*) is a top view of a valve member of an exemplary ink cartridge according to the present invention;

FIG. 63(*d*) is a bottom view of a valve member of an exemplary ink cartridge according to the present invention;

FIG. 63(*e*) is a cross sectional view of the valve member shown in FIG. 63(*c*);

FIG. 64(*b*) is a top view of a first spring member of an exemplary ink cartridge according to the present invention;

FIG. 64(*c*) is a bottom view of a first spring member of an exemplary ink cartridge according to the present invention;

FIG. 64(*d*) is a cross sectional view of the first spring member shown in FIG. 64(*b*);

FIG. 65(*a*) is a front/rear view of a slider member of an exemplary ink cartridge according to the present invention;

FIG. 65(*b*) is a left side/right side view of a slider member of an exemplary ink cartridge according to the present invention;

FIG. 65(*c*) is a top view of a slider member of an exemplary ink cartridge according to the present invention;

FIG. 65(*d*) is a bottom view of a slider member of an exemplary ink cartridge according to the present invention;

FIG. 65(*e*) is a cross sectional view of the slider member shown in FIG. 65(*c*);

FIG. 66(*a*) is a side view of a support member of an exemplary ink cartridge according to the present invention;

FIG. 66(*b*) is a top view of a support member of an exemplary ink cartridge according to the present invention;

FIG. 66(*c*) is a bottom view of a support member of an exemplary ink cartridge according to the present invention;

FIG. 66(*d*) is a cross sectional view of the support member shown in FIG. 66(*b*);

FIG. 67(*a*) is a side view of a check valve of an exemplary ink cartridge according to the present invention;

Figure 67:
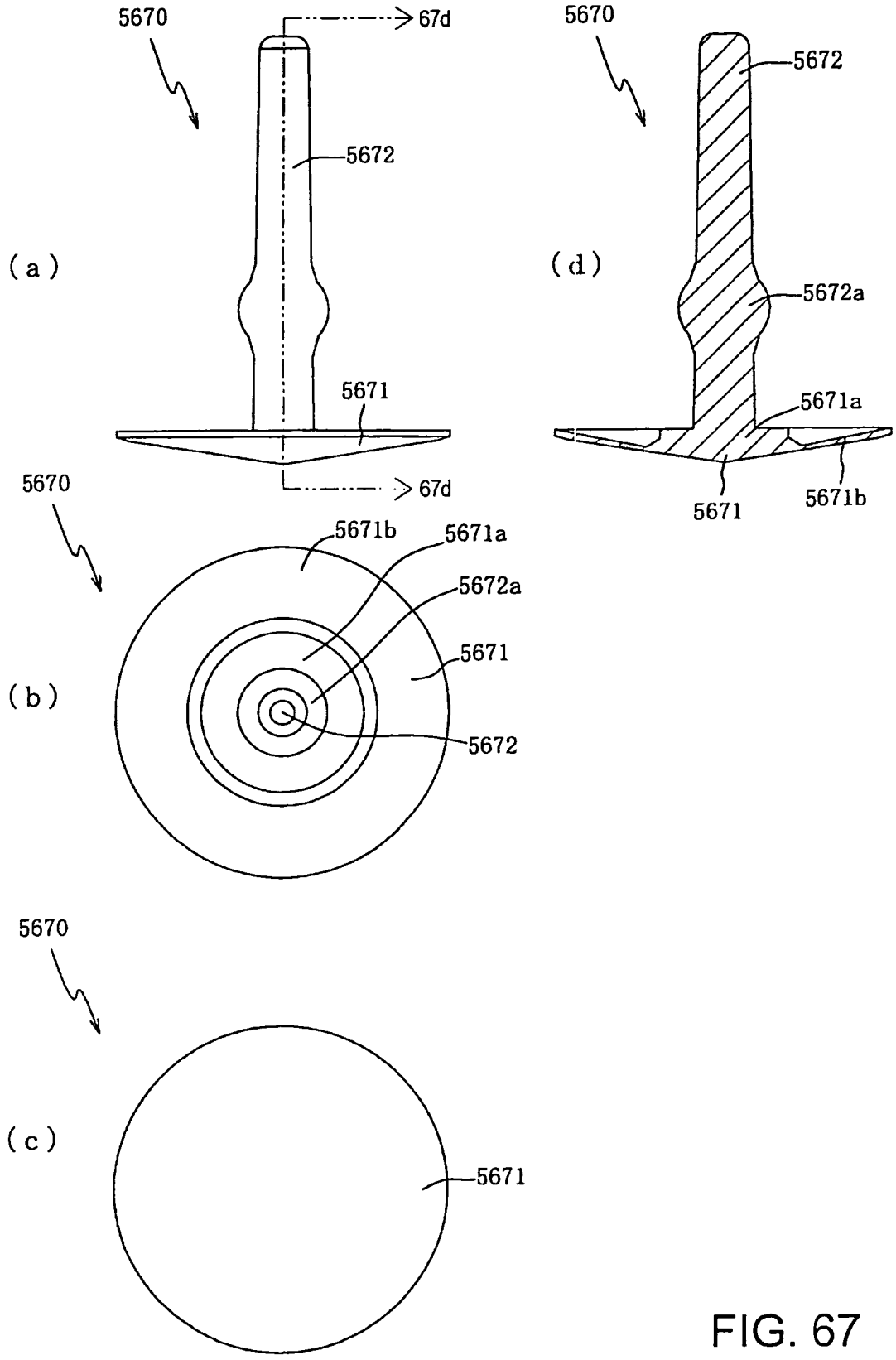
Figure 68:
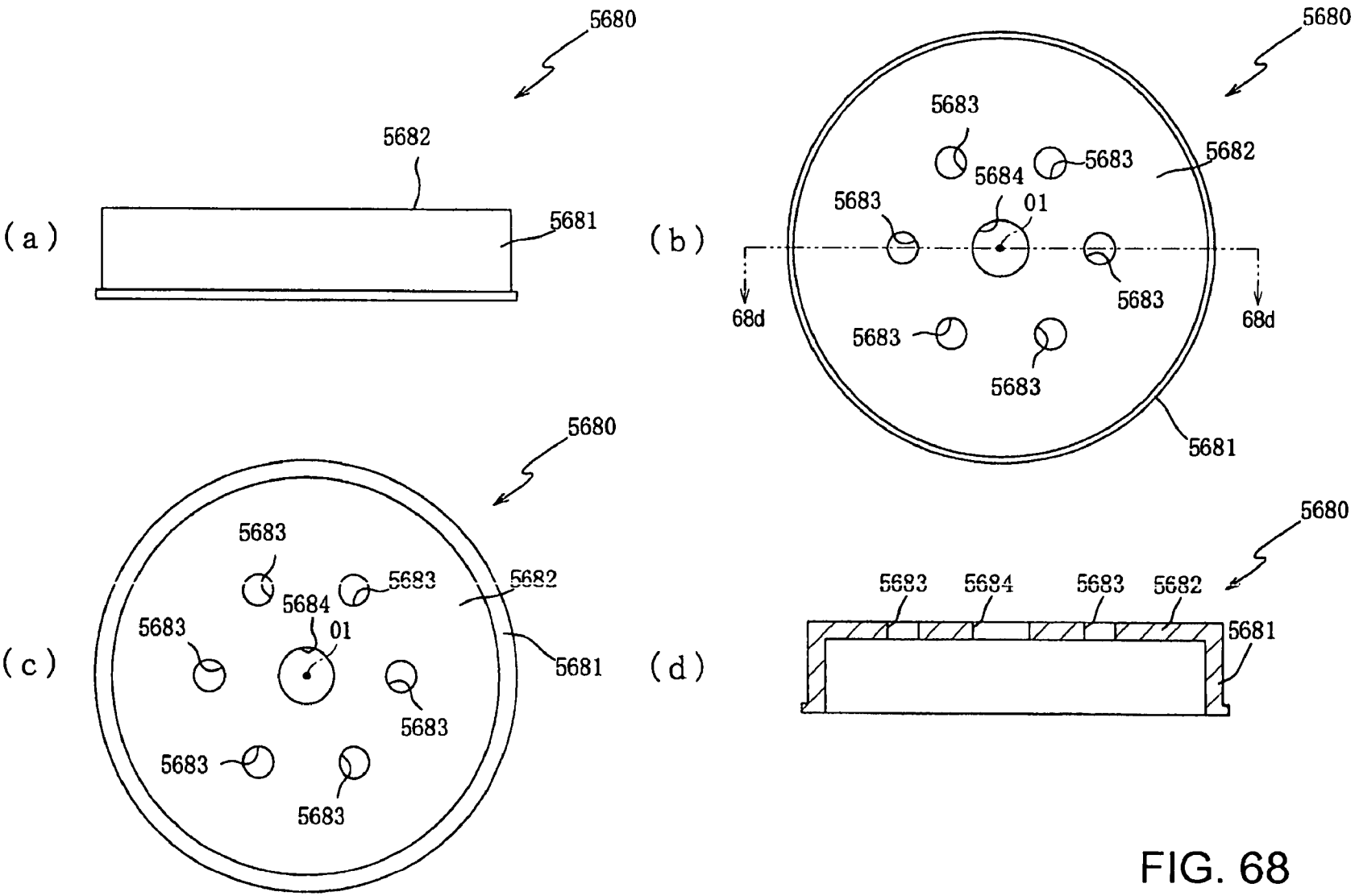
Figure 69:
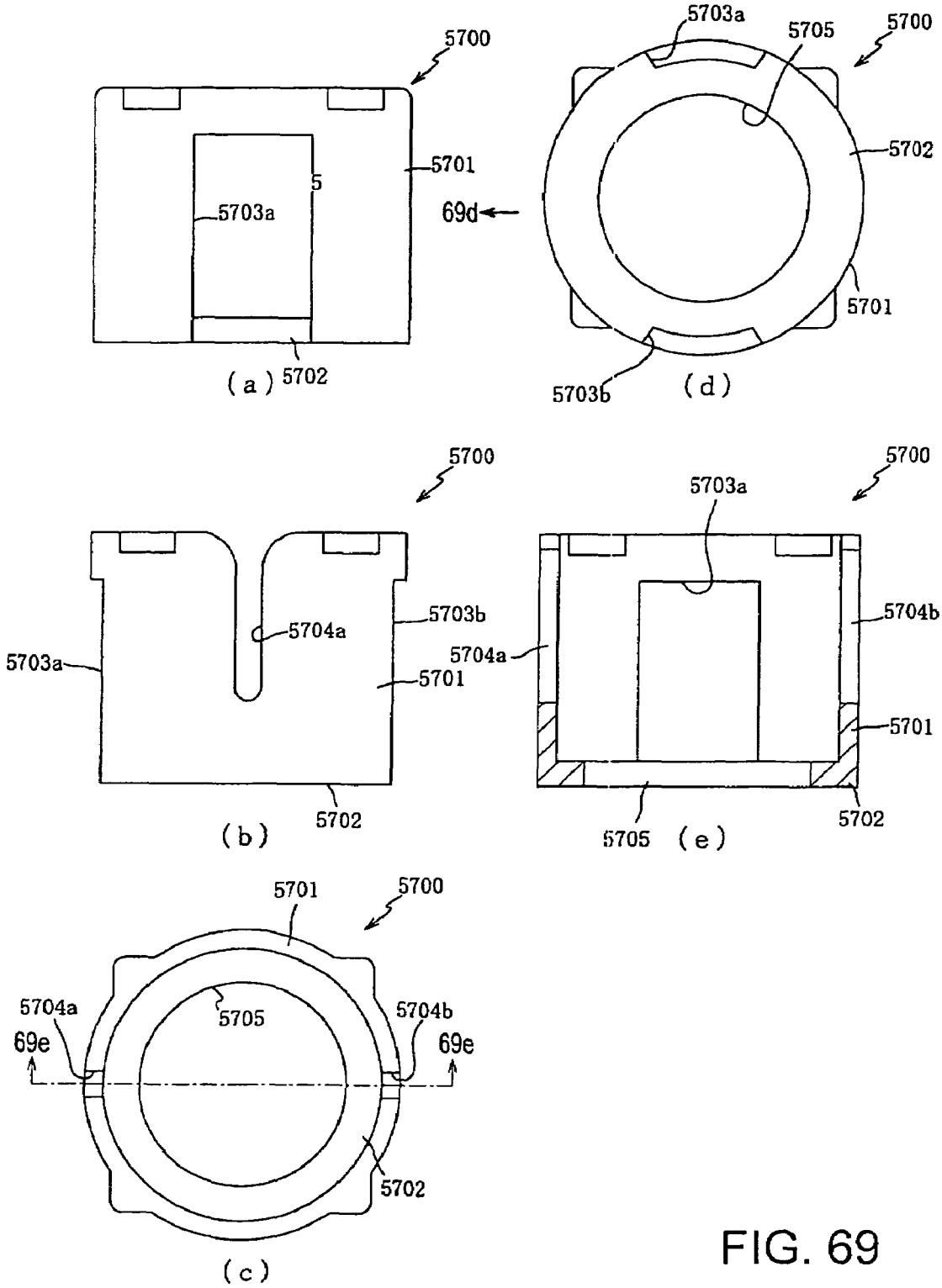
Figure 70:
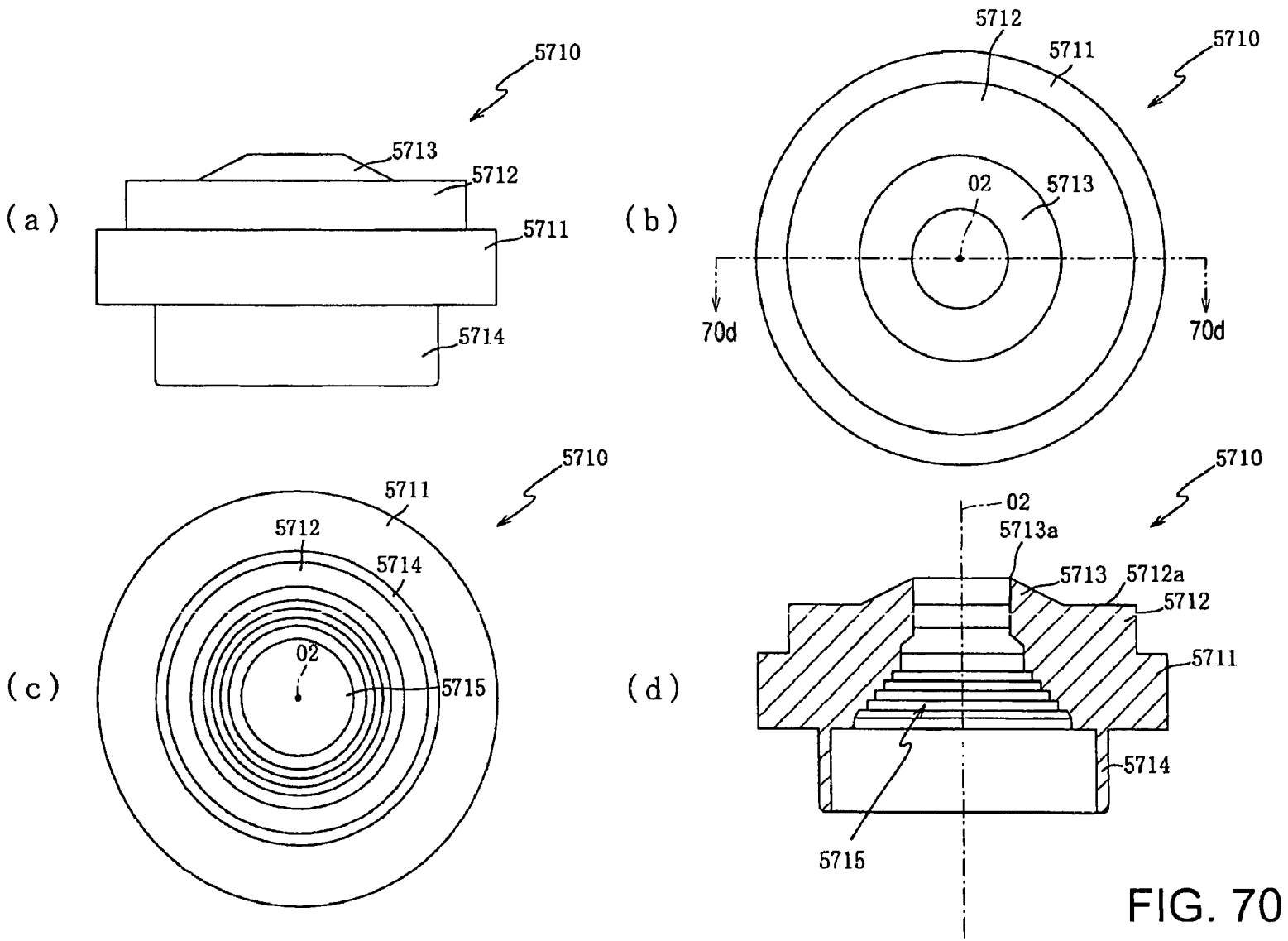

FIG. 67(*b*) is a cross sectional view of the check valve shown in FIG. 67(*a*);

FIG. 67(*c*) is a top view of a check valve of an exemplary ink cartridge according to the present invention;

FIG. 67(*d*) is a bottom view of a check valve of an exemplary ink cartridge according to the present invention;

FIG. 68(*a*) is a side view of a cover member of an exemplary ink cartridge according to the present invention;

FIG. 68(*b*) is a top view of a cover member of an exemplary ink cartridge according to the present invention;

FIG. 68(*c*) is a bottom view of a cover member of an exemplary ink cartridge according to the present invention;

FIG. 68(*d*) is a cross sectional view of the cover member shown in FIG. 68(*b*);

FIG. 69(*a*) is a front/rear view of an intake valve jacket of an exemplary ink cartridge according to the present invention;

FIG. 69(*b*) is a left side/right side view of an intake valve jacket of an exemplary ink cartridge according to the present invention;

FIG. 69(*c*) is a top view of an intake valve jacket of an exemplary ink cartridge according to the present invention;

FIG. 69(*d*) is a bottom view of an intake valve jacket of an exemplary ink cartridge according to the present invention;

FIG. 69(*e*) is a cross sectional view of the intake valve jacket shown in FIG. 69(*c*);

FIG. 70(*a*) is a side view of a joint member of an exemplary ink cartridge according to the present invention;

FIG. 70(*b*) is a top view of a joint member of an exemplary ink cartridge according to the present invention;

FIG. 70(*c*) is a bottom view of a joint member of an exemplary ink cartridge according to the present invention;

FIG. 70(*d*) is a cross sectional view of the joint member shown in FIG. 70(*b*).

Figure 71:
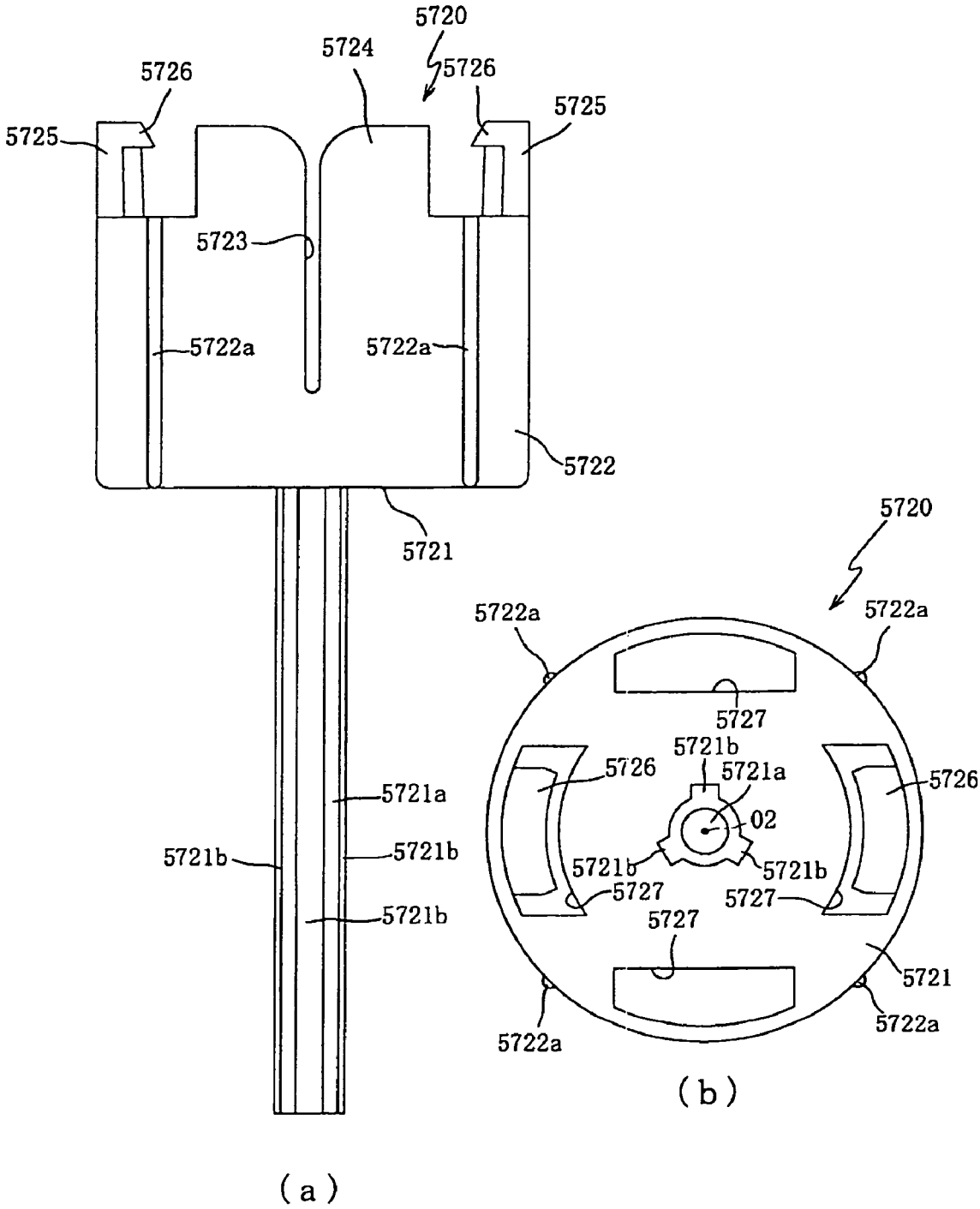
Figure 72:
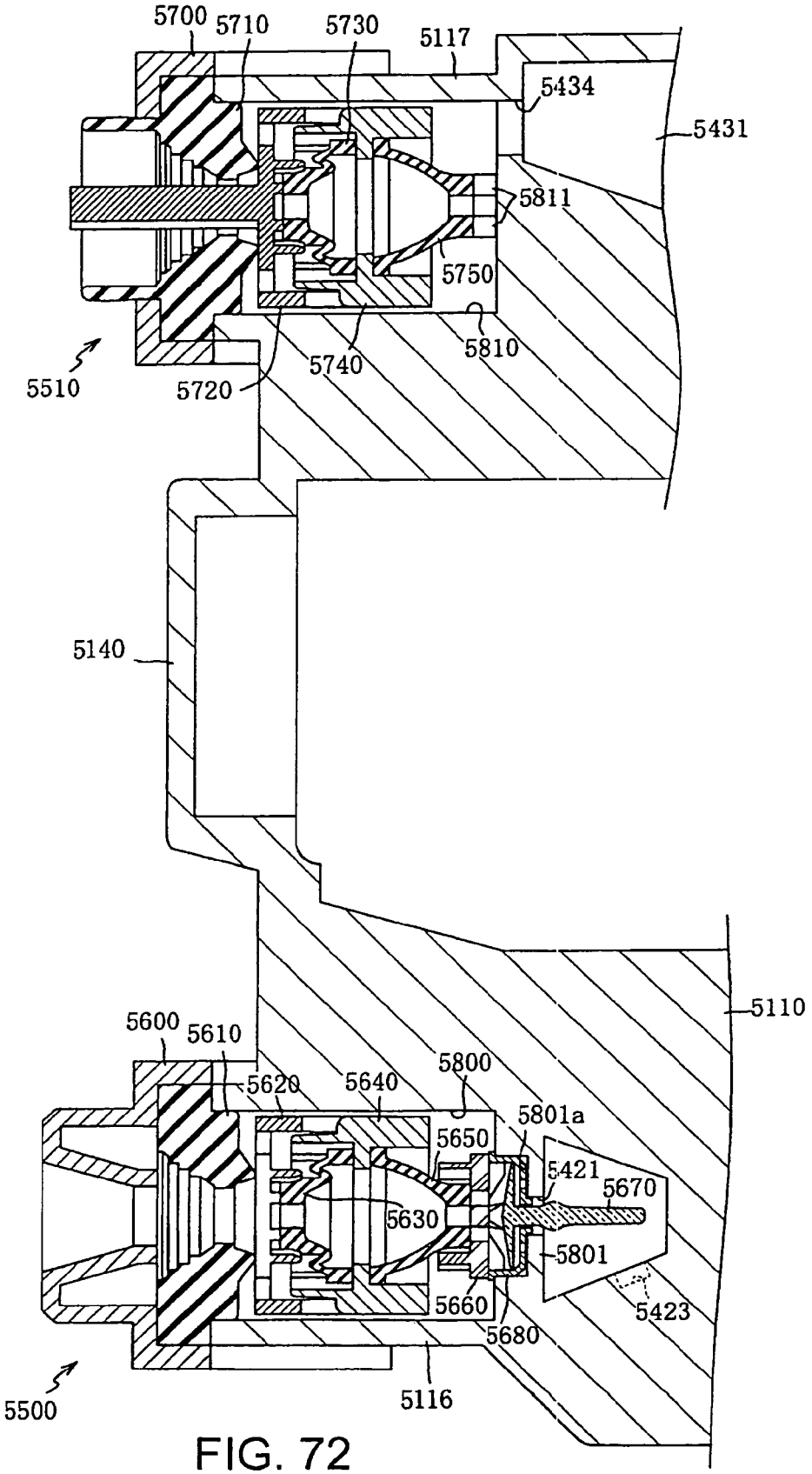
Figure 74:
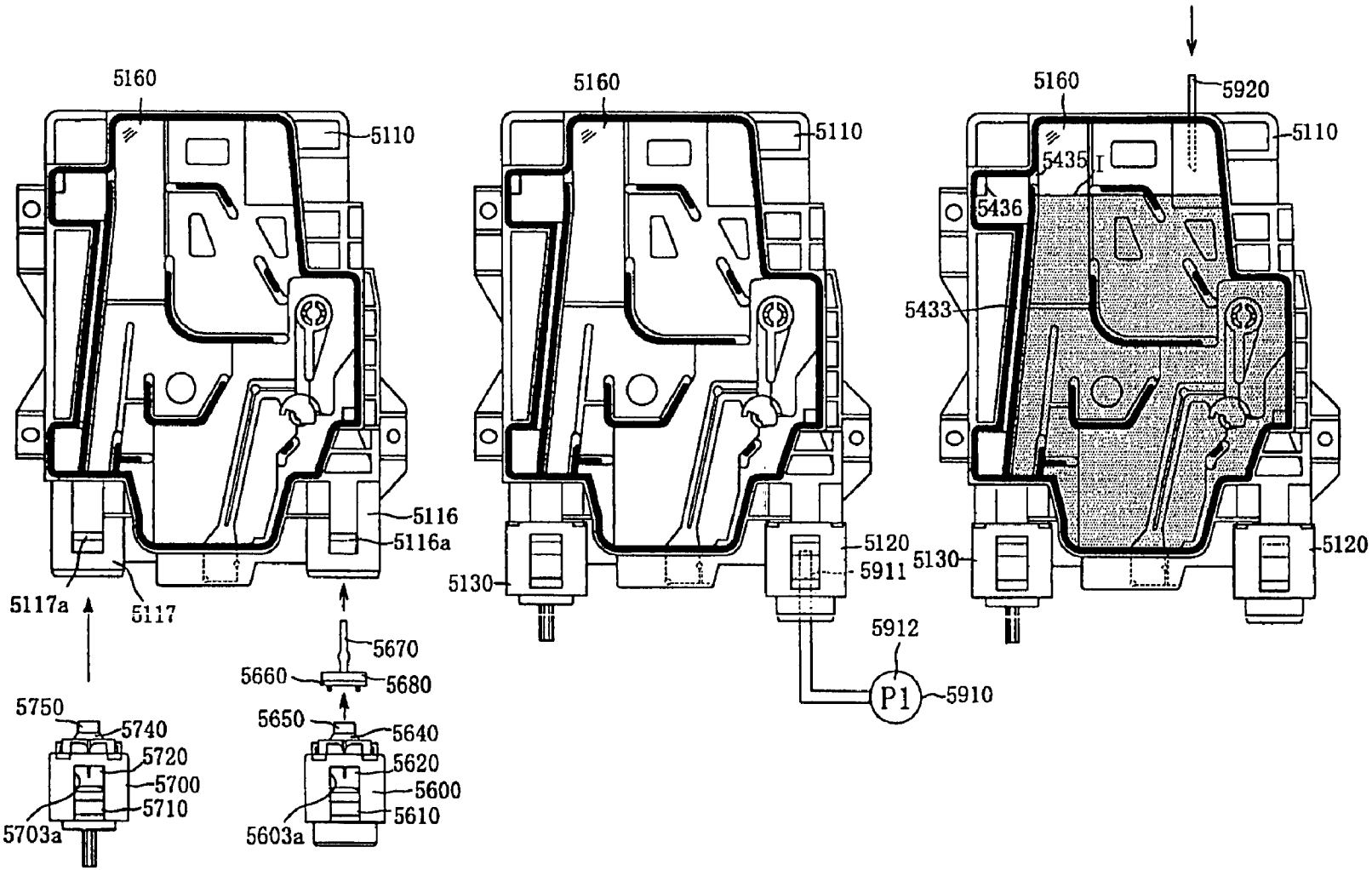
Figure 75:
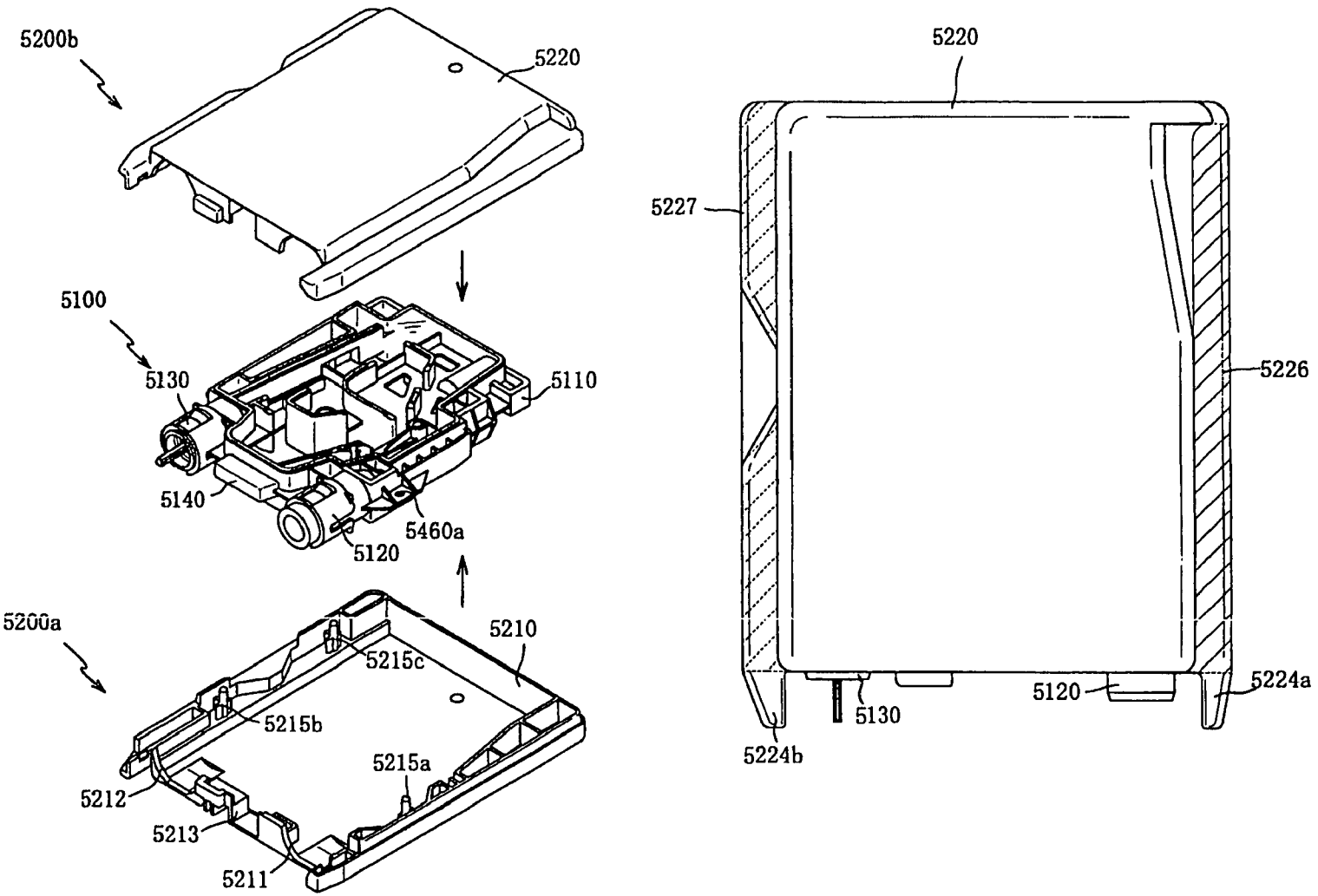
Figure 77:
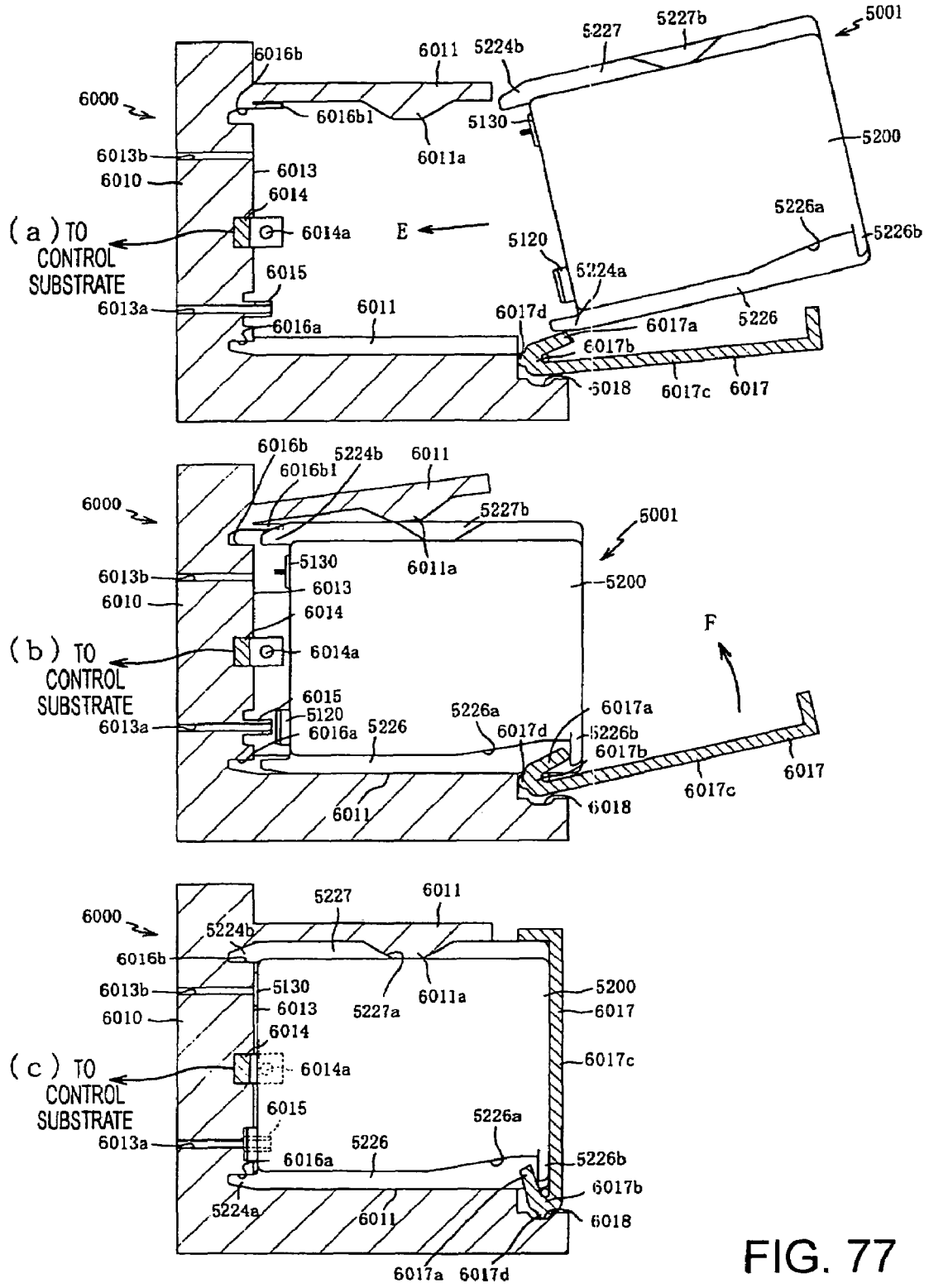
Figure 78:
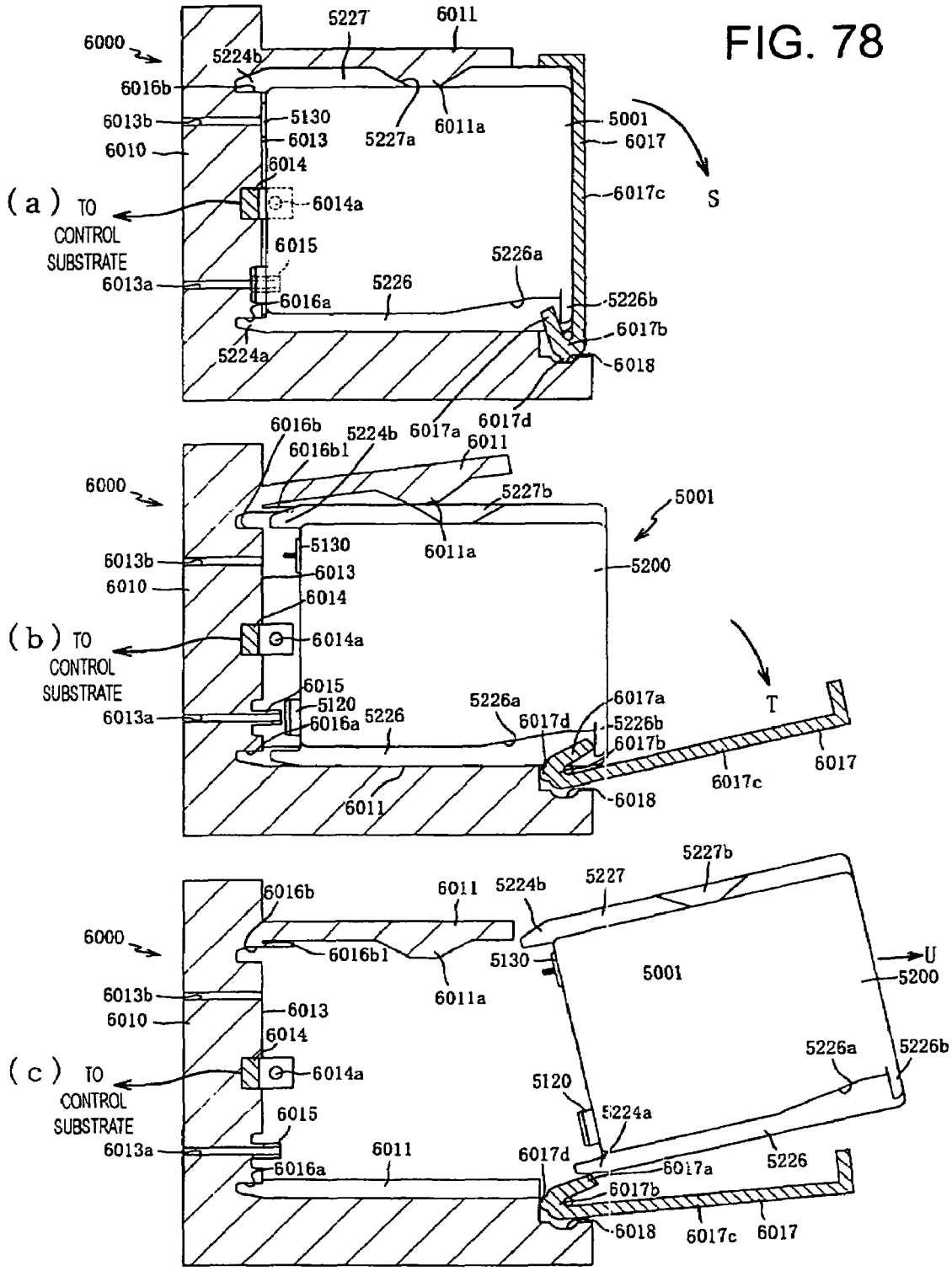
Figure 79:
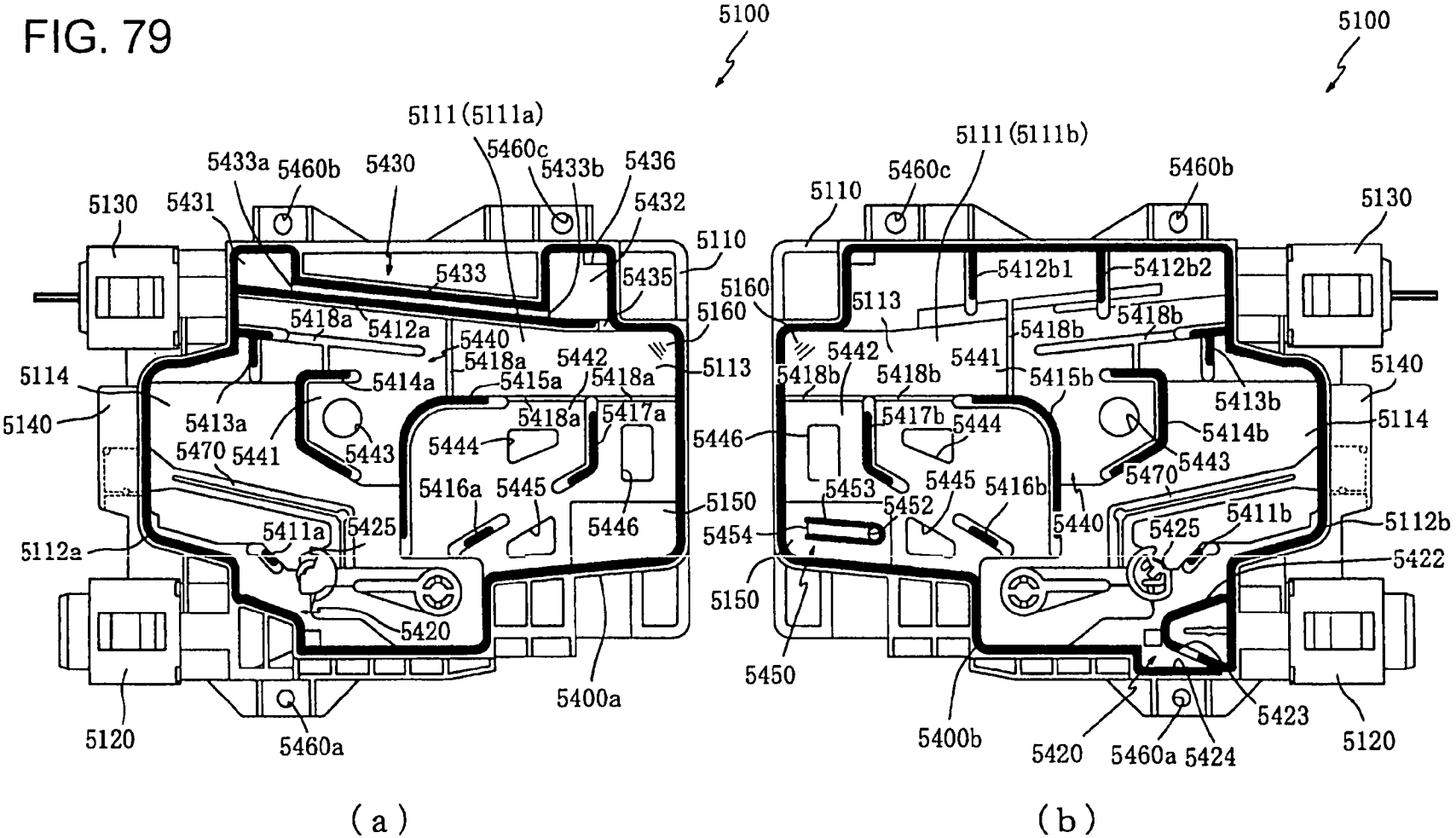
Figure 80:
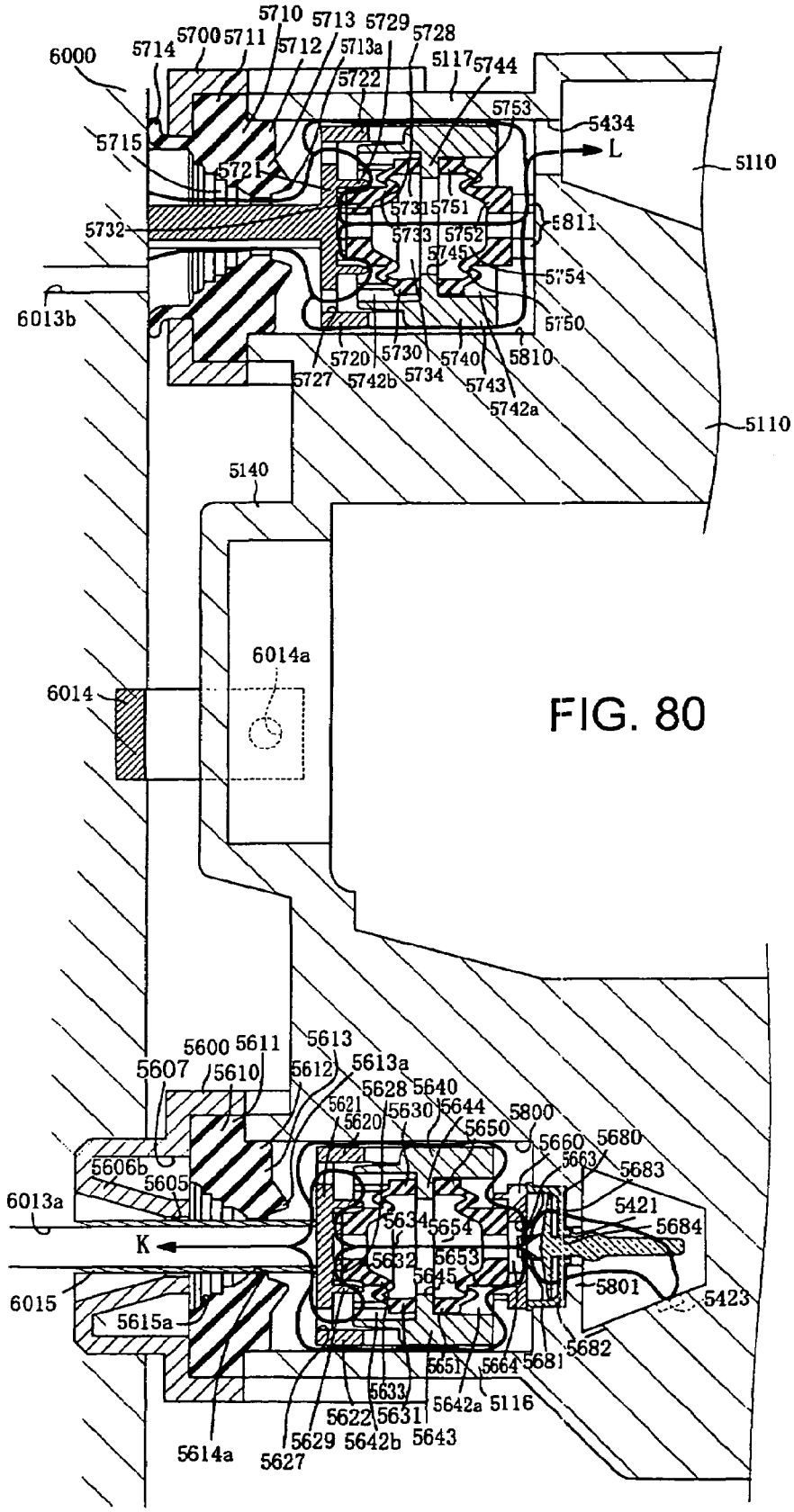
Figure 81:
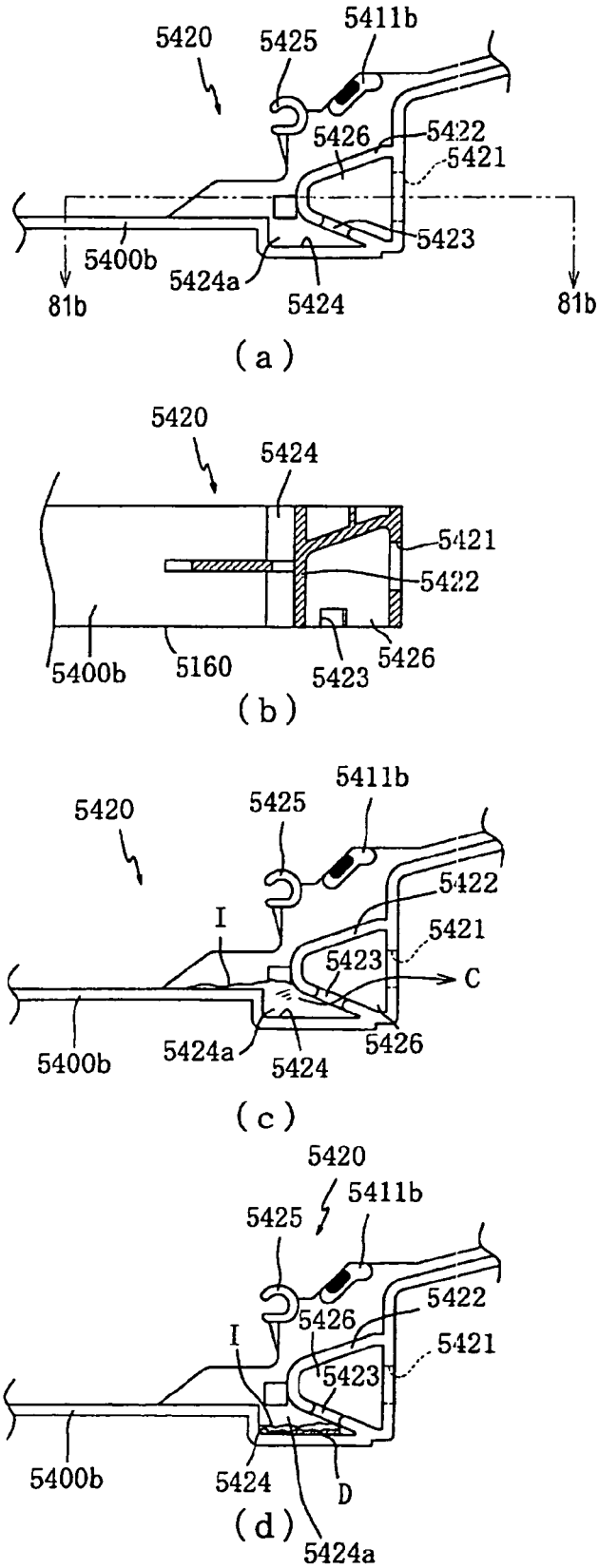
Figure 82:
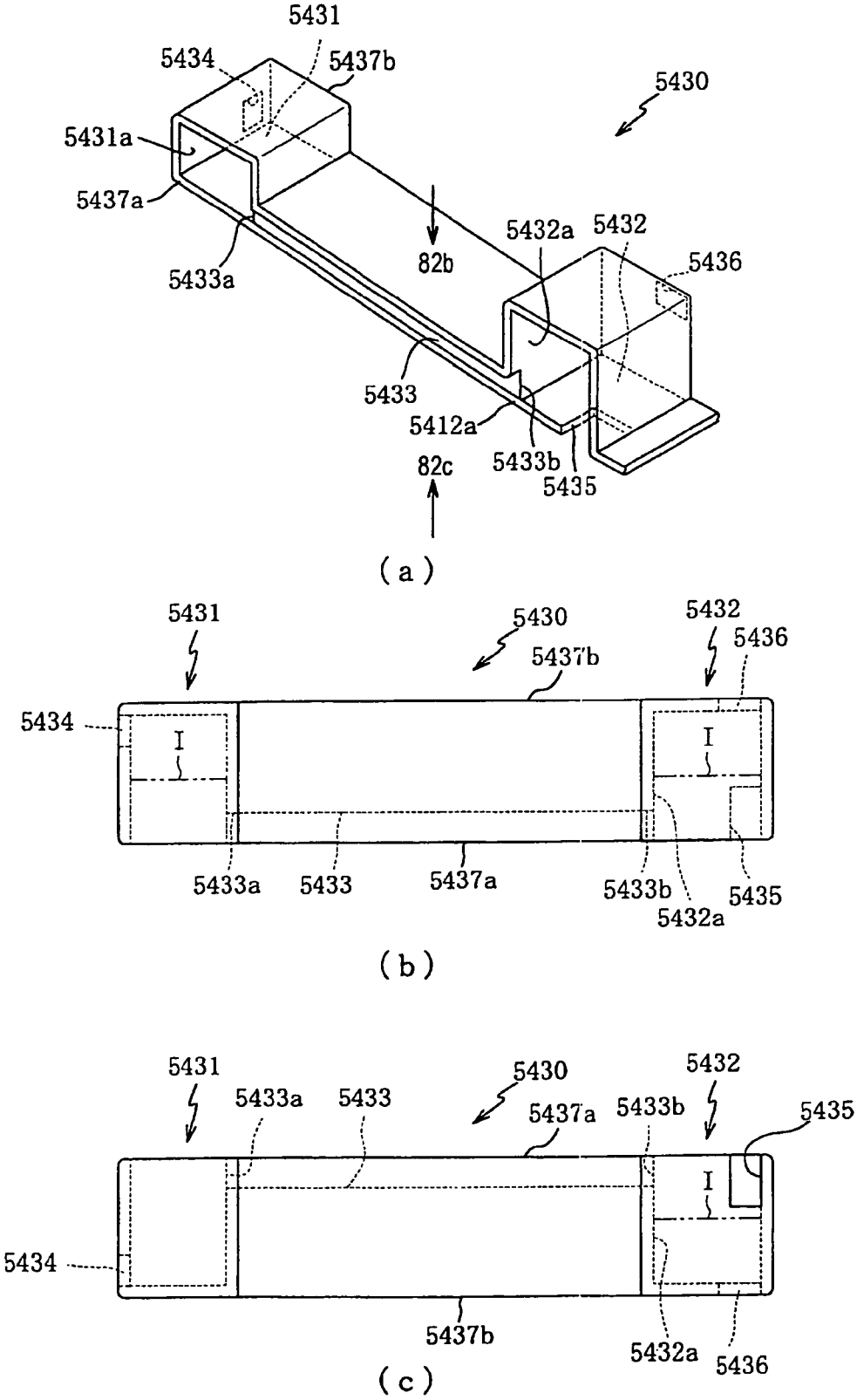
Figure 83:
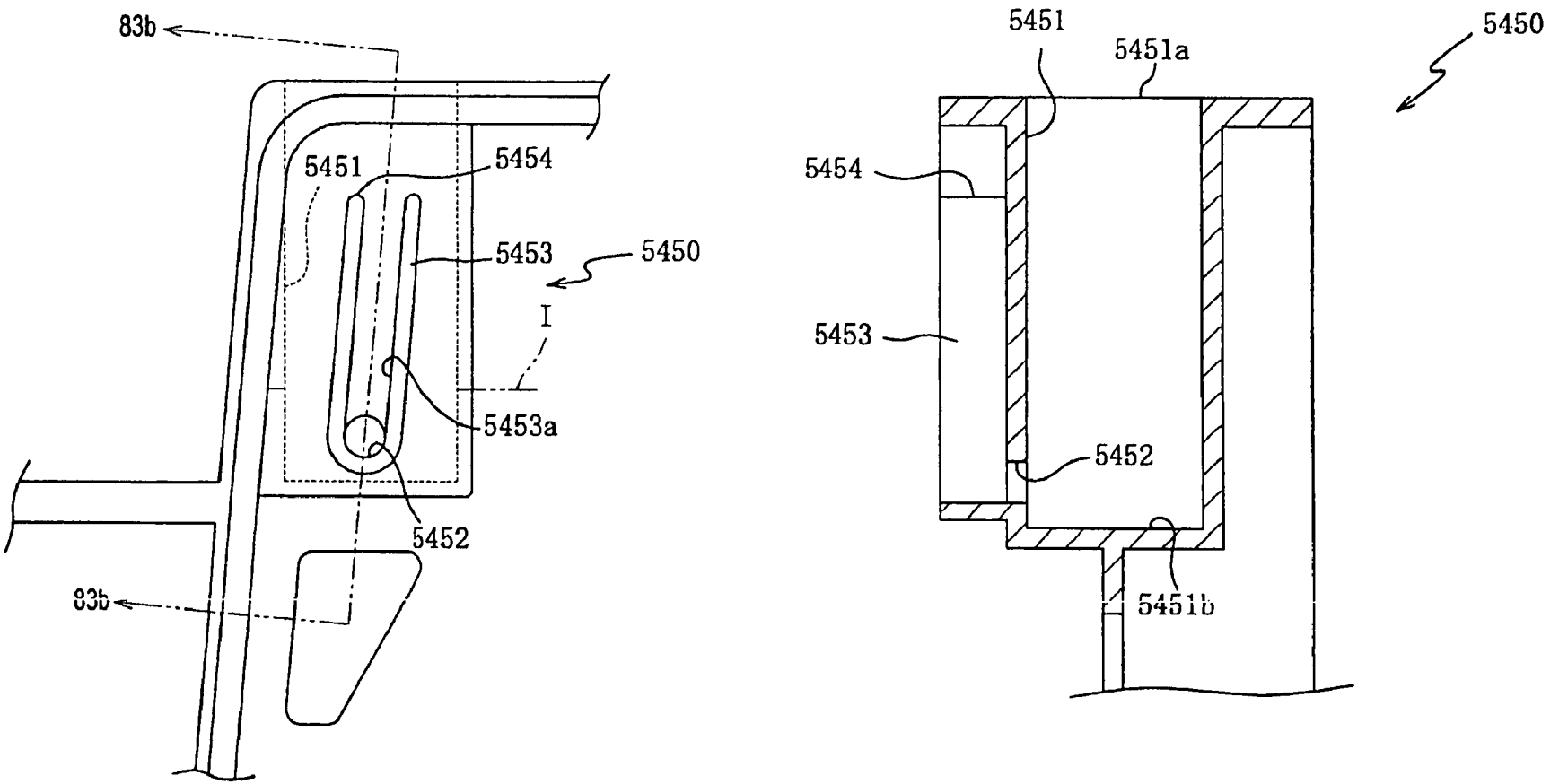
Figure 84:
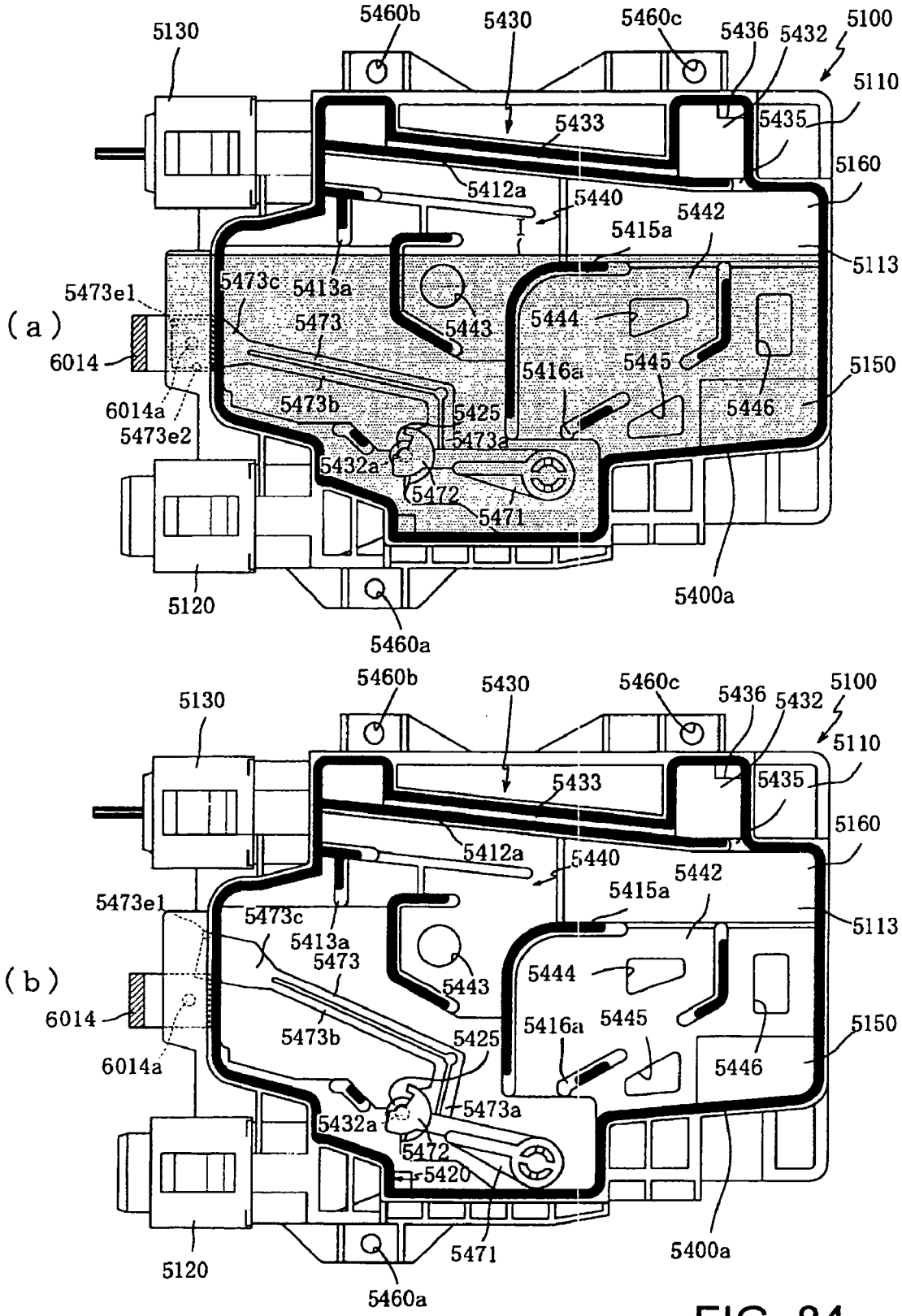
Figure 86:
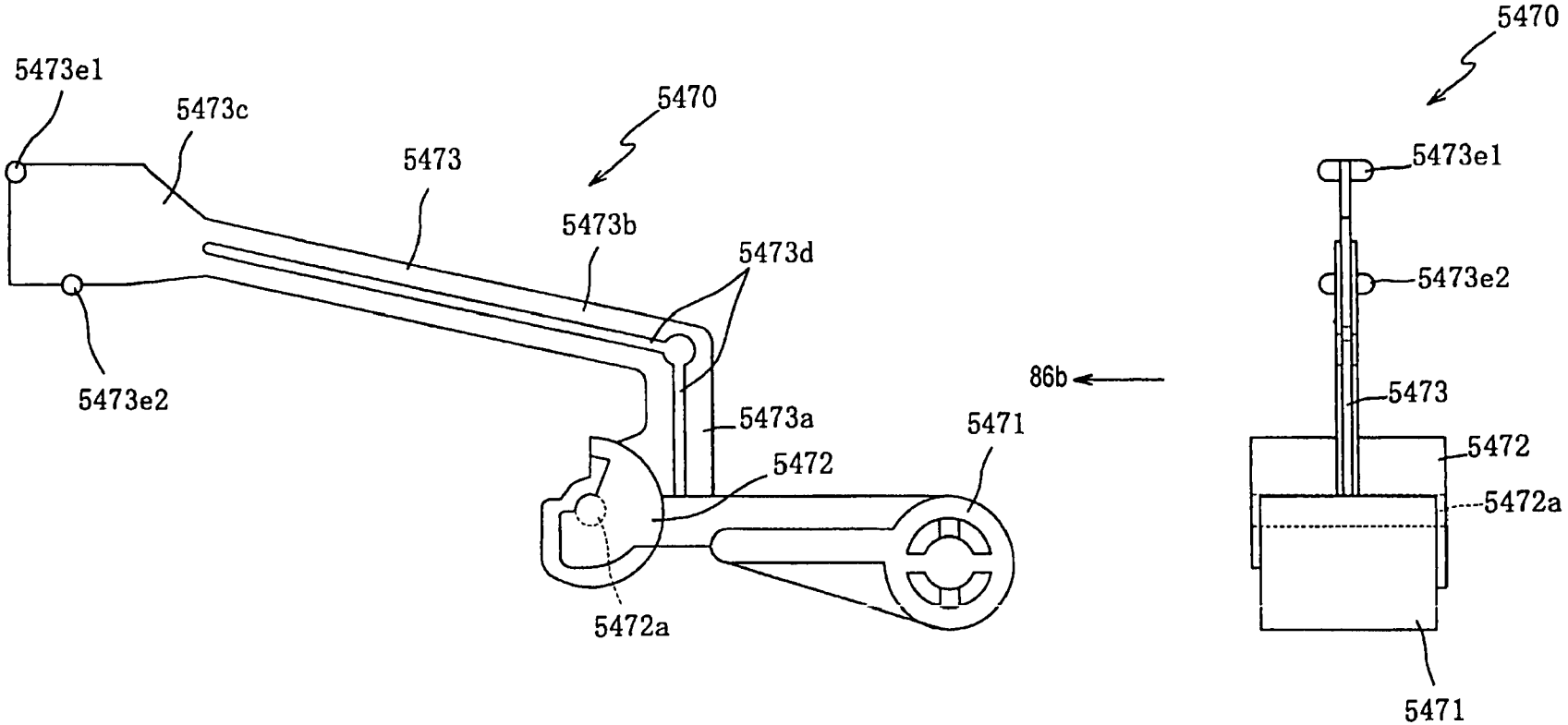

FIG. 71(*a*) is a front/rear view of a valve member/actuator of an exemplary ink cartridge according to the present invention;

FIG. 71(*b*) is a bottom view of a valve member/actuator of an exemplary ink cartridge according to the present invention;

FIG. 72 is a partial cross sectional view of a frame of an exemplary ink cartridge according to the present invention;

FIG. 73(*a*) is a right side view of a frame of an exemplary ink cartridge according to the present invention prior to application of a film;

FIG. 73(*b*) is a front view of a frame of an exemplary ink cartridge according to the present invention prior to application of a film;

FIG. 74(*a*) is a front view of a frame of an exemplary ink cartridge according to the present invention prior to installation of an ink supply valve mechanism and an air intake valve mechanism;

FIG. 74(*b*) is a front view of a frame of an exemplary ink cartridge according to the present invention prior to addition of ink to the frame;

FIG. 74(*c*) is a front view of a frame of an exemplary ink cartridge according to the present invention after to addition of ink to the frame;

FIG. 75(*a*) is a perspective view of a frame and portions of a case of an exemplary ink cartridge according to the present invention prior to assembly;

FIG. 75(*b*) is a front view of an exemplary ink cartridge according to the present invention;

FIG. 76(*a*) is a perspective view of a cap and a case of an exemplary ink cartridge according to the present invention prior to assembly;

FIG. 76(*b*) is a perspective view of an exemplary ink cartridge according to the present invention during packaging;

FIG. 77(*a*) is a cross sectional view of an exemplary ink cartridge and an exemplary inkjet printer according to the present invention prior to mounting of the ink cartridge;

FIG. 77(*b*) is a cross sectional view of an exemplary ink cartridge and an exemplary inkjet printer according to the present invention during mounting of the ink cartridge;

FIG. 77(*c*) is a cross sectional view of an exemplary ink cartridge and an exemplary inkjet printer according to the present invention after mounting of the ink cartridge;

FIG. 78(*a*) is a cross sectional view of an exemplary ink cartridge and an exemplary inkjet printer according to the present invention prior to dismounting of the ink cartridge;

FIG. 78(*b*) is a cross sectional view of an exemplary ink cartridge and an exemplary inkjet printer according to the present invention during dismounting of the ink cartridge;

FIG. 78(*c*) is a cross sectional view of an exemplary ink cartridge and an exemplary inkjet printer according to the present invention after dismounting of the ink cartridge;

FIG. 79(*a*) is a front view of a frame of an exemplary ink cartridge according to the present invention;

FIG. 79(*b*) is a rear view of a frame of an exemplary ink cartridge according to the present invention;

FIG. 80 is a partial cross sectional view of a frame of an exemplary ink cartridge according to the present invention;

FIG. 81(*a*) is a rear view of an ink dispensing portion of an exemplary ink cartridge according to the present invention;

FIG. 81(*b*) is a cross sectional view of the ink dispensing portion shown in FIG. 81(*a*);

FIG. 81(*c*) is a rear view of an ink dispensing portion of an exemplary ink cartridge according to the present invention;

FIG. 81(*d*) is a rear view of an ink dispensing portion of an exemplary ink cartridge according to the present invention;

FIG. 82(*a*) is a perspective view of an air intake portion of an exemplary ink cartridge according to the present invention;

FIG. 82(*b*) is a rear view of an air intake portion of an exemplary ink cartridge according to the present invention;

FIG. 82(*c*) is a front view of an air intake portion of an exemplary ink cartridge according to the present invention;

FIG. 83(*a*) is a rear view of an ink filling portion of an exemplary ink cartridge according to the present invention;

FIG. 83(*b*) is cross sectional view of the ink filling portion shown in FIG. 83(*a*);

FIG. 84(*a*) is a front view of a frame of an exemplary ink cartridge according to the present invention filled with ink;

FIG. 84(*b*) is a front view of a frame of an exemplary ink cartridge according to the present invention emptied of ink;

FIG. 85(*a*) is a front view of an ink detection projection of an exemplary ink cartridge according to the present invention;

FIG. 85(*b*) is a cross sectional view of the ink detection projection shown in FIG. 85(*a*);

FIG. 85(*c*) is a cross sectional view of the ink detection projection shown in FIG. 85(*a*);

FIG. 86(*a*) is a side view of a detector of an exemplary ink cartridge according to the present invention; and FIG. 86(*b*) is an end view of a detector of an exemplary ink cartridge according to the present invention.

DETAILED DESCRIPTION OF EMBODIMENTS

Figure 1:
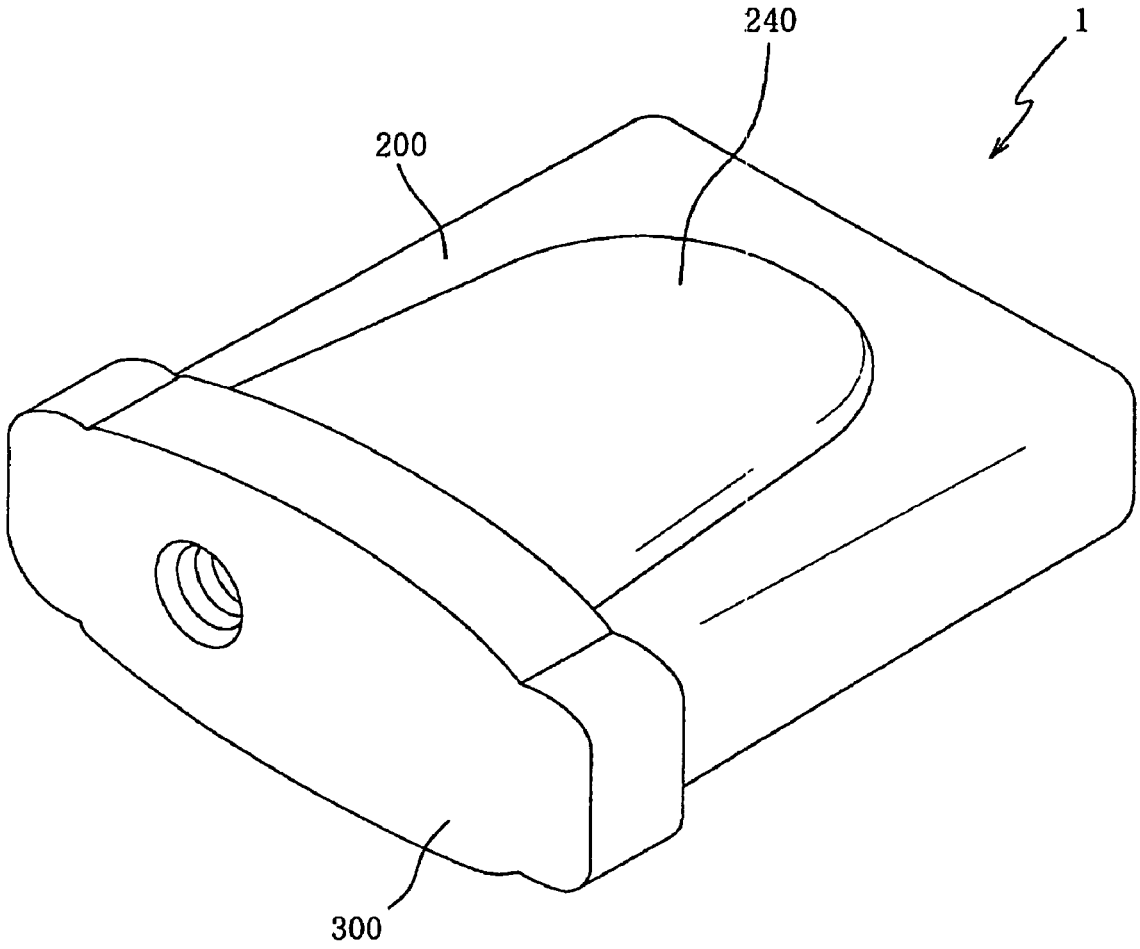
FIG. 1 is a perspective view of an exemplary ink cartridge according to the present invention.
Figure 2:
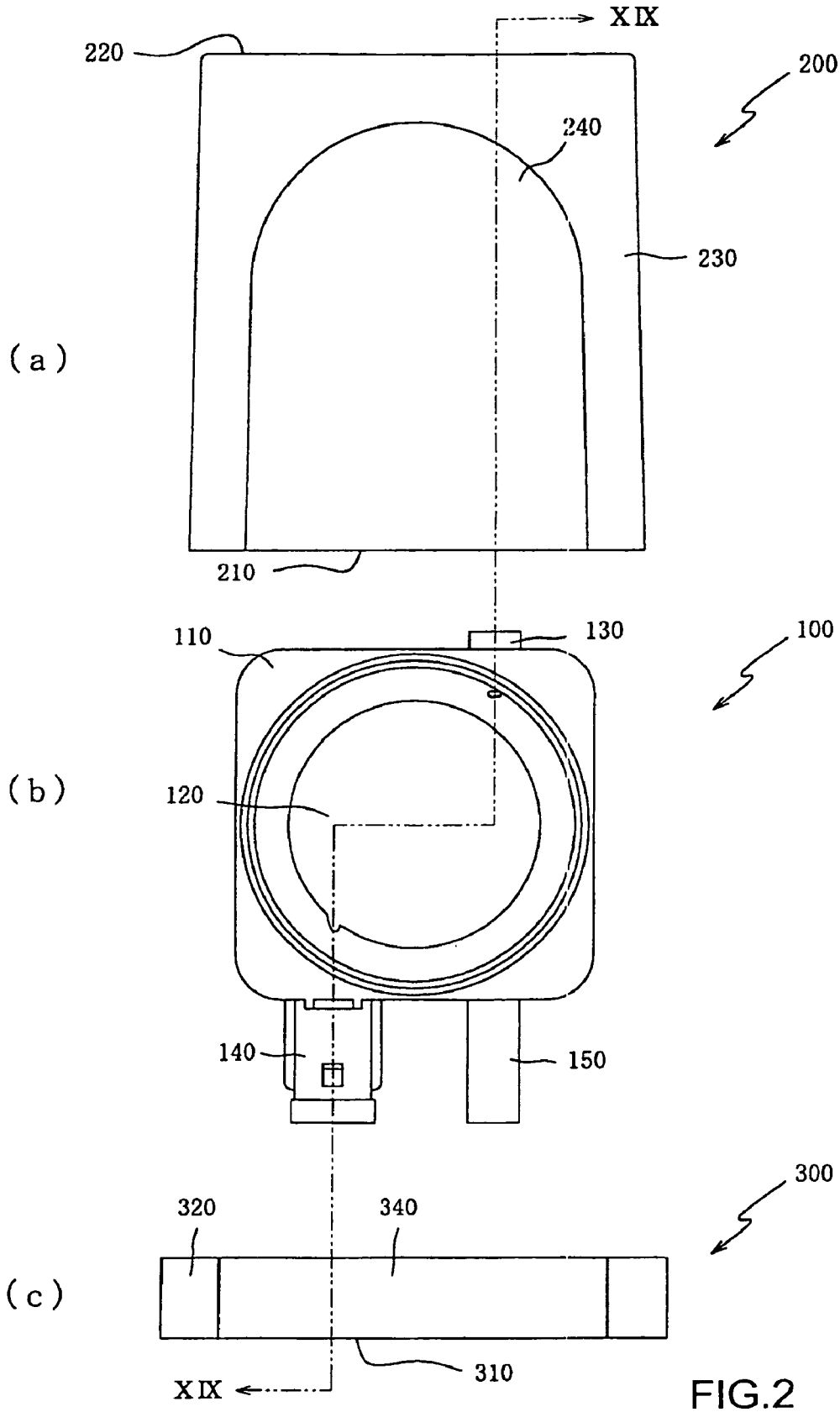
FIG. 2(*a*) is a front view of a case of an exemplary ink cartridge according to the present invention.

FIG. 1 is a perspective view of an ink cartridge 1 according to an exemplary embodiment of the present invention. FIG. 2 is a front view of the ink cartridge 1 separated into parts. FIG. 2(*a*) is a front view of a case 200, FIG. 2(*b*) is a front view of a frame 100, and FIG. 2(*c*) is a front view of a cap 300.

As shown in FIG. 1, the ink cartridge 1 is provided with: the case 200, which is a casing body that substantially covers the frame 100 (see FIG. 2); the frame 100, which can store ink; and the cap 300, which is a lid welded to the case 200, and to which the frame 100 is mounted. The case 200 and the cap 300 form a casing of the ink cartridge 1.

As shown in FIG. 2(*a*), the case 200 is formed in a substantially square shape as seen from the front (a direction perpendicular to the paper plane of FIG. 2(*a*)). The case 200 opens at a case aperture portion 210 (see lower side of FIG. 2(*a*), FIG. 3(*d*)). The surface opposite from the case aperture portion 210 (upper side of FIG. 2(*a*)) is a case ceiling wall 220, and a case sidewall 230 is arranged between the case ceiling wall 220 and the case aperture portion 210. The case sidewall 230 includes two pairs of sidewalls, each pair of sidewalls including two sidewalls that are substantially the same shape and opposite from each other. The two pairs of side walls form four surfaces of the case sidewall 230. In exemplary embodiments, two of the sidewalls forming the case sidewall 230 have larger surface areas than the other sidewalls (the sidewalls opposing each other in a direction perpendicular to the paper plane of FIG. 2(*a*)). A case curved portion 240 may be formed on one or both of the side walls having a greater surface area. The case curved portion 240 may be curved toward an outside of the case 200 (in a direction perpendicular to the paper plane of FIG. 2(*a*)). This case curved portion 240 forms a space that stores the frame 100 in a state in which ink is filled, and also functions so as to improve the strength of the case 200.

As shown in FIG. 2(*b*), the frame 100 is an ink storage body, and is provided with: a frame main body portion 110 forming a main body of the frame 100; an ink storage portion 120 that is formed in the center of the frame main body portion 110 and includes a chamber for storing ink; a substantially cylindrical ink insertion portion 130 through which ink is injected (filled) into the ink storage portion; a substantially cylindrical ink supply portion 140 through which ink in the ink storage portion 120 is supplied to an inkjet printer 1710 (see FIG. 26); and a frame restriction portion 150 that protrudes substantially parallel to the ink supply portion 140 and restricts movement of the frame 100 in a front-to-back direction (perpendicular to the paper plane of FIG. 2(*b*)) when the frame 100 is mounted to the cap 300. FIG. 2(*b*) shows the frame 100 in a state in which a space for storing ink has not been formed. As discussed below, a film 1430 (see FIG. 19) may be welded to the frame main body portion 110 to form a space that becomes an ink storage chamber between the film 1430 and the ink storage portion 120. A detailed explanation of various structures of the frame 100 is provided below.

Figure 5:
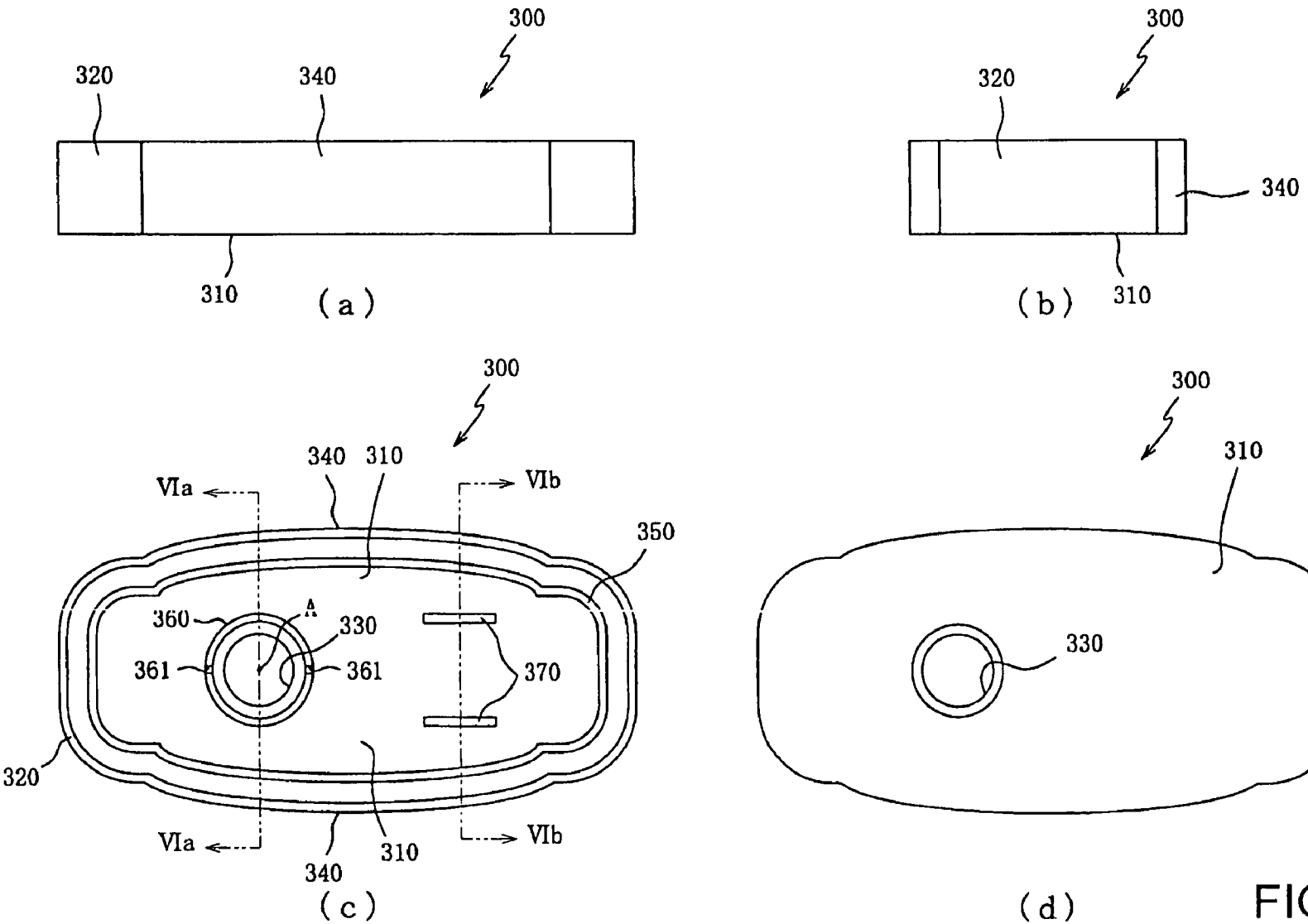
FIG. 5(*a*) is a front/rear view of a cap of an exemplary ink cartridge according to the present invention.

As shown in FIG. 2(*c*), the cap 300 is provided with: a cap bottom wall 310 that forms a bottom surface of the ink cartridge 1; a cap sidewall 320 that extends from an outer edge of the cap bottom wall 310; and a cap through hole 330 (see FIG. 5(*d*)) that is formed at a position corresponding to the ink supply portion 140 of the frame 100. On the cap sidewall 320, at a location corresponding to the case curved portion 240 of the case 200, a cap curved portion 340 is formed that is curved in an outward direction of the cap 300. Furthermore, as shown in FIG. 1, the cap 300 is welded to the case 200 so that the cap sidewall 320 surrounds part (end portion of the case aperture portion 210 side) of the case sidewall 230 of the case 200.

Figure 3:
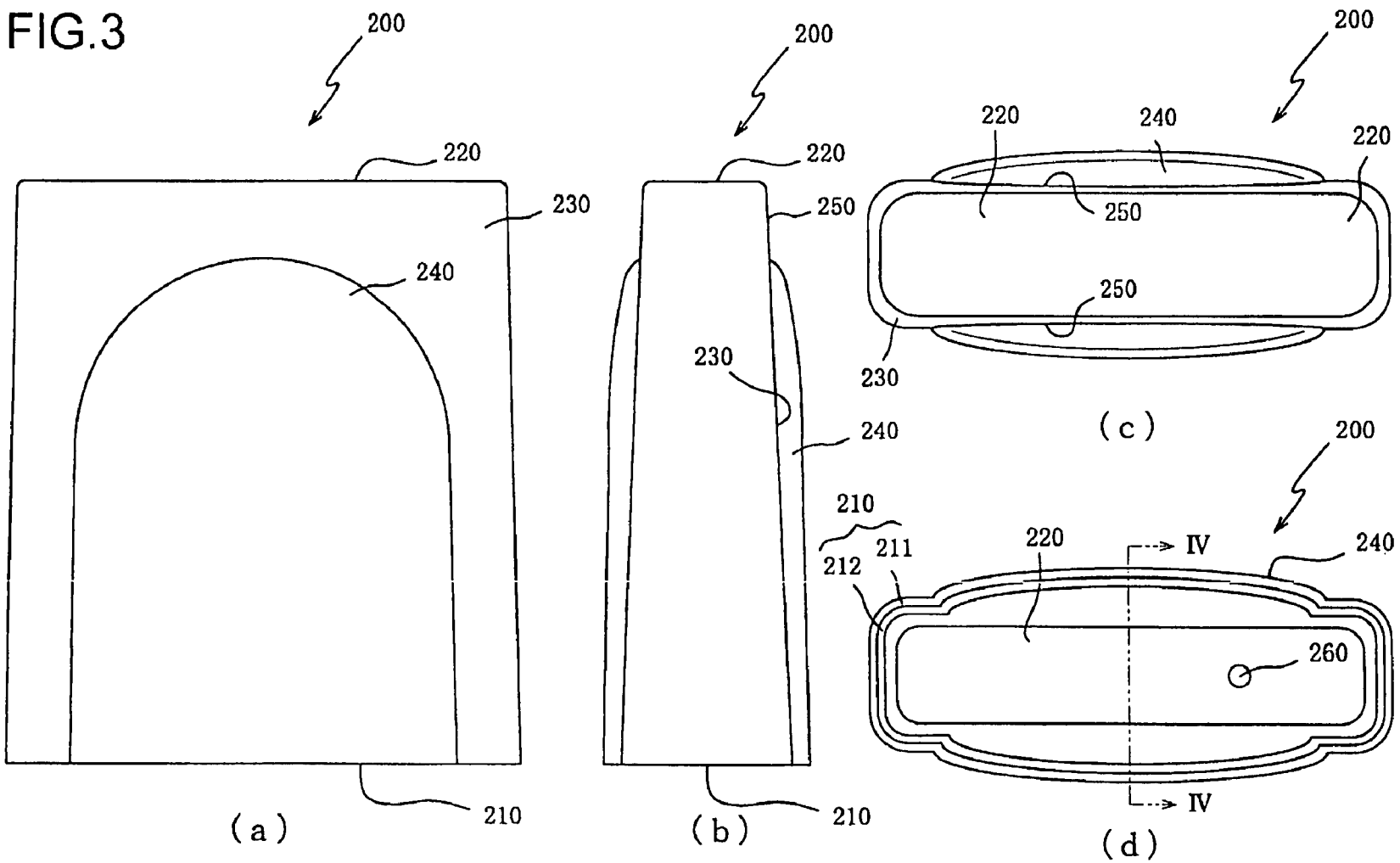
FIG. 3(*a*) is a front/rear view of a case of an exemplary ink cartridge according to the present invention.
Figure 4:
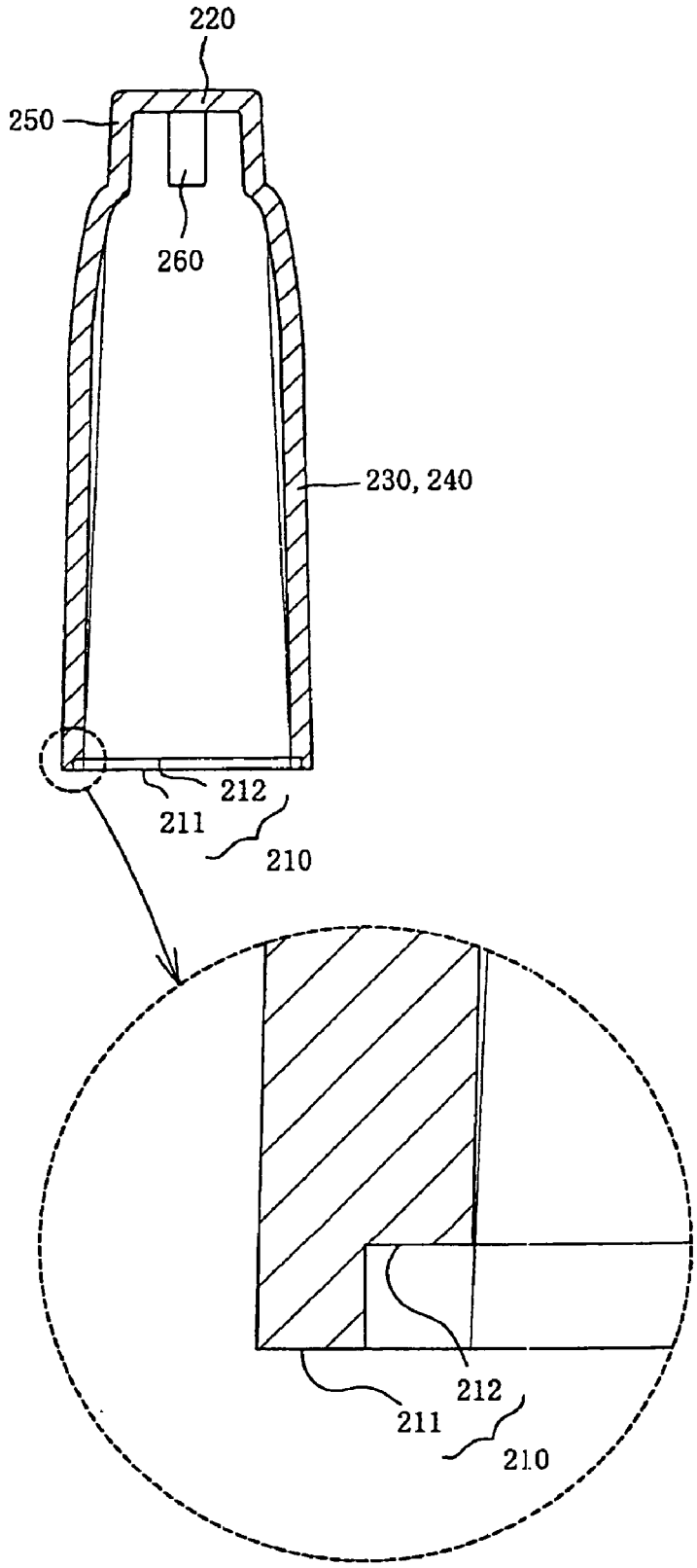
FIG. 4 is a cross sectional view of the case shown in FIG. 3(*d*)

The case 200 is described with reference to FIGS. 3 and 4. FIG. 3 shows views of six surfaces of the case. FIG. 3(*a*) is a front/rear view of the case 200, FIG. 3(*b*) is a left side/right side view of the case 200, FIG. 3(*c*) is a top view of the case 200, and FIG. 3(*d*) is a bottom view of the case 200. FIG. 4 is a cross sectional view of the case 200 shown in FIG. 3(*d*). FIG. 3(*a*) is identical to FIG. 2(*a*), so a detailed explanation of FIG. 3(*a*) is omitted.

As shown in FIG. 3(*b*), the case 200 is constructed so that a horizontal width of the case 200 (the width of the horizontal direction of FIG. 3(*b*)) becomes greater from the case ceiling wall 220 to the case aperture portion 210. The horizontal width of the case curved portion 240, on the other hand, is substantially constant. Furthermore, in the vertical direction of the case sidewall 230 (vertical direction of FIG. 3(*b*)), the case curved portion 240 is formed so that an upper end portion of the case sidewall 230 (end portion of the upper side of FIG. 3(*b*)) is formed to be spaced from the case aperture portion 210 by a predetermined distance. The upper end portion of the case sidewall 230 in which the case curved portion 240 is not formed is a case handle portion 250, and can be used as a handle when the ink cartridge 1 is mounted to the inkjet printer 1710 (see FIG. 26).

As shown in FIG. 3(*c*), the case handle portion 250 is formed to be curved to the inside (vertical direction of FIG. 3(*c*)) of the case 200. The curvature provides the case handle portion 250 with a shape that permits the case 200 to be easily held by a user. Additionally, when the case 200 is pressed into a mounting portion of the inkjet printer 1710 (see FIG. 26), by holding the case handle portion 250, a user's hand will contact the case curved portion 240 thus preventing the case 200 from slipping from the user's hand. Therefore, compared to a case having a substantially rectangular-parallelepiped shape, ease of mounting the ink cartridge 1 to the inkjet printer 1710 is improved.

As shown in FIG. 3(*d*), a case protruding member 260 is formed in the case ceiling wall 220 so as to protrude into the case 200 toward the case aperture portion 210. As shown in FIG. 4, the case protruding member 260 protrudes into the case 200 for a distance corresponding substantially the height of the case handle portion 250. When the frame 100 is stored within the case 200, the case protruding member 260 presses a part of the ink insertion portion 130 of the frame 100 so that the frame 100 does not slide due to vibration, etc. A detailed explanation is provided below.

As shown in FIG. 4, the case aperture portion 210 of the case 200 is provided with a first aperture end surface 211 that is positioned in an outer direction of the case 200, and a second aperture end surface 212 that is positioned inside of the case 200 from the first aperture end surface 211. As shown in the enlarged inset in FIG. 4, the first and second aperture end surfaces 211 and 212 are formed in a stepped configuration so that a portion of the end surface of the case aperture portion 210 is recessed. When the case 200 is mounted to the cap 300, a cap protruding member 350 (see FIG. 6) of the cap 300 contacts the step between the first and second aperture end surfaces 211 and 212. Therefore, the cap protruding member 350 is positioned inside of the case 200 so the case 200 and the cap 300 can be prevented from shifting with respect to each other.

The cap 300 is described with reference to FIGS. 5 and 6. FIG. 5 shows views of six surfaces of the cap 300. FIG. 5(*a*) is a front/rear view of the cap 300, FIG. 5(*b*) is a left side/right side view of the cap 300, FIG. 5(*c*) is a top view showing an inner surface of the cap 300, and FIG. 5(*d*) is a bottom view of the cap 300. FIG. 6 shows cross sectional views of the cap 300. FIG. 6(*a*) is a cross sectional view of the cap 300 shown in FIG. 5(*c*), and FIG. 6(*b*) is a cross sectional view of the cap 300 shown in FIG. 5(*c*). The broken lines in FIGS. 6(*a*) and (*b*) are imaginary lines showing positions of the frame 100 and the case 200 when mounted to the cap 300. FIG. 5(*a*) is identical to FIG. 2(*c*), so a detailed explanation of FIG. 5(*a*) is omitted.

As shown in FIG. 5(*b*), in the cap 300, the cap curved portions 340 are formed to be vertically symmetrical in a side surface view (direction perpendicular to the paper plane of FIG. 5(*b*)). Furthermore, the cap sidewall 320 is formed in a substantially perpendicular direction (vertical direction of FIG. 5(*b*)) with respect to the cap bottom wall 310.

As shown in FIG. 5(*c*), the cap protruding member 350 is formed at a predetermined distance from the cap sidewall 320 inside of the cap sidewall 320 within the cap 300. As shown in FIG. 6(*a*), the cap protruding member 350 is formed to be extremely short in the vertical direction (vertical direction of FIG. 6(*a*)) of the cap sidewall 320. When the case 200 is mounted to the cap 300, this cap protruding member 350 contacts the step formed by the first and second aperture end surfaces 211 and 212, respectively, of the case aperture portion 210.

As shown in FIG. 5(*c*), inside of the cap protruding member 350 within the cap 300, a substantially cylindrical cap joint portion 360 is contacted by the ink supply portion 140 of the frame 100 (left side of FIG. 5(*c*)), and a pair of cap restriction members 370 (right side of FIG. 5(*c*)) restricts movement of the frame 100 by contacting the frame restriction portion 150 of the frame 100 when the cap 300 is assembled with the case 200 and the frame 100.

As seen from a direction perpendicular to the paper plane of FIG. 5(*c*), the cap joint portion 360 is formed in a substantially round shape. As shown in FIG. 6(*a*), the cap joint portion 360 is formed in a cylindrical shape extending to substantially the same height as the cap sidewall 320. The cap joint portion 360 includes a pair of cap guide grooves 361 in which a pair of frame loose insertion members 141 (see FIG. 7) of the ink supply portion 140 are loosely inserted. The cap guide grooves 361 are formed from the upper end surface (end surface of the upper side of FIG. 6(*a*)) of the cap joint portion 360 toward the cap bottom wall 310 (lower direction of FIG. 6(*a*)). The pair of cap guide grooves 361 is symmetrically arranged about an axis A (see FIGS. 5(*c*) and 6(*a*)) of the cap joint portion 360, and the depth of the pair of cap guide grooves 361 in an axis A direction is approximately half the height of the cap joint portion 360 in the axis A direction.

As shown in FIG. 6(*a*), in the cap joint portion 360, a pair of cap joint holes 362 is formed, which contacts a pair of frame joint members 142 (see FIG. 7) of the ink supply portion 140 when the cap 300 is assembled with the case 200 and the frame 100. The pair of cap joint holes 362 is symmetrically arranged about the axis A of the cap joint portion 360 and are arranged substantially perpendicular to a line connecting the pair of cap guide grooves 361. The position of the pair of cap joint holes 362 in the axis A direction corresponds substantially to the position of the lower end portion of the pair of cap guide grooves 361.

The pair of cap restriction members 370 includes a pair of flat plate-shaped members and protrudes from the inner side of the cap bottom wall 310. The distance between the pair of cap restriction members 370 corresponds substantially to the diameter of the cap joint portion 360. Furthermore, as shown in FIG. 6(*b*), the height of the pair of cap restriction members 370 in the axis A direction is approximately half the height of the cap sidewall 320. If the height of the pair of cap restriction members 370 is too low, movement of the frame 100 cannot be prevented. On the contrary, if the height of the pair of cap restriction members 370 is too high, the cap restriction members 370 hinder the frame 100 from being mounted to the cap 300. Forming the pair of cap restriction members 370 to a height approximately half the height of the cap sidewall 320 in the axis A direction restricts movement of the frame 100 and allows for effective mounting of the frame 100.

Additionally, the pair of cap restriction members 370 restricts rotational movement of the frame 100 about the cap joint portion 360 when the frame 100 is mounted to the cap 300. The greater the distance between the cap restriction members 370 and the cap joint portion 360, the more accurately such rotational movement can be prevented. In the exemplary embodiment shown in FIG. 5(*c*), the cap joint portion 360 and the pair of cap restriction members 370 are formed on both sides (positions to the side and away from the center) of the cap 300, so the movement of the frame 100 can be accurately restricted. Furthermore, it is possible to even more accurately restrict movement of the frame 100 by increasing the distance between the cap joint portion 360 and the pair of cap restriction members 370 (in the horizontal direction of FIG. 5(*c*)). In such an arrangement, a distance between the ink supply portion 140 and the frame restriction portion 150 of the frame 100 would also be increased.

As described above, as the cap 300 and the frame 100 are mounted, the ink supply portion 140 is guided by the pair of cap guide grooves 361 of the cap joint portion 360. At the same time, movement is restricted by the pair of cap restriction members 370, so positioning of the cap 300 with respect to the frame 100 is easily performed. Furthermore, the pair of frame joint members 142 of the ink supply portion 140 contacts the pair of cap joint holes 362 of the cap joint portion 360, so the frame 100 and the cap 300 are connected; thus, the frame 100 and the cap 300 can be mounted in a simplified process without welding the frame 100 and the cap 300.

As shown in FIG. 5(*d*), in the cap bottom wall 310 of the cap 300, the cap through hole 330 is formed in a position corresponding to the cap joint portion 360. The center of the cap through hole 330 is positioned on the axis A of the cap joint portion 360. The cap through hole 330 is a hole in which an ink extraction tube 1720 (see FIG. 26) arranged on the inkjet printer 1710 side is inserted when the ink cartridge 1 is mounted to the inkjet printer 1710 (see FIG. 26). Furthermore, as shown in FIG. 6(*a*), the cap through hole 330 is formed in a tapered shape in which the diameter becomes smaller from the outside of the cap bottom wall 310 progressing toward the inside of the cap 300. Therefore, when the ink extraction tube 1720 is inserted into the cap through hole 330, it is guided by the taper-shaped inclined surface of the cap through hole 330, so the ink cartridge 1 can be smoothly mounted.

Figure 7:
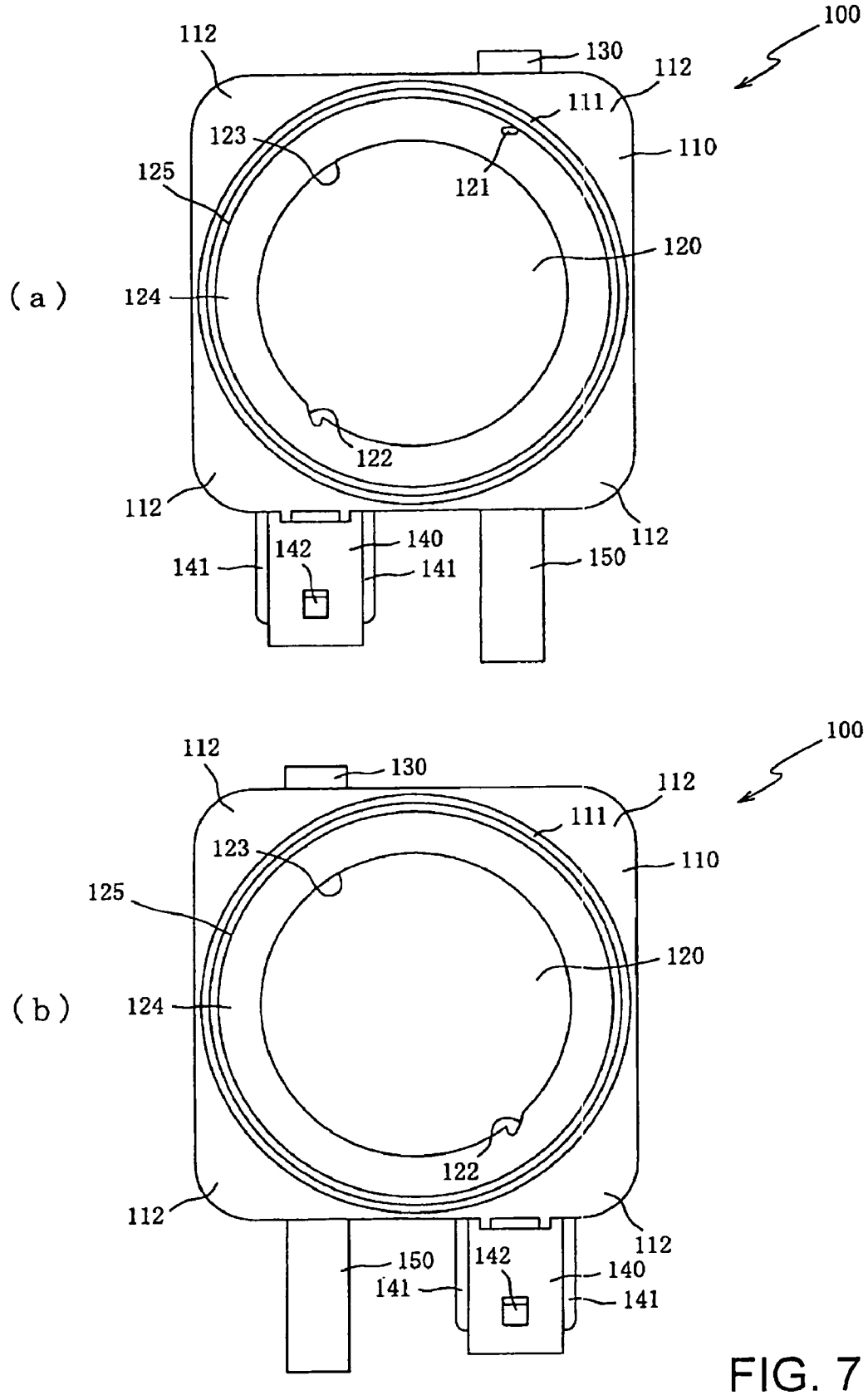
FIG. 7(*a*) is a front view of a frame of an exemplary ink cartridge according to the present invention.
Figure 8:
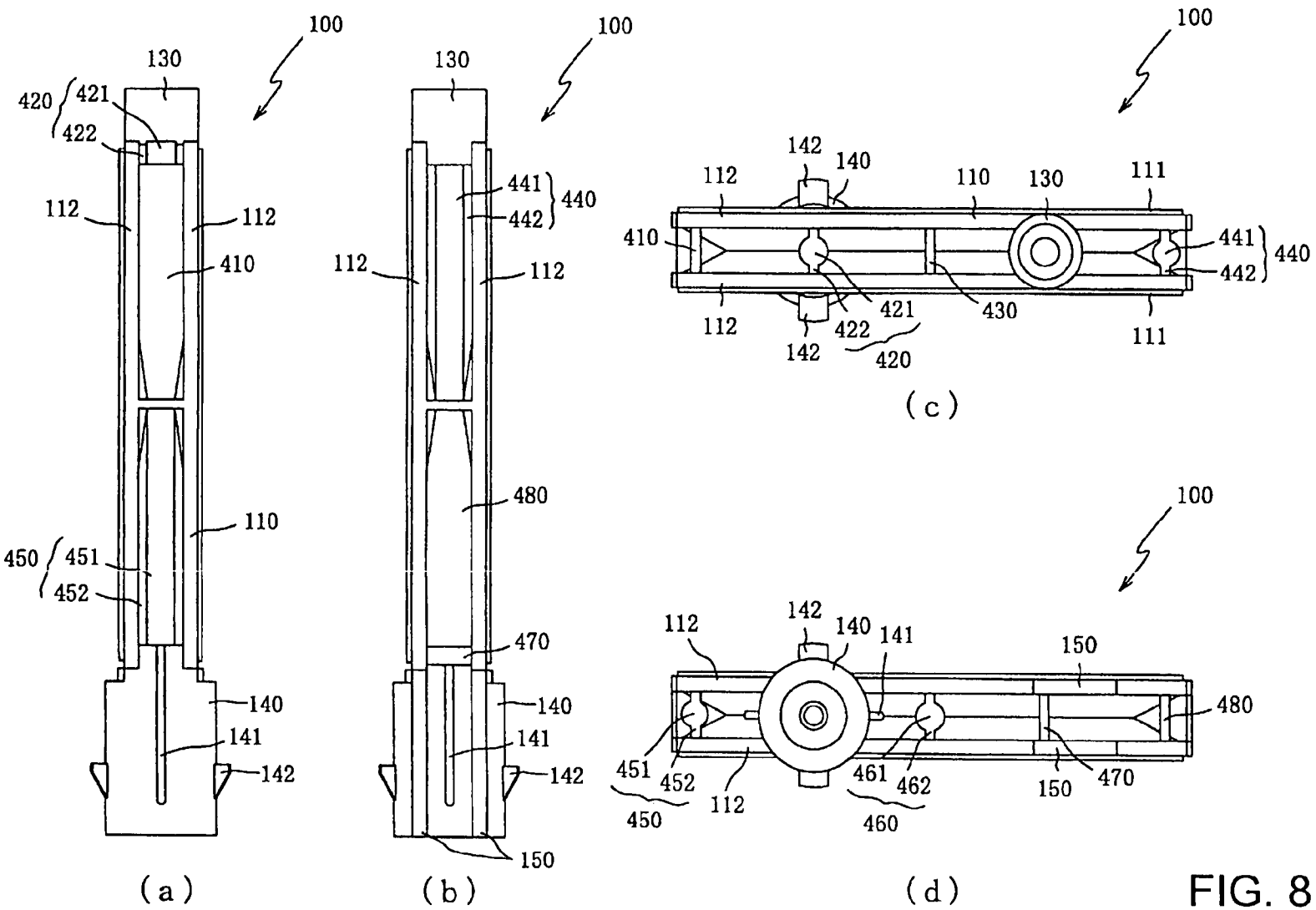
FIG. 8(*a*) is a left side view of a frame of an exemplary ink cartridge according to the present invention.
Figure 9:
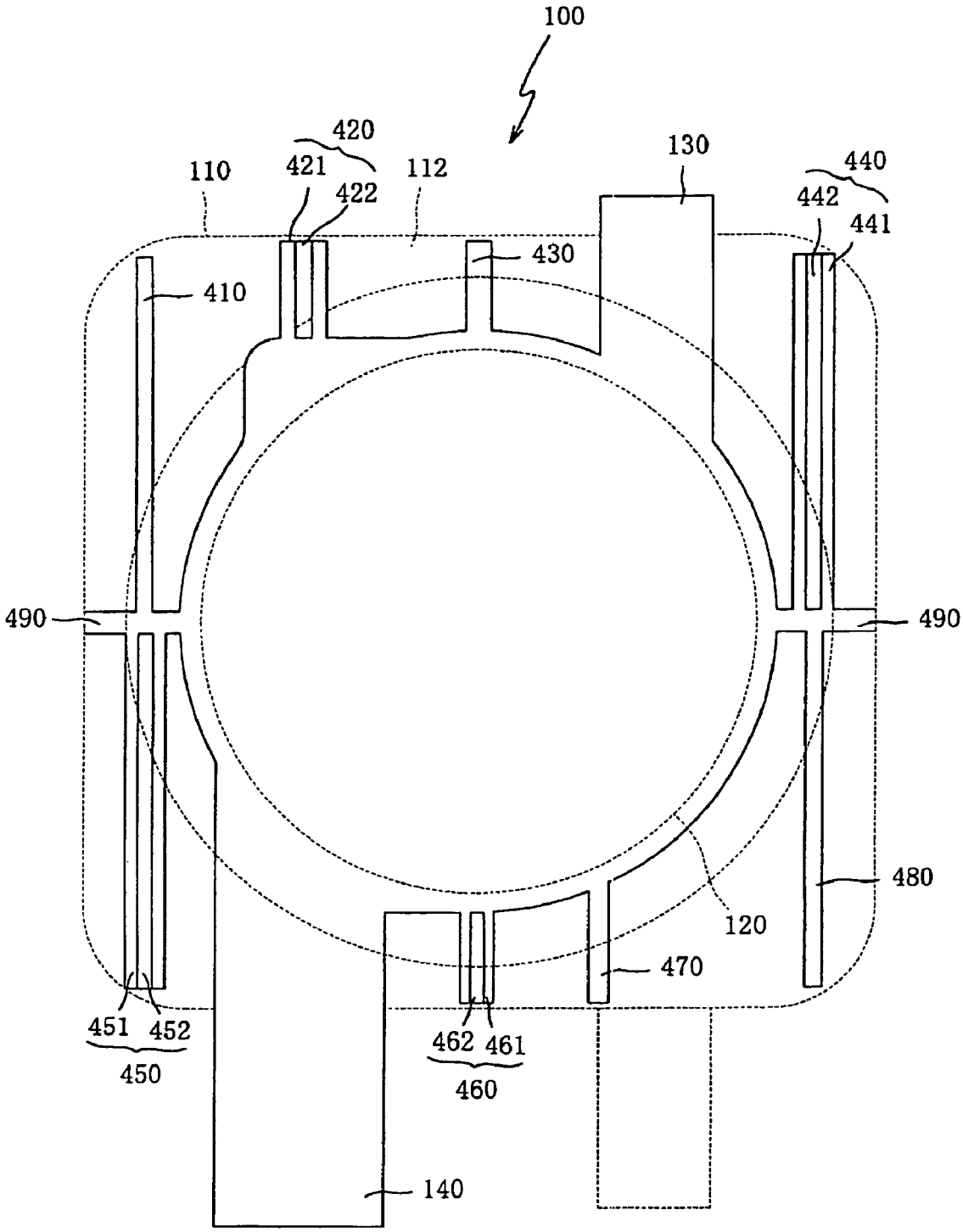
FIG. 9 is a front view of a frame of an exemplary ink cartridge according to the present invention emphasizing ribs of the frame.

The frame 100 is described with reference to FIGS. 7-9. FIG. 7 shows views of the frame 100. FIG. 7(*a*) is a front view of the frame 100, and FIG. 7(*b*) is a rear view of the frame 100. FIG. 8 shows views of the frame 100. FIG. 8(*a*) is a left side view of the frame 100, FIG. 8(*b*) is a right side view of the frame 100, FIG. 8(*c*) is a top view of the frame 100, and FIG. 8(*d*) is a bottom view of the frame 100. FIG. 9 is a view in which ribs of the frame 100 are emphasized and shown. In the following explanation, the right/left direction of FIG. 7(*a*) is a horizontal direction of the frame 100 (or frame main body portion 110), and the up/down direction of FIG. 7(*a*) is a vertical direction of the frame 100 (or frame main body portion 110).

As shown in FIG. 7(*a*), a through hole is formed in the frame main body portion 110 of the frame 100 that forms the ink storage portion 120. As shown in FIGS. 7(*a*) and (*b*), the ink storage portion 120 has an aperture 125 on the each side of the frame main body portion 110. These apertures 125 are respectively connected to frame brim portions 112. Substantially circle-shaped frame protruding members 111 are formed on the frame brim portions 112, that protrude toward a front side (front side in the direction perpendicular to the paper plane of FIG. 7(*a*)) at a position slightly separated from, but close to, the apertures 125 so as to surround the apertures 125. The frame protruding members 111 are welding locations (annular belt region) where the film 1430 (see FIG. 19) can be welded to the frame main body portion 110.

Furthermore, as shown in FIG. 7(*a*), an ink insertion hole 121 connected to the ink insertion portion 130 and an ink supply hole 122 connected to the ink supply portion 140 are formed in the ink storage portion 120. Additionally, with respect to the ink storage portion 120, a substantially round frame through hole 123 connecting the front side and the rear side is formed in a substantially central portion of the ink storage portion 120 in the width direction (direction perpendicular to the paper plane of FIG. 7(*a*)). Furthermore, the ink storage portion 120 is provided with a pair of frame inclined surfaces 124 inclined toward the frame through hole 123 from the apertures 125, respectively, on the front side and the rear side of the frame main body portion 110. The circumferential wall of the ink storage portion 120 is formed by the pair of frame inclined surfaces 124. In addition, the ink insertion hole 121 is formed in the frame inclined surfaces 124, so the ink injected into the ink storage portion 120 from the ink insertion hole 121 can be injected along the frame inclined surfaces 124; thus, bubbling of ink injected into the ink storage portion 120 can be prevented.

Here, the ink supply portion 140 is explained. As shown in FIG. 7(*a*), in the ink supply portion 140, in a position (right and left of FIG. 7(*a*)) opposite to the outer circumference of the ink supply portion 140, the pair of frame loose insertion members 141 that is loosely inserted into the pair of cap guide grooves 361 (see FIG. 6(*a*)) of the cap joint portion 360 is formed and protrudes outward in a diameter direction from the outer circumference of the ink supply portion 140. Furthermore, on the outer circumference of the ink supply portion 140, the pair of frame joint members 142 is formed, which contacts the pair of cap joint holes 362 (see FIG. 6(*a*)) of the cap joint portion 360. This pair of frame joint members 142 is positioned on a straight line substantially perpendicular to a straight line connecting the pair of frame loose insertion members 141. As shown in FIGS. 8(*a*) and 8(*b*), with respect to the pair of frame joint members 142, a top portion is provided with a horizontal surface protruding in a horizontal direction (right/left direction of FIG. 8(*a*)) and an inclined surface that inclines from an outer edge of the horizontal surface toward the outer circumferential wall of the ink supply portion 140 at a bottom portion of the frame joint member 142. Insertion of the frame joint members 142 into the cap joint portion 360 is smoothly performed by the inclined surface of the pair of frame joint members 142, and the frame 100 and the cap 300 are connected (locked) by the horizontal surface of the top portion of the pair of frame joint members 142.

As shown in FIG. 7(*b*), with respect to the frame 100 in a rear view (seen from a direction perpendicular to the paper plane of FIG. 7(*b*)), the frame protruding member 111, the frame through hole 123, and the frame inclined surfaces 124 are formed in the same position and shape as those of the frame 100 in a front view (seen from a direction perpendicular to the paper plane of FIG. 7(*a*)). The ink supply hole 122 is shown in a position that is reversed with respect to FIG. 7(*a*). Furthermore, the ink supply hole 122 is formed at the tip end portion on the frame through hole 123 side of the frame inclined surfaces 124, so ink stored in the ink storage portion 120 can be efficiently consumed. If an ink supply hole is formed in the frame inclined surfaces 124 away from the tip end portion, the film 1430 will adhere to the frame inclined surfaces 124 before ink in the ink storage portion 120 is consumed, thus closing the ink supply hole. However, since the ink supply hole 122 is formed at the tip end portion of the frame inclined surfaces 124, the ink supply hole 122 will not be closed by the film 1430 until ink in the ink storage portion 120 is consumed (see FIG. 19).

Furthermore, the front surface view and the back surface view of the frame 100 differ due to the location of the ink insertion hole 121, which is connected to the ink insertion portion 130. As shown in the rear view of the frame 100 in FIG. 7(*b*), the ink insertion hole 121 does not appear in the ink storage portion 120. That is, the ink insertion hole 121 is formed only on one side (front view side of FIG. 7(*a*)) of the frame 100, so ink is injected from one location.

As shown in FIGS. 7(*a*) and 7(*b*), the frame main body portion 110 is formed in a substantially square shape as seen from a direction perpendicular to the paper plane, and four frame brim portions 112 are formed at the corners. As shown in FIGS. 7(*a*) and 7(*b*), on the front side and the rear side of frame 100, the frame brim portions 112 contact the two apertures 125 of the ink storage portion 120 and are arranged as a pair of flanges extending to the outside of the frame protruding members 111 surrounding the apertures 125. The respective frame brim portions 112 are formed in a plate shape so as to sandwich the ink insertion portion 130 and the ink supply portion 140 as shown in FIGS. 8(*c*) and (*d*). Furthermore, as shown in FIGS. 8(*c*) and (*d*), the frame protruding members 111 are formed on the pair of frame brim portions 112, respectively. A pair of frame brim portions 112 becomes a receiving surface of the film 1430 when the film 1430 is welded to the frame protruding member 111. Furthermore, a pair of frame restriction portions 150 is arranged and connected to the frame brim portions 112. The frame brim portions 112 are formed in a thin plate shape, and a space is formed between the front and back frame brim portions 112, making the frame brim portions 112 weak. In order to maintain the strength of the frame brim portions 112, frame rib members 410, 420, 430, 440, 450, 460, 470, 480, and 490 are formed. Hereafter, the frame rib members 410-490 are explained.

As shown in FIG. 8(*c*), the frame rib members 410, 420, 430 and 440 (first reinforcement ribs) are formed between a pair of frame brim portions 112 in order to maintain the strength of the frame brim portions 112 by connecting the pair of frame brim portions 112. As shown in FIG. 9, the frame rib member 410 is arranged in the vicinity of one end in the horizontal direction of the frame main body portion 110. As shown in FIG. 8(*c*), the frame rib member 410 is formed in a flat plate shape. As shown in FIG. 8(*a*), in the vertical direction (vertical direction of FIG. 8(*a*)) of the frame 100, the frame rib member 410 is formed to extend from the vicinity of the upper end of the frame main body portion 110 to an intermediate position on the frame main body portion 110.

The frame rib member 420 includes a rib circular-cylindrical portion 421 formed in a substantially cylindrical shape, and a pair of rib protruding portions 422 protruding toward the frame brim portions 112 from the rib circular-cylindrical portion 421. As shown in FIG. 9, the frame rib member 420 is formed to extend in the vertical direction (up/down direction of FIG. 9) to the vicinity of the ink storage portion 120 from the outer edge of the upper end side of the frame main body portion 110. In the horizontal direction (right/left direction of FIG. 9) of the frame main body portion 110, the frame rib member 420 is formed on the frame main body portion 110 toward the center from the frame rib member 410. Because the height of the frame brim portions 112 is small at the location where the frame rib member 420 is formed, the height of the frame rib member 420 is also small.

In the same manner as the frame rib member 410, at the center of the frame main body portion 110 in the horizontal direction, the frame rib member 430 is extendingly formed in a flat plate shape in the vertical direction from the outer edge of the upper end side of the frame main body portion 110. As shown in FIG. 9, the length of the frame rib member 430 is determined in the same manner that the length of the frame rib member 420 is determined.

As shown in FIG. 9, the frame rib member 440 is arranged in the vicinity of the end of the frame main body portion 110 opposite from the end where the frame rib member 410 is provided in the horizontal direction. In the same manner as the frame rib member 420, the frame rib member 440 includes a rib circular-cylindrical portion 441 that is substantially cylindrical, and a pair of rib protruding portions 442 that protrude toward the frame brim portions 112 from the rib circular-cylindrical portion 441. As shown in FIG. 8(*b*), the frame rib member 440 is formed to extend from the upper end vicinity of the frame main body portion 110 to an intermediate position in the vertical direction (vertical direction of FIG. 8(*b*)) of the frame 100.

Furthermore, as shown in FIG. 8(*c*), in the horizontal direction of the frame main body portion 110, the ink insertion portion 130 extends vertically between the frame rib member 430 and the frame rib member 440. The ink insertion portion 130 also functions as a frame rib member, because parts of an outer circumferential surface of the ink insertion portion 130 are connected to the pair of frame brim portions 112.

As shown in FIG. 8(*d*), between the frame brim portions 112, the frame rib members 450, 460, 470, and 480 (first reinforcement ribs) are formed, which maintain the strength of the frame brim portions 112. The frame rib member 450 includes a rib circular-cylindrical portion 451 formed in a substantially cylindrical shape, and a pair of rib protruding members 452 protruding toward the frame brim portions 112 from the rib circular-cylindrical portion 451. As shown in FIG. 9, the frame rib member 450 is formed in the vicinity of one end of the frame main body portion 110 in the horizontal direction. As shown in FIG. 8(*a*), the frame rib member 450 is formed to extend from the vicinity of the lower end of the frame main body portion 110 to an intermediate position of the frame 100 in the vertical direction (vertical direction of FIG. 8(*a*)).

In the same manner as the frame rib member 450, the frame rib member 460 includes a rib circular-cylindrical portion 461 that is substantially cylindrical and a pair of rib protruding portions 462 protruding toward the frame brim portions 112 from the rib circular-cylindrical portion 461. As shown in FIG. 9, the frame rib member 460 is formed to extend in the vertical direction to the vicinity of the ink storage portion 120 from the outer edge of the lower end side of the frame main body portion 110. In the horizontal direction of the frame main body portion 110, the frame rib member 460 is formed at the center of the frame main body portion 110. Because the height of the frame brim portions 112 is small at the location where the frame rib member 460 is formed, the height of the frame rib member 460 is also small.

The frame rib member 470 is formed in a flat plate shape to extend in the vertical direction. As shown in FIG. 9, the length of the frame rib member 470 is shorter than the length of the frame rib member 450 and slightly longer than the length of the frame rib member 460. The frame rib member 480 is formed in a flat plate shape in the same manner as the frame rib member 470. As shown in FIG. 9, the frame rib member 480 is arranged in the vicinity of the end of the frame main body portion 110 opposite from the end at which the frame rib member 450 is formed in the horizontal direction of the frame main body portion 110. As shown in FIG. 8(*b*), the frame rib member 480 is formed to extend from the vicinity of the lower end of the frame main body portion 110 to an intermediate position of the frame 100 in the vertical direction (vertical direction of FIG. 8(*b*)).

In addition, as shown in FIG. 8(*d*) and FIG. 9, in the horizontal direction of the frame main body portion 110, the cylindrical ink supply portion 140 extends vertically between the frame rib members 450 and 460. The ink supply portion 140 functions as a frame rib member, because parts of its outer circumferential surface contact the pair of frame brim portions 112.

In addition, as shown in FIGS. 8(*a*) and (*b*), in the intermediate position of the frame main body portion 110 in the vertical direction, the pair of frame rib members 490 (second reinforcement rib) is formed so that the frame rib members 410 and 450, and the frame rib members 440 and 480 are respectively connected to each other. As shown in FIG. 9, on the same straight line, the pair of frame rib members 490 is formed to extend in a direction perpendicular to the frame rib members 410-480 from the ink storage portion 120 to the outer edge (end portion in the horizontal direction of the frame main body portion 110) of the side end of the frame main body portion 110.

Furthermore, as shown in FIG. 7 and FIG. 8(*d*), frame restriction portions 150 are formed to protrude from the pair of frame brim portions 112, respectively, and the frame restriction portions 150 are arranged parallel to each other. The interval between the pair of frame restriction portions 150 corresponds to the interval that is present between the pair of cap restriction members 370 formed in the cap 300.

In exemplary embodiments, the frame main body portion 110 is formed of resin material, and molding is performed using metal molds. For example, by using the frame rib members 490 as a boundary, two different metal molds corresponding to the frame rib members 410-440 side and the frame rib members 450-480 side are prepared. In a state in which the two metal molds are attached to each other, a liquid (or semi-liquid) resin is injected into the metal molding, and the frame main body portion 110 is molded by cooling the resin. Therefore, the pair of frame rib members 490 is formed by resin injected into the gap formed between the two metal molds in a state in which two metal molds are attached to each other. After hardening the resin material, by moving the metal molds in a direction in which the two metal molds are separated from each other, that is, in a vertical direction (vertical direction of FIG. 8(*b*)), the molded frame main body portion 110 is removed from the metal molds, and the frame rib members 410-480, the ink insertion portion 130, and the ink supply portion 140 are formed to extend in the vertical direction. Therefore, the frame main body portion 110 can be easily removed without hindering the movement of the metal molds in the vertical direction.

Thus, only the pair of frame rib members 490 is formed to extend in the horizontal direction, and other frame rib members 410-480, the ink insertion portion 130, and the ink supply portion 140 are arranged to extend in the vertical direction. Therefore, although many members that reinforce the pair of frame brim portions 112 are provided, the frame main body portion 110 can be molded in a simplified metal molding structure formed of two metal molds. Both reinforcement of the frame brim portions 112 and a cost reduction of the metal molds can be accomplished.

Furthermore, the rib circular-cylindrical portions 421, 441, 451, and 461 also function as receiving portions pushed by ejection pins when the frame main body portion 110 is removed from the metal molding.

Thus, as explained above, the frame brim portions 112 are formed in a flat plate shape causing the frame brim portions 112 to be structurally weak. However, by providing the frame rib members 410-490, the strength of the frame brim portions 112 can be improved. As a result, the frame main body portion 110 is strengthened. As described below, the film 1430 (see FIG. 19) is welded to the frame main body portion 110 by pressing the film 1430 against the frame brim portions 112 of the frame main body portion 110. Thus, if the frame brim portions 112 are bent, the film 1430 cannot be welded accurately. Furthermore, the frame main body portion 110 can be damaged. However, as shown in FIG. 9, the frame rib members 410-490 are formed to extend over substantially the entire frame main body portion 110, so damage to the frame main body portion 110 can be prevented, and the frame brim portions 112 can be prevented from being bent when the film 1430 is welded.

Furthermore, as shown in FIG. 9, the center axis of the ink insertion portion 130 and the center axis of the ink supply portion 140 are parallel to the center line (straight line going through the frame rib member 430 and the frame rib member 460) of the ink storage portion 120 (frame main body portion 110) of the frame main body portion 110 in a position shifted from the center line in the horizontal direction (horizontal direction of FIG. 9). When the ink insertion portion 130 and the ink supply portion 140 are positioned on the center line of the ink storage portion 120, the ink storage portion 120 must be formed in a substantially round shape, so the distance that the ink storage portion 120 protrudes outwardly from the frame main body portion 110 becomes greater. Accordingly, the size of the frame main body portion 110 becomes large, and the ink cartridge 1 becomes large. However, when the ink insertion portion 130 and the ink supply portion 140 are formed in positions shifted from the center line of the ink storage portion 120, the ink cartridge 1 can be made smaller.

Additionally, when the ink storage portion 120 is formed in a substantially elliptical shape, the ink cartridge 1 can be made smaller in the same manner as above.

Figure 10:
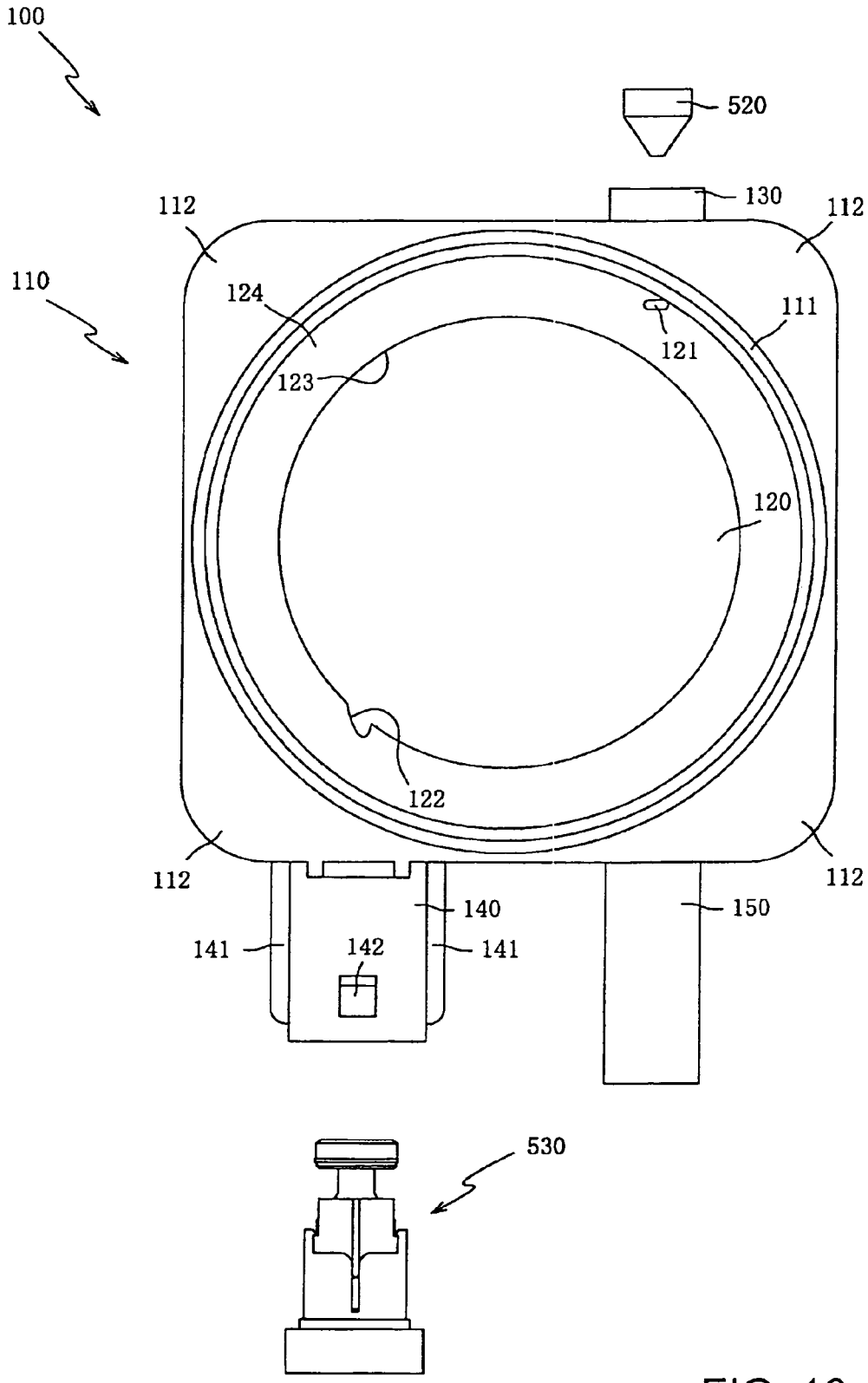
FIG. 10 is a front view of a disassembled frame of an exemplary ink cartridge according to the present invention.

The structure of parts of the frame 100 are described with reference to FIG. 10. FIG. 10 is a front view of the frame 100 separated into its constituent parts.

As shown in FIG. 10, the frame 100 can be separated into four parts. The four parts are the frame main body portion 110 provided with the ink storage portion 120, the ink insertion portion 130, the ink supply portion 140, and the frame restriction portions 150; the film 1430 (see FIG. 19) welded to the frame main body portion 110; an ink insertion plug 520 inserted into the ink insertion portion 130; and a valve mechanism 530 inserted into the ink supply portion 140. Among these four parts, an ink storage body is defined by the frame main body portion 110 and the film 1430. Furthermore, the portion that forms the ink storage portion 120 at the center portion of the frame main body portion 110 is an ink storage chamber formation portion. The following explains the valve mechanism 530 with reference to FIG. 11.

Figure 11:
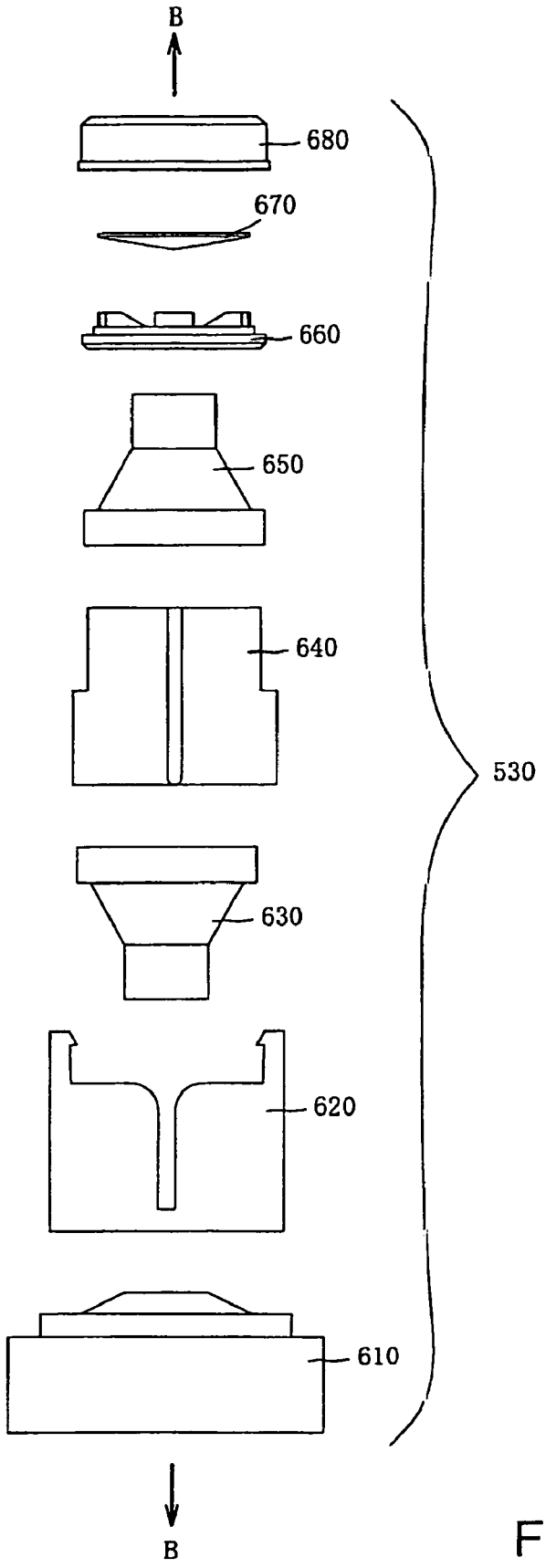
FIG. 11 is a front view of a disassembled ink supply valve mechanism of an exemplary ink cartridge according to the present invention.

FIG. 11 is a front view in showing the valve mechanism 530 separated into its constituent parts. As shown in FIG. 11, the valve mechanism 530 is provided with an insertion port for an ink extraction tube 1720 (see FIG. 26) of the inkjet printer 1710, and is also provided with: a joint member 610 formed of resin material with elasticity, such as rubber, part of the joint member 610 is exposed to the outside of the ink supply portion 140; a valve member 620 that closes an ink flow path when the joint member 610 contacts the bottom wall of the valve member 620; a first spring member 630 stored in the valve member 620 and formed of a resin elastic material; a slider member 640 that covers a release surface of the valve member 620 and can be moved in a uniaxial direction (arrow B direction FIG. 11, axis B direction of the valve mechanism 530) that is a moving direction of the valve member 620 pressed by the ink extraction tube 1720; a second spring member 650 that is stored within the slider member 640 and is formed with the same shape and material as the first spring member 630; a pedestal member 660 that contacts the second spring member 650 and receives a check valve 670; the check valve 670; and a cover member 680 that, between itself and the pedestal member 660, covers the check valve 670. The valve mechanism 530 can be integrally assembled, so the operation of assembling the valve mechanism 530 with the ink supply portion 140 can be easily completed.

The joint member 610, the valve member 620, the first and second spring members 630, 650, respectively, the slider member 640, the pedestal member 660, the check valve 670, and the cover member 680 are described with reference to FIGS. 12-18. Furthermore, in the following explanation, the axis of the valve mechanism 530 is described as axis B (see FIG. 11).

Figure 12:
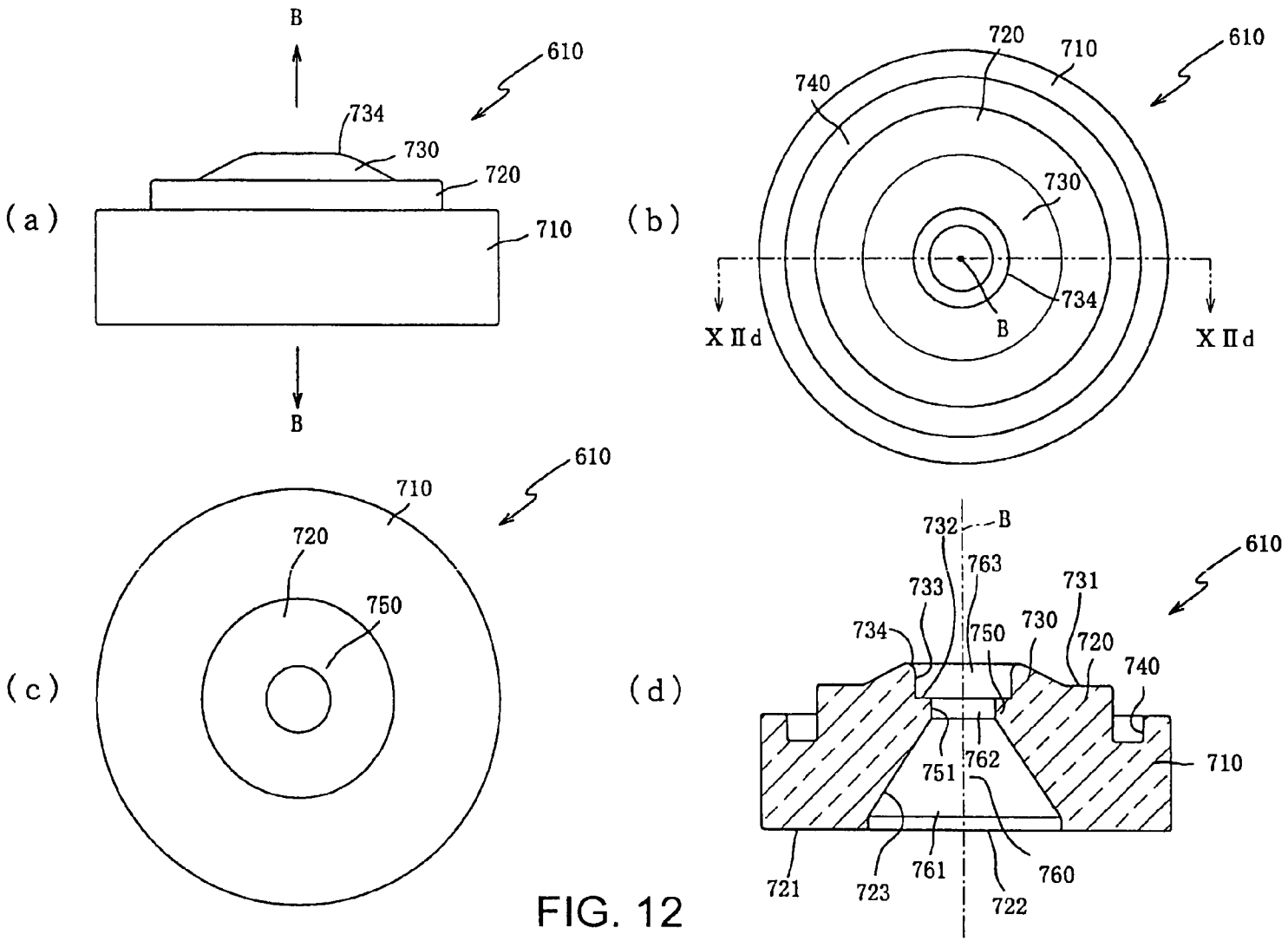
FIG. 12(*a*) is a side view of a joint member of an exemplary ink cartridge according to the present invention.

FIG. 12 shows the joint member 610. FIG. 12(*a*) is a side view of the joint member 610, FIG. 12(*b*) is a top view of the joint member 610, FIG. 12(*c*) is a bottom view of the joint member 610, and FIG. 12(*d*) is a cross sectional view of the joint member 610 shown in FIG. 12(*b*).

As shown in FIG. 12(*a*), the joint member 610 includes three levels in a side view (seen from a direction perpendicular to the paper plane of FIG. 12(*c*)). The lowest level portion (lower side of FIG. 12(*c*)) is a joint outer circumferential portion 710 that forms the outer circumferential portion of the joint member 610. The joint outer circumferential portion 710 is exposed to the outside of the ink supply portion 140. The portion above the joint outer circumferential portion 710 is a joint inner circumferential portion 720 forming the inner circumferential portion of the joint member 610. The joint inner circumferential portion 720 is arranged inside of the ink supply portion 140. The portion shown above the joint inner circumferential portion 720 is a joint contact portion 730 that contacts the valve member 620. As shown in FIG. 12(*b*), the axial centers of the joint outer circumferential portion 710, the joint inner circumferential portion 720, and the joint contact portion 730 are positioned on the same axial center as the axis B of the valve mechanism 530. Furthermore, the joint member 610 is formed of an elastic material such as a resin or rubber.

As shown in FIG. 12(*d*), between the joint outer circumferential portion 710 and the joint inner circumferential portion 720, a joint groove portion 740 is formed having a concave shape in cross section. As shown in FIG. 12(*b*), this joint groove portion 740 is formed in a round shape in a plan view.

The joint groove portion is engaged with the lower end portion of the outer circumferential wall of the ink supply portion 140, which is formed in a cylindrical shape, and the joint member 610 is fixed to the ink supply portion 140. As shown in FIG. 12(*d*), the joint contact portion 730 protrudes from a top surface 731 (surface on the side contacting the valve member 620) of the joint inner circumferential portion 720. The joint contact portion 730 is formed to be narrower toward a tip end portion 734 (end portion to the upper side of FIG. 12(*d*)). The tip end portion 734 contacts the bottom surface of the valve member 620, and closes the ink flow path. In addition, in the joint inner circumferential portion 720, a joint protruding portion 750 protrudes toward the axis B from an inner circumferential surface 733, an aperture 722 that becomes an insertion port for the ink extraction tube 1720 (see FIG. 26) is formed on the bottom surface 721 (lower side of FIG. 12(*d*)) of the joint inner circumferential portion 720, and a taper surface 723 is formed between the aperture 722 and the joint protruding portion 750.

Furthermore, as shown in FIG. 12(*d*), in the joint member 610, an ink flow path 760 is formed, which extends through the tip end portion 734 (lower side of FIG. 12(*d*)) of the joint contact portion 730 from the bottom surface 721 of the joint inner circumferential portion 720. This ink flow path 760 includes the aperture 722 formed in the bottom surface 721, a taper portion flow path 761 formed by the taper surface 723 connected to the aperture 722, a protruding portion flow path 762 formed by an inner circumferential surface 751 of the joint protruding portion 750 connected to the taper surface 723, a contact portion flow path 763 formed by a step surface 732 connected to the inner circumferential surface 751 of the joint protruding portion 750, and an inner circumferential surface 733 of the joint contact portion 730 connected to the step surface 732. Furthermore, the inner circumferential surface 751 of the joint protruding portion 750 is parallel to the axis B, and the step surface 732 is perpendicular to the axis B.

The taper portion flow path 761 is formed in a substantially hollow conical shape in which the diameter gradually becomes smaller progressing from the aperture 722 toward the point of contact with the inner circumferential surface 751 of the joint protruding portion 750. The protruding portion flow path 762 is formed in a substantially hollow cylindrical shape having the same inner diameter as the minimum inner diameter of the taper portion flow path 761. The inner diameter of the protruding portion flow path 762 is formed to be slightly smaller than the diameter of the ink extraction tube (see FIG. 26). The contact portion flow path 763 is formed in a substantially hollow cylindrical shape having an inner diameter larger than that of the protruding portion flow path 762, and the inner diameter is larger than the diameter of the ink extraction tube. Furthermore, the step surface 732 is formed in the boundary between the protruding portion flow path 762 and the contact portion flow path 763. Therefore, the inner diameter rapidly changes in the axis B direction from the protruding portion flow path 762 to the contact portion flow path 763. Thus, as shown in FIG. 12(*d*), the joint contact portion 730 has a structure notched by the inner circumferential surface 733 and the step surface 732 in a pedestal shape, and the tip end portion 734 of the joint contact portion 730 is positioned surrounding the notch portion.

The ink extraction tube 1720 is inserted into the aperture 722, guided by the taper surface 723 of the taper portion flow path 761, and inserted into the protruding portion flow path 762. As discussed above, the inner diameter of the protruding portion flow path 762 is slightly smaller than the diameter of the ink extraction tube 1720, so the ink extraction tube 1720 is elastically adhered to the inner circumferential surface 751 of the joint protruding portion 750 that forms the protruding portion flow path 762. That is, the joint protruding portion 750 functions so as to close around the ink extraction tube 1720 inserted into the protruding portion flow path 762. If an area of the of joint member 610 elastically adhered to the outer circumference of the ink extraction tube 1720 becomes too large, resistance will increase when the ink cartridge 1 is mounted to the inkjet printer 1710 (see FIG. 26), and smooth mounting cannot be accomplished. However, in the embodiment shown, e.g., in FIG. 12(*d*), the joint protruding portion 750 is arranged so that the ink extraction tube 1720 contacts only the inner circumferential surface 751. Thus, by having a small area of the joint member 610 in contact with the ink extraction tube 1720, mounting of the ink cartridge 1 to the inkjet printer 1710 can be smoothly performed. With respect to the ink flow path 760, when the ink extraction tube 1720 is inserted, the flow path in which ink actually flows is inside the ink extraction tube 1720. Also, as described below, by forming the contact portion flow path 763 in a pedestal shape, displacement of the joint member 610 in the axis B direction can be minimized when the ink extraction tube 1720 is inserted.

Figure 13:
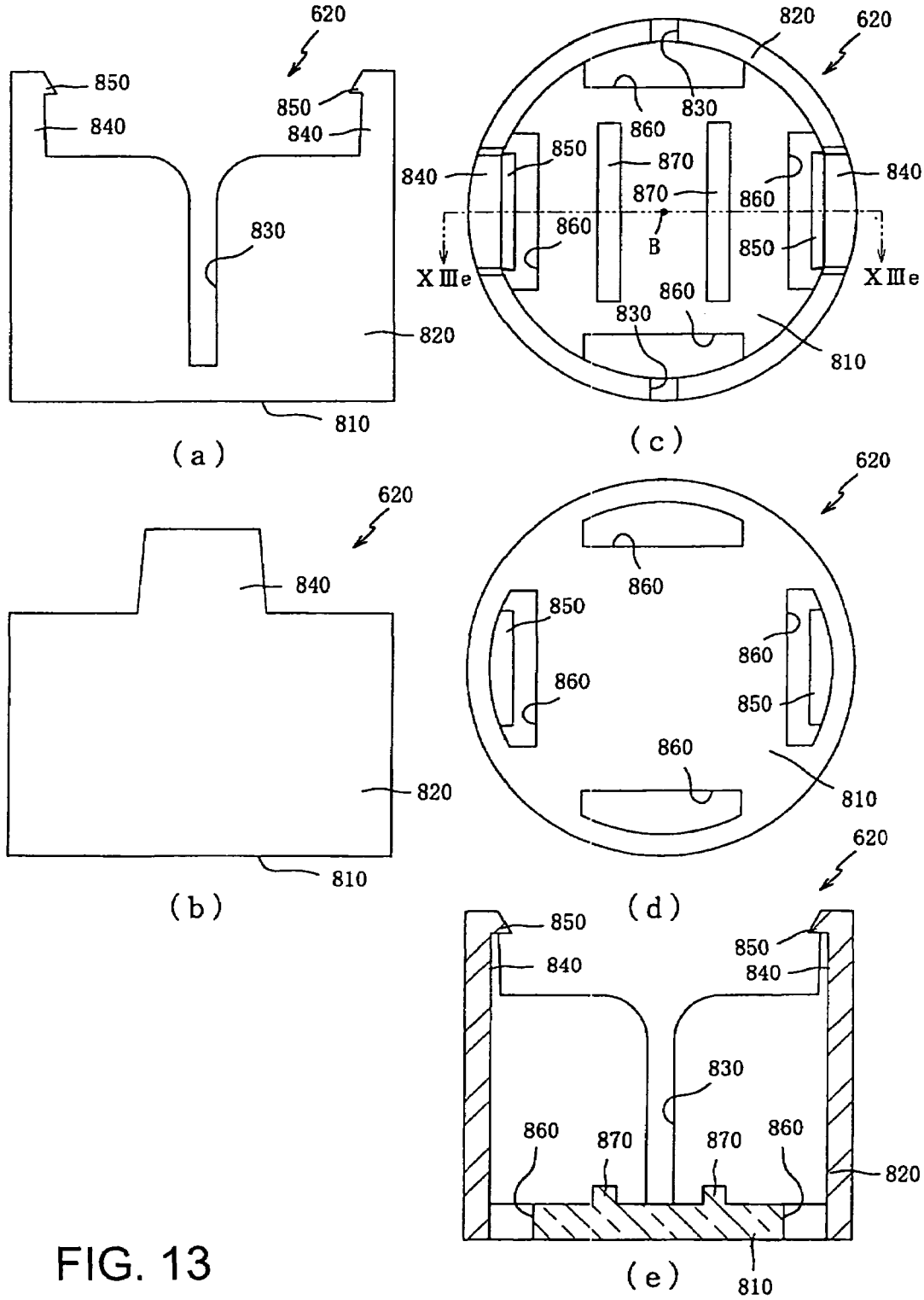
FIG. 13(*a*) is a front/rear view of a valve member of an exemplary ink cartridge according to the present invention.

FIG. 13 shows the valve member 620. FIG. 13(*a*) is a front/rear view of the valve member 620, FIG. 13(*b*) is a side view of the valve member 620, FIG. 13(*c*) is a top view of the valve member 620, FIG. 13(*d*) is a bottom view of the valve member 620, and FIG. 13(*e*) is a cross sectional view of the valve member 620 shown in FIG. 13(*c*).

As shown in FIG. 13(*a*), the valve member 620 is provided with a valve bottom wall 810 forming a bottom surface (surface at the lower side in FIG. 13(*a*)) of the valve member 620, and a valve sidewall 820 extending from the valve bottom wall 810 in the axis B direction. In the valve sidewall 820, a pair of valve guide grooves 830 are formed in which a slider loose insertion member 1030 (see FIG. 15) of the slider member 640 is loosely inserted. As shown in FIG. 13(*c*), the pair of valve guide grooves 830 is symmetrically formed with respect to the axis B of the valve mechanism 530. Furthermore, as shown in FIG. 13(*a*), the pair of valve guide grooves 830 is formed along substantially the entire valve sidewall 820 in the axis B direction. A pair of valve restriction portions 840, which protrude in a direction away from the valve bottom wall 810 and restrict the movement of the slider member 640, are connected to the valve sidewall 820. The respective valve restriction portions 840 protrude toward the axis B at the tip end (upper side of FIG. 13(*a*)) to provide valve hook portions 850 that engage with the slider member 640.

As shown in FIG. 13(*b*), in the axis B direction of the valve mechanism 530, the pair of valve restriction portions 840 are formed to be shorter than the valve sidewall 820. The pair of valve restriction portions 840 are arranged to restrict the slider member 640 using the valve hook portions 850, while the valve sidewall 820 is arranged in order to prevent the slider member 640 from being shifted in the operation direction using the pair of valve guide grooves 830, and to store the first spring member 630. Accordingly, the valve sidewall 820 is formed to be longer and larger than the pair of valve restriction portions 840 in the axis B direction of the valve mechanism 530.

As shown in FIG. 13(*c*), in the axis B direction (direction perpendicular to the paper plane of FIG. 13(*c*)) of the valve mechanism 530, in the valve bottom wall 810, at positions corresponding to the pair of valve guide grooves 830 and the pair of valve restriction portions 840, four ink flow paths 860 are formed. The ink flow paths 860 extend through the valve bottom wall 810 in the vertical direction (direction perpendicular to the paper plane of FIG. 13(*c*)). Furthermore, valve receiving portions 870 are provided on the valve bottom wall 810 that protrude upwardly (front side of the direction perpendicular to the paper plane of FIG. 13(*c*)) from the bottom valve bottom wall 810 and form pedestals for receiving a spring top portion 920 of the first spring member 630. The valve receiving portions 870 include two plate-shaped members arranged substantially parallel to each other on the valve bottom wall 810. Furthermore, as shown in FIG. 13(*e*), the height of the valve receiving portions 870 in the axis B direction is substantially less than the height of the valve sidewall 820. The valve receiving portions 870 are arranged to prevent contact between the first spring member 630 and the valve bottom wall 810 when the first spring member 630 is arranged in the space within the valve sidewall 820. This arrangement is necessary because if the first spring member 630 contacts the valve bottom wall 810, the ink flow path closes and ink does not flow. The valve receiving portions 870 are arranged to ensure ink flow by ensuring that the first spring member 630 does not contact the valve bottom wall 810. Therefore, only a minimal height is necessary.

Figure 14:
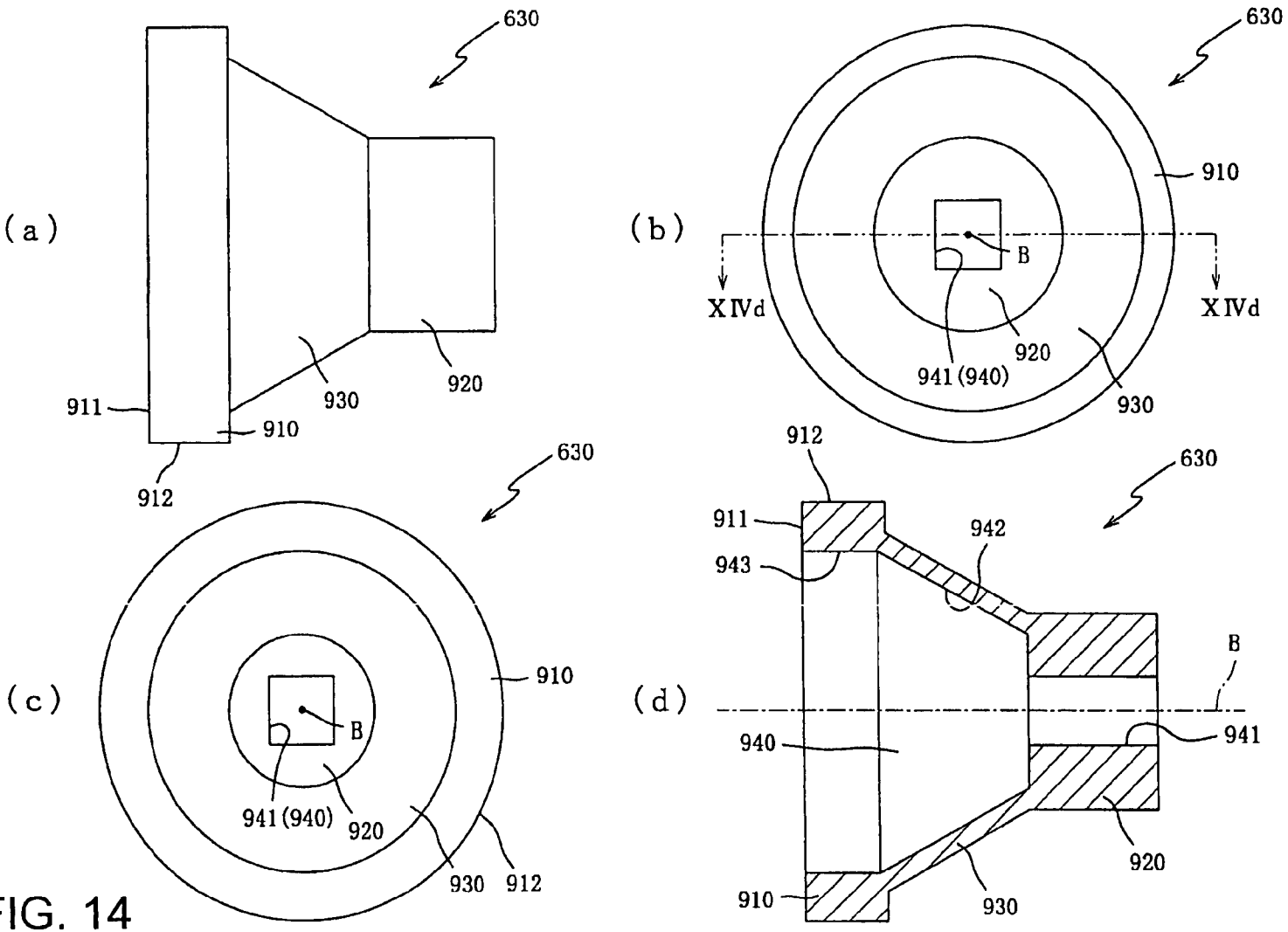
FIG. 14(*a*) is a side view of a first spring member of an exemplary ink cartridge according to the present invention.

FIG. 14 shows the first spring member 630. FIG. 14(*a*) is a side view of the first spring member 630, FIG. 14(*b*) is a top view of the first spring member 630, FIG. 14(*c*) is a bottom view of the first spring member 630, and FIG. 14(*d*) is a cross sectional view of the first spring member 630 shown in FIG. 14(*b*).

The first spring member 630 is formed in a substantially hollow conical shape (or bowl shape), and includes an annular-shaped spring bottom portion 910 that forms a bottom surface (end portion with the larger diameter) of the first spring member 630, an annular-shaped spring top portion 920 that forms a top portion (end portion with the smaller diameter) above the first spring member 630, and a hollow conical spring flexible portion 930 that is provided between the spring top portion 920 and the spring bottom portion 910. The spring flexible portion 930 is bent and deformed when a load of the valve mechanism 530 in the axis B direction is applied (e.g., when the valve member 620 pressed by the ink extraction tube 1720 in an urging direction of the first spring member 630 and the second spring member 650). The spring top portion 920 contacts the valve receiving portions 870 of the valve member 620 and acts as a pressing portion that presses the valve member 620. Furthermore, the diameter of the spring bottom portion 910 is larger than the diameter of the spring top portion 920, so the spring bottom portion 910 acts as a base portion when the spring flexible portion 930 is elastically deformed.

As shown in FIG. 14(*d*), in the first spring member 630, an ink flow path 940 extends from the bottom surface (end surface of the left side of FIG. 14(*d*)) of the spring bottom portion 910 to the tip end (end surface of the right side of FIG. 14(*d*)) of the spring top portion 920. This ink flow path 940 includes a top portion flow path 941 formed by the inner circumferential surface of the spring top portion 920, a flexible portion flow path 942 formed by the inner circumferential surface of the spring flexible portion 930, and a bottom portion flow path 943 formed by the inner circumferential surface of the spring bottom portion 910. As shown in FIG. 14(*d*), the aperture area of the ink flow path 940 gradually becomes larger from the tip end of the spring top portion 920 to the bottom surface of the spring bottom portion 910. Furthermore, as shown in FIGS. 14(*b*) and (*c*), the top portion flow path 941 of the spring top portion 920 is formed in a substantially square shape as seen from the direction perpendicular to the paper plane.

The aperture surface of the top portion flow path 941 is formed in a substantially square shape so that effects caused by bubbles in ink can be reduced. For example, if the top portion flow path 941 were formed in a substantially round shape in a direction perpendicular to the paper plane, spherical bubbles larger in diameter than the top portion flow path 941 could close the flow path. If the flow path is closed, ink cannot be properly transmitted from the ink cartridge 1 to the inkjet printer 1710 (see FIG. 26). As a result, printing quality by the inkjet printer 1710 is deteriorated. However, in the embodiment shown, e.g., in FIG. 14(*b*), because the aperture surface of the top portion flow path 941 has a substantially square shape, even if bubbles larger than the aperture surface of the top portion flow path 941 are present, the corners are not closed. Thus, closure of the ink flow path is prevented, and chances of deteriorated printing quality are reduced.

It should be appreciated that the aperture surface of the top portion flow path 941 is not limited to a square shape. Other polygonal shapes, such as hexagons or star shapes, are also acceptable.

As shown in FIG. 14(*d*), the spring top portion 920 is formed in a cylindrical shape, which is relatively thick and extends in the axis B direction. The spring top portion 920 is formed so that the cross sectional shape perpendicular to the axis B direction (urging direction of the first spring member 630) is made uniform. In the same manner, the spring bottom portion 910 is also formed in a cylindrical shape, which is relatively thick and extends in the axis B direction, and the cross sectional shape perpendicular to the axis B direction is uniform.

In addition, as shown in FIG. 14(*d*), the spring flexible portion 930 is formed in a substantially conical shape, which is inclined at a predetermined angle with respect to the axis B direction, whereby the strength of the spring flexible portion 930 bearing a load in the axis B direction is less than that of the spring bottom portion 910 and the spring top portion 920. Furthermore, the thickness of the spring flexible portion 930 is less than that of the spring bottom portion 910 and the spring top portion 920, contributing to the lesser strength of the spring flexible portion 930. Therefore, when the first spring member 630 is elastically deformed, the spring flexible portion 930 is bent and deformed.

The second spring member 650 is formed in the same shape as the first spring member 630. The structure of the second spring member 650 includes the spring bottom portion 910, the spring top portion 920, the spring flexible portions 930, and the ink flow path 940.

Figure 15:
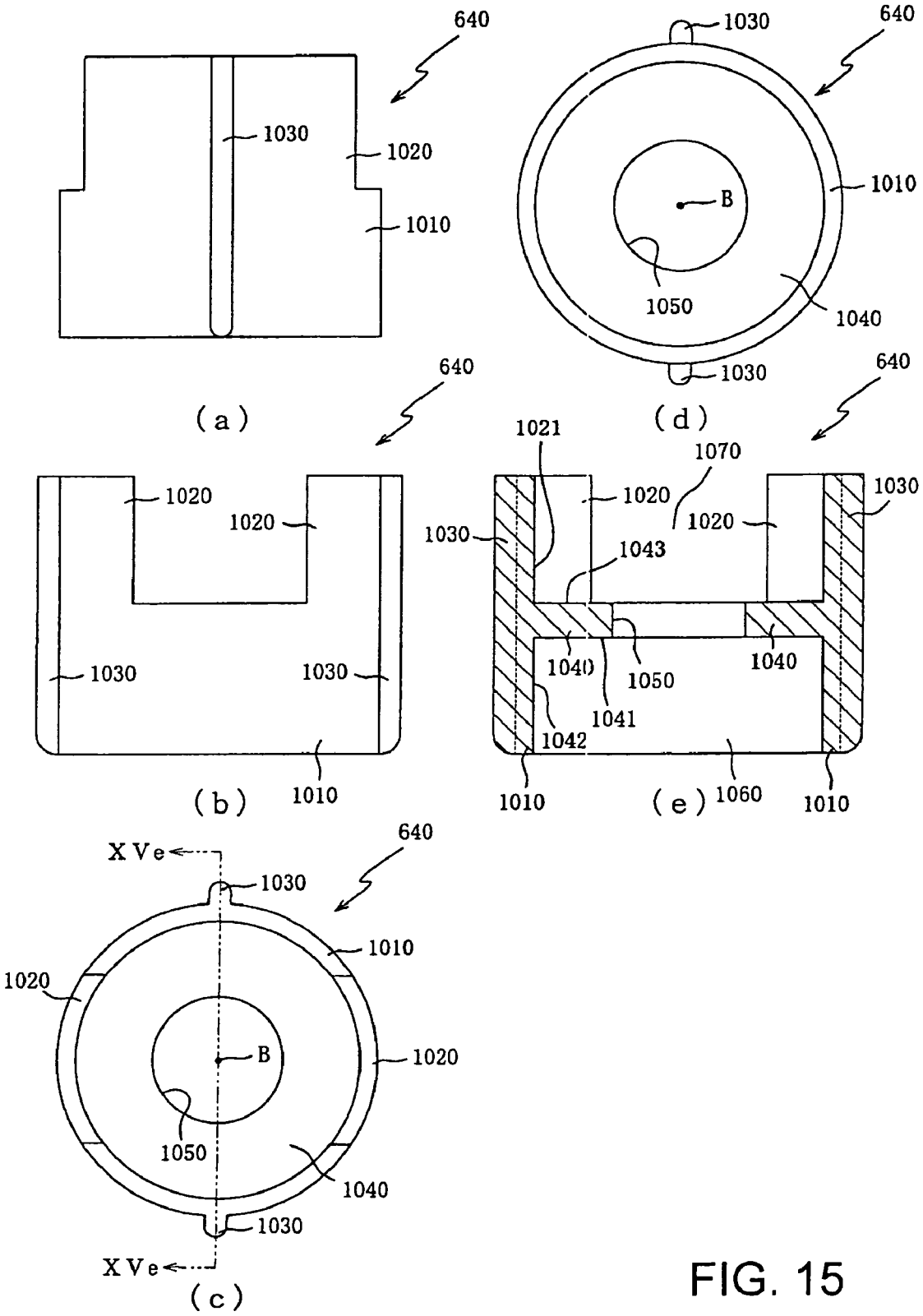
FIG. 15(*a*) is a front/rear view of a slider member of an exemplary ink cartridge according to the present invention.

FIG. 15 shows the slider member 640. FIG. 15(*a*) is a front/rear view of the slider member 640, FIG. 15(*b*) is a left side/right side view of the slider member 640, FIG. 15(*c*) is a top view of the slider member 640, FIG. 15(*d*) is a bottom view of the slider member 640, and FIG. 15(*e*) is a cross sectional view of the slider member 640 shown in FIG. 15(*c*).

As shown in FIGS. 15(*a*) and (*b*), the slider member 640 is formed of resin material that has a greater hardness than the first spring member 630 and the second spring member 650, and includes a slider outer circumferential wall 1010 that forms the outer circumference of the slider member 640, two slider protruding portions 1020 that extend in the axis B direction of the valve mechanism 530 from the slider outer circumferential wall 1010 and are formed symmetrically about the axis B, and a pair of slider loose insertion members 1030 that are arranged on and along the slider outer circumferential wall 1010 and the slider protruding portions 1020 and are formed symmetrically about the axis B and are loosely inserted to the pair of valve guide grooves 830 (see FIG. 13). The slider outer circumferential wall 1010 and the slider protruding portion 1020 are together formed in a substantially cylindrical shape.

The height of the slider protruding portion 1020 in the axis B direction is substantially the same as the height of the slider outer circumferential wall 1010. This is because the spring members 630, 650 are arranged in the inner spaces 1060, 1070, respectively, of the slider member 640 in the axis B direction. Furthermore, movement of the respective spring members 630, 650 in the direction perpendicular to the axis B is restricted by the slider protruding portion 1020 and the slider outer circumferential wall 1010.

The slider loose insertion members 1030 extend along the slider member 640 in the axis B direction (formed over the slider outer circumferential wall 1010 and slider protruding portion 1020). Movement of the slider member 640 in the axis B direction occurs smoothly by cooperation between the slider loose insertion member 1030 and the pair of valve guide grooves 830 (see FIG. 13).

As shown in FIGS. 15(*c*) and (*d*), inside of the slider outer circumferential wall 1010, a slider pedestal portion 1040 is provided on which the respective spring members 630, 650 are arranged. The slider pedestal portion 1040 contacts the spring bottom portion 910 of the respective spring members 630, 650. The slider pedestal portion 1040 divides two inner spaces 1060, 1070 that accommodate the respective spring members 630, 650 within the slider member 640. In the center of the slider pedestal portion 1040, a slider through hole 1050 is formed, and the slider through hole 1050 becomes a flow path in which ink flows. As shown in FIG. 15(*e*), in the axis B direction of the slider member 640, the slider pedestal portion 1040 is formed in a substantially intermediate position.

Figure 16:
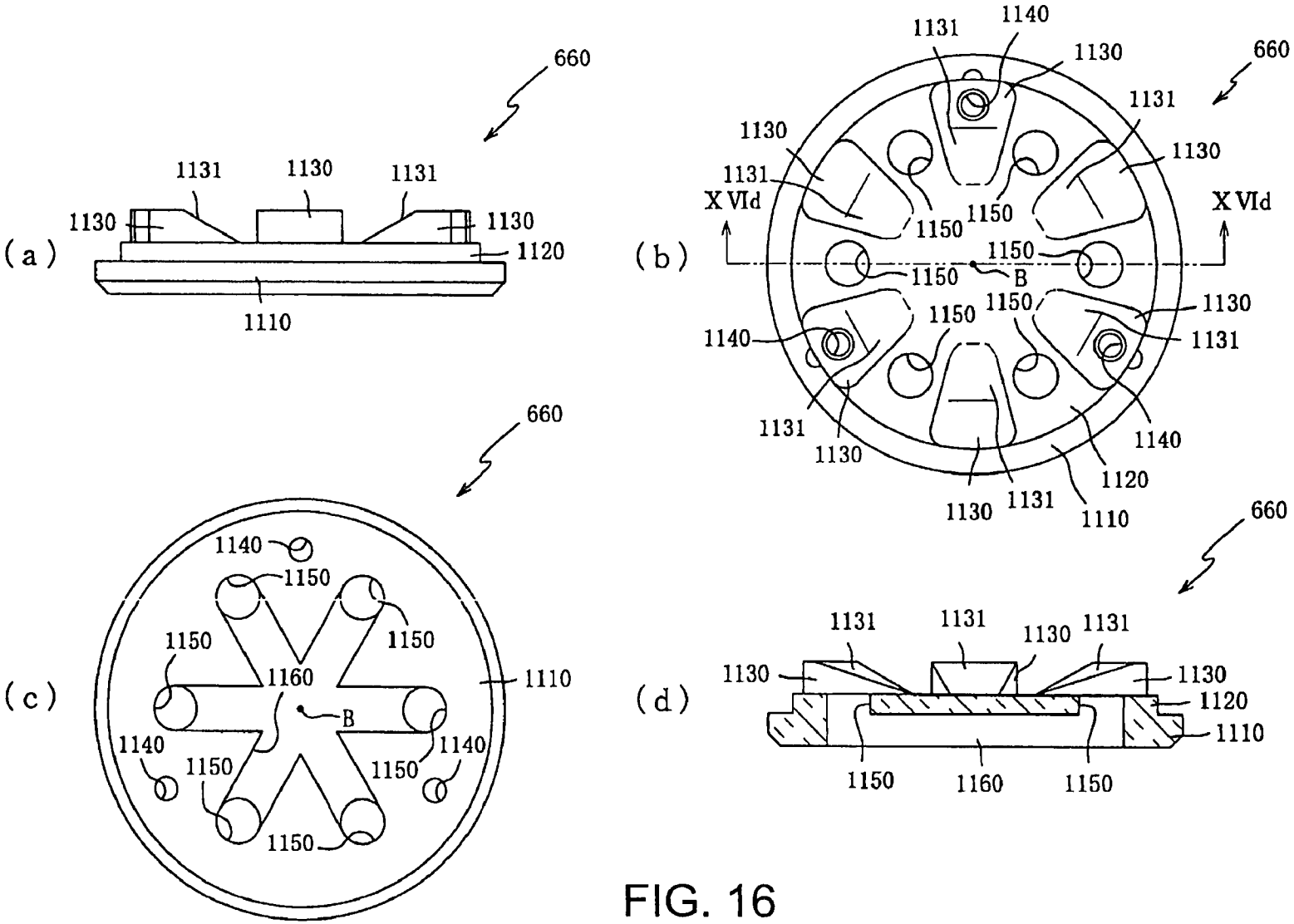
FIG. 16(*a*) is a side view of a support member of an exemplary ink cartridge according to the present invention.

FIG. 16 shows the pedestal member 660. FIG. 16(*a*) is a side view of the pedestal member 660, FIG. 16(*b*) is a top view of the pedestal member 660, FIG. 16(*c*) is a bottom view of the pedestal member 660, and FIG. 16(*d*) is a cross sectional view of the pedestal member 660 shown in FIG. 16(*b*).

As shown in FIG. 16(*a*), the pedestal member 660 is provided with a pedestal bottom portion 1110 that forms a bottom surface of the pedestal member 660 and contacts the spring top portion 920 of the second spring member 650, a pedestal intermediate portion 1120 that is formed with an outer diameter smaller than the outer diameter of the pedestal bottom portion 1110, and pedestal receiving portions 1130 that are arranged on the top surface (upper side of FIG. 16(*a*)) of the pedestal intermediate portion 1120. The pedestal receiving portion 1130 is provided with pedestal inclined surfaces 1131 that are downwardly inclined approaching the center of the pedestal member 660, and a later-described check valve is received by the pedestal inclined surfaces 1131.

As shown in FIG. 16(*b*), the six pedestal receiving portions 1130 are arranged at a predetermined interval in a circumferential direction of the pedestal member 660. Furthermore, three of the six pedestal receiving portions 1130 include first pedestal through holes 1140 that extend from the front to the back of the pedestal member 660. The first pedestal through holes 1140 are formed in portions (horizontal portions of the pedestal receiving portions 1130) of the pedestal receiving portions 1130 other than the portions at which the pedestal inclined surfaces 1131 are provided. Thus, the first pedestal through holes 1140 are formed in portions other than the portions that receive the check valve 670. This configuration prevents suppression of ink flow.

Furthermore, between the pedestal receiving portions 1130 of the pedestal member 660, second pedestal through holes 1150 are formed, which extend through the pedestal intermediate portion 1120 and the pedestal bottom portion 1110. The second pedestal through holes 1150 are formed between the pedestal receiving portions 1130, so that six second pedestal through holes 1150 are formed in a circumferential direction about the pedestal member 660. The second pedestal through holes 1150 form ink flow paths through which ink flows.

As shown in FIG. 16(*c*), on the bottom surface of the pedestal bottom portion 1110, concave-shaped pedestal through grooves 1160 are formed, which connect the respective second pedestal through holes 1150. The pedestal through grooves 1160 connect the second pedestal through holes 1150 in substantially straight lines that pass through and are symmetrical about the axis B. Thus, in the pedestal bottom portion 1110, three pedestal through grooves 1160 are formed, which cross each other at the axis B.

As shown in FIG. 16(*d*), between the pedestal inclined surfaces 1131 of the pedestal receiving portions 1130 and the second pedestal through holes 1150, a gap is formed in the axis B direction. Thus, even when the check valve 670 is supported by the pedestal inclined surfaces 1131, ink flow is ensured. Furthermore, with respect to the pedestal through grooves 1160, the end surface of the spring top portion 920 of the second spring member 650 is positioned inside of the second pedestal through holes 1150, so even when the end surface of the spring top portion 920 of the second spring member 650 contacts the pedestal member 660, ink flow is ensured by the pedestal through grooves 1160.

Figure 17:
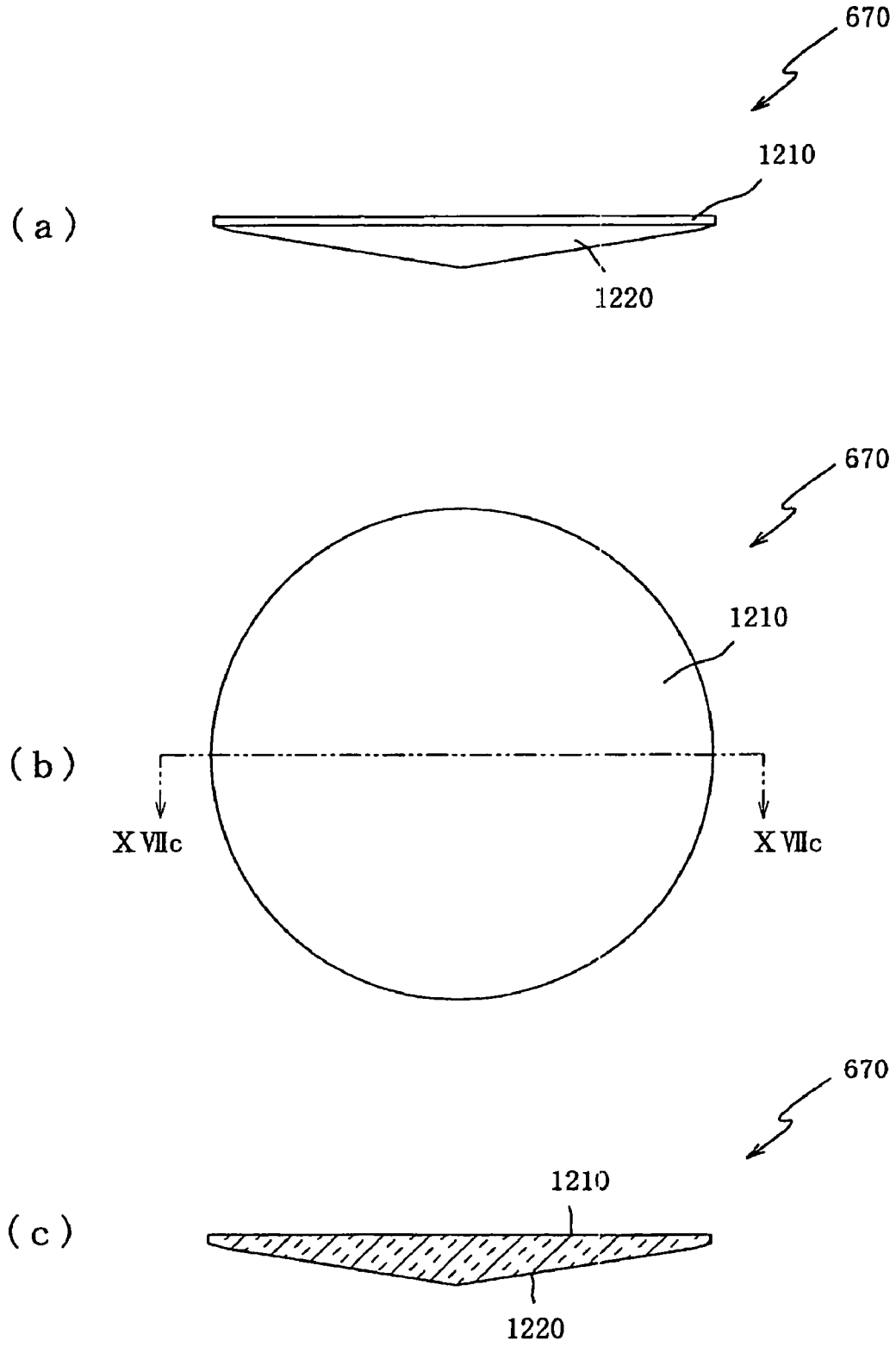
FIG. 17(*a*) is a side view of a check valve of an exemplary ink cartridge according to the present invention.

FIG. 17 shows the check valve 670. FIG. 17(*a*) is a side view of the check valve 670, FIG. 17(*b*) is a top/bottom view of the check valve 670, and FIG. 17(*c*) is a cross sectional view of the check valve 670 shown in FIG. 17(*b*).

The check valve 670 is substantially plate-shaped. A check valve flat portion 1210 that forms a top surface of the check valve 670 is configured to close the ink flow path by contacting the cover member 680. Furthermore, a check valve curved portion 1220 that forms a curved surface of the check valve 670 is received by pedestal receiving portions 1130 of the pedestal member 660. Therefore, when the check valve curved portion 1220 of the check valve 670 is received by the pedestal receiving portions 1130 of the pedestal member 660, the ink flow path is open, and when the check valve flat portion 1210 of the check valve 670 contacts the cover member 680, the ink flow path is closed.

Figure 18:
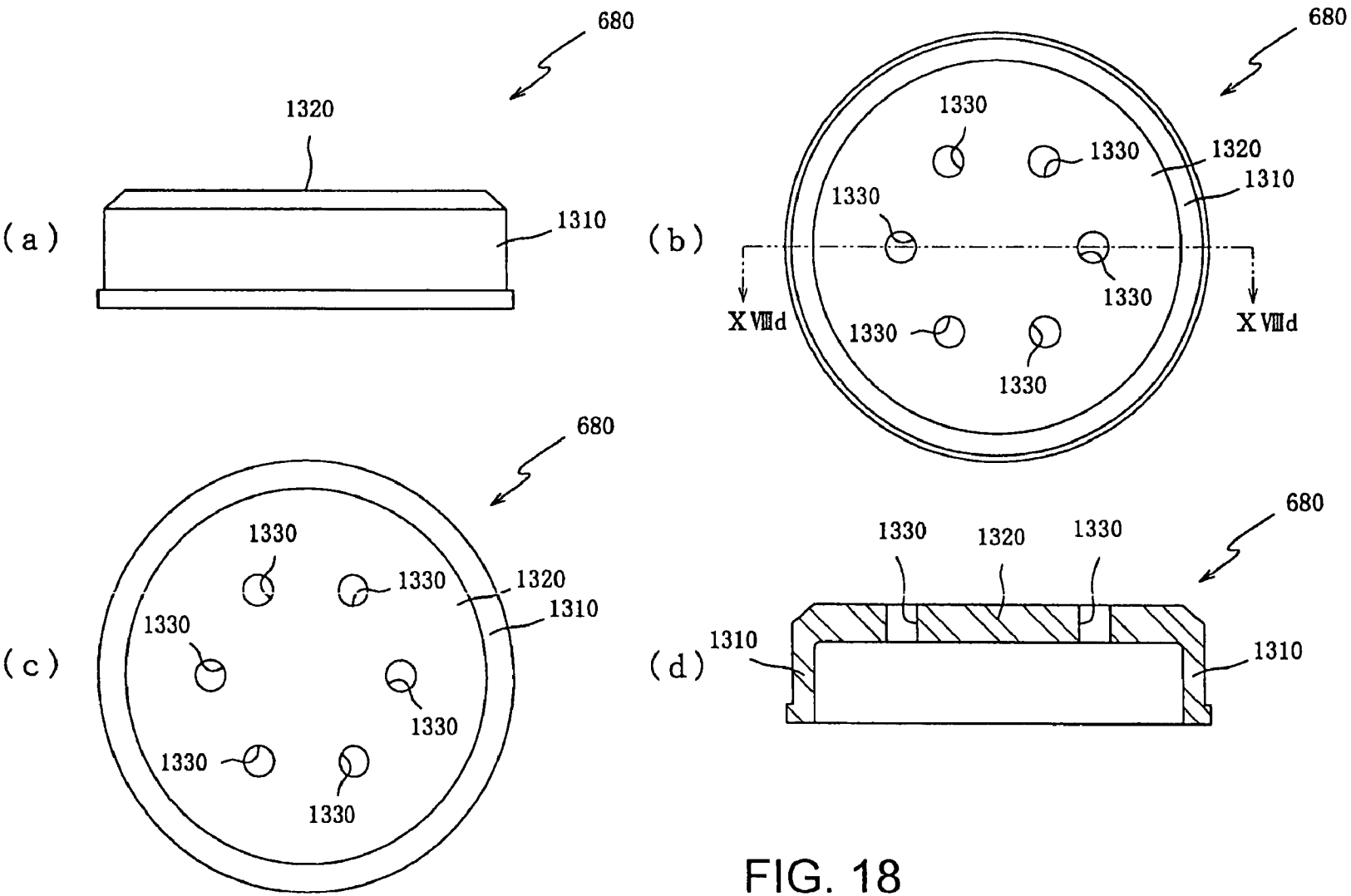
FIG. 18(*a*) is a side view of a cover member of an exemplary ink cartridge according to the present invention.

FIG. 18 shows the cover member 680. FIG. 18(*a*) is a side view of the cover member 680, FIG. 18(*b*) is a top view of the cover member 680, FIG. 18(*c*) is a bottom view of the cover member 680, and FIG. 18(*d*) is a cross sectional view of the cover member 680 shown in FIG. 18(*b*).

The cover member 680 is formed in a substantially cylindrical shape in which a lower surface side is open. The cover member 680 is provided with a cover outer circumferential wall 1310 that forms the outer circumference and a cover top portion 1320 that forms the top surface (upper side of FIG. 18(*a*)) of the cover member 680, and the lower surface is open. The pedestal member 660 is engaged with the opening of the lower surface (lower side of FIG. 18(*a*)) of the cover member 680, and the check valve 670 is accommodated between the pedestal member 660 and the cover member 680. That is, the cover member 680 and the pedestal member 660 constitute a case, which accommodates the check valve.

As shown in FIGS. 18(*b*) and 18(*c*), in the cover top portion 1320, six cover through holes 1330 are formed in circumferential locations through the cover top portion 1320. These cover through holes 1330 become flow paths through which ink flows, and as the check valve 670 contacts the cover top portion 1320, the cover through holes 1330 are closed, and the ink flow paths are closed.

Figure 19:
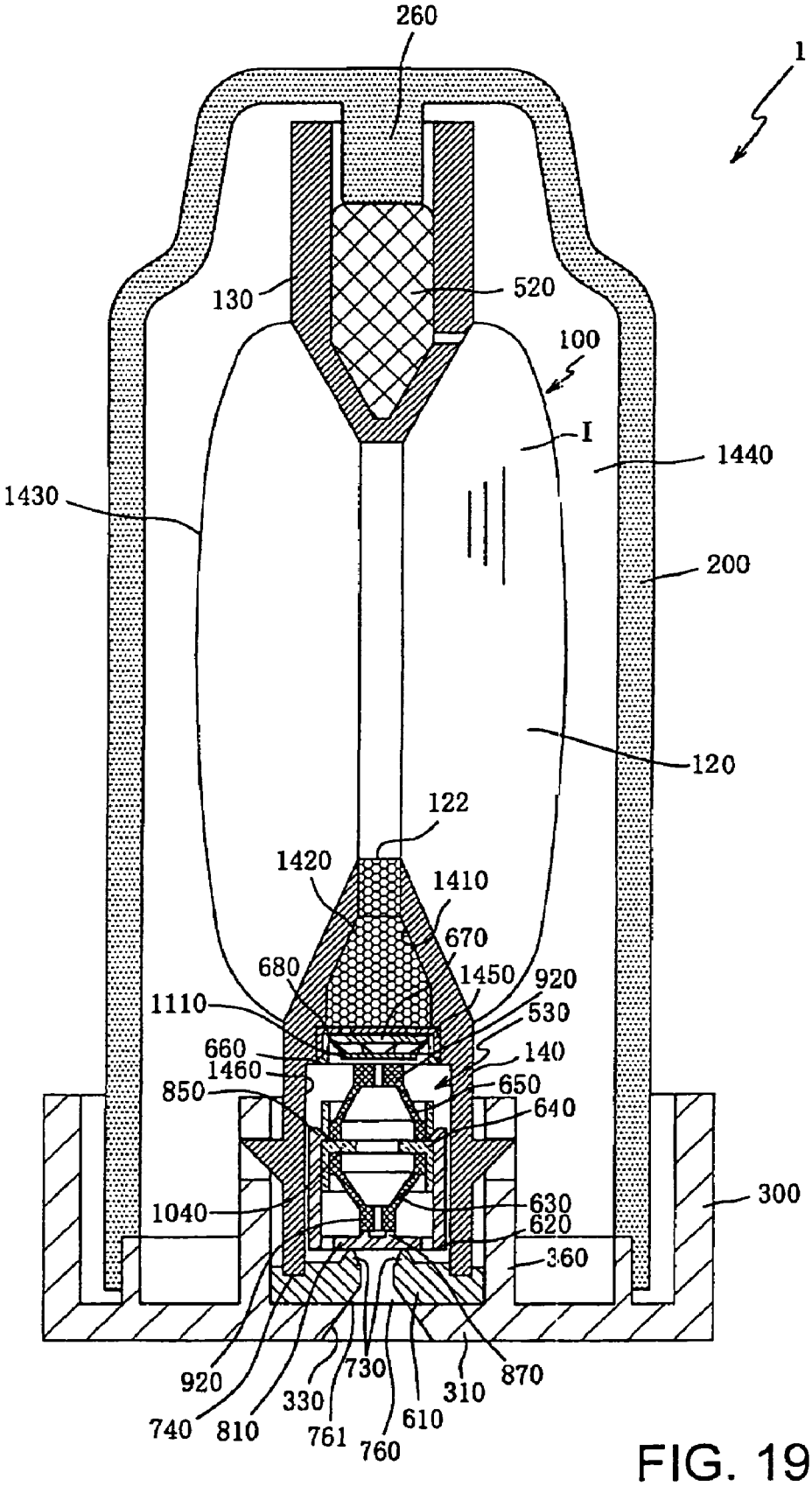
FIG. 19 is a cross sectional view of the ink cartridge shown in FIG. 2.

Next, with reference to FIG. 19, an assembled ink cartridge 1 is described. FIG. 19 is a cross sectional view of the ink cartridge 1 shown in FIG. 2. In the cross sectional view of the ink cartridge 1 shown in FIG. 19, ink I is stored in the frame 100.

FIG. 19 shows a state in which the ink cartridge 1 is assembled by welding the case 200 and the cap 300. In this state, the joint member 610 contacts the cap bottom wall 310 of the cap 300. At the same time, the outer circumferential wall of the ink supply portion 140 is engaged in the joint groove portion 740 of the joint member 610. Furthermore, the outer circumferential surface of the joint member 610 (joint outer circumferential portion 710 (see FIG. 12)) contacts the inner circumferential surface of the cap joint portion 360. Therefore, the inner space 1440 surrounded by the case 200 and the cap 300 is not connected to the outside of the case 200 and the cap 300, and is substantially sealed.

A pair of films 1430 are welded to the frame main body portion 110. Ink I is stored in a space (ink storage portion 120) that is substantially sealed by the films 1430. A process of welding the films 1430 is described later.

The pair of films 1430 are double layer type films (hereafter referred to as "nylon polyethylene") each including a nylon film and a polyethylene film. The side contacting the frame main body portion 110 is a polyethylene film layer. This nylon polyethylene completely shields liquid, but has less complete gas shielding properties. Thus, minimal communication of a gas between the ink storage portion 120 and the inner space 1440 substantially sealed by the films 1430 is possible. Gas that exists within ink I within the ink storage portion 120 gradually permeates through the films 1430 and is moved to the inner space 1440. Therefore, generation of bubbles within ink I can be prevented, and deterioration of printing quality due to bubbles within ink I can be prevented. The films 1430 can be formed from any material as long as the strength can be maintained and the material has some gas permeability. For example, a double-layered film of a nylon film and a polypropylene film, and a film in which nylon and polyethylene, or nylon and polypropylene are mixed and formed can be used.

Furthermore, as shown in FIG. 19, between the ink supply hole 122 of the frame 100 and the cover member 680, an ink flow path 1410 is formed, which is provided with a hollow conical portion or bowl shaped portion in which an aperture size is reduced from the cover member 680 to the ink supply hole 122. Furthermore, on the ink supply hole 122 side from the bowl-shaped portion in the ink flow path 1410, a hollow cylindrical portion is formed, which is connected to the smaller diameter side of the bowl-shaped portion. On the cover member 680 side from the bowl-shaped portion in the ink flow path 1410, a hollow cylindrical portion is formed, which is connected to the larger diameter side of the bowl-shaped portion. In the ink flow path 1410, in order to remove dust and/or foreign matter within ink I of the ink storage portion 120, a filter 1420 formed of a foam-type material is provided. That is, the ink flow path 1410 is a filter housing chamber that houses the filter 1420. The filter 1420 is formed in a cylindrical shape having the same diameter (the same cross sectional shape) as the largest diameter (the diameter of the ink flow path 1410 in the vicinity of the cover member 680) of the ink flow path 1410 and is arranged within the ink flow path 1410 in a compressed state by inserting the filter 1420 in a direction (direction parallel to the axis B direction of the valve mechanism 530) in which ink flows into the ink flow path 1410 from the ink supply portion 140 side. Therefore, a filter with finer pores can be obtained, compared to the state before insertion was performed. Characteristics (efficiency of removal of foreign matter) of the filter 1420 can be controlled, for example, by adjusting a compression percentage, by appropriately selecting a reduction percentage (the inner surface shape such as the inclined surfaces of the ink flow path 1410) of the aperture size of the ink flow path 1410. Accordingly, desired filter characteristics can be obtained without changing the material of the filter 1420. In the embodiment shown in FIG. 19, the filter 1420 is formed of a polyurethane material, but it is also acceptable to use, for example, CFH 40. If dust and/or foreign matter resides within an ink tube (undepicted) of the inkjet printer 1710 (see FIG. 26) and/or the valve mechanism 530, ink may not be accurately supplied, and printing quality can be deteriorated. However, by providing the filter 1420, dust and/or foreign matter can be removed, so ink supply can be accurately performed, and deterioration of printing quality can be prevented.

If, alternatively, when a sheet-like mesh member is mounted or welded to the ink supply hole 122 for filtration, a mounting process is necessary and/or the frame main body portion 110 must be manufactured to have a detachable structure. Accordingly, the structure of the frame main body portion 110 would become more complex, and the time necessary to manufacture the ink cartridge 1 would increase. In contrast, inserting the filter 1420 to the ink flow path 1410 completes mounting of the filter 1420. Thus, the structure of the frame main body portion 110 is simplified, and the manufacturing process can also be simplified.

When inserted into the ink flow path 1410, the filter 1420 is compressed in an insertion direction (direction parallel to the axis B direction of the valve mechanism 530) as movement in the insertion direction is restricted by the ink supply hole 122. The filter 1420 is also compressed in a direction of a plane perpendicular to the insertion direction by the inner surface of the hollow conical shape of the ink flow path 1410. Therefore, the filter 1420 is uniformly compressed in three-dimensions. Accordingly, the filter 1420 as a whole is uniformly compressed, providing stable filter characteristics.

The diameter of the ink supply hole 122 is smaller than the diameter of the filter 1420, so entrance of the filter 1420 into the ink flow path 1410 further than needed is prevented. Also, slippage of the filter 1420 into the ink storage portion 120 is prevented. However, in order to further reliably prevent slipping of the filter 1420 into the ink storage portion 120, a member can also be provided that prevents the filter 1420 from slipping into the ink supply hole 122.

Furthermore, as shown in FIG. 19, on the side (lower side of FIG. 19) of the ink flow path 1410 opposite from the ink storage portion 120, an engaging portion 1450 is provided that is connected to the ink flow path 1410 and is engaged with the case formed by the pedestal member 660 and the cover member 680. The inner diameter of the engaging portion 1450 is larger than the inner diameter of the ink flow path 1410 and is formed to be slightly smaller than the outer diameter of the cover member 680. The pedestal member 660 and the cover member 680 are engaged and fixed to the engaging portion 1450. Therefore, the pedestal member 660 and the cover member 680 are fixed to the engaging portion 1450 so as to contact the filter 1420 when pressed in a compressed state within the ink flow path 1410. The pedestal member 660 and the cover member 680, thus fixed, function as a stopper that prevents the filter 1420 from slipping from the ink flow path 1410.

On the side (lower side of FIG. 19) of the engaging portion 1450 opposite from the ink flow path 1410, a valve mechanism insertion portion 1460 (in the valve mechanism insertion portion 1460, the engaging portion 1450 is also included) is provided. The valve mechanism insertion portion 1460 is connected to the engaging portion 1450, and the valve mechanism 530 is inserted into the valve mechanism insertion portion 1460. The valve mechanism insertion portion 1460 is also an ink flow path. The space formed in the ink flow path 1410, the space formed in the engaging portion 1450, and the space formed in the valve mechanism insertion portion 1460, form an ink flow path chamber in the ink supply portion 140, which becomes an ink supply path when ink is supplied to the outside of the ink cartridge 1. As shown in FIG. 19, the ink flow path chamber is formed inside of the ink supply portion 140, which is formed in a cylindrical shape. Additionally, as shown in FIG. 19, when the valve mechanism 530 is inserted into the valve mechanism insertion portion 1460, the inclination angle of the cap through hole 330 and the inclination angle of the taper portion flow path 761 of the joint member 610 are formed to be identical. Also, the plane of connection between the taper portion flow path 761 and the cap through hole 330 has no step. Therefore, the ink extraction tube 1720 (see FIG. 26) can be smoothly inserted into the ink flow path 760.

The valve mechanism 530 is arranged so that the bottom surface of the joint member 610 contacts the cap bottom wall 310, and the joint contact portion 730 of the joint member 610 can contact the valve bottom wall 810 of the valve member 620. Inside of the valve member 620, the first spring member 630 is stored so that the valve receiving portion 870 of the valve member 620 contacts the spring top portion 920 of the first spring member 630. Furthermore, the first spring member 630 and the second spring member 650 are stored in the two inner spaces 1060, 1070 divided by the slider pedestal portion 1040 of the slider member 640. A bottom surface 911 (see FIG. 14) of the spring bottom portion 910 contacts a surface 1041 (see FIG. 15) of the valve member 620 side of the slider pedestal portion 1040. At the same time, the outer circumferential side surface 912 (see FIG. 14) of the spring bottom portion 910 contacts an inner wall 1042 (see FIG. 15) of the slider outer circumferential wall 1010. In the same manner, with respect to the second spring member 650, the bottom surface 911 of the spring bottom portion 910 contacts a surface 1043 (see FIG. 15) of the side (check valve 670 side) opposite to the valve member 620 of the slider pedestal portion 1040. At the same time, the outer circumferential side surface 912 of the spring bottom portion 910 contacts an inner wall 1021 (See FIG. 15) of the slider protruding portion 1020. Thus, the slider pedestal portion 1040 is the portion at which the first spring member 630 engages the second spring member 650. As shown in FIG. 19, the slider pedestal portion 1040 is sandwiched by the first spring member 630 and the spring bottom portion 910 of the second spring member. Additionally, the valve hook portions 850 of the valve member 620 inserted between the two slider protruding portions 1020 contact the surface 1043 of the slider pedestal portion 1040. The surface 1043 is the surface that contacts the bottom surface 911 of the spring bottom portion 910 of the second spring member 650. Because of this, the slider member 640 is engaged with the valve hook portions 850. The spring top portion 920 of the second spring member 650 can contact the pedestal bottom portion 1110 of the pedestal member 660. Furthermore, the check valve 670 is stored between the pedestal member 660 and the cover member 680. Arrangement of the respective members of the valve mechanism 530 and the operation will be described later in detail.

Figure 20:
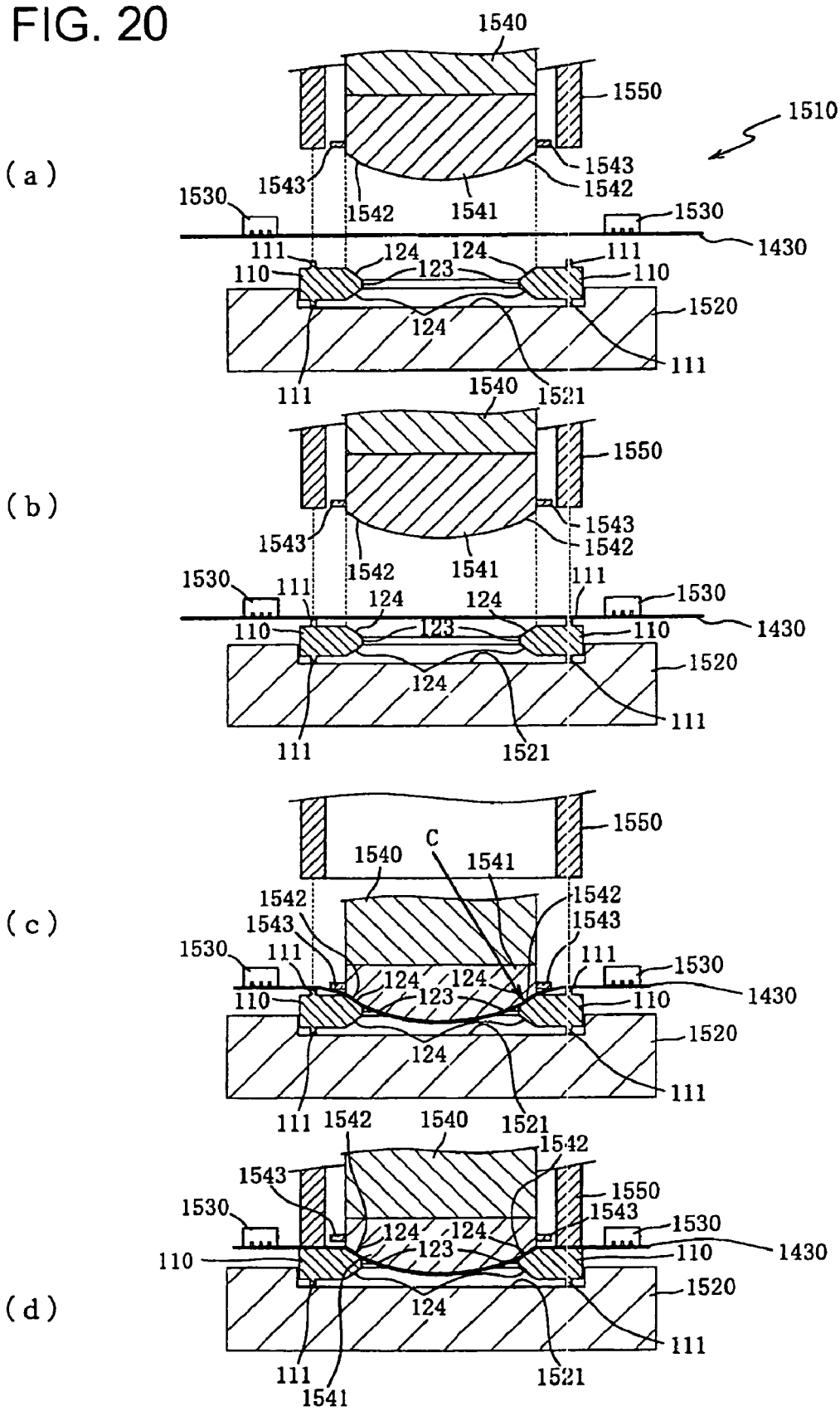
FIGS. 20(*a*)-20(*d*) are sequential cross sectional views showing manufacture of a frame of an exemplary ink cartridge according to the present invention.
Figure 21:
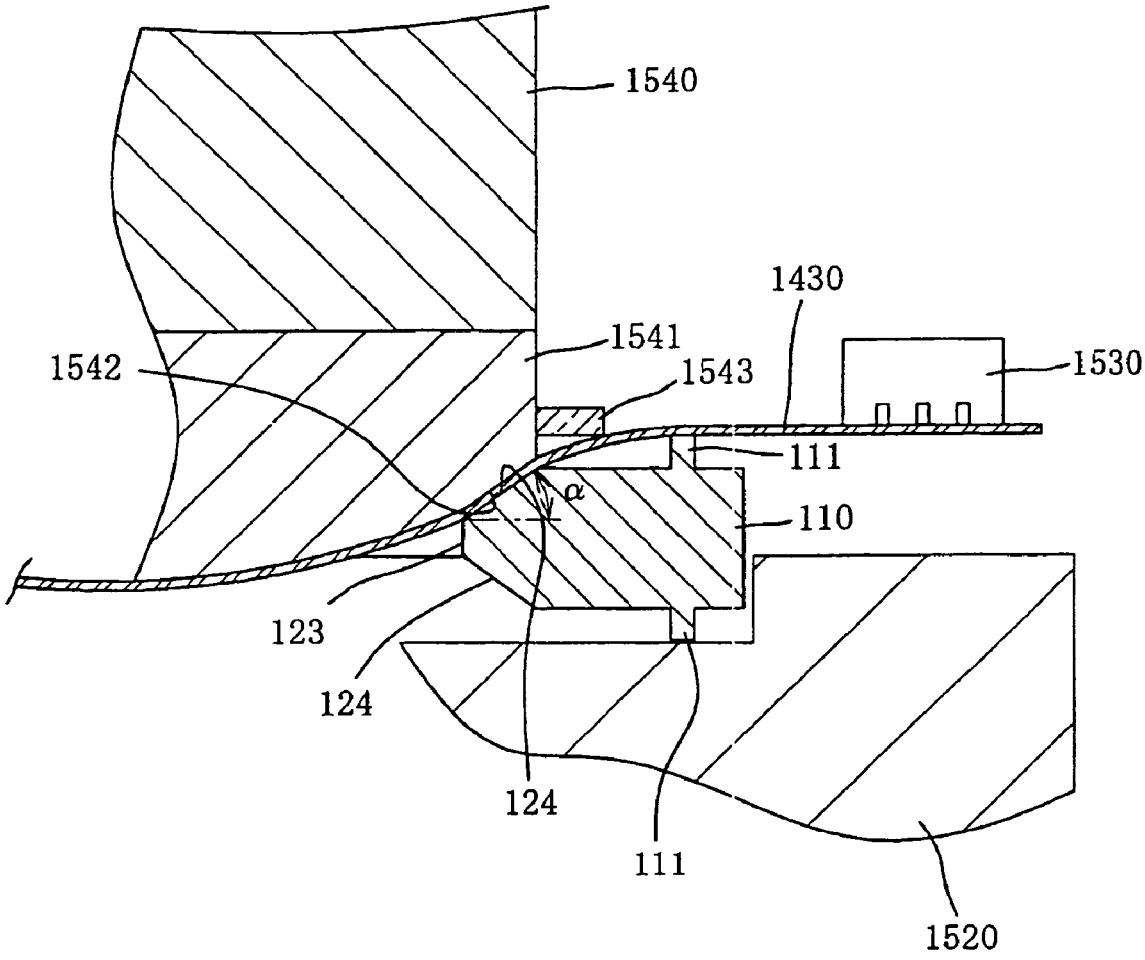
FIG. 21 is an enlargement of the cross sectional view shown in FIG. 20(*c*) at the location emphasized by the arrow C.

The following explains a process of manufacturing the frame 100 with reference to FIGS. 20 and 21. FIG. 20 shows a schematic cross sectional view of a process of manufacturing the frame 100. The manufacturing process progresses from FIG. 20(*a*) to FIG. 20(*d*). FIG. 21 is enlarged view of a portion C of the schematic cross sectional view shown in FIG. 20(*c*).

First, a frame manufacturing device 1510 used in the manufacturing process is described. The frame manufacturing device 1510 is provided with a base portion 1520 that installs and supports the frame main body portion 110, vacuum devices 1530 that apply a vacuum to a film 1430, a pressing portion 1540 that presses the film 1430 against the frame main body portion 110, and a welding device 1550 that welds the film 1430 to the frame main body portion 110.

In the base portion 1520, a concave-shape base holding portion 1521 is formed, which can install the frame main body portion 110. The base holding portion 1521 is formed in a substantially square shape corresponding to the outer shape of the frame main body portion 110. Furthermore, though not depicted, the base holding portion 1521 has a concave portion corresponding to the ink insertion portion 130 and the ink supply portion 140, and positioning is performed when the frame main body portion 110 is installed. Furthermore, in order to perform positioning, it is also acceptable to provide a clamp member that fixes the frame main body portion 110 from the upper direction (upper side of FIG. 20(*a*)) or the side surface (horizontal direction of FIG. 20(*a*)).

The vacuum devices 1530 vacuum and hold the film 1430. In the embodiment shown in FIG. 20(*a*), four vacuum devices 1530 (two vacuum devices 1530 at the front side in the direction perpendicular to the paper plane of FIG. 20 are not depicted) are used. The vacuum devices 1530 are arranged at positions corresponding to the four corners of the frame main body portion 110 and are held so that the film 1430 is not wrinkled.

The pressing portion 1540 is provided with a pressing elastic portion 1541, of which the tip end portion (lower side of FIG. 20(*a*)) is formed of an elastic material. The tip end of the pressing elastic portion 1541 is formed in a substantially spherical shape corresponding to the shape of the ink storage portion 120 of the frame main body portion 110. In the tip end portion of the pressing elastic portion 1541, when the pressing portion 1540 presses the film 1430 in order to contact the frame inclined surfaces 124 of the frame main body portion 110, a pressing inclined surface 1542 is formed corresponding to the inclination angle $\alpha$ (see FIG. 21) of the frame inclined surfaces 124. Therefore, between the frame inclined surfaces 124 of the frame main body portion 110 and the film 1430, formation of a gap is prevented when the films 1430 are pressed by the pressing portion 1540. In addition, in the pressing portion 1540, when the pressing portion 1540 presses the film 1430, a floating control member 1543 is provided that controls floating of the film 1430 (discussed below). The floating control member 1543 is mounted to the outer circumference of the pressing elastic portion 1541, and controls floating of the film 1430 in the vicinity of the frame protruding member 111.

The welding device 1550 is a device that welds the films 1430 to the frame protruding member 111 of the frame main body portion 110. The welding device 1550 is formed in a substantially cylindrical shape so as to cover the entire frame protruding member 111 of the frame main body portion 110 from an upper direction. The welding device 1550 thermally welds the films 1430 to the frame protruding member 111, employing the tip end portion (end portion of the lower side of FIG. 20(*a*)) as a heat generating portion.

The following describes a process of welding the films 1430 to the frame main body portion 110.

In the welding process, the frame main body portion 110 is set within the base holding portion 1521 of the base portion 1520, and the film 1430 is vacuumed by the vacuum devices 1530 (FIG. 20(*a*)). At this time, by cutting the film 1430 larger than the outer shape of the frame main body portion 110, the film 1430 can be reliably welded to the frame main body portion 110.

In FIG. 20(*a*), for example, when a start switch of the frame manufacturing device 1510 is turned on (not depicted), the vacuum devices 1530 come down (FIG. 20(*b*)). As shown in FIG. 20(*b*), when the vacuum devices 1530 come down, the film 1430 contacts the frame protruding member 111.

Then, the pressing portion 1540 comes down to the base portion 1520 direction (lower direction of FIG. 20(*c*)), and the pressing inclined surface 1542 of the pressing portion 1540 contacts the frame inclined surface 124 of the frame main body portion 110 via the film 1430 (state of FIG. 20(*c*)). When the pressing portion 1540 contacts the film 1430 (including before and after the actual contact), application of vacuum by the vacuum devices 1530 is stopped, and the film 1430 can be moved. Because of this, the film 1430 is pressed by the pressing portion 1540, and is moved toward the center of the frame through hole 123 of the frame main body portion 110.

In addition, as shown in FIG. 20(*c*), part of the film 1430 is pressed through the frame through hole 123 until it reaches the side on which the frame inclined surface 124 is provided (frame inclined surface 124 of the lower side of FIG. 20(*c*)), which is the side opposite to the frame inclined surface 124 (frame inclined surface 124 of the upper side of FIG. 20(*c*)) on the side contacting the pressing portion 1540. By pressing the film 1430 past the center portion of the frame through hole 123, looseness is generated in the center portion of the film 1430. By having this looseness, when ink is used and a lesser amount of ink is available (state in which ink storage portion 120 is empty), a pair of upper and lower films 1430 can be adhered, and ink can be effectively consumed. Alternatively, the films 1430 can be deformed (for example, reduced) due to the effect of the external surroundings in which the films are arranged. However, providing looseness, prevents damage of the films 1430.

Additionally, because the films 1430 are pressed by the pressing portion 1540, thickness of the films 1430 does not change. For example, if welding is performed as the films 1430 are heated in their entirety and extended, the films 1430 can be welded in a shape conforming to the frame inclined surfaces 124, but the films 1430 will have irregularities in thickness, lessening the structural strength of the films 1430. However, when the films 1430 are pressed by the pressing portion 1540, the inclination angle sandwiches the film between the pressing inclined surface 1542 and the frame inclined surfaces 124, which have substantially the same inclination angles. As described later, only the welded region outside of the pressing portion 1540 is heated. Therefore, the thickness of the films 1430 does not change and thickness irregularities do not arise. Thus, changes in the strength of the films 1430 and damage to the films 1430 can be prevented.

Here, with reference to FIG. 21, operation of the floating control member 1543 is described. The floating control member 1543 is arranged in order to control floating of the film 1430. For example, because the film 1430 is sandwiched by the pressing portion 1540 and the frame inclined surfaces 124, there are cases that, without the floating control member 1543, the film 1430 rises along the inclination angle $\alpha$ of the frame inclined surfaces 124. This is partly because application of vacuum by the vacuum devices 1530 is stopped. However, if the application of vacuum by the vacuum devices 1530 is not stopped, there is also a problem that the film 1430 cannot be smoothly moved. Because of this, in the embodiment shown in FIG. 21, application of vacuum by the vacuum devices 1530 is stopped, and the floating control member 1543 is provided. If the film 1430 rises between the frame inclined surface 124 and the frame protruding member 111, looseness may be generated in the film 1430, and the film 1430 may not contact the frame protruding member 111. Thus, the film 1430 cannot be accurately welded. However, in the embodiment shown in FIG. 21, by providing the floating control member 1543, floating of the film 1430 can be controlled so the film 1430 can be accurately welded.

Returning to FIG. 20, when the film 1430 is pressed by the pressing portion 1540, the welding device 1550 comes down in the direction of the frame protruding member 11 (lower side of FIG. 20(*d*)) of the frame main body portion 110, and the tip end of the welding device 1550 contacts the tip end (annular belt region) of the frame protruding member 111 via the film 1430. Heat is transmitted from the welding device 1550, the frame protruding member 111 is melted, the region (annular welded region) contacting the frame protruding member 111 of the film 1430 is melted, and heat welding is performed (FIG. 20(*d*)). As described above, the films 1430 are formed of a double layer of nylon and polyethylene, and the polyethylene film is arranged to contact the frame protruding members 111. Additionally, in order to weld the films 1430 to the frame protruding members 111, the frame main body portion 110 may also be formed of a polyethylene resin. By using the same resin material for the films 1430 and the frame main body portion 110, the films 1430 can be reliably welded to the frame protruding members 111. A nylon film has excellent strength compared to a polyethylene film, but its melting point is high, so the welding operability is inferior. Therefore, in the embodiment shown in FIG. 20, the films 1430 have a nylon and polyethylene double-layer structure, so strength is ensured, and welding operability is ensured by using a polyethylene layer as a layer welded to the frame main body portion 110 and using a low temperature for welding. Furthermore, the nylon layer is not melted at the time of the welding operation, so there will be less change in thickness of the films in the vicinity of the welded portion, and the strength of the films in the vicinity of the welded portion can also be maintained.

After heat welding is completed, the vacuum devices 1530, the pressing portion 1540, and the welding device 1550 are lifted and returned to the position shown in FIG. 20(*a*). Then, an unnecessary portion of the film 1430 is cut, as needed. Furthermore, at this time, it is also acceptable to perform a cooling process, which cools the portion at which the film 1430 and the frame protruding member 111 are welded.

In addition, in the welding process, after the pressing portion 1540 comes down, and the pressing inclined surface 1542 contacts the frame inclined surfaces 124, the vacuum devices 1530 are stopped. After that, the welding device 1550 comes down, and the films 1430 and the frame protruding member 111 are heat welded. However, when the films 1430 are inserted into the frame through hole 123 to a lesser extent by the pressing inclined surface 1542 (when the capacity of the ink storage portion 120 is small), it is also acceptable to stop application of vacuum by the vacuum devices 1530 after the welding device 1550 comes down and performing heat welding.

Here, the shape relationship between the films 1430 and the frame main body portion 110 is explained. With respect to the frame main body portion 110 of the embodiment shown in FIG. 7, the ink storage portion 120 is formed in a substantially round shape (see FIG. 7(*a*)). If, however, the ink storage portion 120 is formed in a square shape, wrinkles of the films 1430 are generated at the four vertex portions of the square shape. If wrinkles in the films 1430 are generated and welded, ink may remain in the wrinkled portion and will not be efficiently consumed. However, in the embodiment described above, the ink storage portion 120 is formed in a substantially round shape, so it is difficult to form wrinkles in the films 1430 and, even if wrinkles are formed in the films 1430, only small wrinkles are generated. Accordingly, the ink cartridge 1 can efficiently consume ink. The ink storage portion 120 can also be formed in an elliptical shape. The ink storage portion 120 can even be formed in a square shape as long as the vertex portions are formed as smooth curves. That is, the shape of the ink storage portion 120 is not limited, so long as a shape that prevents formation of wrinkles in the films 1430 is adopted.

Welding of the films 1430 to the frame main body portion 110 is performed on both sides of the frame main body portion 110 (welding of the film 1430 to the lower side in FIG. 20(*a*)). The welding process is the same, so description is omitted.

Figure 22:
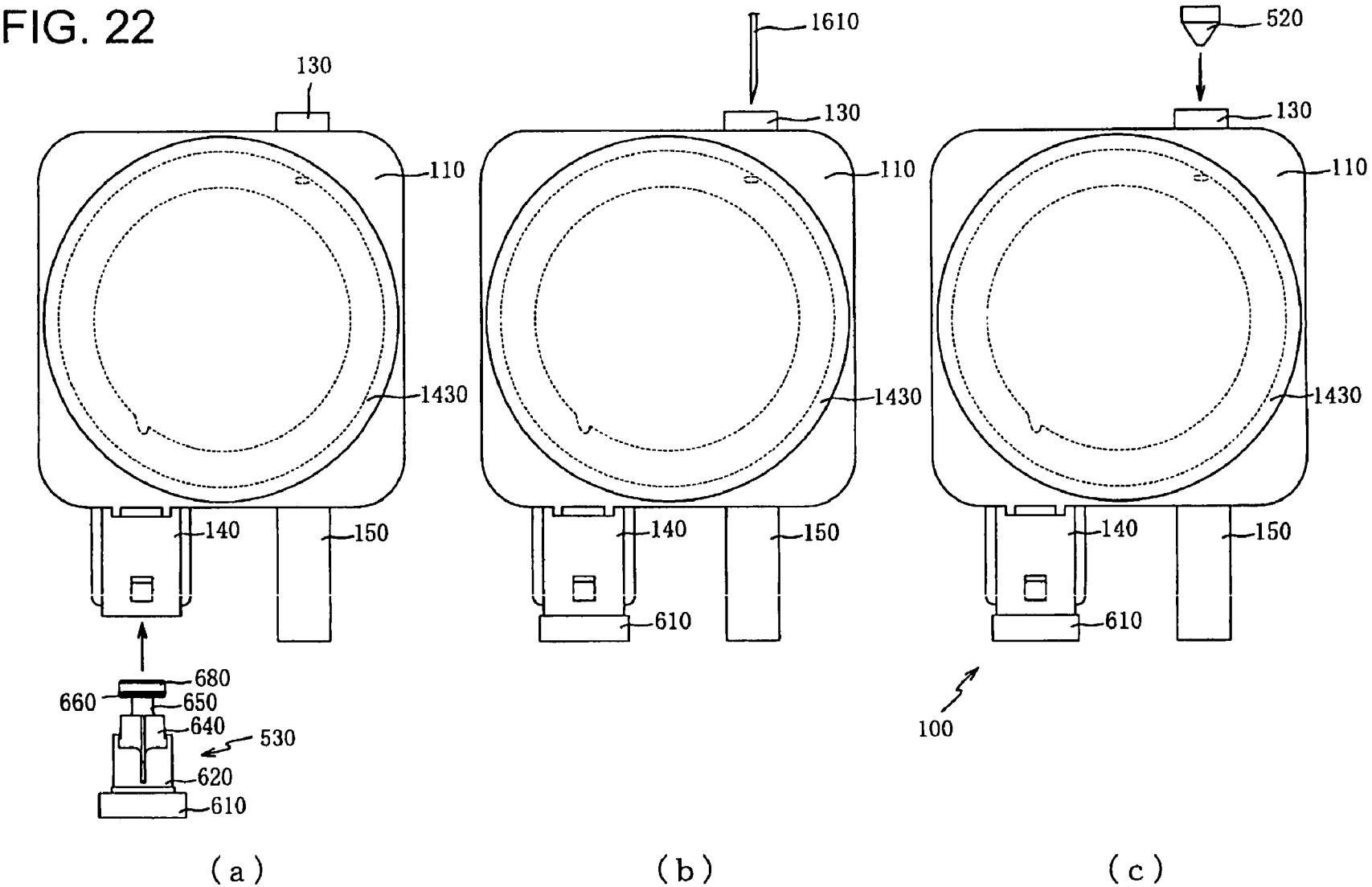
FIGS. 22(*a*)-22(*c*) are sequential front views showing manufacture of a frame of an exemplary ink cartridge according to the present invention.

The following explains a method of manufacturing the frame 100 with reference to FIG. 22. FIG. 22 shows a method of manufacturing the frame 100. Furthermore, the frame main body portion 110 shown in FIG. 22 includes films 1430 welded via a welding process.

First, as shown in FIG. 22(*a*), the valve mechanism 530 is mounted to the ink supply portion 140 (valve mechanism insertion portion 1460 (see FIG. 19)) of the frame main body portion 110. In FIG. 22(*a*), the valve mechanism 530 is already assembled. In the embodiment shown in FIG. 22(*a*), the joint member 610 is a single unit, the valve member 620, the first spring member 630, the slider member 640, and the second spring member 650 are integrated, and the pedestal member 660, the check valve 670, and the cover member 680 are integrated. Hereafter, the process of assembling the valve mechanism 530 is explained.

First, the filter 1420 is inserted to the ink flow path 1410 (see FIG. 19). Furthermore, a reverse flow suppression mechanism, in which the cover member 680, the check valve 670, and the pedestal member 660 are integrally assembled, is pressed into the engaging portion 1450 (see FIG. 19). As mentioned above, the engaging portion 1450 within the ink supply portion 140 is formed to have an inner diameter slightly smaller than the outer diameter of the cover member 680. Therefore, the cover member 680, the check valve 670, and the pedestal member 660 are fixed to the engaging portion 1450. After that, the unit, in which the valve member 620, the first spring member 630, the slider member 640, and the second spring member 650 are integrally assembled, is inserted to the valve mechanism insertion portion 1460, and finally the joint groove portion 740 of the joint member 610 is engaged with the ink supply portion 140, so assembly of the valve mechanism 530 is completed. Before being inserted into the valve mechanism insertion portion 1460, the valve member 620, the first spring member 630, the slider member 640, and the second spring member 650 are integrated, and the pedestal member 660, the check valve 670, and the cover member 680 are integrated. This process simplifies the mounting process of the valve mechanism 530. In addition, as described above, the width of the joint groove portion 740 of the joint member 610 is formed to be slightly smaller than the thickness of the outer circumferential wall of the ink supply portion 140, so when the valve mechanism 530 is mounted, the valve mechanism 530 cannot be easily removed.

As shown in FIG. 22(*b*), after the valve mechanism 530 is mounted to the ink supply portion 140, ink is injected by an ink insertion needle 1610 through the ink insertion portion 130.

Furthermore, in FIG. 22(*b*), the joint member 610 is fixed to the ink supply portion 140 as the joint groove portion 740 is engaged with the end portion of the ink supply portion 140. Therefore, along with the valve member 620 of the valve mechanism 530, the ink supply flow path of the ink supply portion 140 is completely closed, so injected ink does not leak from the ink supply portion 140. After that, as shown in FIG. 22(*c*), when ink is injected by the ink insertion needle 1610, the ink insertion plug 520 is pressed into the ink insertion portion 130.

Figure 25:
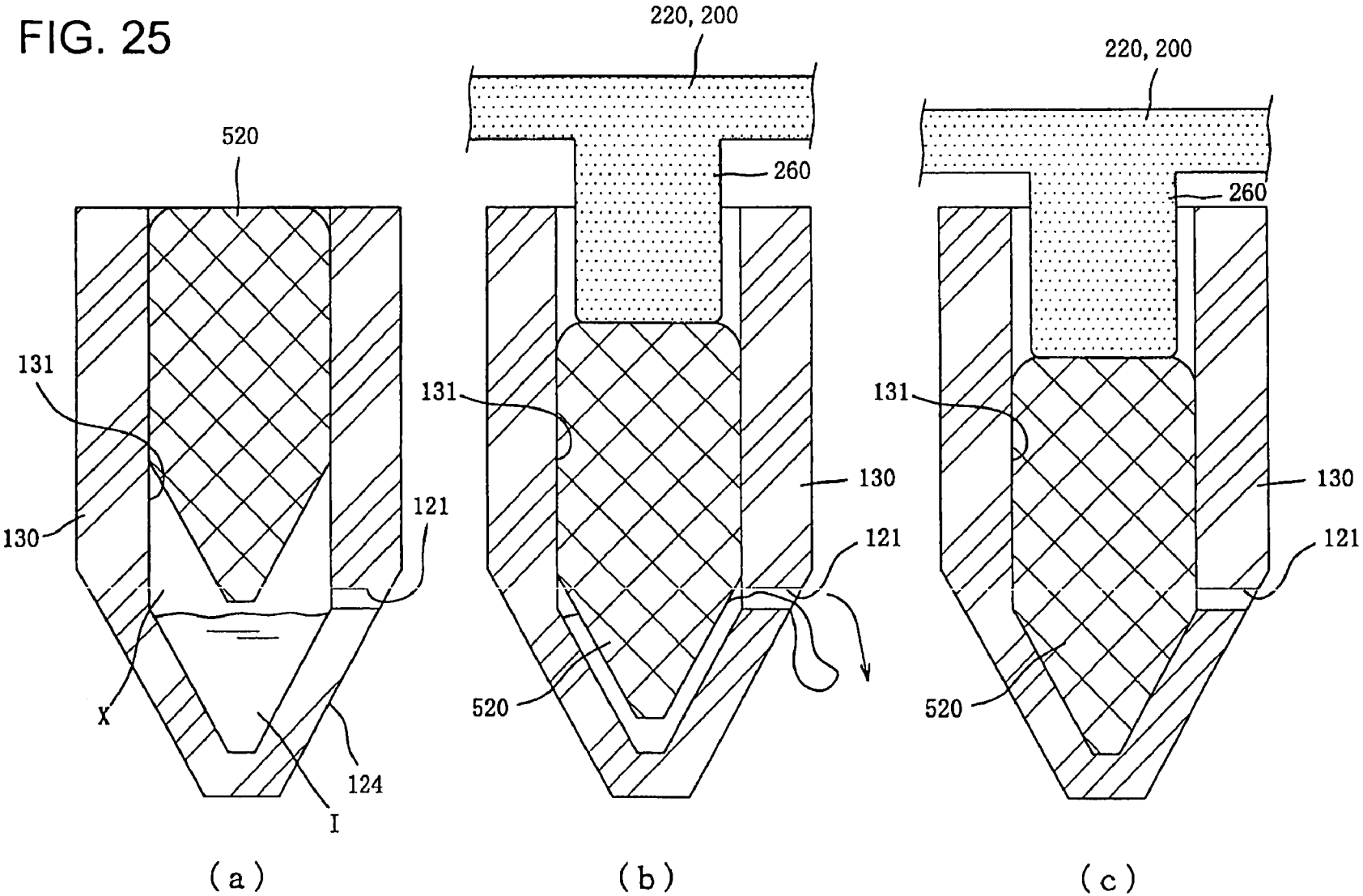
FIGS. 25(*a*)-25(*c*) are sequential cross sectional views showing mounting of an ink insertion plug of an exemplary ink cartridge according to the present invention.

As shown in FIG. 25(*a*), the ink insertion plug 520 is formed of an elastic material. The insertion tip end is formed in a convergent conical shape conforming to the inner surface shape of the ink insertion portion 130. The ink insertion plug 520 initially is not inserted to the deepest part of the ink insertion portion 130, and the rear end surface is pressed to a position in the vicinity of the aperture end surface of the ink insertion portion 130.

Thus, in the deepest end of the ink insertion portion 130, a space X is formed, which is connected to the ink storage portion 120 via the ink insertion hole 121. In this state, the ink insertion needle 1610 can penetrate through the ink insertion plug 520 so that the tip end of the ink insertion needle 1610 is positioned in the space X, and ink can be inserted.

Once ink is inserted, and an ink amount corresponding to the maximum holding capacity of the ink storage portion 120 has been injected, as shown in FIG. 19, the pair of films 1430 extend outwardly from the surface of the frame brim portions 112 of the frame main body portion 110. However, as described above, in the case sidewall 230 of the case 200, a case curved portion 240 is formed, which is curved outward. Therefore, the films 1430 that are extending outwardly do not contact the inner surface of the case 200.

Additionally, one reason for having the ink insertion portion 130 and inserting ink therethrough is that the reverse flow suppression mechanism having the check valve 670 is mounted within the ink supply portion 140. The reverse flow suppression mechanism is arranged so that the ink supplied to the recording device does not reverse flow into the ink cartridge 1 when the ink cartridge 1 is mounted to the recording device. However, because of the reverse flow suppression mechanism, ink cannot be inserted through the ink supply portion 140. Therefore, the ink insertion portion 130 is arranged exclusively for ink insertion, and ink is injected therethrough.

Figure 23:
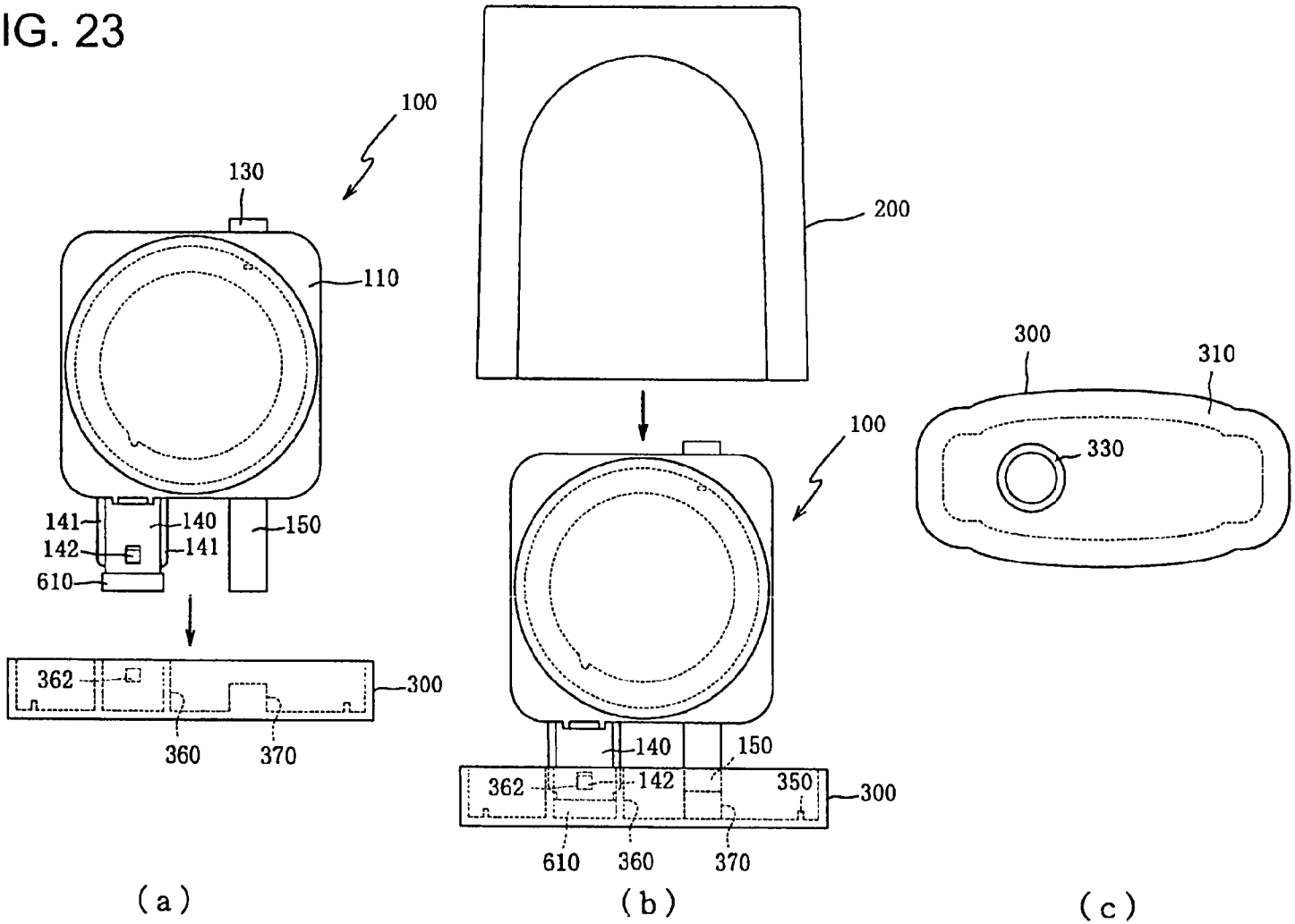
FIGS. 23(*a*)-23(*c*) are sequential front views showing manufacture of an exemplary ink cartridge according to the present invention.

The following explains the process of manufacturing the ink cartridge 1 with reference to FIG. 23. FIG. 23 shows a process of manufacturing the ink cartridge 1.

As shown in FIG. 23(*a*), mounting of the frame 100 to the cap 300 is performed so that the pair of frame loose insertion members 141 of the ink supply portion 140 are loosely inserted to the pair of cap guide grooves 361. At the same time, mounting is performed so that the pair of frame restriction portions 150 are positioned between and contact the pair of cap restriction members 370. Mounting of the frame 100 is completed when the pair of frame joint members 142 are engaged with the pair of cap joint holes 362. As explained with reference to FIG. 6, when the pair of frame joint members 142 contact the pair of cap joint holes 362, easy removal of the frame 100 can be prevented. At the same time, rotation of the frame 100 is restricted by the pair of frame restriction portions 150 and the pair of cap restriction members 370, so the frame 100 and the cap 300 can be mounted without any wobbling. That is, the frame 100 and the cap 300 are mounted without a fixing operation by adhesive or welding, and the pair of frame joint members 142 and the pair of cap joint holes 362 contact each other by mechanical engagement. Therefore, the frame 100 could easily shift about the cylindrical cap joint portion 360, with respect to the cap 300. However, rotation of the frame 100 is prevented by the pair of frame restriction portions 150 and the pair of cap restriction members 370. Therefore, the assembly operation can be simplified, and rotation of the frame 100 can be prevented.

The ink supply portion 140 and the cap 300 are connected via the joint member 610, so external vibration transmitted to the cap 300 is not directly transmitted to the frame 100, and is attenuated by the joint member 610.

When the frame 100 is mounted to the cap 300 as shown in FIG. 23(*b*), the joint member 610 is located between the tip end portion of the ink supply portion 140 and the cap bottom wall 310 of the cap 300. The joint member 610 is sandwiched between these components. That is, the cap 300 functions as a pressing member that fixes and presses the joint member 610 against the ink supply portion 140. It is possible to fill with ink before performing the mounting process described above, but in order to reliably avoid leakage of ink from the ink supply portion 140 after insertion, it is acceptable to perform the ink insertion operation as shown in FIGS. 22(*b*) and (*c*) after mounting the frame 100 to the cap 300 and strongly fixing the joint member 610 to the ink supply portion 140.

As shown in FIG. 23(*b*), when the frame 100 and the cap 300 are mounted, the case 200 is mounted so as to cover the frame 100. In this state, the cap protruding member 350 contacts a step formed by the first aperture end surface 211 (see FIG. 4) and the second aperture end surface 212 (see FIG. 4) of the case 200 (see FIG. 24(*a*)).

As shown in FIG. 23(*c*), when the cap 300 and the case 200 are mounted, the cap protruding member 350 and the case 200 (step surface between first aperture end surface 211 and the second aperture end surface 212) may be welded from bottom wall side of the cap 300 using an ultrasonic welding device (undepicted). The dotted lines of FIG. 23(*c*) correspond to a position where the cap protruding member 350 is formed, and the dotted-line location may welded by ultrasonic welding.

Here, with reference to FIG. 24, the process of welding the case 200 and the cap 300 is explained. FIG. 24 shows enlarged cross sectional views of a portion of the ink cartridge 1 where the case 200 and the cap 300 may be welded. FIG. 24(*a*) shows a state before welding, and FIG. 24(*b*) shows a state after welding.

FIG. 24(*a*) shows a state in which the cap protruding member 350 of the cap 300 contacts a step that is formed by the first aperture end surface 211 and the second aperture end surface 212 of the case 200 such that part of the end surface is notched. In FIG. 24(*a*), a slight gap is formed between the cap sidewall 320 of the cap 300 and the case sidewall 230. In this state, an ultrasonic wave is locally applied to a position corresponding to the cap protruding member 350 from the cap bottom wall 310 side of the cap 300. Ultrasonic wave welding is well-known technology, so a detailed description thereof is omitted.

As shown in FIG. 24(*b*), when the case 200 and the cap 300 are welded by ultrasonic wave welding, the cap protruding member 350 and the case aperture portion 210 of the case 200 are melted together and welded. Then, the first aperture end surface 211 and the second aperture end surface 212 are melted and disappear, and parts of the melted portion of the cap protruding member 350, the first aperture end surface 211, and the second aperture end surface 212 are stored in a gap between the case sidewall 230 and the cap sidewall 320 as melted debris X (burr). Thus, by having a gap that stores a melted debris X between the cap sidewall 320 and the case sidewall 230, the melted debris X is not exposed to the outside, and the aesthetic appearance of the ink cartridge 1 is not damaged.

The case 200 and the cap 300 are positioned by the step formed by first and second aperture end surfaces 211, 212, and the cap protruding member 350, so the gap between the cap sidewall 320 and the case sidewall 230 can be substantially uniform over the entire circumference of the cap 300, and the melted debris X can be reliably stored in the gap.

As an alternative to the step of the case sidewall 230, an inclined surface may be formed, and the corner portions of the cap protruding member 350 can contact the inclined surface.

Here, with reference to FIG. 25, the operation of the ink insertion plug 520 is explained when the case 200 is mounted to the cap 300. FIG. 25 shows cross sectional views of the ink insertion plug 520 during mounting.

As shown in FIG. 25(*a*), the inside of the ink insertion portion 130 is an ink insertion path, and the ink insertion path is formed by an insertion inner circumferential portion 131. The tip end of the insertion inner circumferential portion 131 that extends deeper into the ink cartridge 1 than the ink insertion hole 121 (lower side of FIG. 25(*a*)) is formed in a hollow conical shape. This configuration is provided because the ink storage portion 120 is formed by the frame inclined surfaces 124, and the deepest part of the insertion inner circumferential portion 131 becomes a shape conforming to the frame inclined surfaces 124. Furthermore, the tip end of the ink insertion plug 520 is formed in a convergent conical shape so as to match the shape of the insertion inner circumferential portion 131. When the frame 100 is manufactured and ink insertion is completed, the top portion end surface (end surface of the upper side of FIG. 25(*a*)) of the ink insertion plug 520 is arranged in substantially the same position as the external end surface (end surface of the top side of FIG. 25(*a*)) of the ink insertion portion 130, and is not inserted to the deepest part of the ink insertion portion 130. As described above, this is to obtain the space X, which communicates with the ink insertion hole 121 and permits ink to be injected into the deepest part of the ink insertion portion 130. (When the ink insertion plug 520 is inserted to the deepest part of the ink insertion portion 130, the space X that allows passage through the ink insertion hole 121 is not provided, so ink cannot be inserted by the ink insertion needle 1610.) As a result, when ink is inserted, there are cases that ink I remains in the hollow conical space X in the deepest part of the insertion inner circumferential portion 131.

As shown in FIG. 25(*b*), when the case 200 is mounted to the cap 300, if the case 200 is pressed in the cap 300 direction (state of FIG. 23(*b*)), the case protruding member 260 contacts the ink insertion plug 520, and the ink insertion plug 520 is pushed by the case protruding member 260. At this time, ink that remains in the insertion inner circumferential portion 131 is pushed by the ink insertion plug 520. As a result, ink flows into the ink storage portion 120 (see FIG. 19) from the ink insertion hole 121.

As shown in FIG. 25(*c*), when the case 200 and the cap 300 are welded, the ink insertion plug 520 fills in the space X to the deepest part within the insertion inner circumferential portion 131. Therefore, there is no ink within the insertion inner circumferential portion 131, and all of the ink I can be injected without waste. As indicated above, the ink insertion plug 520 is pressed by the case protruding member 260. By pressing the ink insertion plug 520 with the case protruding member 260, the frame 100 is less likely to wobble within the case 200.

Additionally, the frame 100 is floatingly supported in a space within the case 200 as the ink supply portion 140 and the ink insertion portion 130 are connected with respect to the case 200. However, the frame 100 is connected via the joint member 610 formed of an elastic material on the ink supply portion 140 side and via the ink insertion plug 520 formed of the same elastic material on the ink insertion portion 130 side, so the frame 100 is supported in the space within the case 200 in a damping state. Therefore, even if a shock is applied to the case 200, the vibration is attenuated by an elastic material and is transmitted to the frame 100, so the effect of the external shock with respect to the frame 100 can be reduced. Therefore, the joint member 610 and the ink insertion plug 520 also function as a damper that suppresses vibration applied to the case 200 from being transmitted to the frame 100. In comparison with a cartridge in which an exclusive damper member is arranged, the number of parts is reduced. In addition, because the case protruding member 260 presses the ink insertion plug 520, the ink insertion plug 520 is prevented from slipping. Although, as described above, when the case 200 and the cap 300 are welded, the ink insertion plug 520 is pressed into the deepest part of the ink insertion portion 130 by the case protruding member 260. However, it is also acceptable to push the ink insertion plug 520 to the deepest part of the ink insertion portion 130 immediately after ink is injected (i.e., before assembly of the case 200 and the cap 300).

As explained before, the ink cartridge 1 is manufactured by inserting ink I into the ink storage portion 120 of the frame 100, then putting the frame 100 in the case 200, and welding the case 200 and the cap 300. In a conventional ink cartridge, there are cases in which ink is inserted from outside of the case portion after the case is put on the frame. In such conventional ink cartridges, a frame and a case must be prepared separately for cartridges storing different amounts and/or colors of ink. However, in the embodiment described above, the case is put on after ink is inserted into the ink storage portion 120 of the frame 100. Thus, a single frame 100 can be commonly used. That is, even when multiple case shapes are required, a single frame 100 can be used. As a result, the manufacturing cost of the ink cartridge 1 can be reduced.

Furthermore, the ink cartridge 1 manufactured by the above-described process includes the ink insertion portion 130 and the ink insertion plug 520 at locations that cannot be visually detected from the outside. Therefore, erroneous removal of the ink insertion plug 520 and splashing of ink by the user is prevented.

Figure 26:
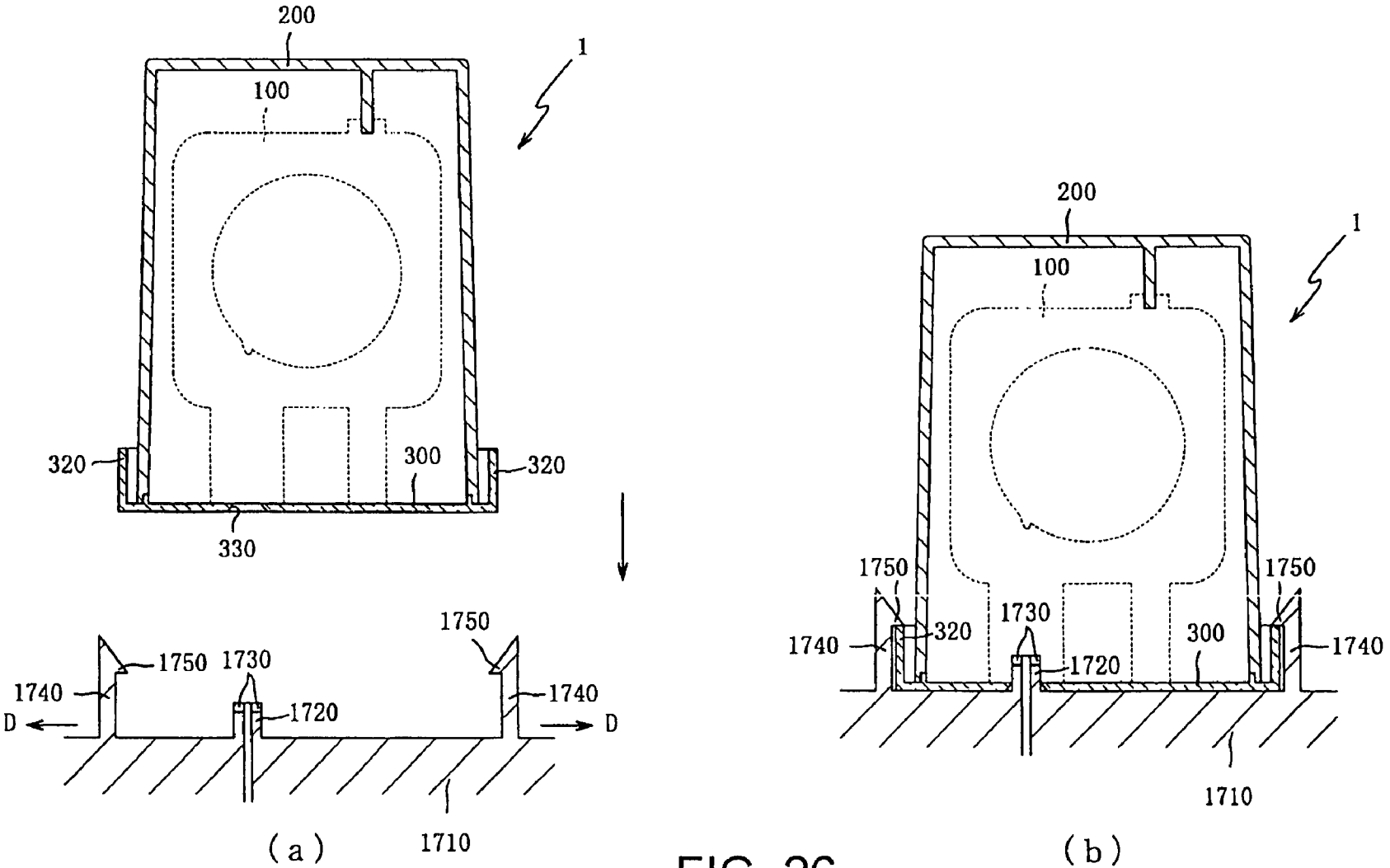
FIGS. 26(*a*) and 26(*b*) are sequential cross sectional views showing mounting of an exemplary ink cartridge according to the present invention in an inkjet printer.

Next, with reference to FIG. 26, mounting of ink cartridge 1 to the inkjet printer 1710 is explained. FIG. 26 shows cross sectional views depicting a process of mounting the ink cartridge 1 to the inkjet printer 1710. FIG. 26(*a*) shows a state before the ink cartridge 1 is mounted. FIG. 26(*b*) shows a state after the ink cartridge 1 is mounted. Furthermore, the ink cartridge 1 of FIG. 26 is schematically shown, so the case 200 and the cap 300 are shown in solid lines, and the frame 100 is shown in broken lines.

As shown in FIG. 26(*a*), in the mounting portion at which the ink cartridge 1 of the inkjet printer 1710 is mounted, the hollow ink extraction tube 1720 is provided, which extends through the joint member 610 (see FIG. 19) of the valve mechanism 530 within the ink cartridge 1 from the cap through hole 330 and extracts ink I from the ink cartridge 1. The ink extraction tube 1720 is connected to a head (undepicted) of the inkjet printer 1710 via an undepicted flow path. The ink extraction tube 1720 protrudes from the mounting portion of the inkjet printer 1710 (protruding upward in FIG. 26). At the tip end (upper side of FIG. 26(*a*)) of ink extraction tube 1720, concave ink extraction grooves 1730 are provided. Because of these ink extraction grooves 1730, even if the ink extraction tube 1720 contacts the bottom surface of the valve member 620 (see FIG. 19) of the valve mechanism 530, an ink flow path is obtained.

As shown in FIG. 26(*a*), in the mounting portion of the inkjet printer 1710, a pair of clamp members 1740 are provided that protrude (protrude upward in FIG. 26(*a*)) and sandwich the ink extraction tube 1720. At the tip ends (upper end portions in FIG. 26(*a*)) of the clamp members 1740, clamp engaging portions 1750 are provided that protrude in a direction opposite to each other and engage the cap sidewall 320. Furthermore, the clamp members 1740 have flexible properties in a direction of separation from each other (arrow D direction of FIG. 26). When the ink cartridge 1 is mounted, the clamp members 1740 are pressed in the arrow D direction by the cap bottom wall 310 and are bent. The direction in which the ink cartridge 1 is mounted to the inkjet printer 1710 is determined by the positional relationship between the ink extraction tube 1720 and the cap through hole 330.

As shown in FIG. 26(*b*), when ink cartridge 1 is mounted to the mounting portion of the inkjet printer 1710, the clamp engaging portions 1750 of the clamp members 1740 are engaged with the end portions of the cap sidewall 320 of the cap 300, and the ink cartridge 1 is fixed. To remove the ink cartridge 1, one of the clamp engaging portions 1750 and the cap sidewall 320 can be disengaged by sliding the clamp members 1740 in the arrow D direction.

As mentioned above, the cap sidewall 320 is arranged so that the melted debris X (see FIG. 24) generated in the process of welding the case 200 and the cap 300 cannot be visually seen from the outside. Furthermore, the cap sidewall 320 also functions as an engaging portion that mountingly fixes the ink cartridge 1 to the inkjet printer 1710. Therefore, there is no need for an engaging portion to separately engage the clamp members 1740, so the complexity of the structure of the ink cartridge 1 can be reduced and cost reduction can be achieved.

Figure 27:
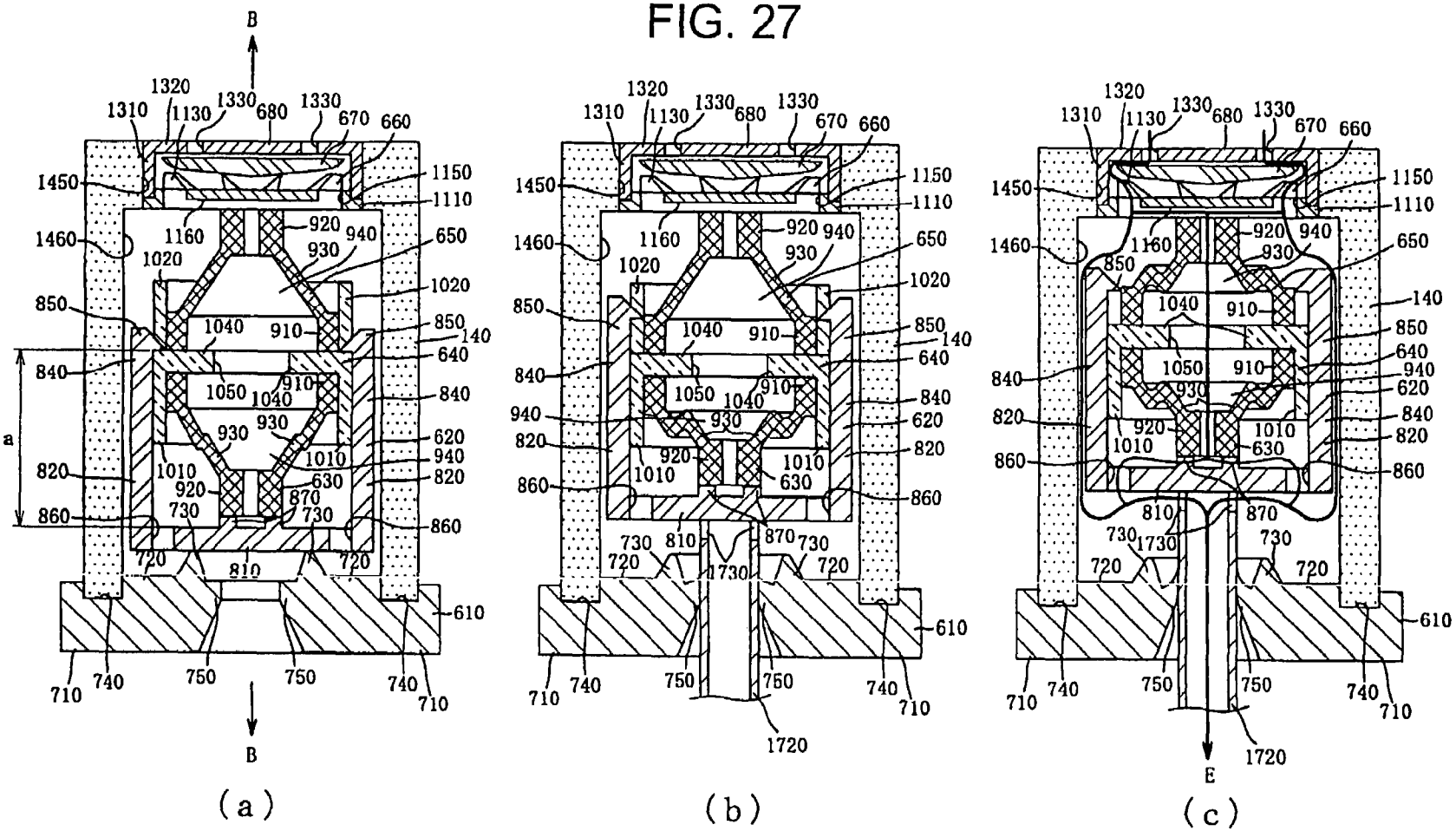
FIGS. 27(*a*)-27(*c*) are sequential cross sectional views showing operation of a valve mechanism of an exemplary ink cartridge according to the present invention.

Operation of the valve mechanism 530 when the ink extraction tube 1720 is inserted into the valve mechanism 530 is described below with reference to FIG. 27. FIG. 27 shows operation of the valve mechanism 530. FIG. 27(*a*) shows a state before the ink extraction tube 1720 is inserted. FIG. 27(*b*) shows a state in which the ink extraction tube 1720 is being inserted. FIG. 27(*c*) shows a state in which the ink cartridge 1 in which the ink extraction tube 1720 has been completely inserted (see FIG. 26).

FIG. 27(*a*) shows a state before the ink cartridge 1 is mounted to the inkjet printer 1710. At this point, the valve member 620 is urged in a direction of contact with the joint member 610, which is a direction parallel to the axis B, by the first and second spring members 630, 650. As shown in FIG. 27(*a*), the first spring member 630 stored within the valve member 620 (and the slider member 640) is slightly bent. There is no flexing, however, in the spring flexible portion 930 of the second spring member 650 arranged on the top portion (upper side of FIG. 27(*a*)) of the slider member 640. This configuration determines the bending order of the spring members 630 and 650. That is, the first spring member 630 in which the spring flexible portion 930 is already slightly bent is more easily bent than the second spring member 650. Thus, when the ink extraction tube 1720 is inserted, the first spring member 630 is first bent, and then the second spring member 650 is bent.

Bending of the spring flexible portion 930 of the first spring member 630 is caused when the valve hook portions 850 of the valve member 620 are engaged with the surface 1041 of the slider pedestal portion 1040 of the slider member 640. The distance (see FIG. 27(*a*)) between the end surface of the inside of the valve bottom wall 810 of the valve member 620 and the end surface of the valve bottom wall 810 side of the valve hook portions 850 is formed to be shorter than the total distance of the thickness of the slider pedestal portion 1040 of the slider member 640, the height of the vertical direction of the first spring member 630, and the height of the valve protruding portion 750. Therefore, when the valve hook portions 850 of the valve member 620 are engaged with the surface 1043 of the slider member 640, bending is generated in the spring flexible portion 930 of the first spring member 630. The height of the valve mechanism 530 in the axis B direction is subject to dimensional error during manufacturing the respective parts, so the greater the number of parts, the greater the dimensional error. However, the slider member 640 contacts the valve hook portions 850 of the valve member 620, so at least dimensional error in the first spring member 630 is not a concern. Accordingly, dimensional error in the valve mechanism 530 is reduced, and the extension operation of the valve mechanism 530 is stable.

As shown in FIG. 27(*a*), the inner diameter of the valve sidewall 820 of the valve member 620 is formed to be substantially the same as the outer diameter of the slider outer circumferential wall 1010 of the slider member 640. Therefore, when the slider member 640 is moved in the axis B direction of the valve mechanism 530, generation of shifting in the moving direction can be prevented. Additionally, the inner diameter of the slider outer circumferential wall 1010 is formed to be substantially the same as the outer diameter of the spring bottom portion 910 of the respective spring members 630, 650. Therefore, in a state in which the respective spring members 630, 650 are arranged on the slider pedestal portion 1040 of the slider member 640, the chance of the respective spring members 630, 650 being shifted in a direction (horizontal direction of FIG. 27(*a*)) perpendicular to the axis B is reduced. The shape of the valve sidewall 820 of the valve member 620 is formed to be substantially the same as the shape of the inner diameter of the ink supply portion 140. Therefore, shifting can be prevented when the valve member 620 is moved in the axis B direction, rendering the extension operation of the valve mechanism 530 in the axis B direction more stable.

As shown in FIG. 27(*b*), when the ink extraction tube 1720 is inserted into the joint member 610 and the valve mechanism insertion portion 1460 of the ink supply portion 140, the valve member 620 is moved in the pedestal member 660 direction (upper direction of FIG. 27(*b*)) by the ink extraction tube 1720 contacting the valve bottom wall 810 of the valve member 620. Along with this movement, the first spring member 630 is compressed. However, when the ink extraction tube 1720 is only partially inserted, only the first spring member 630 is bent and deformed by movement of the valve member 620, so the slider member 640 is not moved, and the valve hook portions 850 of the valve member 620 are separated from the slider pedestal portion 1040 of the slider member 640.

When the ink extraction tube 1720 is further inserted, the valve member 620 is further moved in the direction of the pedestal member 660. Along with this, the slider member 640 is moved in the direction of the pedestal member 660 (direction opposite to the urging direction of the first spring member 630 and the second spring member 650), and flexible deformation of the second spring member 650 begins.

As shown in FIG. 27(*c*), when the ink cartridge 1 is mounted to the mounting portion of the inkjet printer 1710, the second spring member 650 is elastically deformed, and an ink flow path shown by arrow E is formed. The ink flow path shown by the arrow E is a flow path that progresses, in order, through the ink storage portion 120 (see FIG. 19), the ink supply hole 122 (see FIG. 19), the filter 1420 (see FIG. 19) within the ink flow path 1410, the cover through holes 1330 of the cover member 680, the first pedestal through holes 1140 and second pedestal through holes 1150, the pedestal through grooves 1160, the ink flow path 940 of the second spring member 650, the slider through hole 1050, the ink flow path 940 of the first spring member 630, a flow path formed between the first spring member 630 and the valve receiving portion 870, ink flow paths 860 of the valve member 620, a flow path going through the ink extraction grooves 1730 of the ink extraction tube 1720, and the ink extraction tube 1720. This flow path becomes a main flow path in which most of ink flows. Furthermore, a space between the valve sidewall 820 of the valve member 620 and the inner circumferential surface of the valve mechanism insertion portion 1460 also becomes an ink flow path.

In the main flow path, the top portion flow path 941 formed in the spring top portion 920 of the first spring member 630 and the top portion flow path 941 formed in the spring top portion 920 of the second spring member 650 become the smallest cross sections of the flow path and are locations at which the flow path can be easily closed by the presence of bubbles included in the ink. However, as described above, the aperture of the top portion flow path 941 is formed in a substantially square shape, so this problem can be avoided.

Operation of the joint member 610 when the ink extraction tube 1720 is inserted to the joint member 610 is explained with reference to FIG. 28. FIG. 28 shows operation of the joint member 610. FIG. 28(*a*) shows a state before the ink extraction tube 1720 is inserted, and FIG. 28(*b*) shows a state after the ink extraction tube 1720 is inserted.

As shown in FIG. 28(*a*), in a state before the ink extraction tube 1720 is inserted, the joint protruding portion 750 protrudes in a substantially horizontal direction (direction perpendicular to the axis B), and the step surface 732 is substantially horizontal. Furthermore, the diameter of the tip end portion 734 of the joint contact portion 730 is shown by b.

As shown in FIG. 28(*b*), when the ink extraction tube 1720 is inserted into the protruding portion flow path 762 via the taper portion flow path 761 from the aperture 722, the joint protruding portion 750 is displaced (displaced within the protruding portion flow path 762) in an insertion direction (upward direction of FIG. 28(*b*)) of the ink extraction tube 1720. The joint protruding portion 750 is dragged by the ink extraction tube 1720 due to friction between the inner circumferential surface 751 and the ink extraction tube 1720. At this point, the joint contact portion 730 has a structure notched in a pedestal shape by the inner circumferential surface 733 and the step surface 732. Therefore, displacement of of the joint protruding portion 750 by ink extraction tube 1720 in the insertion direction is not directly transmitted to the tip end portion 734 of the joint contact portion 730. Thus, as shown in FIG. 28(*b*), the tip end portion 734 of the joint contact portion 730 is hardly displaced in the insertion direction, and the tip end portion 734 of the joint contact portion 730 is slightly displaced in the direction (arrow F direction) of separation from the ink extraction tube 1720. The diameter of the joint contact portion 730 in this state is shown by b1, and is slightly larger than the diameter b of FIG. 28(*a*). That is, the shape change in the joint member 610 that accompanies the insertion of the ink extraction tube 1720 becomes a shape change in which the joint contact portion 730 is displaced in the arrow F direction. If there were no step surface 732 at the boundary of the joint contact portion 730 and the joint protruding portion 750, and the joint contact portion 730 had a shape having a moderately inclined surface toward the tip end portion 734 of the joint contact portion 730 from the inner circumferential surface 751 of the joint protruding portion 750, when the joint protruding portion 750 was deformed so as to be displaced by the ink extraction tube 1720 in the insertion direction of the ink extraction tube 1720, deformation of the joint protruding portion 750 would be directly transmitted to the joint contact portion 730. The joint contact portion 730 would then be displaced in the insertion direction along with the joint protruding portion 750. As a result, an insertion stroke of the ink extraction tube 1720 to form an ink flow path between the valve member 620 (see FIG. 27) and the joint contact portion 730, would be long. In such a configuration, it would be necessary to make the ink extraction tube 1720 long. If the ink extraction tube 1720 is too long, it can contact other members, easily damaging those members. However, in the embodiment shown in FIG. 28, the joint contact portion 730 is displaced in a direction (arrow F direction) substantially perpendicular to the insertion direction of the ink extraction tube 1720, so there is no need for a long stroke to form the ink flow path. Thus, the chance that the ink extraction tube 1720 will contact other members and that damage will be caused can be reduced.

Figure 29:
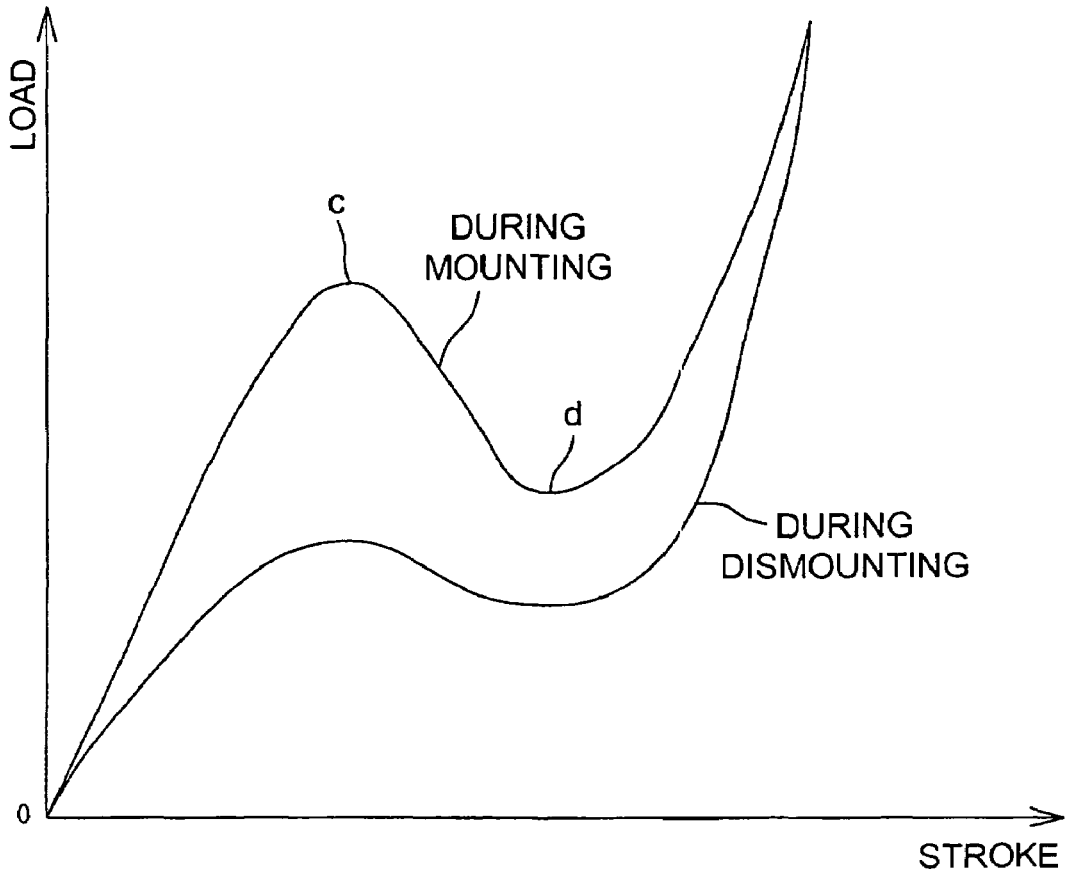
FIG. 29 is a graph showing a tactile feeling when an exemplary ink cartridge according to the present invention is mounted to an inkjet printer.

A tactile feeling that accompanies mounting of the ink cartridge 1 is explained with reference to FIG. 29. FIG. 29 is a graph showing a tactile feeling when the ink cartridge 1 is mounted. A horizontal axis of FIG. 29 shows a moving distance (stroke) when the ink cartridge 1 is mounted. A vertical axis of FIG. 29 is a load that is generated when the ink cartridge 1 is mounted.

As shown in FIG. 29, when the ink cartridge 1 begins to be mounted, and the ink extraction tube 1720 contacts the valve member 620, the load rapidly increases. Then, when the spring flexible portions 930 of the first spring member 630 begin to be elastically deformed, the load rapidly decreases. This change in state is point c of FIG. 29 (intermediate state between FIG. 27(*a*) and FIG. 27(*b*)).

After that, if mounting of the ink cartridge 1 continues, elastic deformation of the first spring member 630 is completed, and elastic deformation of the second spring member 650 begins. At this point, the load rapidly increases again. This state is shown by point d of FIG. 29.

Thus, by having the respective spring members 630, 650, there is a two-level change of load. Therefore, a person who mounts the ink cartridge 1 can feel that mounting of the ink cartridge 1 is accurately performed. This change of load is called a "tactile feeling". Therefore, a user can confirm through a tactile feeling, without visual examination, whether the ink cartridge 1 is accurately mounted.

Furthermore, in the same manner, the load changes when the ink cartridge 1 is detached. The change is shown by the curve of the load at the time of detachment of the ink cartridge 1 as shown in FIG. 29. When the ink cartridge 1 begins to be detached, the load is high because there is an elastic force that returns the respective spring members 630, 650 to their original state, but when the detachment of the ink cartridge continues, the change in the load becomes smooth.

Figure 30:
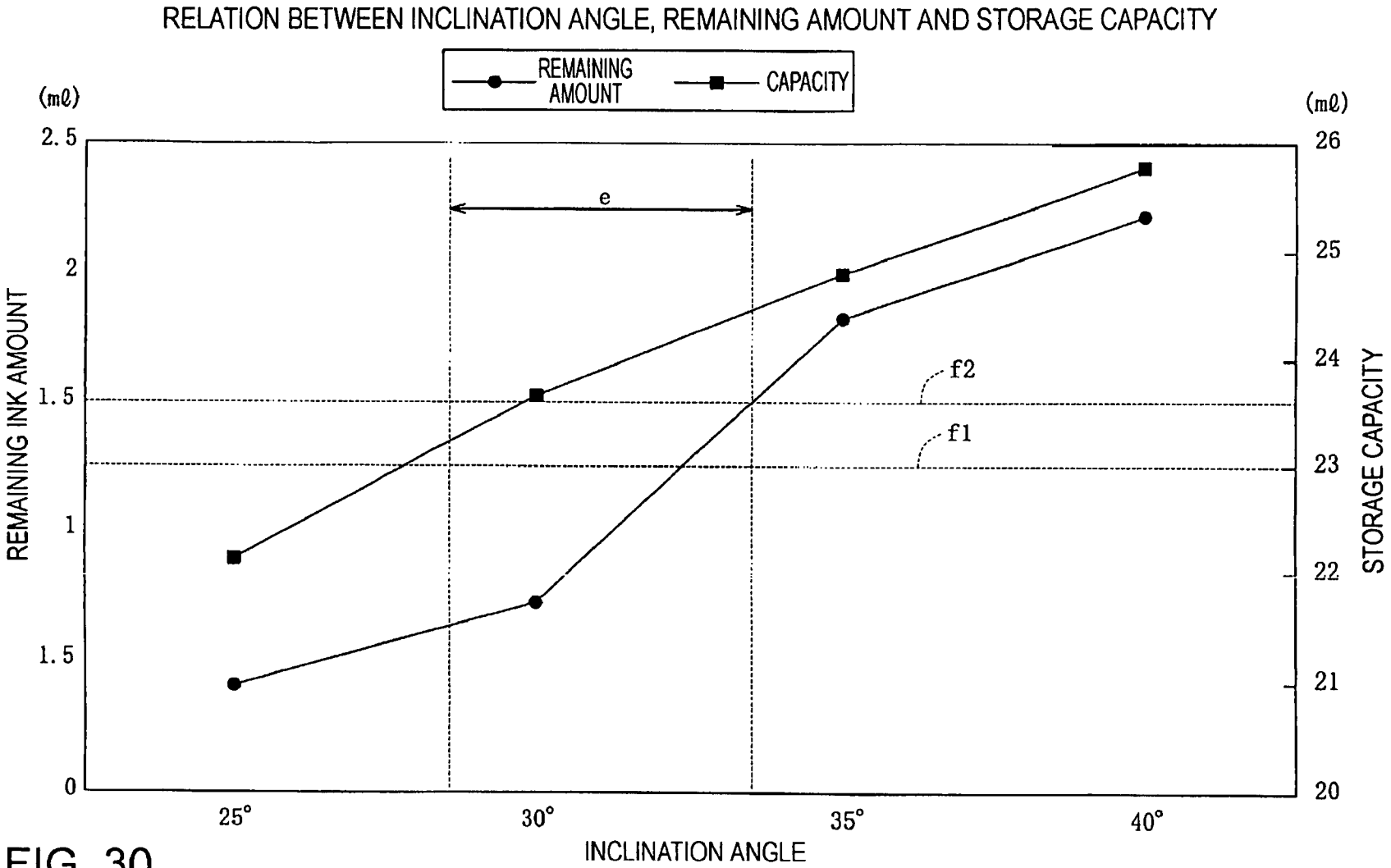
FIG. 30 is a graph showing a relationship between a configuration of a frame inclined surface and a remaining ink amount and a relationship between the configuration of the frame inclined surface and storage capacity in an exemplary ink cartridge according to the present invention.

The inclination angle α (see FIG. 21) of the frame inclined surfaces 124 of the frame main body portion 110 is described with reference to FIG. 30. FIG. 30 is a graph showing the relationship between the inclination angle α of the frame inclined surfaces 124, a remaining ink amount, and a storage capacity. The horizontal axis (vertical direction of FIG. 30) of FIG. 30 shows the inclination angle α of the frame inclined surfaces 124, and the vertical axis (vertical direction of FIG. 30) of FIG. 30 shows the remaining ink amount (vertical axis of the left side of FIG. 30) and the storage capacity (vertical axis of the right side of FIG. 30). The black round dots of FIG. 30 show the remaining ink amount, and the black square dots show the storage capacity.

In the embodiment shown in FIG. 19, the frame inclined surfaces 124 are formed in a linear shape in a cross sectional view. This configuration is provided to effectively consume ink and reduce a remainder amount of ink stored within the ink storage portion 120. That is, when the frame inclined surfaces 124 are formed in a curved shape in a cross sectional view, when the ink housing amount is small, the films 1430 cannot accurately contact the frame inclined surfaces 124. Thus, there remains a slight gap between the frame inclined surfaces 124 and the films 1430, and ink is stored therein.

Additionally, the frame inclination angle α of the frame inclined surfaces 124 is set at an angle at which a large ink storage amount can be obtained and the a remainder ink amount can be reduced. In the embodiment described above, the frame inclination angle α is set to be 30°. With respect to the ink cartridge 1, the minimum allowable storage capacity is determined. The storage capacity is 23 milliliters (hereafter referred to as "ml"), which is shown as the broken straight line f1 in FIG. 30. As shown in FIG. 30, from the standpoint of the minimum storage capacity, it is preferable that the inclination angle α of the frame inclined surfaces 124 is formed at 27° or higher.

Furthermore, with respect to the remainder ink amount, the target value of the maximum allowable remainder amount is determined. The target value is 1.5 ml or less. This target value is shown as the broken straight line f2 in FIG. 30. From the standpoint of the remainder ink amount, it is preferable that the inclination angle α of the frame inclined surfaces 124 is formed at 34° or less.

As shown in FIG. 30, the storage capacity becomes larger in proportion to a large inclination angle α. However, the remainder ink amount rapidly increases when the value of the inclination angle α is larger than 30°. According to this analysis, an optimal inclination angle α of the frame inclined surfaces 124 is 30°.

Additionally, it is preferable that the inclination angle α is 27° or more in terms of the storage capacity. However, taking remainder ink amount into consideration, it is preferable that the inclination angle α is within a range e of 28° to 34°. Any inclination angle α set within this range, would be suitable.

In the embodiment described above, the frame 100, the case 200, and the cap 300 are formed of resin material. The valve mechanism 530 is also formed of resin material. By not using metal material as a structural element of the ink cartridge 1, disposal can be performed by burning the ink cartridge 1. For example, in an ink cartridge in which an urging member (e.g., the respective spring members 630, 650) of a valve mechanism is formed of metal, at the time of disposal, the ink cartridge needs to be taken apart, and the urging member needs to be removed. This additional step raises disposal cost. As the structural elements of the ink cartridge 1 are combustible, disposal cost can be reduced.

An ink cartridge 2 is described with reference to FIG. 31. In the ink cartridge 1, the tip end portion shape of the ink insertion plug 520 (see FIG. 19) is formed in a substantially conical shape. Meanwhile, in the ink cartridge 2, an insertion inner circumferential portion 1830 of an ink insertion portion 1820 of a frame 1810 is formed as a substantially hollow cylindrical groove. At the same time, an ink insertion plug 1840 to be inserted into the insertion inner circumferential portion 1830 is formed in a substantially cylindrical shape. Portions of the ink cartridge 2 corresponding to same portions of the ink cartridge 1 are shown with the same symbols, so explanation thereof is omitted.

Figure 31:
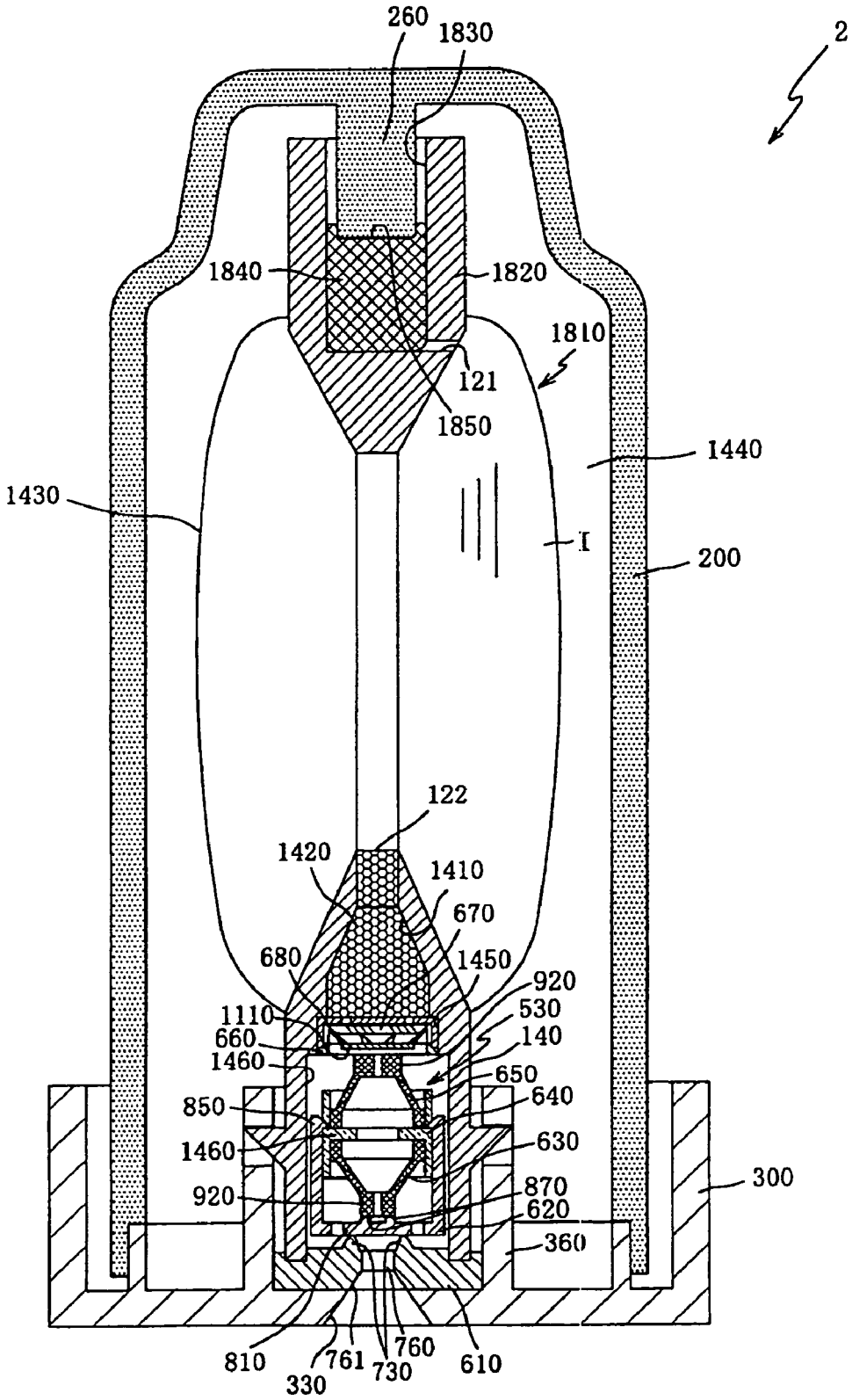
FIG. 31 is a cross sectional view of an exemplary ink cartridge according to the present invention.

FIG. 31 is a cross sectional view of the ink cartridge 2. As shown in FIG. 31, with respect to the ink cartridge 2, the shape of the insertion inner circumferential portion 1830 of the ink insertion portion 1820 of the frame 1810 is formed as a substantially hollow cylindrical groove. The ink insertion hole 121 is connected to the end portion (lower side of FIG. 31) of the deepest part, opposite to the aperture portion (upper side of FIG. 31), of the insertion inner circumferential portion 1830. The ink insertion plug 1840 that is inserted to the insertion inner circumferential portion 1830 is formed in a substantially cylindrical shape. Therefore, when the case 200 is mounted to the cap 300, and the ink insertion plug 1840 is pushed by the case protruding member 260, the outer surface of the ink insertion plug 1840 contacts the inner surface of the insertion inner circumferential portion 1830 without any gap. That is, connection between the insertion inner circumferential portion 1830 and the ink insertion hole 121 is blocked by the ink insertion plug 1840.

Therefore, in the same manner as in the ink cartridge 1, when the case 200 is mounted to the cap 300, the ink insertion plug 1840 is pushed by the case protruding member 260. Thus, the process of manufacturing the ink cartridge 2 can be simplified. Additionally, by pressing the ink insertion plug 1840 with the case protruding member 260, wobbling of the frame 1810 can be reduced. In addition, in the same manner as in the ink cartridge 1, even if shock is applied to the case 200, it is moderated as it is transmitted to the frame 1810. Thus, the frame 1810 can be protected from external shock. Furthermore, as the case protruding member 260 presses the ink insertion plug 1840, it also functions to prevent slippage of the ink insertion plug 1840.

As shown in FIG. 31, with respect to the ink insertion plug 1840, the portion contacting the case protruding member 260 includes an insertion plug groove portion 1850. The insertion plug groove portion 1850 is a concave-shaped groove, and the diameter of the groove is formed to be substantially the same as the diameter of the case protruding member 260. When the ink insertion plug 1840 is pressed by the case protruding member 260, the tip end of the case protruding member 260 engages with the insertion plug groove portion 1850. Thus, the chance that the position at which the ink insertion plug 1840 contacts the case protruding member 260 will be shifted and the frame 1810 will inclined is reduced. When the frame 1810 is inclined, the load to be applied to the joint member 610 changes and ink may leak. The insertion plug groove portion 1850, prevents such ink leakage.

An ink cartridge 3 is described with reference to FIG. 32. In the ink cartridge 1, the valve member 620 is urged in the joint member 610 direction by an elastic force of the first spring member 630 and the second spring member 650, so the ink flow path is closed (see FIG. 27(*a*)). Meanwhile, in the ink cartridge 3, a valve member 1930 is urged in the joint member 610 direction by an elastic force of a coil spring member 1940 formed of a metal material or resin material, and the ink flow path is closed. Portions of the ink cartridge 3 corresponding to same portions of the ink cartridge 1 are shown with the same symbols, so explanation thereof is omitted.

Figure 32:
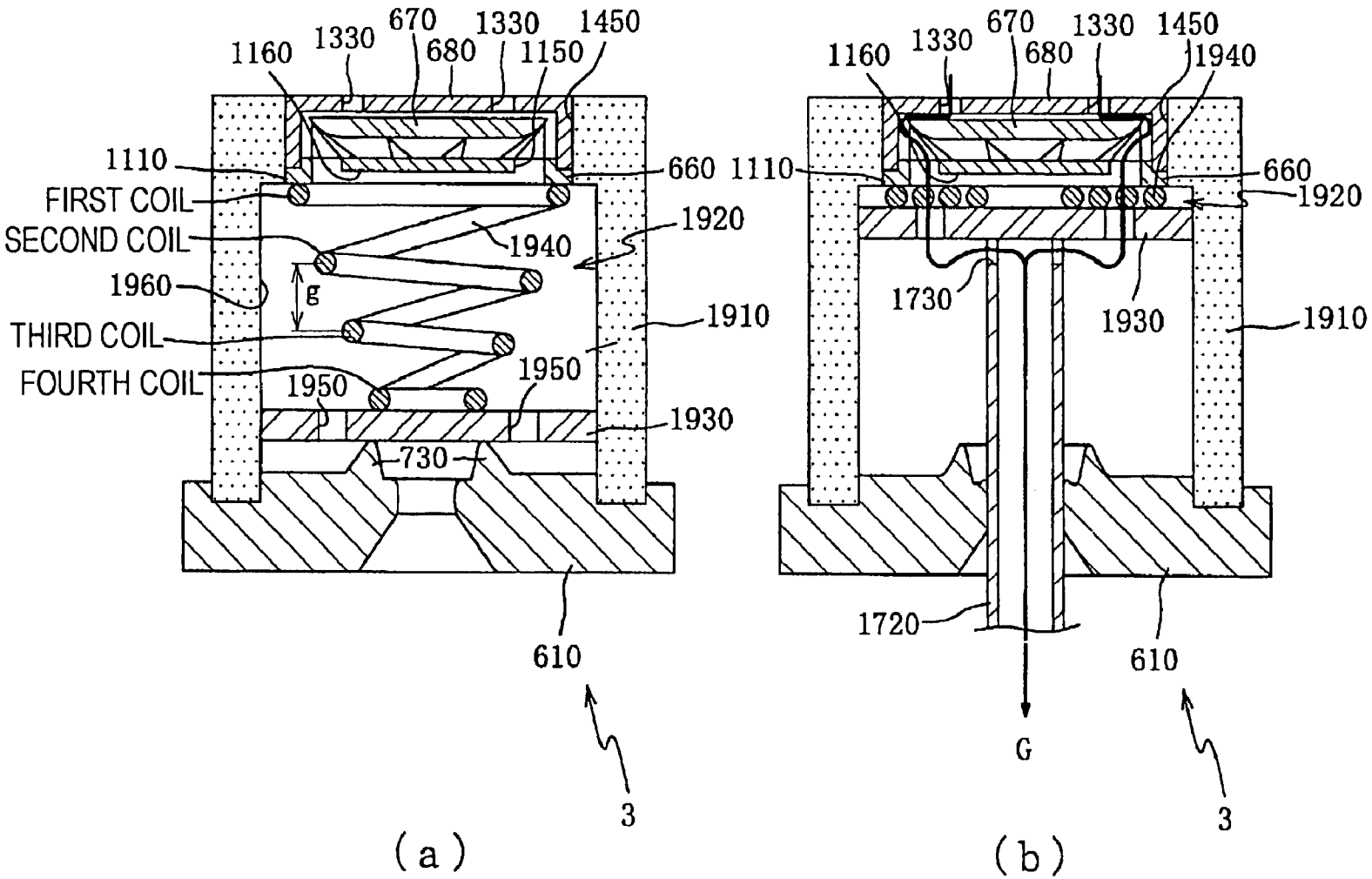
FIGS. 32(*a*) and 32(*b*) are sequential cross sectional views showing insertion of an ink supply tube into part of an ink supply portion of an exemplary ink cartridge according to the present invention.

FIG. 32 shows cross sectional views of an ink supply portion 1910 of the ink cartridge 3. FIG. 32(*a*) shows a state before an ink extraction tube 1720 (see FIG. 26) is inserted, and FIG. 32(*b*) shows a state after the ink extraction tube 1720 is inserted.

As shown in FIG. 32, with respect to a valve mechanism 1920, between the pedestal bottom portion 1110 of the pedestal member 660 engaged with the engaging portion 1450 and the valve member 1930 closing the ink flow path by contacting the joint contact portion 730 of the joint member 610, a coil spring member 1940 is arranged, which is formed of a substantially conical coil spring.

The valve member 1930 is formed in a substantially round flat plate shape. Valve through holes 1950 are formed, which become ink flow paths in the vicinity of the outer circumferential portion. Though not depicted, six valve through holes 1950 are substantially uniformly formed about the circumference of the valve member 1930. The diameter of the valve member 1930 is formed to be substantially the same as the inner diameter of a valve mechanism insertion portion 1960. Thus, when the valve member 1930 is vertically moved, the chances of inclination of the valve member 1930 are reduced. In particular, when the ink cartridge 3 is detached from the inkjet printer 1710 (see FIG. 26), if the valve member 1930 is inclined, the position at which the joint contact portion 730 contacts the joint member 610 is changed, and ink may leak. However, in the ink cartridge 3, the chances of the valve member 1930 being inclined and moved are reduced, so the chances of ink leakage are reduced.

The coil spring member 1940 is a conical wound coil spring. The large diameter side (upper side of FIG. 32) contacts the pedestal bottom portion 1110 of the pedestal member 660, and the smaller diameter side (lower side of FIG. 32) contacts the valve member 1930. With respect to the coil spring member 1940, in the extension direction (vertical direction of FIG. 32), pitch lengths g are formed to be substantially the same. Furthermore, the coil spring member 1940 of the ink cartridge 3 is formed of four coils of coil spring. The first through fourth coils are shown progressing from large diameter to small diameter. The inner diameter of the first coil is formed to be larger than the outer diameter of the second coil. The inner diameter of the second coil is formed to be larger than the outer diameter of the third coil. The inner diameter of the third coil is formed to be larger than the outer diameter of the fourth coil. That is, a coil spring is used so that the inner diameter of $n^{th}$ coil is larger than the outer diameter of $(n+1)^{th}$ coil.

With respect to the coil spring member 1940, the valve member 1930 can be urged in the direction of the joint member 610 (downward direction in FIG. 32), so it can also be arranged so that the smaller diameter contacts the pedestal bottom portion 1110 of the pedestal member 660, and the larger diameter contacts the valve member 1930.

As shown in FIG. 32(*b*), when the ink extraction tube 1720 is inserted into the valve mechanism insertion portion 1960, the valve member 1930 is pushed in the pedestal member 660 direction (upward direction of FIG. 32(*b*)) by the ink extraction tube 1720, and the coil spring member 1940 is compressed. FIG. 32(*b*) shows a state in which the ink cartridge 3 is mounted to the inkjet printer 1710 (see FIG. 26), and the inner diameter of $n^{th}$ coil is formed to be larger than the outer diameter of $(n+1)^{th}$ coil. Thus, the second through fourth coils are accommodated within the first coil. That is, the conical inclination angle at the time of non-compression is set at an inclination angle such that the first through fourth coils do not interfere in the compression direction at the time of compression. Thus, when the ink extraction tube 1720 inserted into the valve mechanism insertion portion 1960 and pushes the valve member 1930 in the pedestal member 660 direction, the coil spring member 1940 is compressed to be compact to a degree in which the thickness in this direction becomes substantially the same as the diameter of the coils. Therefore, the length of the ink supply portion 1910 can be shortened, in comparison to valve mechanism formed of a plurality of members or in which the coil spring is formed in a cylindrical shape, and the ink cartridge 3 can be made smaller. Furthermore, as only one coil spring member 1940 needs to be used as an urging member, the structure of the valve mechanism 1920 can be simplified.

The ink flow path in a state in which the ink cartridge 3 is mounted to the inkjet printer 1710 is shown by arrow G. The ink flow path is formed by, in order, the cover through holes 1330 of the cover member 680, the second pedestal through holes 1150 of the pedestal member 660, the valve through holes 1950 of the valve member 1930, and the ink extraction tube 1720.

An ink cartridge 4 is described with reference to FIG. 33. In the ink cartridge 1, the valve member 620 is urged in the joint member 610 direction by an elastic force of the first spring member 630 and the second spring member 650, and the ink flow path is closed. Meanwhile, in the ink cartridge 4, the valve member 1930 is urged in the joint member 610 direction by an elastic force of a coil spring member 2040, and the ink flow path is closed. Portions of the ink cartridge 4 corresponding to same portions of the ink cartridge 1 are shown with the same symbols, so explanation thereof is omitted The valve member 1930 provided in the ink cartridge 4 is the same as the valve member 1930 of the ink cartridge 3, so explanation thereof is omitted.

Figure 33:
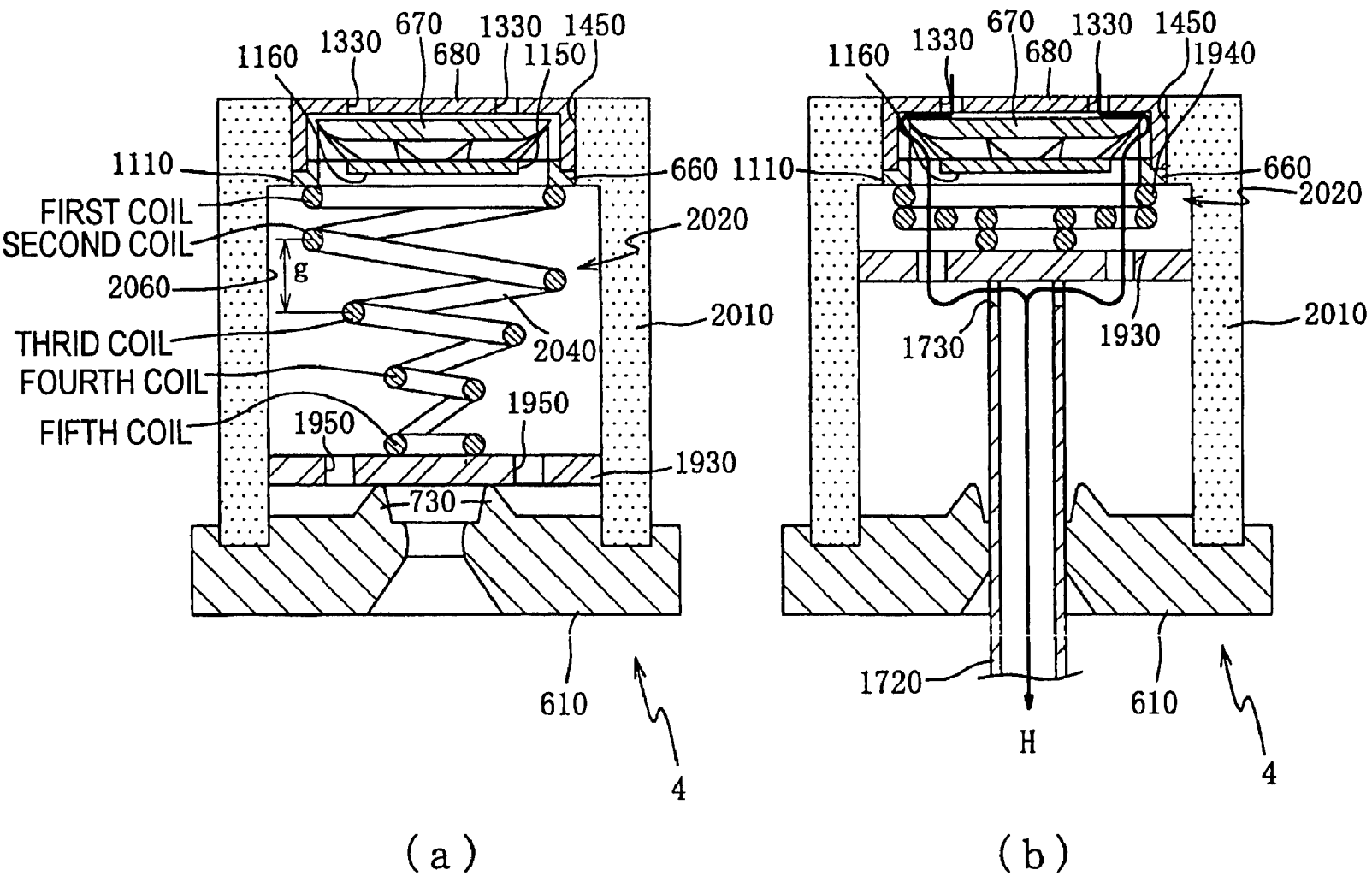
FIGS. 33(*a*) and 33(*b*) are sequential cross sectional views showing insertion of an ink supply tube into part of an ink supply portion of an exemplary ink cartridge according to the present invention.

FIG. 33 shows cross sectional views of an ink supply portion 2010 of the ink cartridge 4. FIG. 33(*a*) shows a state before the ink extraction tube 1720 is inserted, and FIG. 33(*b*) shows a state after the ink extraction tube 1720 is inserted.

As shown in FIG. 33, with respect to a valve mechanism 2020 of the ink cartridge 4, the coil spring member 2040 includes a coil spring formed of a substantially cylindrical portion and a substantially conical portion is arranged between the pedestal bottom portion 1110 of the pedestal member 660 engaged with the engaging portion 1450 and the valve member 1930 that closes the ink flow path by contacting the joint contact portion 730 of the joint member 610.

The coil spring member 2040 is a wound spring coil. Both end portions of the coil spring member 2040 in the extension direction (vertical direction of FIG. 33(*a*)) are formed in a substantially cylindrical shape, and the intermediate portion is formed in a substantially conical shape. With respect to the coil spring member 2040, the portion with the larger diameter (upper side of FIG. 33(*a*)) contacts the pedestal bottom portion 1110 of the pedestal member 660, and the portion with the small diameter (lower side of FIG. 33(*a*)) contacts the valve member 1930. With respect to the coil spring member 2040, in the extension direction (vertical direction in FIG. 33), pitch lengths g are substantially the same. Furthermore, the coil spring member 2040 includes five coils of coil spring. The first through fifth coils are shown, starting from the larger diameter coils and progressing to the smaller diameter coils. The diameter of the first and second coils is substantially the same size. The inner diameter of the first and second coils is formed to be larger than the outer diameter of the third coil. The inner diameter of the third coil is formed to be larger than the outer diameter of the fourth coil. Furthermore, the diameter of the fourth and fifth coils is formed to be substantially the same. That is, the second through fourth coils are formed to be a substantially conical shape, and with respect to the second through fourth coils, the inner diameter of $n^{th}$ coil is larger than the outer diameter of $(n+1)^{th}$ coil.

Additionally, with respect to the coil spring member 2040, the valve member 1930 is urged in the joint member 610 direction (lower direction of FIG. 33). Thus, the portion with the smaller diameter can contact the pedestal bottom portions 1110 of the pedestal member 660, and the portion with the large diameter can contact the valve member 1930.

As shown in FIG. 33(*b*), when the ink extraction tube 1720 is inserted to a valve mechanism insertion portion 2060, the valve member 1930 is pushed in the pedestal member 660 direction (upper direction of FIG. 33(*b*)). FIG. 33(*b*) shows a state in which the ink cartridge 4 is mounted to the inkjet printer 1710 (see FIG. 26). From the second to the fourth coils, the inner diameter of $n^{th}$ coil is larger than the outer diameter of $(n+1)^{th}$ coil, so the third and fourth coils are accommodated within the second coil. Because of this, when the ink extraction tube 1720 inserted into the valve mechanism insertion portion 2060 and pushes the valve member 1930 in the direction of the pedestal member 660, the coil spring member 2040 is pressed to be compact so that the thickness in this direction becomes substantially the same as three times the diameter of the wound coil. Therefore, the length of the ink supply portion 2010 in the extension direction is shortened, in comparison to a valve mechanism formed of a plurality of members or in which the coil spring is formed in a cylindrical shape, and the ink cartridge 4 can be made smaller. Furthermore, in the ink cartridge 4, only one coil spring member 2040 is used as an urging member, so the structure of the valve mechanism 2020 can be simplified.

The ink flow path in a state in which the ink cartridge 4 is mounted to the inkjet printer 1710 (see FIG. 26) is shown by arrow H. The ink flow path is formed by, in order, the cover through holes 1330 of the cover member 680, the second pedestal through holes 1150 of the pedestal member 660, the valve through holes 1950 of the valve mechanism 1920, and the ink extraction tube 1720.

An ink cartridge 5 is described with reference to FIG. 34. In the ink cartridge 3, the pedestal member 660 and the cover member 680 are engaged with the engaging portion 1450. In the ink cartridge 5, one end of the coil spring member 1940 contacts a filter stopper member 2170 that suppresses slippage of the filter 1420. Portions of the ink cartridge 5 corresponding to same portions of the ink cartridge 3 are shown with the same symbols, so explanation thereof is omitted.

Figure 34:
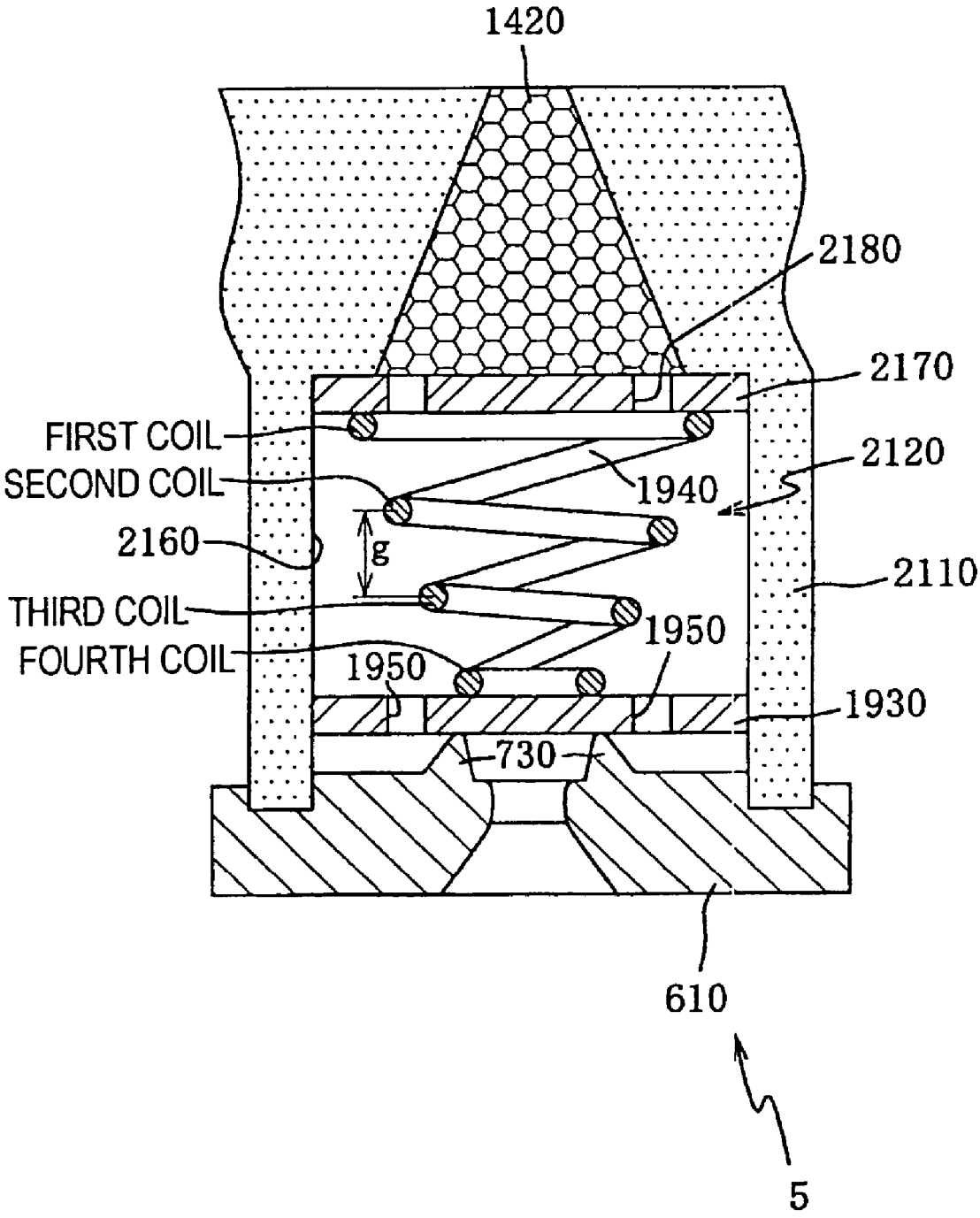
FIG. 34 is a cross sectional view of part of an ink supply portion of an exemplary ink cartridge according to the present invention.

FIG. 34 is a cross sectional view of an ink supply portion 2110 of the ink cartridge 5.

As shown in FIG. 34, the valve mechanism 2120 of the ink cartridge 5 includes the valve member 1930, the coil spring member 1940, and the filter stopper member 2170 that contacts one end side of the coil spring member 1940 and is urged in the direction of the filter 1420 (upward direction of FIG. 34).

The filter stopper member 2170 is formed in a substantially round flat plate shape. Stopper through holes 2180 are formed, which become ink flow paths in the vicinity of the outer circumferential portion of the filter stopper member 2170. Though not depicted, six stopper through holes 2180 are formed substantially about the circumference of the filter stopper member 2170. The outer diameter of the filter stopper member 2170 is formed to be substantially the same as the inner diameter of the valve mechanism insertion portion 2160, so shifting of the position of the filter stopper member 2170 can be prevented. Furthermore, it is also acceptable for the outer diameter of the filter stopper member 2170 to have a larger diameter than the inner diameter of the valve mechanism insertion portion 2160. Further, the filter stopper member 2170 can be fixed.

As shown in FIG. 34, the filter stopper member 2170 is constantly urged by the coil spring member 1940, so the filter 1420 does not slip into the valve mechanism insertion portion 2160. Therefore, dust and/or foreign matter can be effectively removed by the filter 1420. The valve mechanism 2120 includes the filter stopper member 2170, the coil spring member 1940, and the valve member 1930, so a structure of the ink cartridge 5 can be simplified.

An ink cartridge 6 is described with reference to FIG. 35. In the ink cartridge 1, the valve mechanism 530 includes the joint member 610, the valve member 620, the first spring member 630, the slider member 640, the second spring member 650, the pedestal member 660, the check valve 670, and the cover member 680. In the ink cartridge 6, a valve member 1930 is provided that does not include the slider member 640 and has a different shape. The valve member 1930 of the ink cartridge 6 is the same as the valve member 1930 of the ink cartridge 3, so explanation thereof is omitted. Portions of the ink cartridge 6 corresponding to same portions of the ink cartridge 1 are shown with the same symbols, so explanation thereof is omitted.

Figure 35:
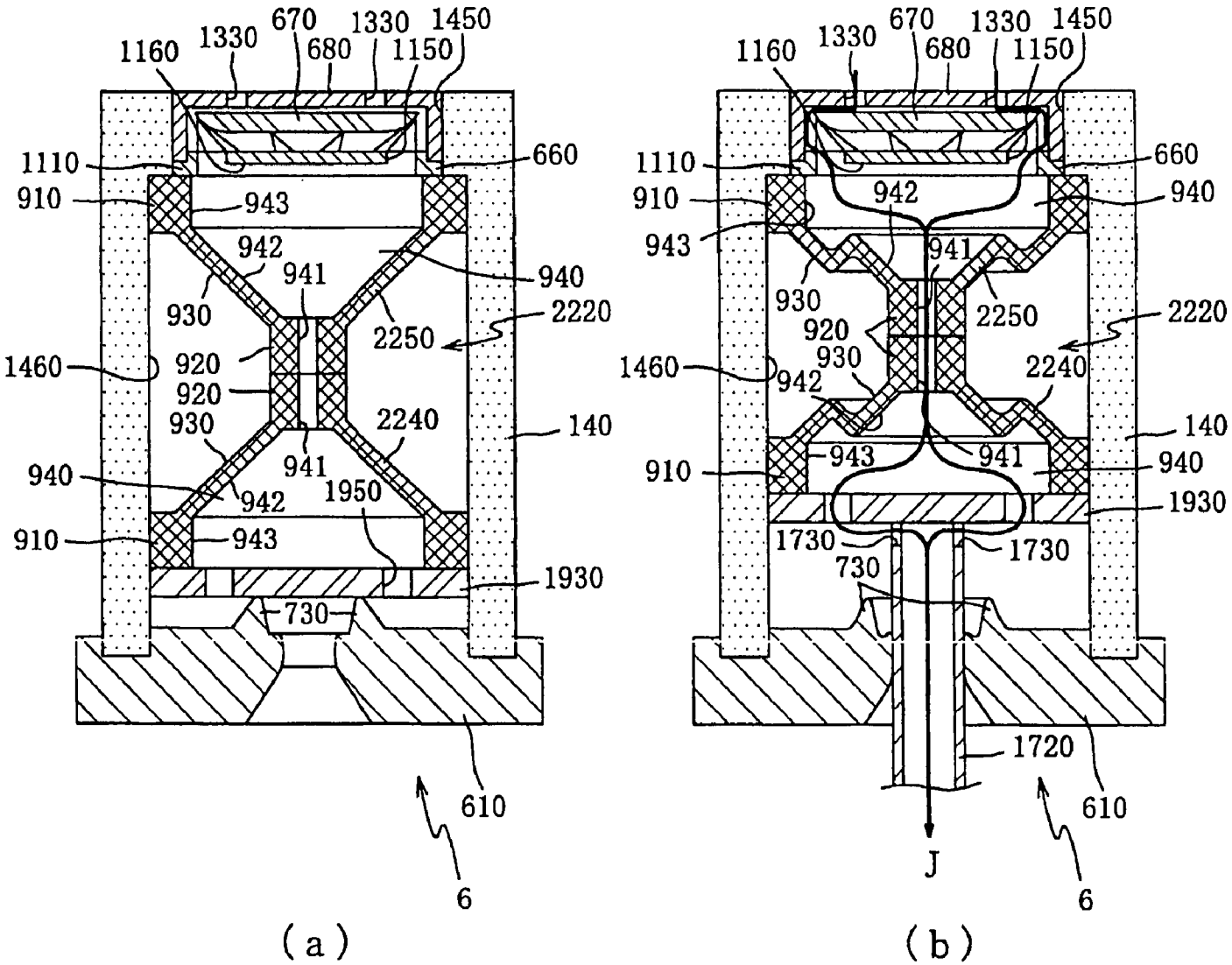
FIGS. 35(*a*) and 35(*b*) are sequential cross sectional views showing insertion of an ink supply tube into part of an ink supply portion of an exemplary ink cartridge according to the present invention.

FIG. 35 shows cross sectional views of the ink supply portion 140 of the ink cartridge 6. FIG. 35(*a*) shows a state before the ink extraction tube 1720 is inserted, and FIG. 35(*b*) shows a state after the ink extraction tube 1720 is inserted.

As shown in FIG. 35(*a*), with respect to a valve mechanism 2220 of the ink cartridge 6, between the pedestal bottom portion 1110 of the pedestal member 660 engaged with the engaging portion 1450 and the valve member 1930 that closes an ink flow path by contacting the joint contact portion 730 of the joint member 610, a first spring member 2240 and a second spring member 2250 are arranged, which are formed of resin material having elasticity such as rubber.

The first spring member 2240 is formed of the same material and has the same shape as the first spring member 630 of the ink cartridge 1. The structure of the first spring member 2240 includes an annular spring bottom portion 910 that forms a bottom surface (end portion with the large diameter) of the first spring member 2240, the annular spring top portion 920 that has a diameter smaller than the diameter of the spring bottom portion 910 and forms a top surface (end portion with smaller diameter) of the first spring member 2240, and a hollow conical spring flexible portion 930 that connects the spring top portion 920 and the spring bottom portion 910 and is flexibly deformed when a load is applied. The ink flow path 940 is also provided in first spring member 2240, including the top portion flow path 941 that becomes the inner circumferential surface of the spring top portion 920, a flexible portion flow path 942 that becomes the inner circumferential surface of the spring flexible portion 930, and a bottom portion flow path 943 that becomes the inner circumferential surface of the spring bottom portion 910.

The second spring member 2250 is formed of the same material and has the same shape as the first spring member 2240 (the outer shape size is different) and includes the spring bottom portion 910, the spring top portion 920, the spring flexible portion 930, and the ink flow path 940 (top portion flow path 941, flexible portion flow path 942, bottom portion flow path 943). The second spring member 2250 is arranged opposite to, and symmetrically with, the first spring member 2240 in a vertical direction.

As shown in FIG. 35, the respective spring top portions 920 of the first spring member 2240 and the second spring member 2250 contact each other, and the spring bottom portions 910 are arranged so as to contact a respective one of the pedestal bottom portion 1110 of the pedestal member 660 and the valve member 1930. The side surfaces of the spring bottom portions 910 contact the inner wall of the ink supply portion 140, which has a hollow cylindrical shape, so movement in the diameter direction is restricted. The contact surfaces of the respective spring top portions 920 may be attached (e.g., welded). The outer diameter of the spring bottom portion 910 is formed have substantially the same diameter as the inner diameter of the valve mechanism insertion portion 1460, so the chances of shifting of the positions of the respective spring members 2240, 2250 are reduced.

As shown in FIG. 35(*b*), when the ink extraction tube 1720 is inserted into the valve mechanism insertion portion 1460, the valve member 1930 is pushed in the pedestal member 660 direction (upper direction of FIG. 35(*b*)). FIG. 35(*b*) shows a state in which the ink cartridge 6 is mounted to the inkjet printer 1710 (see FIG. 26). In FIG. 35(*b*), the spring flexible portions 930 of the first spring member 2240 and the second spring member 2250 are elastically deformed.

At this point, when the first spring member 2240 and the second spring member 2250 are elastically deformed, the side surfaces of the spring bottom portions 910 with the largest diameter contact the inner wall of the ink supply portion 140, so movement in the diameter direction is restricted. Therefore, axis wobbling that can easily be generated by elastic deformation is prevented.

The ink flow path in a state in which the ink cartridge 6 is mounted to the inkjet printer 1710 is shown by arrow J. The ink flow path is formed by, in order, the cover through holes 1330 of the cover member 680, the second pedestal through holes 1150 of the pedestal member 660, the ink flow paths 940 of the respective spring members 2240, 2250, the ink flow path of the valve through holes 1950 of the valve member 1930, and the ink extraction tube 1720.

An ink cartridge 7 is described with reference to FIG. 36. In the ink cartridge 1, the valve member 620 is urged in the direction of the joint member 610 by the elastic force of the first spring member 630 and the second spring member 650, and the ink flow path is closed (see FIG. 27(*a*)). In the ink cartridge 7, the valve member 1930 is urged in the joint member 610 direction by an elastic force of a spring member 2340 that is formed in a substantially cylindrical shape, and the ink flow path is closed. Portions of the ink cartridge 7 corresponding to same portions of the ink cartridge 1 are shown with the same symbols, so explanation thereof is omitted. Furthermore, the valve member 1930 of the ink cartridge 7 is the same as the valve member 1930 of the ink cartridge 3, so explanation thereof is omitted.

Figure 36:
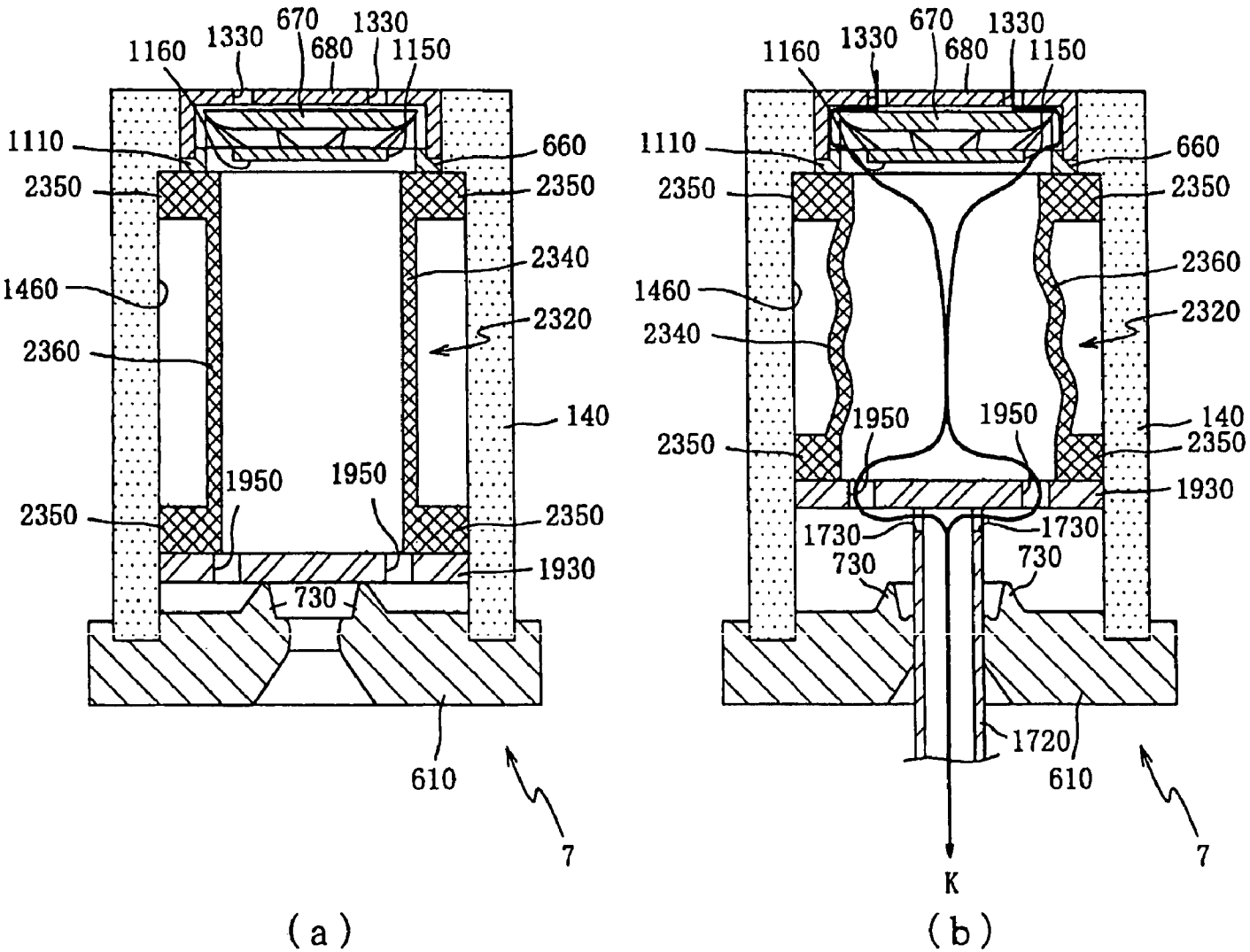
FIGS. 36(*a*) and 36(*b*) are sequential cross sectional views showing insertion of an ink supply tube into part of an ink supply portion of an exemplary ink cartridge according to the present invention.

FIG. 36 is a cross sectional view of the ink supply portion 140 of the ink cartridge 7. FIG. 36(*a*) shows a state before the ink extraction tube 1720 is inserted. FIG. 36(*b*) shows a state after the ink extraction tube 1720 is inserted.

As shown in FIG. 36, with respect to a valve mechanism 2320 of the ink cartridge 7, between the pedestal bottom portion 1110 of the pedestal member 660 engaged with the engaging portion 1450 and the valve member 1930 that closes the ink flow path by contacting the joint contact portion 730 of the joint member 610, a spring member 2340 is arranged, which is formed of resin material having elasticity such as rubber and has a substantially hollow cylindrical shape.

With respect to the spring member 2340, two spring end portions 2350, including a spring end portion that contacts the pedestal bottom portion 1110 of the pedestal member 660 and a spring end portion that contacts the valve member 1930 are formed on respective ends (upper side and lower side of FIG. 36) of the spring member 2340. Between the two spring end portions 2350, a spring flexible portion 2360 is formed, which is bent and deformed when a load is applied. The spring flexible portion 2360 is formed to be thinner than the spring end portions 2350, so the strength of the spring flexible portion 2360 is weaker. When the spring member 2340 is elastically deformed, the spring flexible portion 2360 is bent and deformed. Furthermore, the outer diameter of each of the spring end portions 2350 is formed to be substantially the same as the inner diameter of the valve mechanism insertion portion 1460, so the chances of the position of the spring member 2340 being shifted are reduced.

As shown in FIG. 36(*b*), when the ink extraction tube 1720 is inserted into the valve mechanism insertion portion 1460, the valve member 1930 is pushed in the pedestal member 660 direction (upper direction of FIG. 36(*b*)). FIG. 36(*b*) shows a state in which the ink cartridge 7 is mounted to the inkjet printer 1710 (see FIG. 26) and shows a state in which the spring flexible portion 2360 is elastically deformed. The spring flexible portion 2360 is elastically deformed alternately in directions substantially perpendicular to the extension direction (vertical direction of FIG. 36).

In addition, the ink flow path in a state in which the ink cartridge 7 is mounted to the inkjet printer 1710 is shown by arrow K. An ink flow path is formed by, in order, the cover through holes 1330 of the cover member 680, the second pedestal through holes 1150 of the pedestal member 660, the hollow internal portion of the spring member 2340, the valve through holes 1950 of the valve member 1930, and the ink extraction tube 1720.

An ink cartridge 8 is described with reference to FIG. 37. In the ink cartridge 1, the valve mechanism 530 includes the joint member 610, the valve member 620, the first spring member 630, the slider member 640, the second spring member 650, the pedestal member 660, the check valve 670, and the cover member 680. In the ink cartridge 8, a valve member 2430 is provided that does not include the slider member 640 and has a different shape. Portions of the ink cartridge 8 corresponding to same portions of the ink cartridge 1 are shown with the same symbols, so explanation thereof is omitted.

Figure 37:
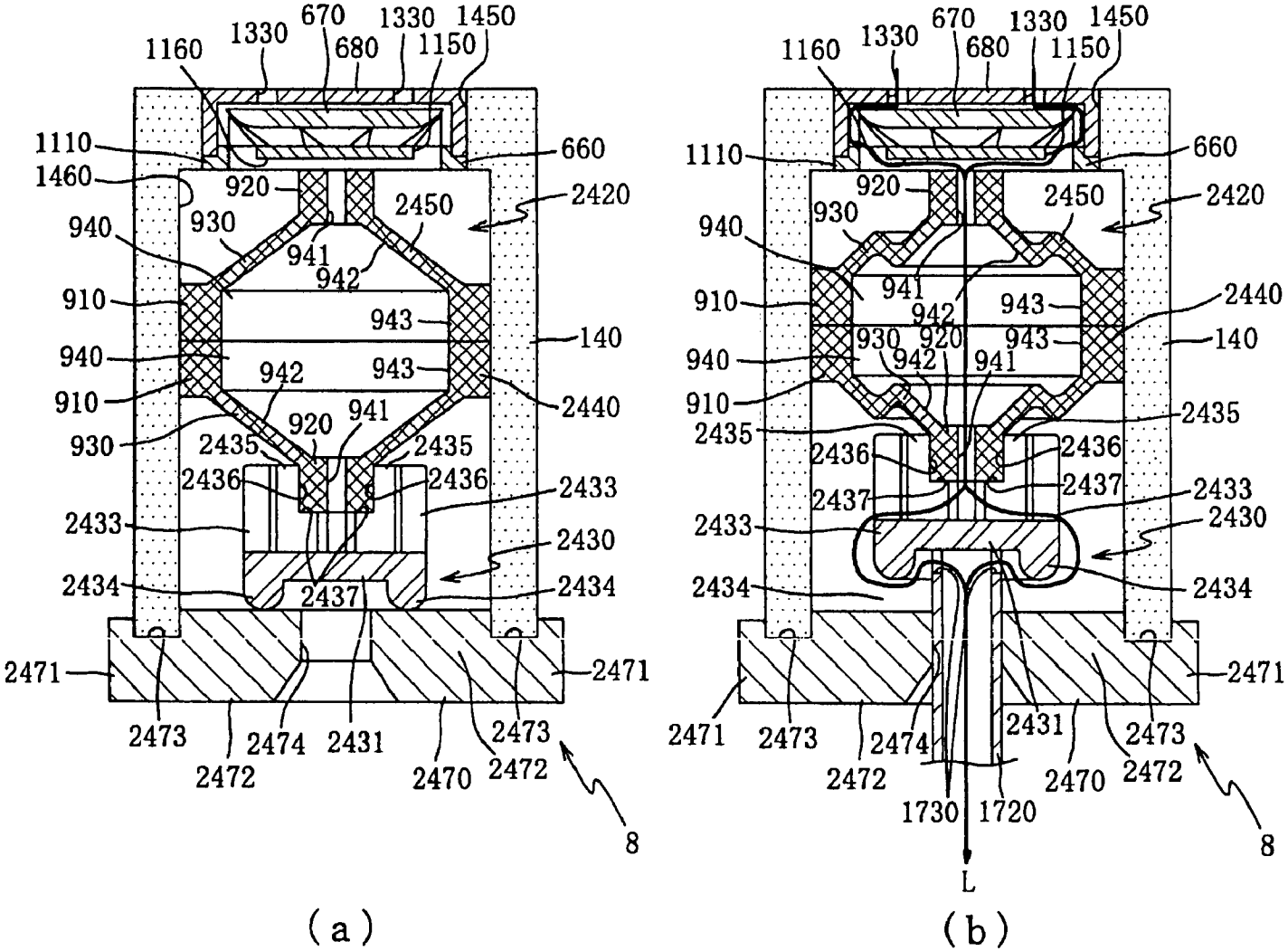
FIGS. 37(*a*) and 37(*b*) are sequential cross sectional views showing insertion of an ink supply tube into part of an ink supply portion of an exemplary ink cartridge according to the present invention.

FIG. 37 shows cross sectional views of the ink supply portion 140 of the ink cartridge 8. FIG. 37(*a*) shows a state before the ink extraction tube 1720 is inserted, and FIG. 37(*b*) shows a state after the ink extraction tube 1720 is inserted.

As shown in FIG. 37(*a*), with respect to the valve mechanism 2320 of the ink cartridge 8, between the pedestal bottom portion 1110 of the pedestal member 660 engaged with the engaging portion 1450 and the valve member 2430 that closes the ink flow path by contacting a joint member 2470, a first spring member 2440 and a second spring member 2450 are arranged, which are formed of resin material having elasticity such as rubber.

Figure 38:
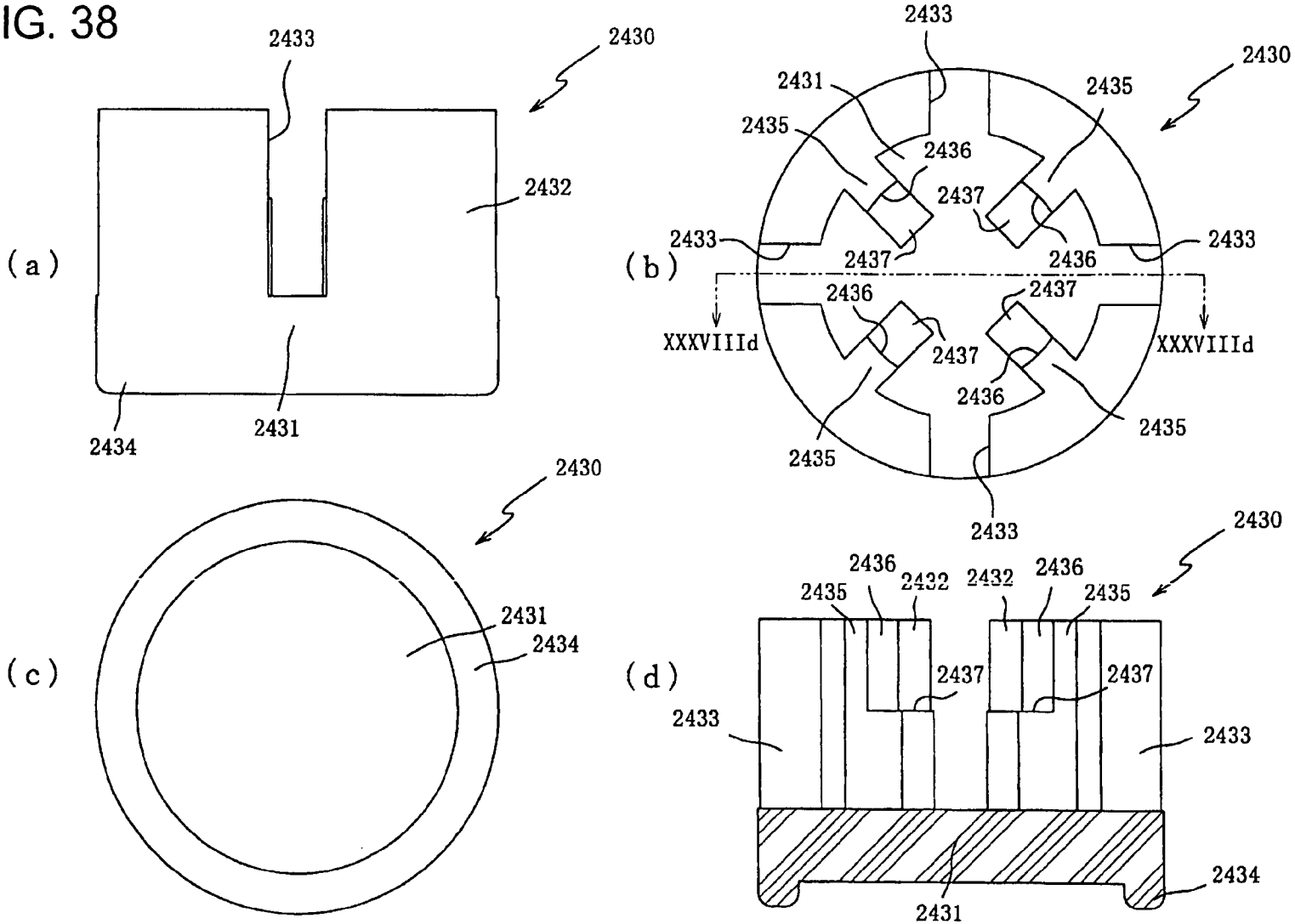
FIG. 38(*a*) is a side view of a valve member of an exemplary ink cartridge according to the present invention.

The valve member 2430 is explained with reference to FIG. 38. FIG. 38 shows the valve member 2430. FIG. 38(*a*) is a side view of the valve member 2430. FIG. 38(*b*) is a top view of the valve member 2430. FIG. 38(*c*) is a bottom view of the valve member 2430. FIG. 38(*d*) is a cross sectional view of the valve member 2430 shown in FIG. 38(*b*).

As shown in FIG. 38(*a*), the valve member 2430 includes a valve bottom portion 2431 that forms a bottom wall (lower side of FIG. 38(*a*)) of the valve member 2430, a valve outer circumferential portion 2432 that forms an outer circumferential wall of the valve member 2430, valve groove portions 2433 that extend toward the valve bottom portion 2431 from the top end surface (end surface of the top side of FIG. 38(*a*)) of the valve outer circumferential portion 2432, and a valve protruding portion 2434 that protrudes from the valve bottom portion 2431 to a side opposite from the valve outer circumferential portion 2432 (lower direction of FIG. 38(*a*)).

As shown in FIG. 38(*b*), the valve groove portions 2433 are formed at four locations of the valve outer circumferential portion 2432, and are formed at substantially identical intervals about the circumference of the valve outer circumferential portion 2432. As shown in FIG. 38(*c*), the valve protruding portions 2434 are formed on the outer edge portion of the valve bottom portion 2431. As the valve protruding portion 2434 contacts the joint member 2470 (see FIG. 37), the ink flow path is closed.

As shown in FIG. 38(*b*), valve receiving portions 2435 are formed in the valve member 2430 that protrude toward the center of the valve member 2430 from the valve outer circumferential portion 2432. The valve receiving portions 2435 are formed in intermediate positions between the valve groove portions 2433 about the circumference of the valve member 2430, and receive the first spring member 2440. The valve receiving portions 2435 receive the first spring member 2440 by contacting the spring top portion 920 of the first spring member 2440. The valve receiving portions 2435 include valve control surfaces 2436 that control shifting of the first spring member 2440 by contacting the side surface of the spring top portion 920 and valve receiving surfaces 2437 that receive the spring top portion 920 by contacting the aperture surface of the top portion flow path 941 of the spring top portion 920.

As shown in FIG. 38(*d*), with respect to the valve receiving portions 2435, the valve control surfaces 2436 are formed in a substantially intermediate position in the height direction (vertical direction of FIG. 38(*d*)) of the valve receiving portions 2435. The valve receiving surfaces 2437 are formed to be substantially parallel to the valve bottom portion 2431. Therefore, the first spring member 2440 can be received without wobbling.

Returning to FIG. 37(*a*), the joint member 2470 includes a joint outer circumferential portion 2471 that forms the outer circumferential wall of the joint member 2470 and is exposed to the outside of the ink supply portion 140, a joint inner circumferential portion 2472 that is accommodated within the ink supply portion 140, a joint engaging portion 2473 that is formed between the joint inner circumferential portion 2472 and the joint outer circumferential portion 2471 and is engaged with the outer circumferential wall of the ink supply portion 140, and a joint insertion portion 2474 that is formed in the joint inner circumferential portion 2472 and in which the ink extraction tube 1720 is inserted. The joint member 2470 is formed of an elastic material such as rubber, and the ink flow path is closed as the joint inner circumferential portion 2472 contacts the valve protruding portion 2434 of the valve member 2430.

Furthermore, the top surface of the joint inner circumferential portion 2472, which contacts the valve protruding portions 2434 of the joint inner circumferential portion 2472, is a flat surface.

As shown in FIG. 37(*a*), with respect to the valve mechanism 2420 of the ink cartridge 8, between the pedestal bottom portion 1110 of the pedestal member 660 engaged with the engaging portion 1450 and the valve member 2430 that closes the ink flow path by contacting the joint member 2470, the first spring member 2440 and the second spring member 2450 are arranged.

The first spring member 2440 of the ink cartridge 8 has the same shape (the outer shape size is different) as the first spring member 630 of the ink cartridge 1. The structure of the first spring member 2440 is mainly provided with the annular spring bottom portion 910 that forms a bottom surface (end portion with the larger diameter) of the first spring member 2440, the annular spring top portion 920 that forms a top surface (end portion with the smaller diameter) of the first spring member 2440, and the hollow conical spring flexible portion 930 that connects the spring top portion 920 and the spring bottom portion 910. The hollow conical spring flexible portion 930 is flexibly deformed when a load is applied. The ink flow path 940 is also included, includes the top portion flow path 941 that becomes the inner circumferential surface of the spring top portion 920, the flexible portion flow path 942 that becomes the inner circumferential surface of the spring flexible portion 930, and the bottom portion flow path 943 that becomes the inner circumferential surface of the spring bottom portion 910.

The second spring member 2450 has the same shape as the first spring member 2440 and includes the spring bottom portion 910, the spring top portion 920, the spring flexible portion 930, and the ink flow path 940 (top portion flow path 941, flexible portion flow path 942, and bottom portion flow path 943). The second spring member 2450 is arranged in a reverse configuration with respect to the first spring member 2440 in the vertical direction. As shown in FIG. 37(*a*), the respective spring bottom portions 910 of the first spring member 2440 and the second spring member 2450 contact each other, and the spring top portions 920 contact a respective one of the pedestal bottom portion 1110 of the pedestal member 660 and the valve receiving portions 2435 of the valve member 2430. It is also acceptable for the contact surfaces of the respective spring bottom portions 910 to be attached (e.g., welded) to each other. Furthermore, the outer diameter of each of the spring bottom portions 910 of the respective spring members 2440, 2450 is formed to be substantially the same as the inner diameter of the valve mechanism insertion portion 1460, so even if the respective spring members 2440, 2450 are deformed, the chances of the position being shifted in a direction perpendicular to the extension direction are reduced.

As shown in FIG. 37(*b*), when the ink extraction tube 1720 is inserted into the valve mechanism insertion portion 1460, the valve member 2430 is pushed in the pedestal member 660 direction (upper direction of FIG. 37(*b*)). FIG. 37(*b*) shows a state in which the ink cartridge 8 is mounted to the inkjet printer 1710 (see FIG. 26), and the spring flexible portions 930 of the first spring member 2440 and the second spring member 2450 are elastically deformed.

The ink flow path in a state in which the ink cartridge 8 is mounted to the inkjet printer 1710 is shown by arrow L. The ink flow path is formed by, in order, the cover through holes 1330 of the cover member 680, the second pedestal through holes 1150 of the pedestal member 660, ink flow paths 940 of the spring members 2440, 2450, the ink flow path of the valve groove portions 2433 of the valve member 2430, and the ink extraction tube.

An ink cartridge 9 is described with reference to FIG. 39. In the ink cartridge 8, between the pedestal member 660 that receives the check valve 670 and the valve member 2430 that closes the ink flow path by contacting the joint member 2470, the first spring member 2440 and the second spring member 2450 are provided. In the ink cartridge 9, a spring member 2540 is provided between the pedestal member 660 and the valve member 2430. Portions of the ink cartridge 9 corresponding to same portions of the ink cartridge 8 are shown with the same symbols, so explanation thereof is omitted.

Figure 39:
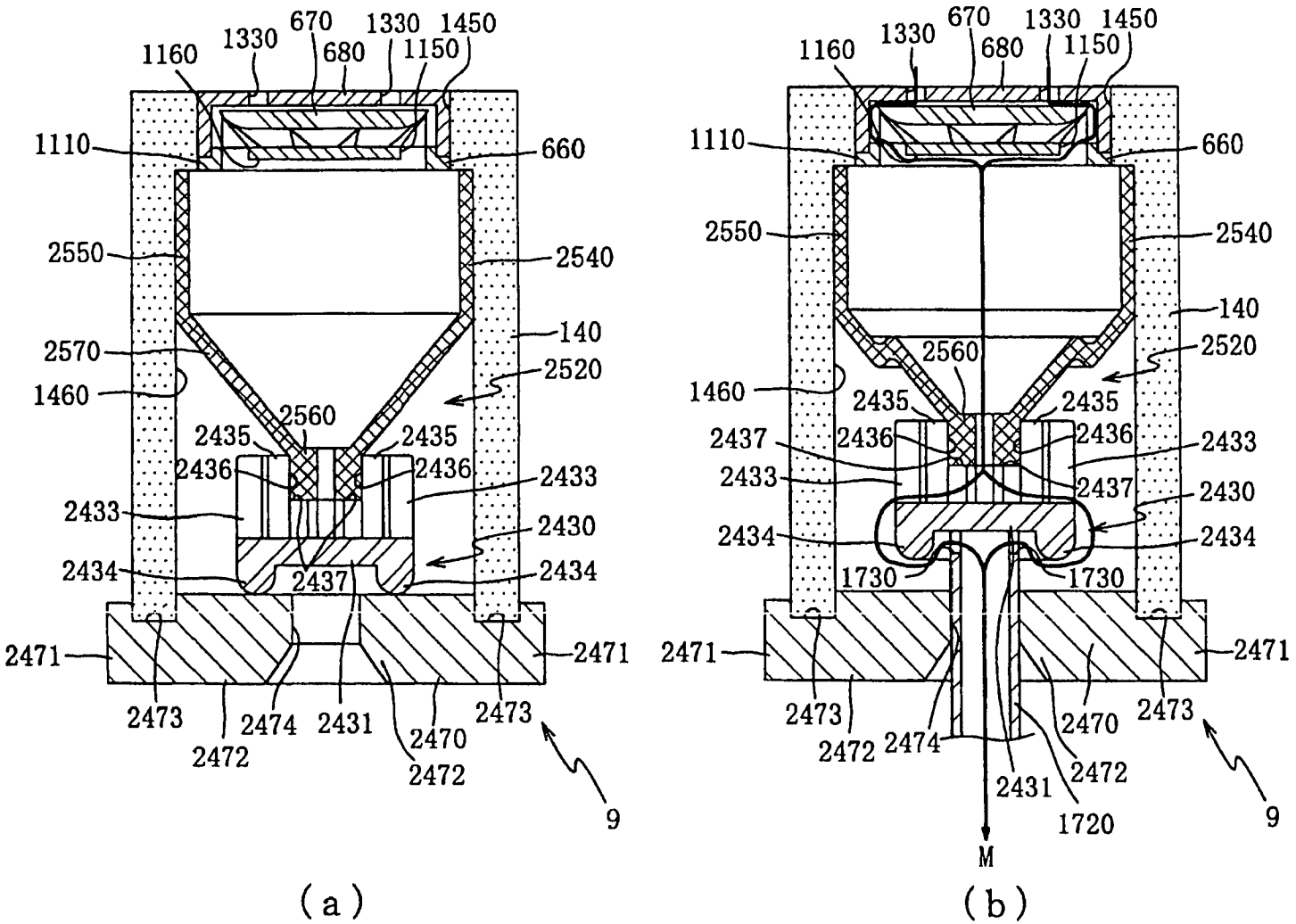
FIGS. 39(*a*) and 39(*b*) are sequential cross sectional views showing insertion of an ink supply tube into part of an ink supply portion of an exemplary ink cartridge according to the present invention.

FIG. 39 shows cross sectional views of the ink supply portion 140 of the ink cartridge 9. FIG. 39(*a*) shows a state before the ink extraction tube 1720 is inserted, and FIG. 39(*b*) shows a state after the ink extraction tube 1720 is inserted.

As shown in FIG. 39(*a*), with respect to the valve mechanism 2520 of the ink cartridge 9, between the pedestal bottom portion 1110 of the pedestal member 660 engaged with the engaging portion 1450 and the valve member 2430 that closes the ink flow path by contacting the joint member 2470, the spring member 2540 is arranged. The spring member 2540 is formed of resin material with elasticity such as rubber.

The spring member 2540 is provided with a spring cylindrical portion 2550 that is formed in a substantially cylindrical shape, a spring end portion 2560 with a diameter smaller than that of the spring cylindrical portion 2550 that contacts the valve receiving portions 2435 of the valve member 2430, and a hollow conical spring flexible portion 2570 that connects the spring end portion 2560 and the spring cylindrical portion 2550 and is flexibly deformed when a load is applied. The spring cylindrical portion 2550 contacts the inner circumferential surface of the valve mechanism insertion portion 1460, so elastic deformation in the outer diameter direction is restricted. As a result, the spring flexible portion 2570 is elastically deformed.

As shown in FIG. 39(*b*), when the ink extraction tube 1720 is inserted to the valve mechanism insertion portion 1460, the valve member 2430 is pushed in the pedestal member 660 direction (upper direction of FIG. 36(*b*)). FIG. 39(*b*) shows a state in which the ink cartridge 9 is mounted to the inkjet printer 1710 (see FIG. 26), and the spring flexible portion 2570 is elastically deformed.

Furthermore, the ink flow path in a state in which the ink cartridge 9 is mounted to the inkjet printer 1710 is shown by arrow M. The ink flow path is formed by, in order, the ink flow path of the cover through holes 1330 of the cover member 680, the second pedestal through holes 1150 of the pedestal member 660, the hollow internal portion of the spring member 2540, the valve groove portions 2433 of the valve member 2430, and the ink extraction tube 1720.

An ink cartridge 10 is described with reference to FIG. 40. In the ink cartridge 8, between the pedestal member 660 that supports the check valve 670 and the valve member 2430 that closes the ink flow path by contacting the joint member 2470, the first spring member 2440 and the second spring member 2450 are provided. In the ink cartridge 10, by contrast, between the pedestal member 660 and the valve member 2430, a first spring member 2640 and a second spring member 2650 are provided, which are formed of resin materials having elasticity, such as rubber, formed in a substantially hollow hemispherical shape. Portions of the ink cartridge 10 corresponding to same portions of the ink cartridge 8 are shown with the same symbols, so explanation thereof is omitted.

Figure 40:
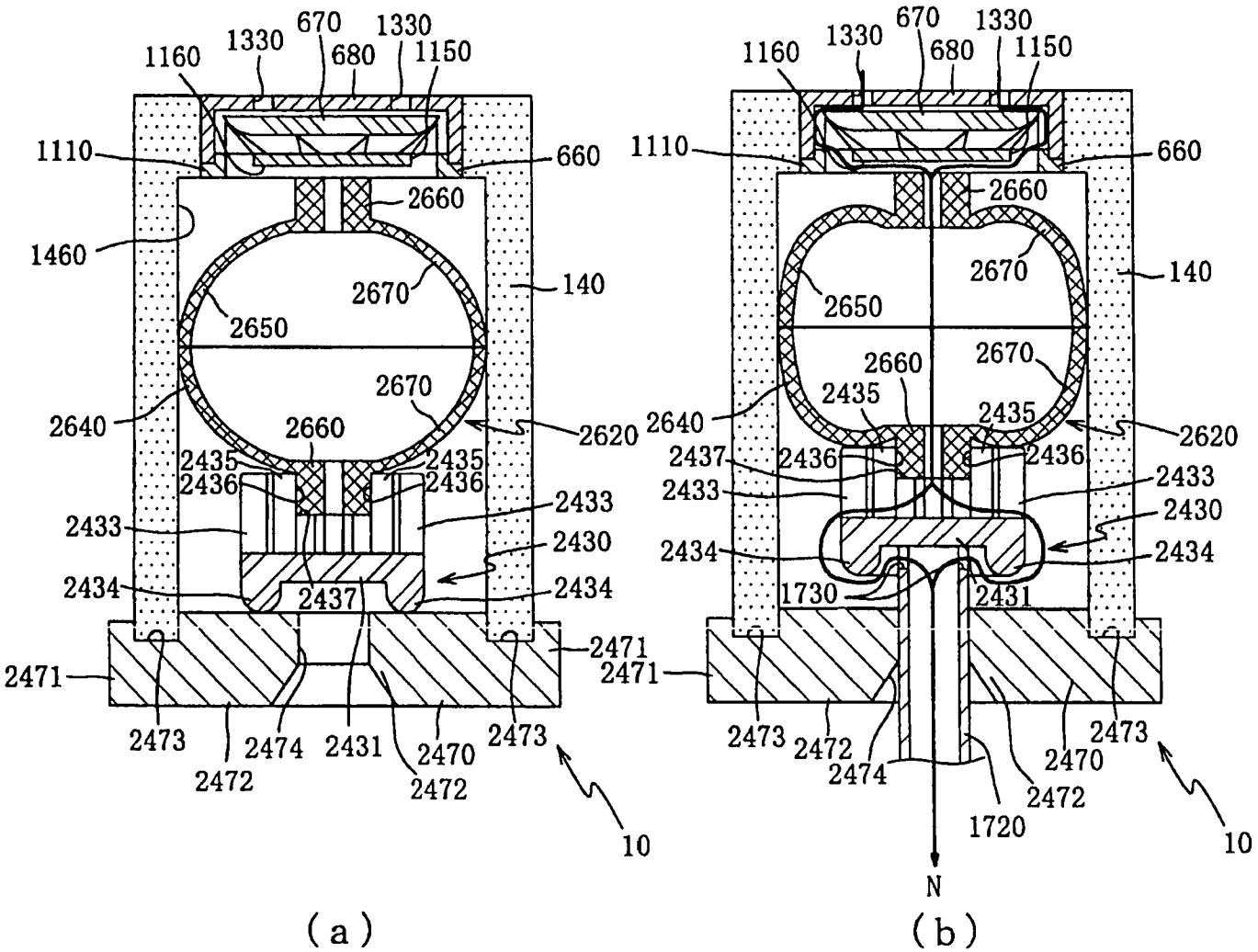
FIGS. 40(*a*) and 40(*b*) are sequential cross sectional views showing insertion of an ink supply tube into part of an ink supply portion of an exemplary ink cartridge according to the present invention.

FIG. 40 shows cross sectional views of the ink supply portion 140 of the ink cartridge 10. FIG. 40(*a*) shows a state before the ink extraction tube 1720 is inserted, and FIG. 40(*b*) shows a state after the ink extraction tube 1720 is inserted.

As shown in FIG. 40(*a*), with respect to a valve mechanism 2620 of the ink cartridge 10, between the pedestal bottom portion 1110 of the pedestal member 660 engaged with the engaging portion 1450 and the valve member 2430 that closes the ink flow path by contacting the joint member 2470, the first spring member 2640 and the second spring member 2650 are arranged, which are formed in a substantially hollow hemispherical shape.

The first spring member 2640 is provided with a spring end portion 2660 that contacts the valve receiving portions 2435 of the valve member 2430, and a spring flexible portion 2670 that has a substantially hollow hemispherical shape extending in the diameter direction from the spring end portion 2660. The second spring member 2650 is formed in the same shape as the first spring member 2640, and is provided with the spring end portion 2660 and the spring flexible portion 2670. The aperture portions of the spring flexible portion 2670 of the first and second spring member 2640, 2650 contact each other without any gap. The aperture portions of the spring flexible portion 2670 of the first and second spring members 2640, 2650 can also be connected to each other by an adhesive (e.g., by welding).

As shown in FIG. 40(*b*), when the ink extraction tube 1720 is inserted into the valve mechanism insertion portion 1460, the valve member 2430 is pressed in the direction of the pedestal member 660 (upward direction in FIG. 40(*b*)). FIG. 40(*b*) shows a state in which the ink cartridge 10 is mounted to the inkjet printer 1710 (see FIG. 26), and the respective spring flexible portion 2670 of the respective spring members 2640, 2650 is elastically deformed.

The ink flow path in a state in which the ink cartridge 10 is mounted to the inkjet printer 1710 is shown by arrow N. The ink flow path is formed by, in order, the cover through holes 1330 of the cover member 680, the second pedestal through holes 1150 of the pedestal member 660, the respective spring members 2640, 2650, the valve groove portions 2433 of the valve member 2430, and the ink extraction tube 1720.

An ink cartridge 11 is described with reference to FIG. 41. In the ink cartridge 8, between the pedestal member 660 that receives the check valve 670 and the valve member 2430 that closes the ink flow path by contacting the joint member 2470, the first spring member 2440 and the second spring member 2450 are provided. In the ink cartridge 11, by contrast, between the pedestal member 660 and the valve member 2430, a spring member 2740 and a slider member 2780 that operates in conjunction with the spring member 2740 are provided. Portions of the ink cartridge 11 corresponding to same portions of the ink cartridge 8 are shown with the same symbols, so explanation thereof is omitted.

Figure 41:
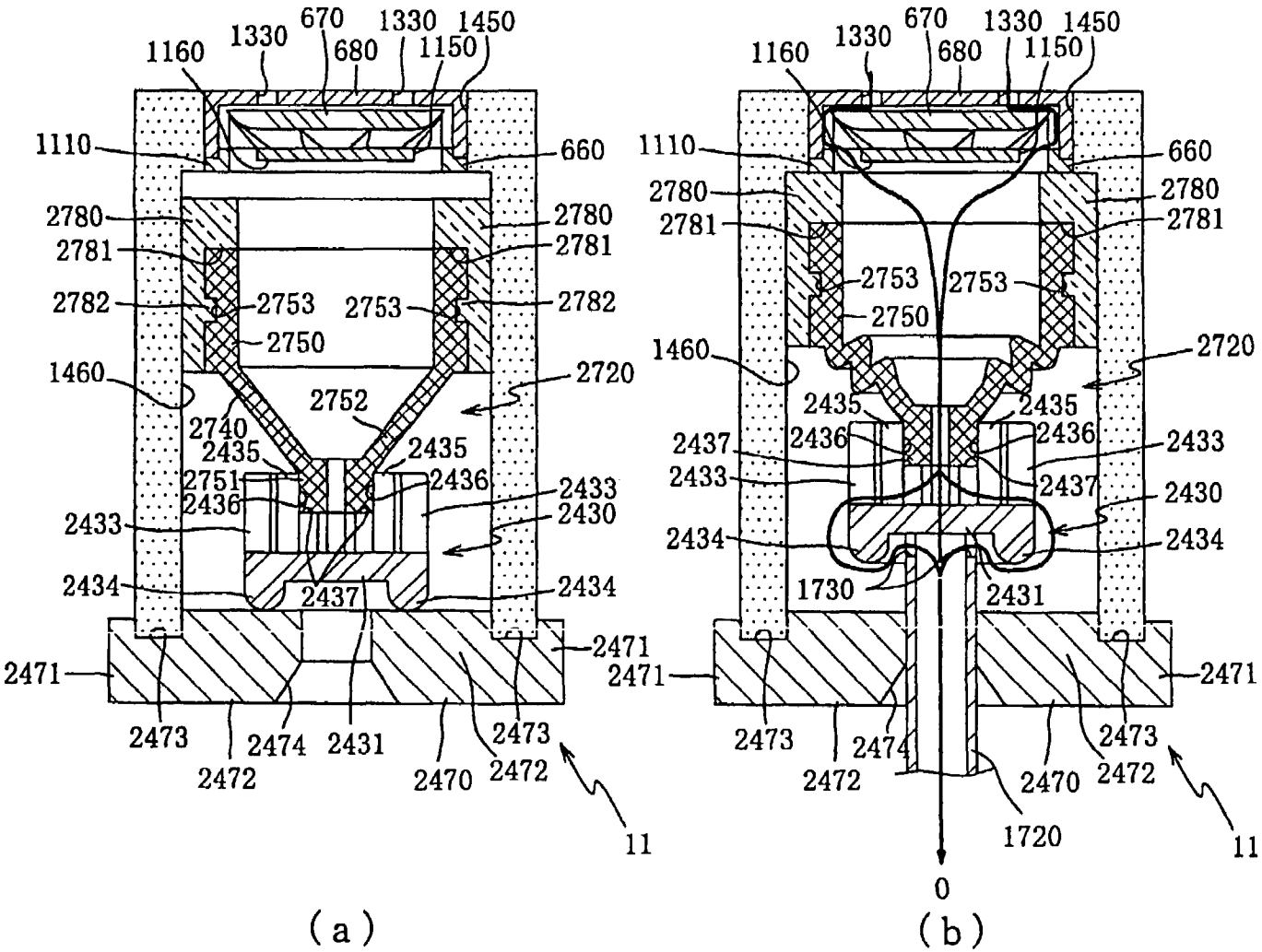
FIGS. 41(*a*) and 41(*b*) are sequential cross sectional views showing insertion of an ink supply tube into part of an ink supply portion of an exemplary ink cartridge according to the present invention.

FIG. 41 shows cross sectional views of the ink supply portion 140 of the ink cartridge 11. FIG. 41(*a*) shows a state before the ink extraction tube 1720 is inserted, and FIG. 41(*b*) shows a state after the ink extraction tube 1720 is inserted.

As shown in FIG. 41(*a*), with respect to the valve mechanism 2720 of the ink cartridge 11, between the pedestal bottom portion 1110 of the pedestal member 660 engaged with the engaging portion 1450 and the valve member 2430 that closes the ink flow path by contacting the joint member 2470, the spring member 2740 formed of resin material with elasticity such as rubber, and the slider member 2780 that is connected to the spring member 2740 and restricts movement of the spring member 2740 in the extension direction (vertical direction of FIG. 41(*a*)), are arranged.

The spring member 2740 is provided with a spring cylindrical portion 2750 that is formed in a substantially cylindrical shape, a spring end portion 2751 that contacts the valve receiving portions 2435 of the valve member 2430, a spring flexible portion 2752 that connects the spring end portion 2751 and the spring cylindrical portion 2750 and is flexibly deformed when a load is applied, and a spring groove portion 2753 that is formed in a concave shape in order to be engagingly fixed to the slider member 2780. Though not depicted, the spring groove portion 2753 is formed over the outer circumferential surface of the spring cylindrical portion 2750. Additionally, the spring cylindrical portion 2750 is formed to be thicker than the spring flexible portion 2752, so the strength of the cylindrical portion 2750 is increased and the spring flexible portion 2752 is flexibly deformed.

The slider member 2780 is formed in a substantially round shape and is provided at its inner circumferential surface with a slider mounting portion 2781 in which the spring member 2740 is mounted. A slider convex portion 2782 is formed in a convex shape in the slider mounting portion 2781 and is engaged with the spring groove portion 2753. Though not depicted, the slider mounting portion 2781 and the slider convex portion 2782 are formed over the inner circumferential surface of the slider member 2780. Therefore, the slider convex portion 2782 is engaged with the spring groove portion 2753, and the slider member 2780 is fixed to the spring member 2740. The slider member 2780 is formed of resin material harder than that of the spring member 2740. Thus, when the ink extraction tube 1720 is inserted, the spring member 2740 is flexibly deformed without having the slider member 2780 deformed. In addition, the outer diameter of the slide member 2780 is formed to be substantially the same as the inner diameter of the valve mechanism insertion portion 1460, so that shifting of the slider member 2780 from the moving direction can be prevented.

As shown in FIG. 41(*b*), when the ink extraction tube 1720 is inserted to the valve mechanism insertion portion 1460, the valve member 2430 is pushed in the pedestal member 660 direction (upper direction of FIG. 36(*b*)). FIG. 41(*b*) shows a state in which the ink cartridge 11 is mounted to the inkjet printer 1710 (see FIG. 26) and in which the spring flexible portion 2752 is elastically deformed. With respect to the operation of the valve mechanism 2720, when the ink extraction tube 1720 is inserted, the slider member 2780 is moved in the direction of the pedestal member 660 (upward direction in FIG. 41(*b*)). When the slider member 2780 and the pedestal member 660 come into contact, movement of the slider member 2780 (spring member 2740) is restricted. When the ink extraction tube 1720 is further inserted, the spring flexible portion 2752 is elastically deformed. Thus, the slider member 2780 permits the ink extraction tube 1720 to be smoothly inserted.

The ink flow path in a state in which the ink cartridge 11 is mounted to the inkjet printer 1710 is shown by arrow O. The ink flow path is formed by, in order, the ink flow path of the cover through holes 1330 of the cover member 680, the second pedestal through holes 1150 of the pedestal member 660, the inside of the spring member 2740, the valve groove portions 2433 of the valve member 2430, and the ink extraction tube 1720.

An ink cartridge 12 is described with reference to FIG. 42. In the ink cartridge 8, between the pedestal member 660 that receives the check valve 670 and the valve member 2430 that seal ink flow path by contacting the joint member 2470, a first spring member 2440 and a second spring member 2450 are provided, which are formed of resin material having elasticity, such as rubber. In the ink cartridge 12, by contrast, between the pedestal member 660 and the valve member 2430, a first spring member 2840, a second spring member 2850, and a slider member 2880 that is sandwiched and operated by the first and second spring members 2840, 2850, are provided. Portions of the ink cartridge 12 corresponding to same portions of the ink cartridge 8 are shown with the same symbols, so explanation thereof is omitted.

Figure 42:
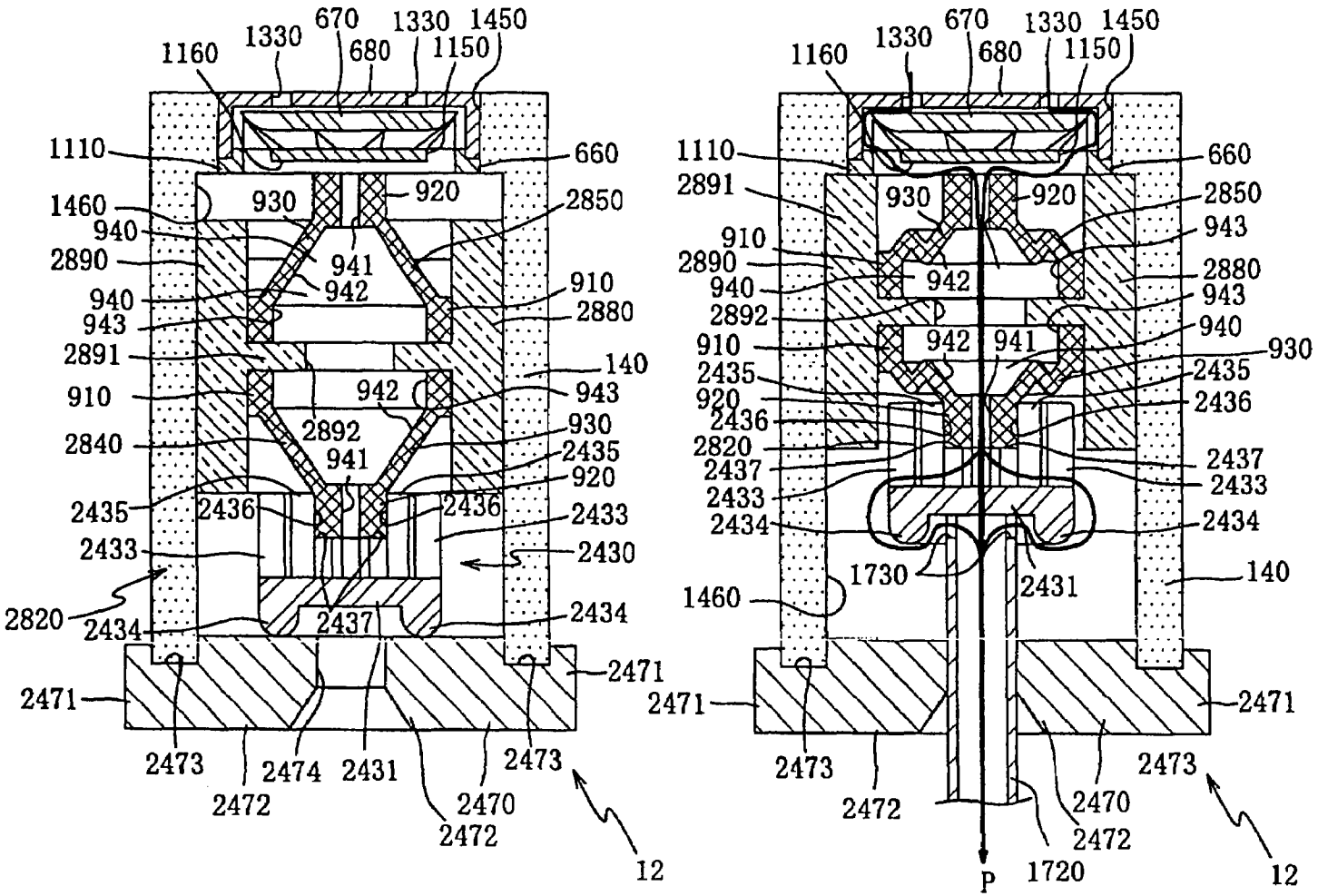
FIGS. 42(*a*) and 42(*b*) are sequential cross sectional views showing insertion of an ink supply tube into part of an ink supply portion of an exemplary ink cartridge according to the present invention.

FIG. 42 shows cross sectional views of the ink supply portion 140 of the ink cartridge 12. FIG. 42(*a*) shows a state before the ink extraction tube 1720 is inserted, and FIG. 42(*b*) shows a state after the ink extraction tube 1720 is inserted.

As shown in FIG. 42(*a*), between the pedestal bottom portion 1110 of the pedestal member 660 engaged with the engaging portion 1450 and the valve member 2430 that closes the ink flow path by contacting the joint member 2470, a valve mechanism 2820 of the ink cartridge 12 is provided. The valve mechanism 2820 includes the first spring member 2840, the second spring member 2850, and the slider member 2880, which is arranged between the second spring member 2850 and the first spring member 2840, accommodates part of the respective spring members 2840, 2850, and is moved in conjunction with the respective spring members 2840, 2850.

The first spring member 2840 is formed in the same shape (the outer shape size is different) as the first spring member 630 of the ink cartridge 12. Therefore, the structure of the first spring member 2840 is mainly provided with an annular spring bottom portion 910 that forms a bottom surface (end portion with the larger diameter) of the first spring member 2840, an annular spring top portion 920 that is formed having a diameter smaller than the diameter of the spring bottom portion 910 and that forms the top surface (end portion with a smaller diameter) of the first spring member 2840, and a hollow conical spring flexible portion 930 connects the spring top portion 920 and the spring bottom portion 910 and is flexibly deformed when a load is applied. Furthermore, an ink flow path 940 is provided, which includes a top portion flow path 941 formed by the inner circumferential surface of the spring top portion 920, a flexible portion flow path 942 formed by the inner circumferential surface of the spring flexible portion 930, and a bottom portion flow path 943 formed by the inner circumferential surface of the spring bottom portion 910.

The second spring member 2850 is formed in the same shape as the first spring member 2840 and includes the spring bottom portion 910, the spring top portion 920, the spring flexible portion 930, and the ink flow path 940 (top portion flow path 941, flexible portion flow path 942, and bottom portion flow path 943). The second spring member 2850 is arranged in a reverse configuration with respect to the first spring member 2840 in the vertical direction.

The slider member 2880 is provided with a cylindrical slider outer circumferential portion 2890 that forms an outer wall of the slider member 2880, a slider intermediate wall 2891 that contacts the spring bottom portions 910 of the first spring member 2840 and of the second spring member 2850, and a slider through hole 2892 that is formed through the slider intermediate wall 2891 and becomes the ink flow path. Furthermore, the inner diameter of the slider outer circumferential portions 2890 is substantially the same as the outer diameter of the spring bottom portions 910 of the respective spring members 2840, 2850, so shifting of the arrangement of the respective spring members 2840, 2850 can be prevented. The outer diameter of the slider member 2880 is formed to be substantially the same as the inner diameter of the valve mechanism insertion portion 1460, so shifting of the slider member 2880 from the moving direction can be prevented. The slider member 2880 is formed of resin material harder than that of the respective spring members 2840, 2850. Therefore, when the ink extraction tube 1720 is inserted, the respective spring members 2840, 2850 are flexibly deformed without deforming the slider member 2880.

As shown in FIG. 42(*a*), the respective spring bottom portions 910 of the first spring member 2840 and the second spring member 2850 contact the slider intermediate wall 2891. At the same time, the respective spring top portions 920 are arranged so as to contact the pedestal bottom portion 1110 of the pedestal member 660 and the valve receiving portions 2435 of the valve member 2430.

As shown in FIG. 42(*b*), if the ink extraction tube 1720 is inserted to the valve mechanism insertion portion 1460, the valve member 2430 is pressed in the pedestal member 660 direction (upward direction in FIG. 36(*b*)). FIG. 42(*b*) shows a state in which the ink cartridge 12 is mounted to the inkjet printer 1710 (see FIG. 26) and in which the spring flexible portions 930 are elastically deformed.

With respect to operation of the valve mechanism 2820, when the ink extraction tube 1720 is inserted, the slider member 2880 is moved in the pedestal member 660 direction (upward direction in FIG. 42(*b*)), the slider member 2880 contacts the pedestal member 660, and movement of the slider member 2880 is restricted. Instead of contacting the pedestal member 660, movement of the slider member 2880 can also be restricted by contacting the end surface of the inner wall of the ink supply portion 140. Then, when the ink extraction tube 1720 is further inserted, the spring flexible portions 930 of the spring members 2840, 2850 are elastically deformed. The slider member 2880 permits the ink extraction tube 1720 to be smoothly inserted. Also, movement is restricted by the slider member 2880, so extreme deformation of the second spring member 2850 can be prevented. Because extreme deformation of the second spring member 2850 that would prevent it from being returned to its original state can be prevented, and ink leakage can be prevented.

The ink flow path in a state in which the ink cartridge 12 is mounted to the inkjet printer 1710 is shown by arrow P. The ink flow path is formed by, in order, the cover through holes 1330 of the cover member 680, the second pedestal through holes 1150 of the pedestal member 660, the ink flow path 940 the second spring member 2850, the slider through hole 2892 of the slider member 2880, the ink flow path 940 of the first spring member 2840, the valve groove portions 2433 of the valve member 2430, and the ink extraction tube 1720.

An ink cartridge 13 is described with reference to FIG. 43. In the ink cartridge 1, the ink insertion plug 520 is pressed by the case protruding member 260, the frame 100 is supported with respect to the case 200 by the ink supply portion 140 and the ink insertion portion 130, and external vibration transmitted to the frame 100 is reduced. Meanwhile, in the ink cartridge 13, a portion other than the ink insertion portion 130 of the frame 100 is pressed by a case protruding member 3220, to control external vibration. Portions of the ink cartridge 13 corresponding to same portions of the ink cartridge 1 are shown with the same symbols, so explanation thereof is omitted.

Figure 43:
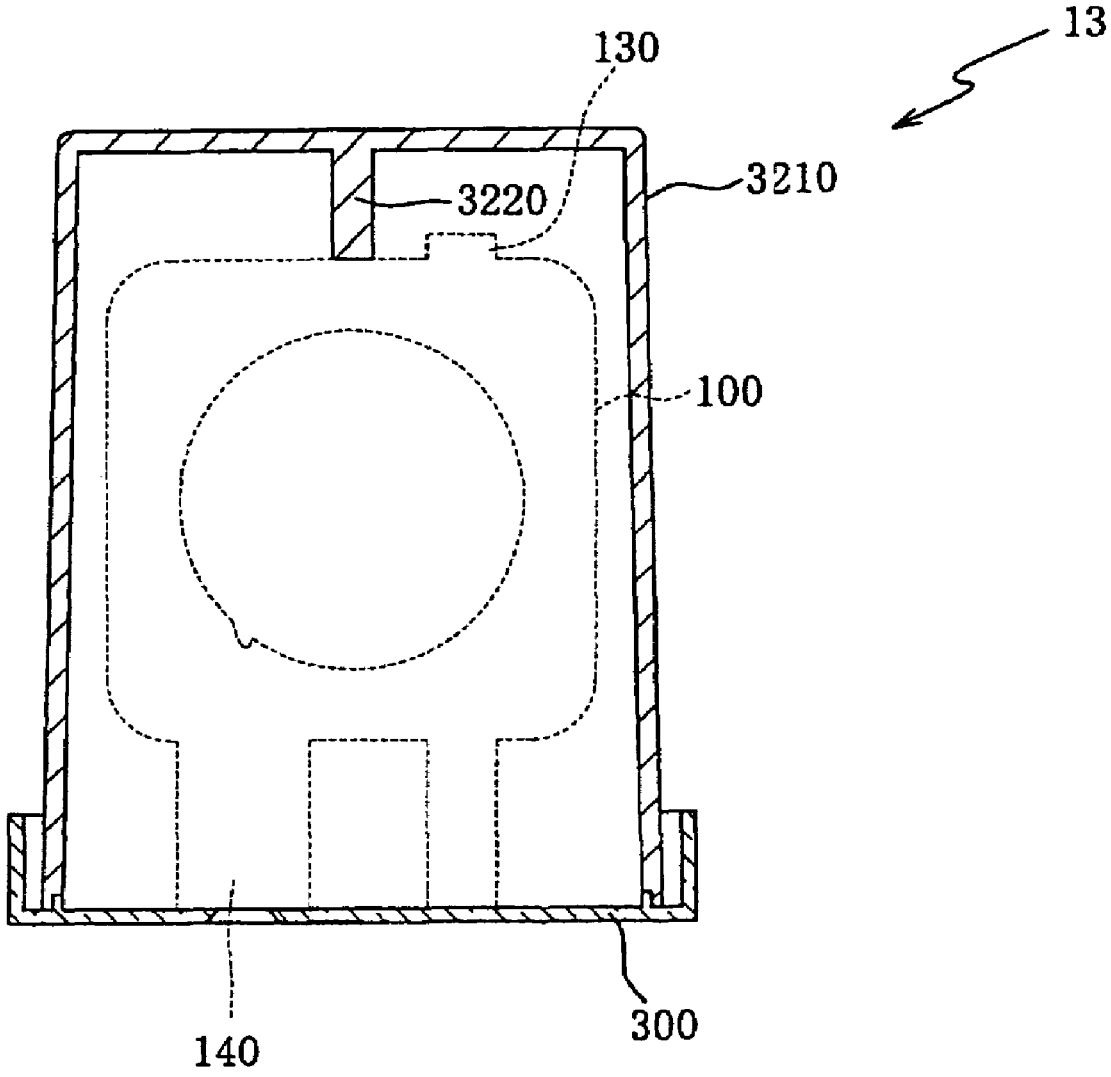
FIG. 43 is a schematic cross sectional view of an exemplary ink cartridge according to the present invention.

FIG. 43 is a schematic cross sectional view of the ink cartridge 13. In FIG. 43, the frame 100 is shown with dotted lines, and a case 3210 and the cap 300 are shown with solid lines.

As shown in FIG. 43, the case 3210 of the ink cartridge 13 is provided with the case protruding member 3220 protruding toward the cap 300 side (lower side of FIG. 43) from the ceiling wall of the case 3210. The case protruding member 3220 is formed in a substantially central portion of the ceiling wall of the case 3210.

The case protruding member 3220 presses the frame 100 toward the cap 300 side by contacting a portion other than the ink insertion portion 130 of the frame 100 in a state in which the case 3210 and the cap 300 are welded. Therefore, the chances of the frame 100 being moved by vibration or the like can be reduced. In addition, the case protruding member 3220 is formed in a substantially central portion of the ceiling wall of the case 3210, so the center position, in the horizontal direction (horizontal direction of FIG. 43) of the frame 100, is pressed. Thus, the frame 100 is stable in a pressed state, and movement of the frame 100 can be further reduced.

Additionally, with respect to the ink cartridge 13, at the time of manufacturing the frame 100 (see FIG. 22(*c*)), the ink insertion plug 520 to be pressed into the ink insertion portion 130 is pressed so as to contact the end surface of the deepest part of the insertion inner circumferential portion 131 opposite to the aperture of the ink insertion portion 130, after ink is inserted.

An ink cartridge 14 is described with reference to FIG. 44. In the ink cartridge 1, the ink insertion plug 520 is pressed by the case protruding member 260, the frame 100 is supported with respect to the case 200 by the ink supply portion 140 and the ink insertion portion 130, and external vibration to be transmitted to the frame 100 can be reduced. In the ink cartridge 14, by contrast, a case protruding member 3320 formed in a case 3310 presses a frame receiving portion 3340 formed in the frame 3330, instead of the ink insertion portion 130, so external vibration transmitted to the frame 3330 can be reduced. Portions of the ink cartridge 14 corresponding to same portions of the ink cartridge 1 are shown with the same symbols, so explanation thereof is omitted.

Figure 44:
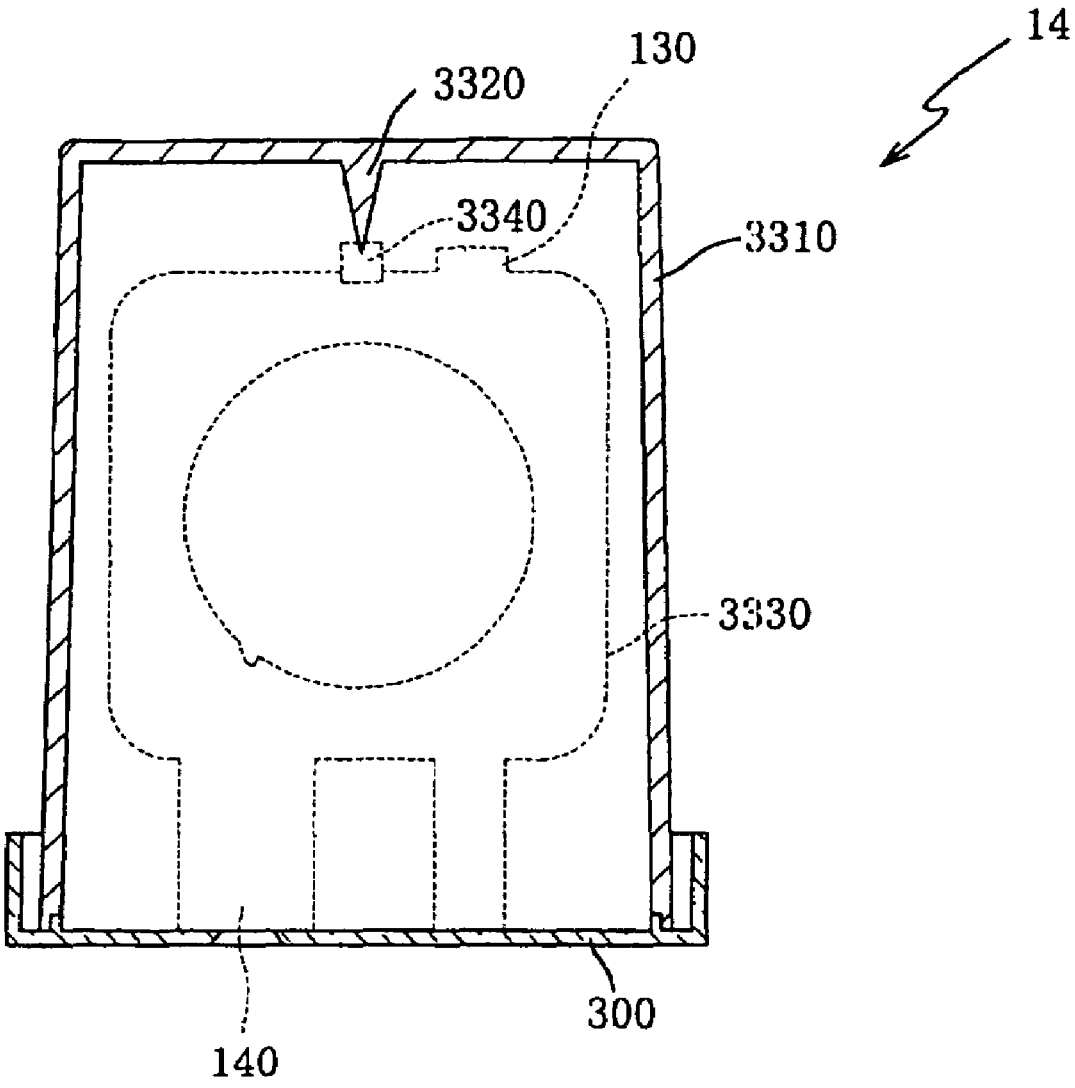
FIG. 44 is a schematic cross sectional view of an exemplary ink cartridge according to the present invention.

FIG. 44 is a schematic cross sectional view of the ink cartridge 14. In FIG. 44, the frame 100 is shown by dotted lines, and the case 3310 and the cap 300 are shown by solid lines.

As shown in FIG. 44, the case 3310 of the ink cartridge 14 protrudes toward the cap 300 side (lower side of FIG. 44) from the ceiling wall of the case 3310, and the case protruding member 3320 is provided, which is formed in a substantially center portion of the ceiling wall of the case 3310. With respect to the case protruding member 3320, the tip end is formed to be sharpened. The frame 3330 is provided with the frame receiving portion 3340 formed of an elastic material in a position corresponding to the case protruding member 3320 and different from a position in which the ink insertion portion 130 is formed. When the case 3310 and the cap 300 are welded, the case protruding member 3320 pierces into the frame receiving portion 3340, and presses the frame 3330 toward the cap 300 side.

Therefore, in the same manner as in the ink cartridge 1, even if a shock is applied to the case 3310, the shock is moderated as it is transmitted to the frame 3330, so the frame 3330 can be protected from the external shock. Furthermore, the case protruding member 3320 is formed in a substantially central portion of the ceiling wall of the case 3310. Thus, it pierces into the center position of the frame 3330 in the horizontal direction (horizontal direction of FIG. 44), so the frame 3330 is stabilized in a pressed state.

Additionally, in the ink cartridge 14, at the time of manufacturing the frame 3330 (see FIG. 22(*c*)), after ink is inserted, the ink insertion plug 520 to be pressed into the ink insertion portion 130 is pressed so as to contact the end surface of the deepest part of the insertion inner circumferential portion 131 opposite to the aperture of the ink insertion portion 130.

An ink cartridge 15 is described with reference to FIG. 45. In the ink cartridge 1, the check valve 670 is formed to a substantially plate shape. In the ink cartridge 15, by contrast, a check valve 3430 is provided with a plate-shaped portion and a shaft portion. Portions of the ink cartridge 15 corresponding to same portions of the ink cartridge 1 are shown with the same symbols, so explanation thereof is omitted.

Figure 45:
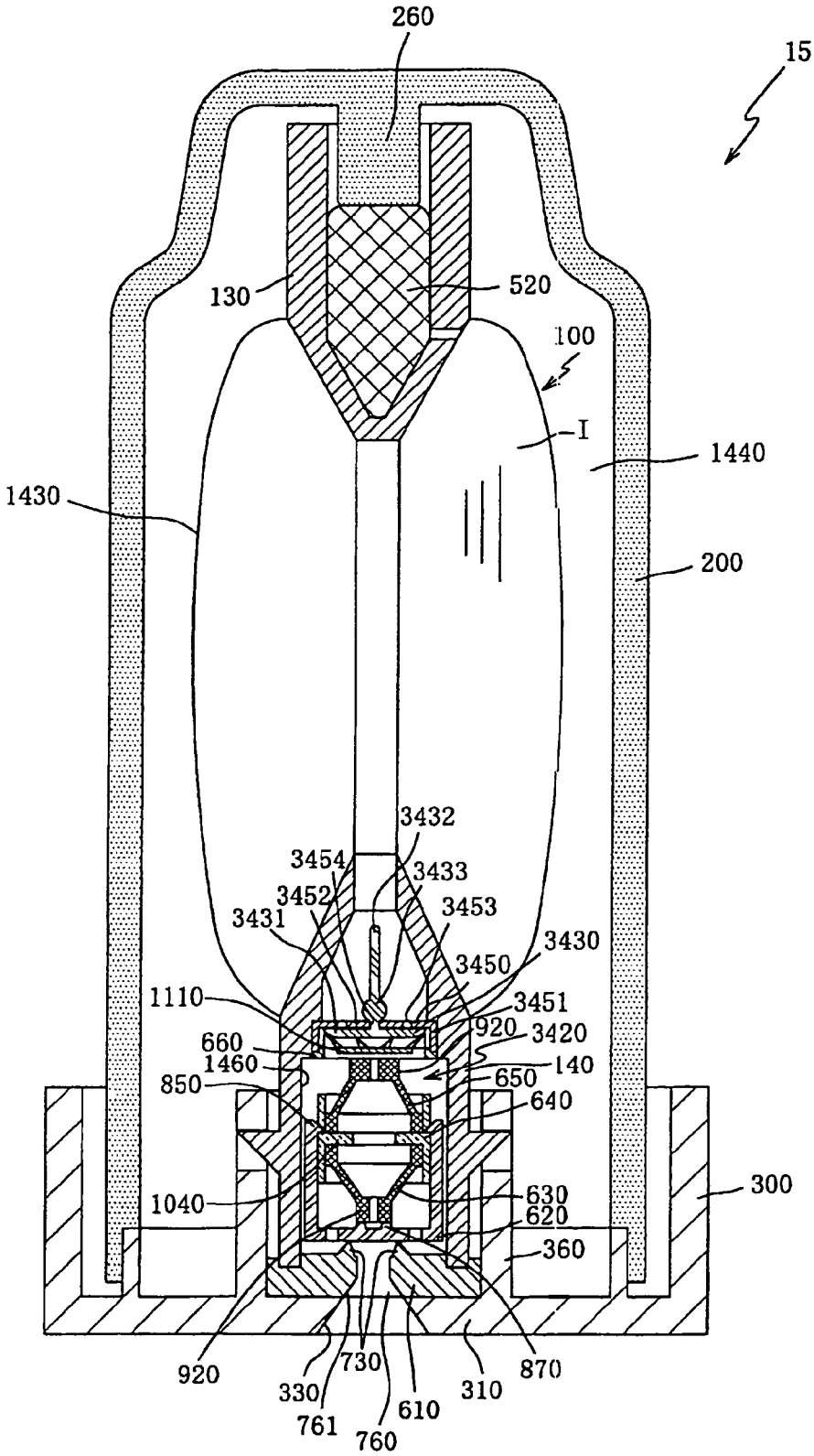
FIG. 45 is a cross sectional view of an exemplary ink cartridge according to the present invention.

FIG. 45 is a cross sectional view of the ink cartridge 15.

A valve mechanism 3420 of the ink cartridge 15 is provided with the joint member 610, the valve member 620, the first spring member 630, the slider member 640, the second spring member 650, and the pedestal member 660 that have the same shape as in the ink cartridge 1. The valve mechanism 3420 is further provided with a check valve 3430 and a cover member 3450.

The check valve 3430 is provided with a check valve plate portion 3431 that is formed in a substantially plate shape, a check valve shaft portion 3432 that is formed in a substantially bar shape, and a check valve ball portion 3433 that is located in the vicinity of the cover member 3450 of the check valve shaft portion 3432 and is formed in a substantially spherical shape.

The cover member 3450 is provided with a cover outer circumferential wall 3451 that forms an outer circumferential wall of the cover member 3450, a cover top portion 3452 that forms a top portion of the cover member 3450, first cover through holes 3453 that are formed in the vicinity of the outer edge of the cover top portion 3452 and form an ink flow path, and a second cover through hole 3454, formed at the axis position of the cover top portion 3452, in which the check valve shaft portion 3432 is inserted. Furthermore, the diameter of the second cover through hole 3454 is larger than the diameter of the check valve shaft portion 3432, and is formed to be smaller than the diameter of the check valve ball portion 3433. Therefore, after the check valve shaft portion 3432 goes through the second cover through hole 3454, the check valve 3430 does not slip from the cover member 3450, so at the time of manufacturing the valve mechanism 3420, the chances of losing the check valve 3430 can be reduced.

Furthermore, in the ink cartridge 15, the check valve shaft portion 3432 of the check valve 3430 is arranged within the ink flow path 1410. Both the check valve shaft portion 3432 of the check valve 3430 and the filter 1420 may be arranged within the ink flow path 1410, however.

An ink cartridge 16 is described with reference to FIG. 46. The ink cartridge 1 is mounted to the inkjet printer 1710 (see FIG. 26) by a pair of clamp members 1740. The ink cartridge 16, by contrast, is mounted using one clamp member 3543, and the ink cartridge 16 is detached by a clamp releasing member 3544.

Figure 46:
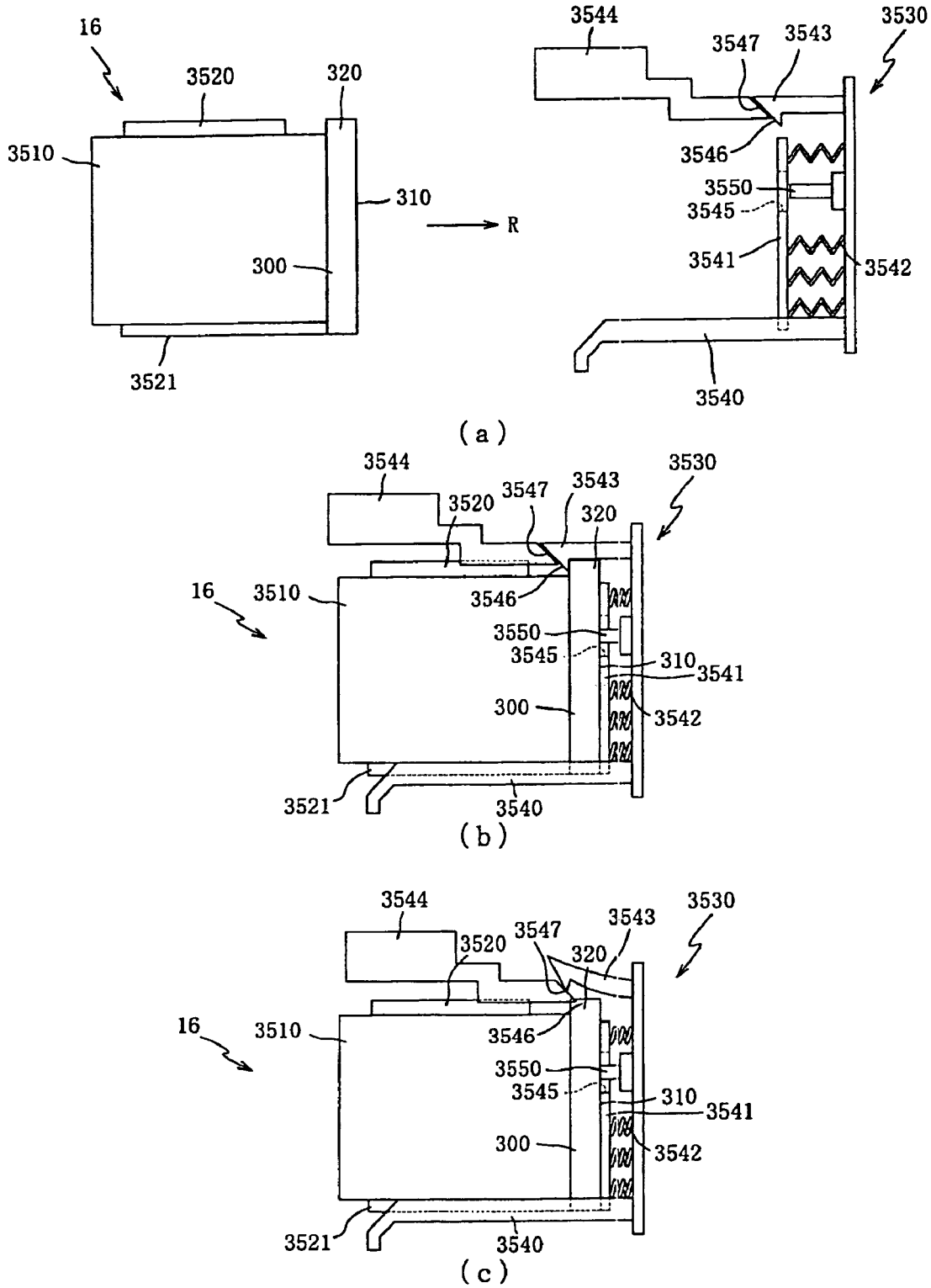
FIGS. 46(*a*)-46(*c*) are sequential side views showing mounting of an exemplary ink cartridge according to the present invention to a mounting portion of an inkjet printer.

FIG. 46 is a side view showing a process of mounting the ink cartridge 16 to a mounting portion 3530.

As shown in FIG. 46(*a*), with respect to the ink cartridge 16, on a pair of side surfaces opposite to a case 3510, case protruding portions 3520, 3521 are respectively formed. The lengths of these case protruding portions 3520, 3521 in the direction (arrow R of FIG. 46) of mounting the ink cartridge 16 are different. The case protruding portions 3520, 3521 protrude to the same position as the cap sidewall 320 of the cap 300 in a direction substantially perpendicular to the mounting direction. The case protruding portion 3520 has a smaller length in the mounting direction of the ink cartridge 16 (upper side of FIG. 46(*a*)) than the case protruding portion 3521, and the case protruding portion 3521 has a greater length in the mounting direction of the ink cartridge 16 (lower side of FIG. 46(*a*)) than the case protruding portion 3520. Furthermore, the cap 300 is formed in the same shape as in the ink cartridge 1, and part of the case 3510 is surrounded by the cap sidewall 320.

The mounting portion 3530 is provided with a sidewall support plate 3540 that supports the side surface (part of the side surface of the case 3510 and part of the cap sidewall 320 of the cap 300) of the ink cartridge 16 from the lower direction, a bottom wall support plate 3541 that receives the cap bottom wall 310 of the cap 300, urging members 3542 that urge the bottom wall support plate 3541 in a direction opposite to the mounting direction (opposite to the arrow R direction), a clamp member 3543 that locks the ink cartridge 16 with the mounting portion 3530 by being engaged with the cap sidewall 320 of the cap 300, and a clamp releasing member 3544 that releases the clamp member 3543 from an engaged state.

Additionally, the inner side (surface side contacting the side surface of the ink cartridge 16) of the sidewall support plate 3540 is formed in a shape corresponding to the shape (curvature) of the cap sidewall 320. When the ink cartridge 16 is mounted, the ink cartridge 16 is guided in the bottom wall support plate 3541 direction (right direction of FIG. 46(*a*)) by the inner side of the sidewall support plate 3540. In the clamp releasing member 3544, a slide groove (undepicted) is formed, which has a shape corresponding to the shape of the case protruding portion 3520. In the same manner as the sidewall support plate 3540, the ink cartridge 16 is guided in the bottom wall support plate 3541 direction (right direction of FIG. 46(*a*)) by the slide groove of the clamp releasing member 3544. Therefore, the ink cartridge 16 can be smoothly mounted, and mounting of the ink cartridge 16 in a direction inclined with respect to the bottom wall support plate 3541 can be prevented.

In the bottom wall support plate 3541, a through hole 3545 is formed, through which the ink extraction tube 3550 can be inserted. When the bottom wall support plate 3541 is moved in the mounting direction (arrow R direction), the ink extraction tube 3550 inserted through the through hole 3545 protrudes to the ink cartridge 16 side.

In the clamp member 3543, an inclined surface 3546 is formed, which is inclined with respect to the mounting direction (arrow R direction). In the clamp releasing member 3544, an inclined surface 3547 is formed, which corresponds to the inclined surface 3546 of the clamp member 3543. The clamp member 3543 and the clamp releasing member 3544 are arranged so that the inclined surfaces (inclined surface 3546 and inclined surface 3547) are substantially parallel to each other.

FIG. 46(*b*) shows a state in which the ink cartridge 16 is mounted to the mounting portion 3530. When the ink cartridge 16 is mounted to the mounting portion 3530, the case 3510 and the cap sidewall 320 contact the sidewall support plate 3540, the case protruding portion 3520 contacts an undepicted slide groove of the clamp releasing member 3544, and the ink cartridge 16 is guided to the sidewall support plate 3540. When the mounting operation of the ink cartridge 16 continues, the cap bottom wall 310 of the cap 300 contacts the bottom wall support plate 3541, and the bottom wall support plate 3541 is pressed in a direction opposite to an urging force of the urging members 3542 (mounting direction R). At this time, the cap bottom wall 310 contacts the inclined surface 3546 of the clamp member 3543, and the clamp member 3543 is bent in a direction of separation from the cap sidewall 320 (upper direction of FIG. 46(*b*)). Furthermore, when the ink cartridge 16 is inserted, contact between the cap sidewall 320 and the inclined surface 3546 of the clamp member 3543 discontinues, and the clamp member 3543 returns to its original state. The ink cartridge 16 locks by engaging the cap sidewall 320.

As shown in FIG. 46(*c*), the ink cartridge 16 is detached by pressing the clamp releasing member 3544 in the mounting direction (arrow R direction). Then, by contact with the inclined surface 3547 of the clamp releasing member 3544, the inclined surface 3546 of the clamp member 3543 is bent in a direction of separation from the cap sidewall 320, and the engagement of the clamp member 3543 and the cap sidewall 320 is released. At this time, the bottom wall support plate 3541 is pressed counter to the mounting direction by the urging force of the urging members 3542, and is moved to a position in which the cap bottom wall 310 does not contact the inclined surface 3546 of the clamp member 3543.

Therefore, during mounting, the ink cartridge 16 is inserted into the mounting portion 3530. During dismounting of the ink cartridge 16, the clamp releasing member 3544 is pressed. Therefore, the ink cartridge 16 can be simply attached and detached.

Figure 47:
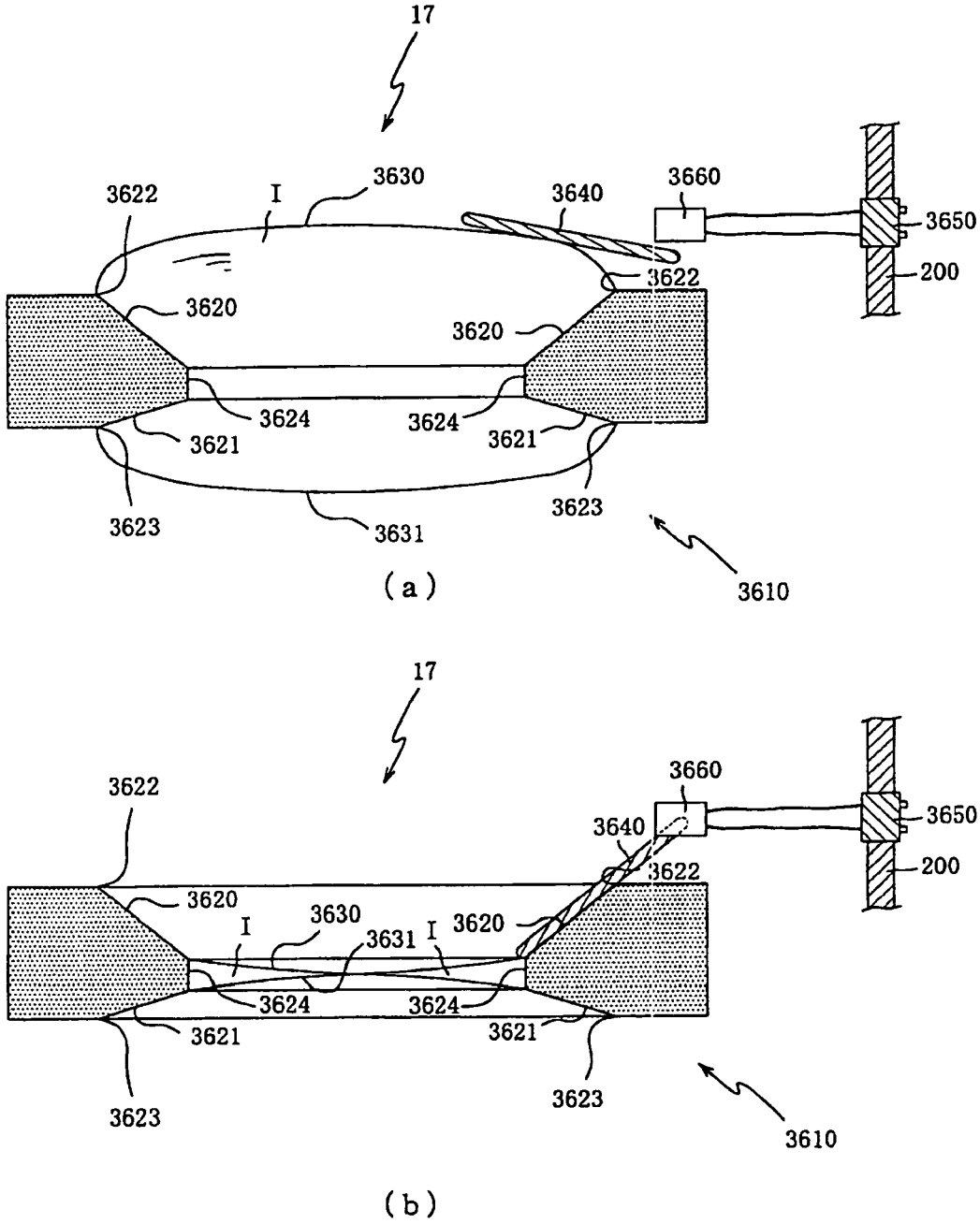
FIGS. 47(*a*) and 47(*b*) are sequential cross sectional views showing detection of an empty state of an exemplary ink cartridge according to the present invention.

An ink cartridge 17 is described with reference to FIG. 47. FIG. 47 includes schematic cross sectional views of a structure for detecting an empty state of the ink cartridge 17.

As shown in FIG. 47(*a*), with respect to a frame 3610 of the ink cartridge 17, the inclination angles of frame inclined surfaces 3620, 3621 are made different. Additionally, the frame inclined surface 3620 side and the frame inclined surface 3621 side are connected to frame through holes 3624. When the inclination angles of the frame inclined surfaces 3620, 3621 are different, the distance between the frame aperture portion 3622 on the frame inclined surface 3620 side and the frame through holes 3624 is different from the distance between a frame aperture portion 3623 on the frame inclined surface 3621 and the frame through holes 3624. Therefore, the size of the film 3630 on the frame inclined surface 3620 side is different from the size of the film 3631 on the frame inclined surface 3621 side. Thus, an ink storage capacity on the frame inclined surface 3620 side is different from an ink storage capacity on the frame inclined surface 3621 side.

As shown in FIG. 47(*a*), on the film 3630, a shielding plate 3640 is mounted. Furthermore, a connector 3650 is arranged on part of the case 200, which permits electrical contact to the outside when the ink cartridge 17 is mounted to an inkjet printer (undepicted). A detecting sensor 3660 is connected to the connector 3650 via signal lines. The detecting sensor 3660 is a sensor that detects an empty state of the ink cartridge 17 and is a transparent type photo sensor with a light emitting portion and a light receiving portion. Therefore, when the shielding plate 3640 shields an optical path between the light emitting portion and the light receiving portion of the detecting sensor 3660, the detecting sensor 3660 is turned on, and ink empty state is detected.

FIG. 47(*a*) shows a state in which an sufficient amount of ink I is present within the frame 3610. As shown in FIG. 47(*a*), the shielding plate 3640 is substantially parallel to the frame 3610, and does not shield an optical path of the detecting sensor 3660.

In the inkjet printer, when printing is repeated, the amount of ink I decreases, and the films 3630, 3631 are bent in the respective frame inclined surfaces 3620, 3621 directions. At this time, the ink storage capacity on the frame inclined surface 3621 side is small, so ink I on the frame inclined surface 3621 side is first used up, and the film 3631 contacts the frame inclined surface 3621.

Furthermore, in the inkjet printer, when printing is repeated, ink on the frame inclined surface 3620 side is also used up, and the film 3630 contacts the frame inclined surface 3620. At this point, the shielding plate 3640 also contacts the frame inclined surface 3620 via the film 3630. This state is shown in FIG. 47(*b*). When the shielding plate 3640 also contacts the frame inclined surface 3620, the shielding plate 3640 shields an optical path of the detecting sensor 3660, so the ink empty state is detected by the detecting sensor 3660.

Thus, as explained, by setting the difference in the inclination angles of the frame inclined surfaces 3620, 3621, the bending order of the films 3630, 3631 can be determined when ink I is used up. By mounting the shielding plate 3640 to the film 3630 with a larger capacity for storing the ink R, the empty state can be accurately detected.

An ink cartridge 18 is described with reference to FIG. 48. In the ink cartridge 17, by having different inclination angles of the frame inclined surfaces 3620, 3621, the empty state is accurately detected. In the ink cartridge 18, by contrast, by having different aperture sizes of the frame aperture portions 3770, 3771, the empty state is accurately detected. Portions of the ink cartridge 18 corresponding to same portions of the ink cartridge 17 are shown with the same symbols, so explanation thereof is omitted.

FIG. 48 includes schematic views showing a structure for detecting the empty state of the ink cartridge 18.

As shown in FIG. 48(*a*), with respect to the frame 3710 of the ink cartridge 18, the inclination angles with respect to a horizontal surface (aperture surface of the frame aperture portion 3770) of the frame inclined surfaces 3720, 3721 are made to be identical, but the sizes of the frame aperture portions 3770, 3771 constituted by the respective frame inclined surfaces 3720, 3721 are different. That is, the diameter of the aperture of the frame aperture portion 3770 is different from the diameter of the aperture of the frame aperture portion 3771. Thus, the size of the film 3730 on the frame inclined surface 3720 (frame aperture portion 3770) side is different from the size of the film 3731 on the frame inclined surface 3721 (frame aperture portion 3771) side. Thus, the ink storage capacity on the frame inclined surface 3720 (frame aperture portion 3770) side is different from the ink storage capacity on the frame inclined surface 3721 (frame aperture portion 3771) side.

Because of this configuration, in the inkjet printer, when printing is repeated, the amount of ink I within the frame 3710 decreases, and ink I stored on the frame inclined surface 3721 side is first used up. Then, ink I on the frame inclined surface 3720 side is used up (state of FIG. 48(*b*)). The shielding plate 3640 is mounted to the film 3730 on the frame inclined surface 3720 side with the larger ink capacity, so in a state in which the ink I is used up, the optical path of the detecting sensor 3660 is shielded, and the empty state is detected.

Thus, as explained, by employing a size difference in the apertures of the frame aperture portions 3770, 3771, the bending order of the films 3730, 3731 can be determined, and the empty state can be accurately detected.

An ink cartridge 19 is described with reference to FIG. 49. In the ink cartridge 17, by having different inclination angles of the frame inclined surfaces 3620, 3621, the empty state can be accurately detected. In the ink cartridge 19, by contrast, by having different thicknesses for the films 3830, 3831, the empty state can be accurately detected. Portions of the ink cartridge 19 corresponding to same portions of the ink cartridge 17 are shown with the same symbols, so explanation thereof is omitted.

FIG. 49 includes schematic views showing a structure for detecting the empty state of the ink cartridge 19.

With respect to the frame 3810 of the ink cartridge 19, the inclination angles of the frame inclined surfaces 3820, 3821 are formed to be the same, and the diameter size of the apertures of the frame aperture portions 3870, 3871 is also formed to be the same. Furthermore, the ink storage capacity on the frame inclined surface 3820 (frame aperture portion 3870) side is substantially the same as the ink storage capacity on the frame inclined surface 3821 (frame aperture portion 3871) side. However, the films 3830, 3831 of the ink cartridge 19 have different thicknesses, and the film 3830 is formed to be thicker than the film 3831. Therefore, the film 3830 is stronger than the film 3831, so when the amount of ink I reduces, the film 3831 first contacts the frame inclined surface 3821. Then, the film 3830 contacts the frame inclined surface 3820. The shielding plate 3640 is mounted to the film 3830 that is thicker, so in a state in which ink I is used up, the optical path of the detecting sensor 3660 is shielded, and the empty state is detected.

Thus, as explained, by employing different strengths for the films 3830, 3831, the order in which the films 3730, 3731 bend as ink is used is determined, so the empty state can be accurately detected.

Furthermore, in the ink cartridges 17, 18 and 19, the shielding plate 3640 is mounted to the respective films 3630, 3730, and 3830 that are flexibly deformed. When the respective films contact the frame inclined surfaces 3620, 3720, 3820, there is a possibility that the moving direction of shielding plate 3640 will shifted and out of the optical path of the detecting sensor 3660. Accordingly, it is also acceptable to provide a guide member (not depicted) that guides the shielding plate 3640 to the optical path of the detecting sensor 3660. For example, guide members can be arranged on both sides so as to sandwich the shielding plate 3640 and a path to the detecting sensor 3660 can be formed, or the moving direction of the shielding plate 3640 can be restricted by having a support portion that supports part of the shielding plate 3640 with respect to the frame.

In the ink cartridges 17, 18 and 19, the empty state can also be detected by using configurations described above together with a method of calculating the empty state from the amount of ink ejected using an undepicted control device. Employing such a configuration permits even more accurate detection of the empty state.

A detecting sensor can also be provided on the inkjet printer. In this configuration, when an ink cartridge is mounted, part of the case shields the optical path of the detecting sensor. Part of the case is formed to be transparent or translucent, so as to transmit light that is emitted from the light emitting portion of the detecting sensor. The shielding plate 3640 is mounted so that, when there is no ink I, the shielding plate 3640 enters part of the case and shields the optical path of the detecting sensor. Therefore, even when the detecting sensor is provided on the inkjet printer, the empty state can be accurately detected. Furthermore, if the detecting sensor is not arranged within the case, the cost of manufacturing the ink cartridge cost can be reduced.

By changing the film size, the ink capacities on the inclined surface sides can be changed. Thus, in the process of welding the film (see FIG. 20), it is also acceptable to change the amount of the film pressed by the pressing portion. With this configuration, the film size is different and the ink capacity is different. Thus, the empty state can be accurately detected.

As long as the bending order of the films is determined, it is also acceptable if films formed from different materials but with the same film thickness are welded. With this configuration, even if the film thicknesses are the same, the material quality is different, so the film strength is also different. Thus, the bending order of the films can be determined, and the empty state can be accurately detected.

An ink cartridge 20 is described with reference to FIG. 50. On the cap protruding member 350 of the ink cartridge 1, the end surface of the case 200 side is formed to be a flat surface. On a cap protruding member 3910 of the ink cartridge 20, by contrast, the tip end is formed to have a convergent shape. Portions of the ink cartridge 20 corresponding to same portions of the ink cartridge 1 are shown with the same symbols, so explanation thereof is omitted.

FIG. 50 includes enlarged cross sectional views of a portion of the ink cartridge 20 at which the case 200 and the cap 300 of the ink cartridge 20 are welded.

As shown in FIG. 50(*a*), with respect to the ink cartridge 20, the tip end of the cap protruding member 3910 of the cap 300 is formed to have a convergent shape. Thus, compared to the case in which the tip end of the cap protruding member 3910 is formed to have a flat surface, the cap protruding member 3910 is promptly melted, and melted debris X can easily flow downward. Therefore, the cap 300 and the case 200 can be welded at an early stage.

If the inclined surface of the cap protruding member 3910 is formed to be downwardly inclined in the cap sidewall 320 direction, when the cap protruding member 3910 is melted the melted debris X is guided to a gap between the cap sidewall 320 and the case sidewall 230. Therefore, the chances of the melted debris X entering the ink cartridge can be reduced.

Figure 51:
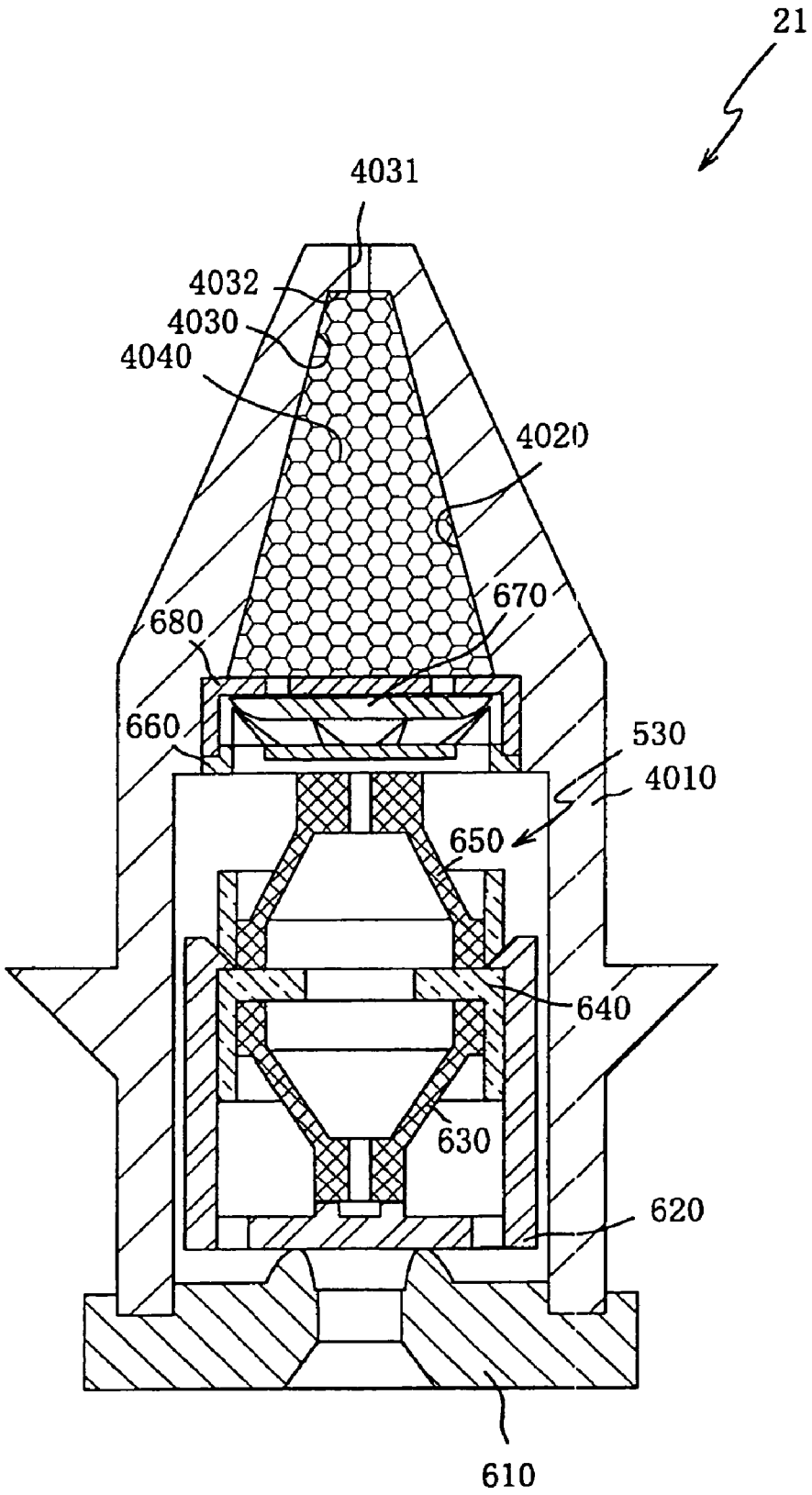
FIG. 51 is a cross sectional view of an exemplary ink cartridge according to the present invention.

An ink cartridge 21 is described with reference to FIG. 51. FIG. 51 is a cross sectional view of part of an ink supply portion 4010 of the ink cartridge 21. In the ink cartridge 21, an ink flow path 4020 is formed to be different from that of the ink cartridge 1. Portions of the ink cartridge 21 corresponding to same portions of the ink cartridge 1 are shown with the same symbols, so explanation thereof is omitted.

As shown in FIG. 51, the ink flow path 4020 of the ink supply portion 4010 includes a first flow path 4030 formed in a truncated cone shape and a second flow path 4031 formed in a substantially cylindrical shape. The diameter of the second flow path 4031 is smaller than the minimum diameter of the first flow path 4030. Therefore, a step surface 4032 is formed between the first flow path 4030 and the second flow path 4031. The step surface 4032 protrudes in a direction perpendicular to a direction in which the filter 4040 is inserted.

When the ink cartridge 21 is manufactured, if the filter 4040 that is formed in a cylindrical shape of substantially the same diameter as the maximum diameter of the first flow path 4030 is inserted to the ink flow path 4020, the filter 4040 contacts the step surface 4032 within the ink flow path 4020. The diameter of the second flow path 4031 is smaller than the diameter of the first flow path 4030, so the step surface 4032 functions as a wall surface that restricts further entrance of the filter 4040 into the ink flow path 4020. Therefore, the filter 4040 is not pressed into the second flow path 4031. Accordingly, the problem of the filter 4040 being pushed into the ink storage portion 120 can be prevented.

Figure 52:
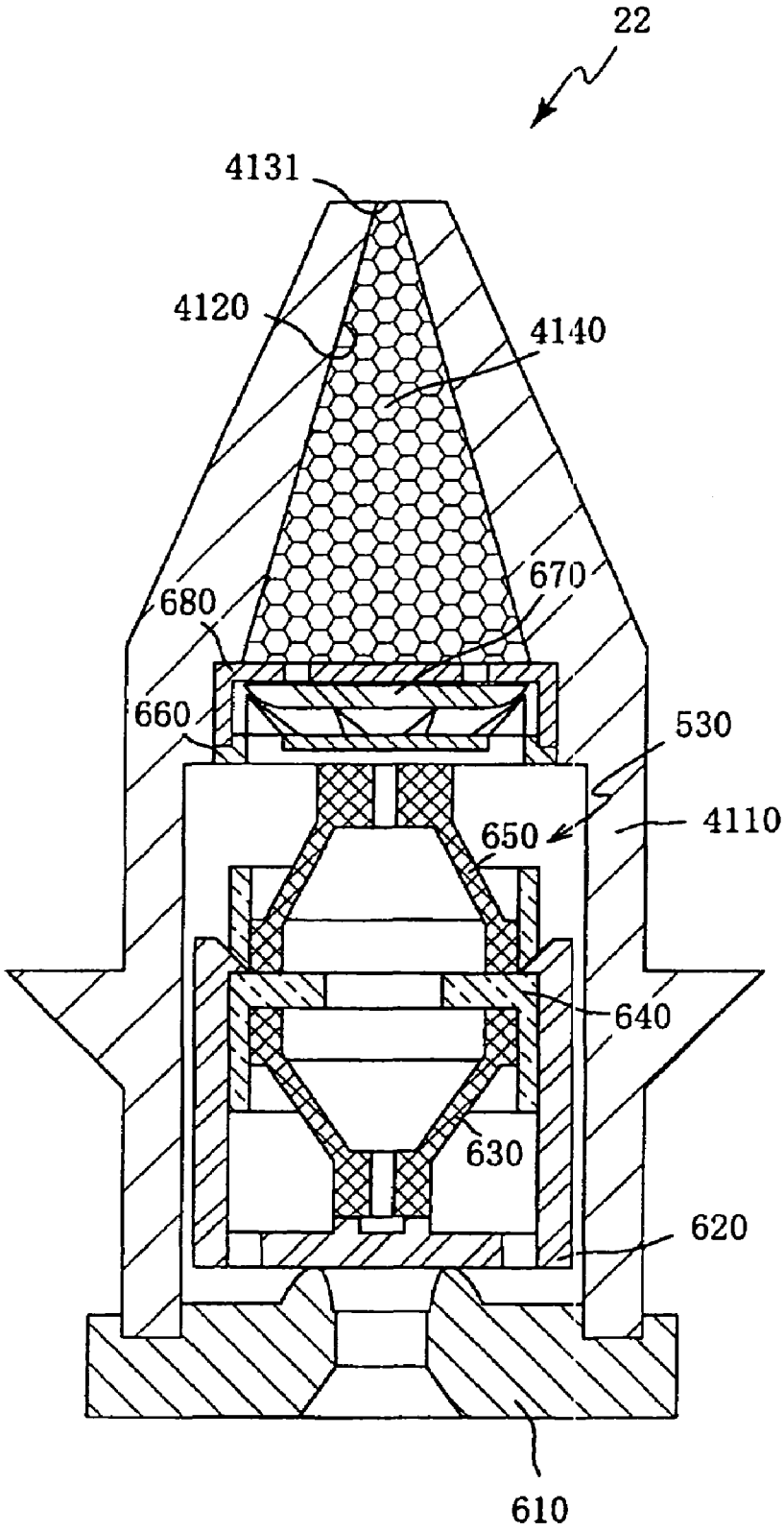
FIG. 52 is a cross sectional view of part of an ink supply portion of an exemplary ink cartridge according to the present invention.

An ink cartridge 22 is described with reference to FIG. 52. FIG. 52 is a cross sectional view of part of an ink supply portion 4110 of the ink cartridge 22. An ink flow path 4120 of the ink cartridge 22 is different from that of the ink cartridge 1. Portions of the ink cartridge 22 corresponding to same portions of the ink cartridge 1 are shown with the same symbols, so explanation thereof is omitted.

As shown in FIG. 52, the overall ink flow path 4120 of the ink supply portion 4110 is formed to have a hollow conical shape. An aperture of an ink supply hole 4131 formed at one end on the ink storage portion 120 side of the ink flow path 4120 is formed to be the smallest within the ink flow path 4120. Therefore, when the ink cartridge 22 is manufactured, even if the filter 4140 is pushed into the ink flow path 4120, the chances of filter 4140 being pushed into the ink storage portion 120 are reduced.

The present invention is not limited to the embodiments described above. Various modifications will be apparent to those of ordinary skill in the art.

For example, with reference to FIG. 53, modified examples of the slider member, the pedestal member, and the cover member are explained. FIG. 53 includes top views of a slider member 4210, a pedestal member 4220, and a cover member 4230. Portions of the slider member 4210, pedestal member 4220 and cover member 4230 corresponding to same portions of the slider member 640, the pedestal member 660, and the cover member 680 of the ink cartridge 1 are shown with the same symbols, so explanation thereof is omitted.

As shown in FIG. 53(*a*), in the direction perpendicular to the paper plane, the slider through hole 4211 of the slider member 4210 is formed in a substantially square shape. As shown in FIG. 53(*b*), in the direction perpendicular to the paper plane, first pedestal through holes 4221 and second pedestal through holes 4222 of the pedestal member 4220 are formed in a substantially square shape. Additionally, as shown in FIG. 53(*c*), cover through holes 4231 of the cover member 4230 are formed in a substantially square shape in the direction perpendicular to the paper plane.

By making the respective through holes (slider through hole 4211, first pedestal through holes 4221, second pedestal through holes 4222, and cover through holes 4231), which form an ink flow path, substantially square in shape as described above, adverse effects on ink flow due to formation of ink bubbles can be reduced. Thus, by using one or more of the slider member 4210, the pedestal member 4220, and the cover member 4230, the effects of ink bubbles can be reduced, and printing quality deterioration can be prevented.

In any of the valve mechanisms described above, if the flow path in which ink flows is formed in a square shape, the effects of ink bubbles can be further reduced. Although holes having a square shape are mentioned above, holes having any polygonal shapes other than a substantially round shape can be employed.

Figure 54:
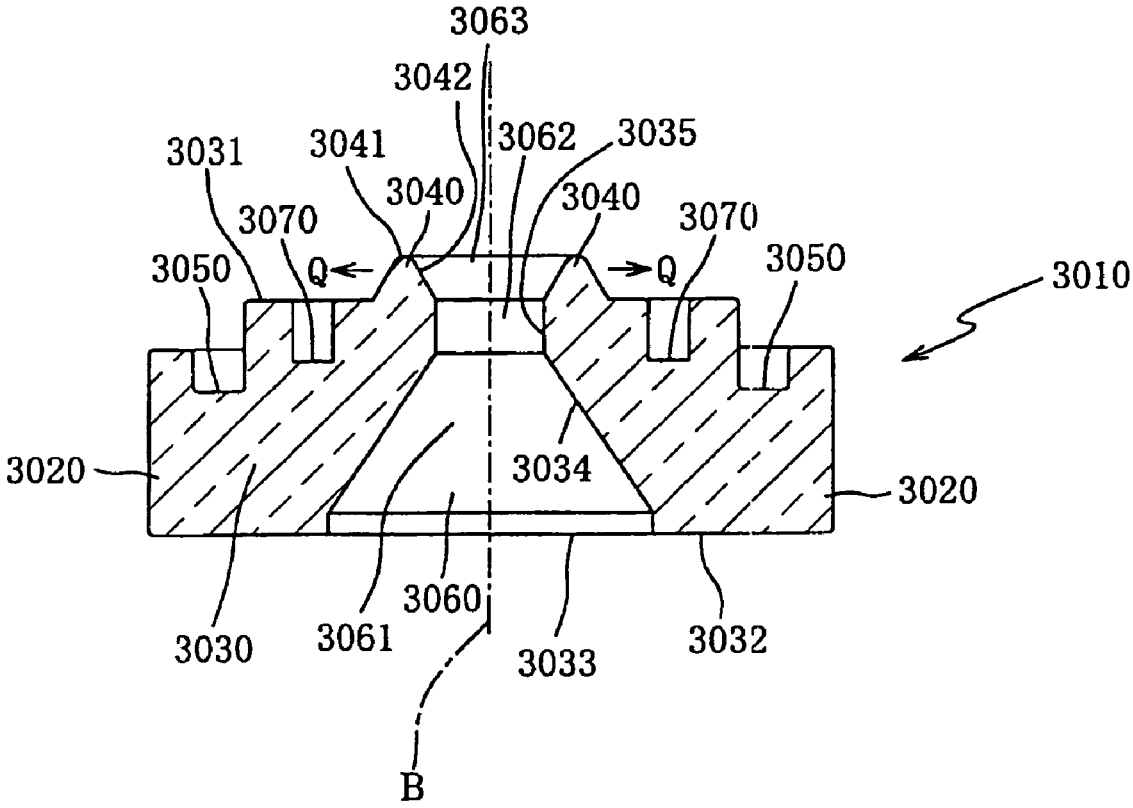
FIG. 54 is a cross sectional view of a joint member of an exemplary ink cartridge according to the present invention.

A modified joint member 3010 is described with reference to FIG. 54. FIG. 54 is a cross sectional view of the joint member 3010.

The joint member 3010 is provided with a joint outer circumferential portion 3020 that forms the outer circumferential wall of the joint member 3010 and is exposed to the outside of the ink supply portion 140, a joint inner circumferential portion 3030 that is formed inside of the joint outer circumferential portion 3020 and is inserted to the ink supply portion 140, a joint contact portion 3040 that protrudes toward the valve member 620 (see FIG. 19) side (upper side of FIG. 54(*b*)) from a top surface 3031 of the joint inner circumferential portion 3030 and contacts the valve member 620, a first joint groove portion 3050 that is formed between the joint outer circumferential portion 3020 and the joint inner circumferential portion 3030 and engaged with the outer circumferential wall of the ink supply portion 140, and a second joint groove portion 3070 that is formed in the periphery of the joint contact portion 3040 in the joint inner circumferential portion 3030. The second joint groove portion 3070 is opened to the top surface 3031 of the joint inner circumferential portion 3030, the depth direction is parallel to the axis B, and the bottom surface of the groove has substantially the same height as a connecting point of a taper portion flow path 3061, and a seal portion flow path 3062, which will be described later.

In the joint member 3010, an ink flow path 3060 is formed, which extends to a tip end portion 3041 (lower side of FIG. 12(*d*)) of the joint contact portion 3040 from a bottom surface 3032 of the joint inner circumferential portion 3030.

The ink flow path 3060 is provided with an aperture 3033 formed at the bottom surface 3032, the taper portion flow path 3061 formed by a taper surface 3034 connected to the aperture 3033, the substantially hollow cylindrical seal portion flow path 3062 that is formed by an inner circumferential surface 3035 parallel to the axis B connected to the taper surface 3034 and seals the ink extraction tube 1720, and a contact portion flow path 3063 that is formed by an inner circumferential surface 3042 of the joint contact portion 3040 connected to the inner circumferential surface 3035.

When the ink extraction tube 1720 is inserted to the ink flow path 3060 of the joint member 3010, the outer circumferential surface of the ink extraction tube 1720 elastically contacts the inner circumferential surface 3035 of the seal portion flow path 3062. Then, the inner circumferential surface 3035 is dragged by the ink extraction tube 1720 due to the friction of the contact surface and is displaced in the insertion direction, and this displacement is transmitted to the joint contact portion 3040. However, the joint contact portion 3040 is easily bent in a direction of separation from the axis B by the second joint groove portions 3070 formed surrounding the joint contact portion. Thus, the joint contact portion 3040 is displaced so as to lean in the direction of the second joint groove portion 3070 (arrow Q direction of FIG. 54(*b*)). Therefore, the joint contact portion 3040 is hardly lifted to the valve member 620 side, so the valve member 620 is separated from the joint contact portion 3040 at an early stage, and the ink flow path is formed. Therefore, the stroke at the time of mounting the ink cartridge can be shortened.

Figure 55:
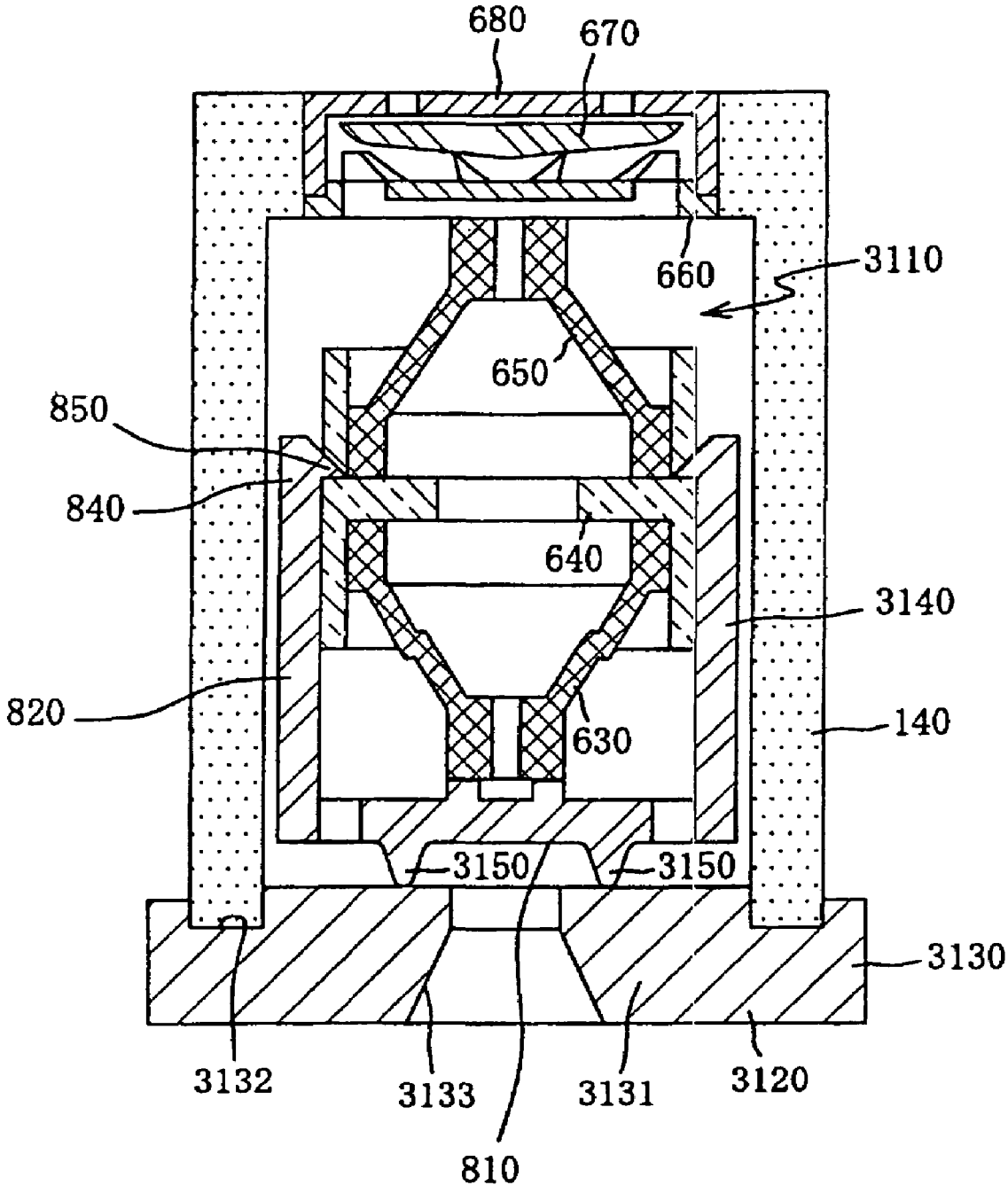
FIG. 55 is a cross sectional view of a valve mechanism of an exemplary ink cartridge according to the present invention.

A valve mechanism 3110 is described with reference to FIG. 55. FIG. 55 is a cross sectional view of the valve mechanism 3110.

As shown in FIG. 55, in the same manner as in the ink cartridge 1, the valve mechanism 3110 is provided with the first spring member 630, the slider member 640, the second spring member 650, the pedestal member 660, the check valve 670, and the cover member 680. Furthermore, the valve mechanism 3110 is also provided with a joint member 3120, and a valve member 3140.

The joint member 3120 of the valve mechanism 3110 is provided with a joint outer circumferential portion 3130 that forms the outer circumferential wall of the joint member 3120 and is exposed to the outside of the ink supply portion 140, a joint inner circumferential portion 3131 that forms the inner circumferential portion of the joint outer circumferential portion 3130 and is inserted into the ink supply portion 140, a joint groove portion 3132 that is formed between the joint inner circumferential portion 3131 and the joint outer circumferential portion 3130 and is engaged with the outer circumferential wall of the ink supply portion 140, and an ink flow path 3133 that is formed at the center of the joint inner circumferential portion 3131.

In the same manner as in the ink cartridge 1, the valve member 3140 is provided with the valve bottom wall 810 that forms the bottom surface of the valve member 3140, the valve sidewall 820 that forms the outer circumferential wall of the valve member 3140, the pair of valve guide grooves 830 in which the slider loose insertion member 1030 are loosely inserted, the pair of valve restriction portions 840 that restrict movement of the slider member 640, and the valve hook portions 850 that engage the slider member 640. Furthermore, in the valve bottom wall 810, a valve protruding portion 3150 is formed, which protrudes in the joint member 3120 direction. This valve protruding portion 3150 is formed so as to surround the ink flow path 3133 of the joint member 3120, and the ink flow path is closed by contacting the joint member 3120.

When the ink extraction tube 1720 (see FIG. 26) is inserted into the joint member 3120, the valve member 3140 is lifted toward the pedestal member 660 (upper side of FIG. 54. Therefore, the valve protruding portion 3150 is separated from the joint member 3120 at an early stage, and the ink flow path is formed. Thus, the stroke at the time of mounting an ink cartridge can be shortened.

As long as a structure is provided in which, as explained with respect to FIGS. 54 and 55, the ink flow path is closed as the joint member contacts the valve member, and in which when the ink extraction tube 1720 is inserted, the joint member is separated from the valve member at an early stage and the ink flow path is formed, either a structure in which a protrusion is formed on the joint member side or a structure in which a protrusion is formed on the valve member side may be employed.

Other exemplary modified examples are described below. For example, in the above described embodiments, the cap 300 includes the cap sidewall 320. It is also acceptable not include the cap sidewall 320. In such a structure, the engaging portion that is fixed to the mounting portion of the inkjet printer 1710 (see FIG. 26) can engage the case sidewall 230.

Furthermore, with respect to the valve member 1930 described above, the ink flow path is the valve through holes 1950, but the shape of the valve through holes 1950 can be also formed in a square shape as seen from a top view. Furthermore, the stopper through hole 2180 of the filter stopper member 2170 can also be formed in a square shape as seen from the top view. By employing such a structure, blockage of the ink flow path due to ink bubbles can be reduced.

Additionally, as described above, the cover member 680 and the pedestal member 660 are engaged with the engaging portion 1450. However, the cover member 680, the check valve 670, and the pedestal member 660 can be excluded, and the filter stopper member 2170 can also be employed.

Furthermore, in ink cartridges in which when the spring members contact the pedestal bottom portion 1110, the flow path of the second pedestal through holes 1150 is not closed, a pedestal member lacking the pedestal through groove 1160 cold be employed.

Additionally, the structure by which the cap sidewall is provided with a step and the melted debris resulting from welding the cap to the case cannot be visually seen from the outside, can also be applied to thermal welding of the cap and the case, as well as welding the ink cartridge.

A further exemplary embodiment of the present invention is described below with reference to FIGS. 56-86.

Figure 56:
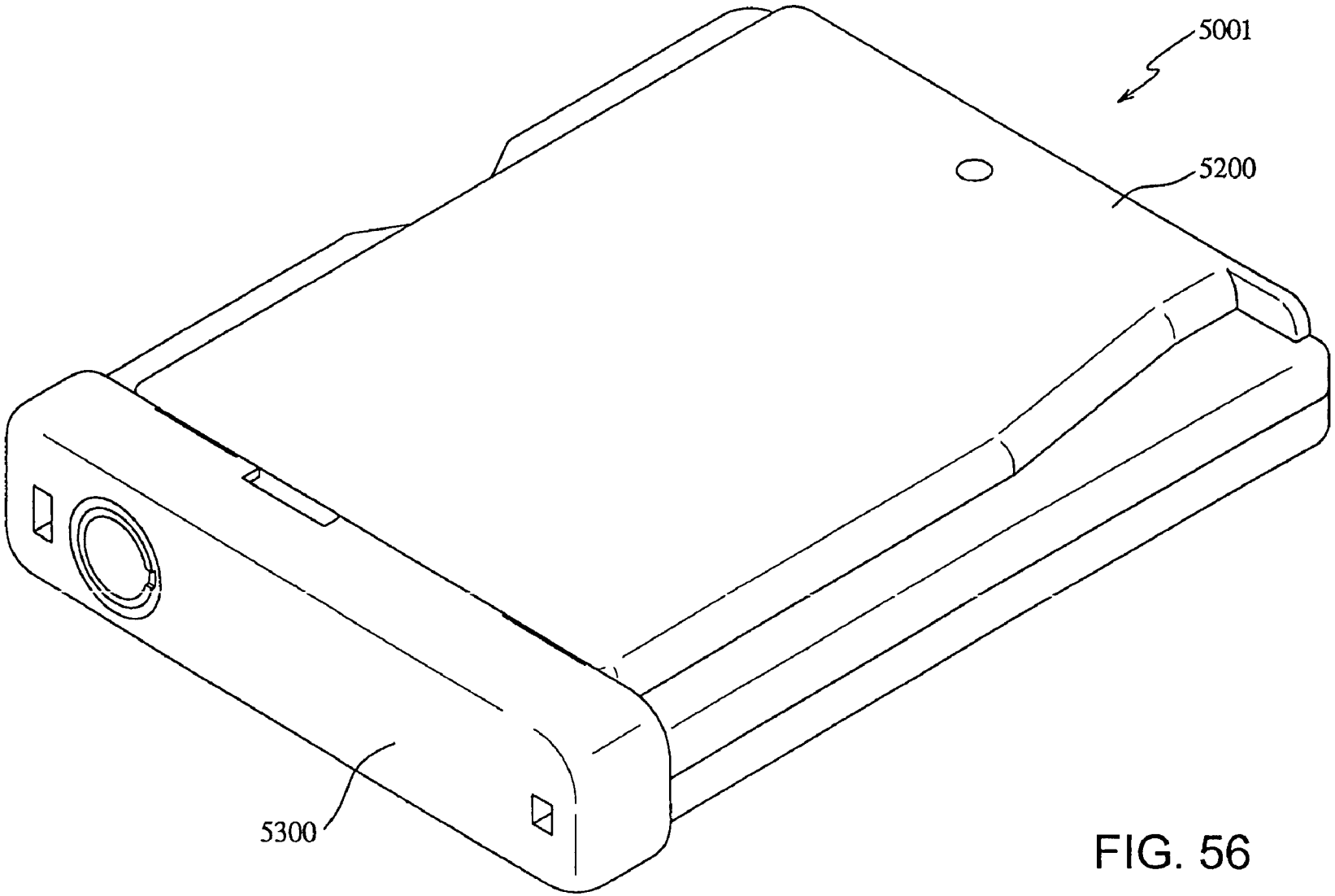
FIG. 56 is a perspective view of an exemplary ink cartridge according to the present invention.

FIG. 56 is a perspective view of an exemplary ink cartridge 5001 according to the present invention for supplying ink to an inkjet printer 6000 (see FIG. 77). As shown in FIG. 56, the ink cartridge 5001 is provided with a case 5200 and a cap 5300, which enclose a frame 5100 (see FIG. 57). The case 5200 and the cap 5300 form a casing of the ink cartridge 5001.

Figure 57:
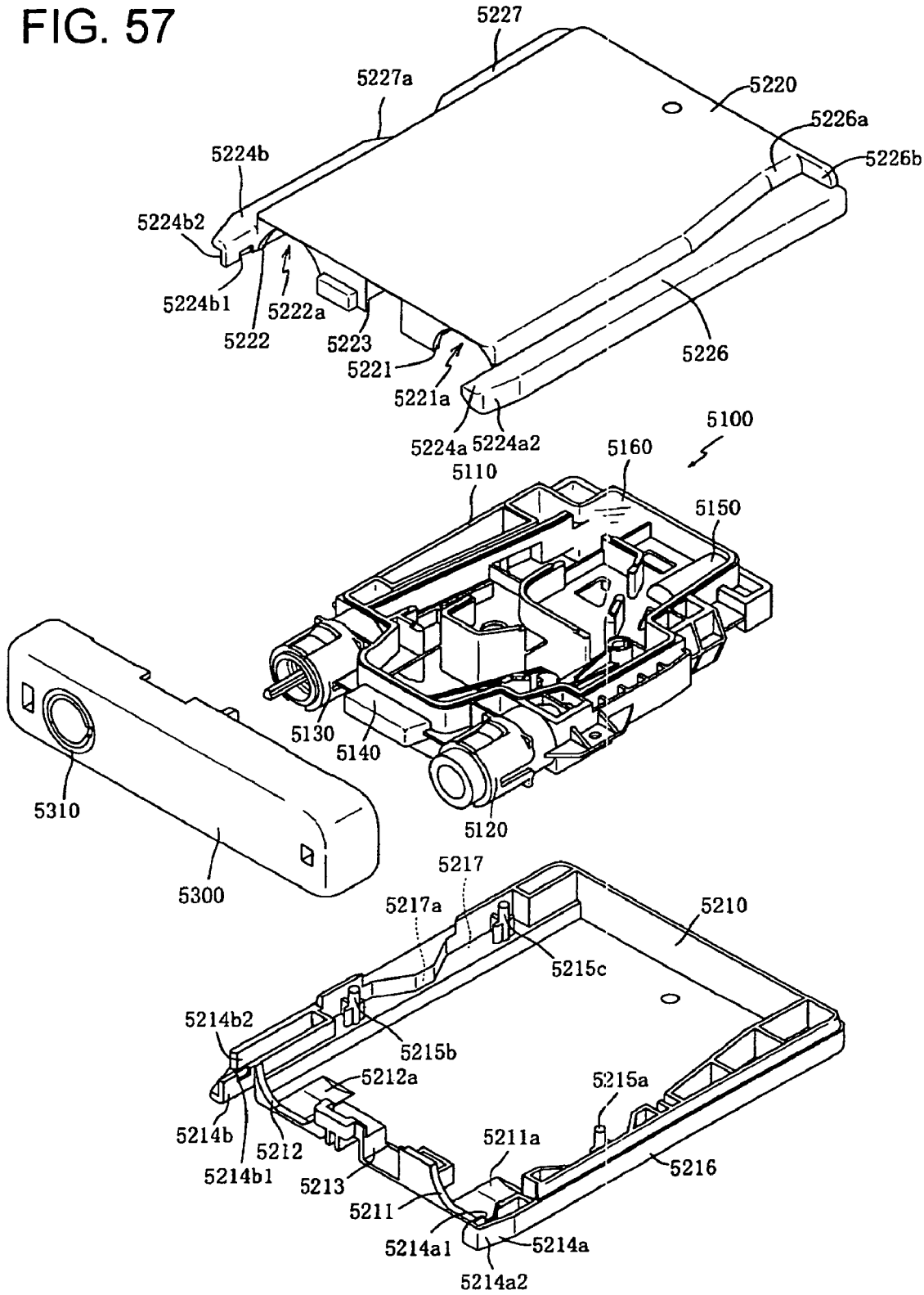
FIG. 57 is a perspective view of an exemplary ink cartridge according to the present invention in a disassembled state.

FIG. 57 is a perspective view of the ink cartridge 5001 in a disassembled state showing the case 5200 the cap 5300 and the frame 5100. As shown in FIG. 57, the case 5200 includes a front case portion 5220 and a rear case portion 5210. The front case portion 5220 and the rear case portion 5210, when assembled, enclose the frame 5100. When the ink cartridge 5001 is assembled, the cap 5300 covers one end of the assembled front case portion 5220 and rear case portion 5210.

The frame 5100 includes a frame body 5110, an ink supply port 5120, an air intake port 5130, an ink detection projection 5140, an ink filling chamber 5150 and a film 5160. The film 5160 is adhered to upper edges of sidewalls of the frame body 5110 so that, together, the film 5160 and the frame sidewalls enclose an ink storage space. The ink supply port 5120 is configured to permit supply of ink from the ink cartridge 5001 to the inkjet printer 6000 via an ink supply valve mechanism 5500 (see FIG. 60(*a*)). The air intake port 5130 is configured to permit air to enter from an exterior of the ink cartridge 5001 into the ink storage space via an air intake valve mechanism 5510 (see FIG. 60(*b*)), as ink is discharged from the ink cartridge 5001 via the ink supply port 5120. The ink detection projection 5140 is configured so as to communicate with a detection device 6014 (see FIG. 77) when the ink cartridge 5001 is installed in the inkjet printer 6000, so that the presence, absence and/or amount of ink in the ink storage space can be detected by the inkjet printer 6000. The ink filling chamber 5150 is configured to permit introduction of ink into the ink storage space of the ink cartridge 5001.

As indicated above, the case 5200 includes a front case portion 5220 and a rear case portion 5210. The front case portion 5220 and the rear case portion 5210 include various features for accommodating the frame 5100 and permitting communication between the frame 5100 and the exterior of the ink cartridge 5001 when the front case portion 5220 and the rear case portion 5210 are assembled. A front supply aperture portion 5221 of the front case portion 5220 and a rear supply aperture portion 5211 of the rear case portion 5210 form a supply aperture 5221*a* through which the ink supply port 5120 communicates with the exterior of the ink cartridge 5001. The rear case portion 5210 also includes an ink supply valve accommodating surface 5211*a* in the vicinity of the rear supply aperture portion 5211 for accommodating the ink supply valve mechanism 5500. A front air intake aperture portion 5222 of the front case portion 5220 and a rear air intake aperture portion 5212 of the rear case portion 5210 form an air intake aperture 5222*a* through which the air intake port 5130 communicates with the exterior of the ink cartridge 5001. The rear case portion 5210 also includes an air intake valve accommodating surface 5212*a* in the vicinity of the rear air intake aperture portion 5212 for accommodating the air intake valve mechanism 5510. A front ink detector aperture portion 5223 of the front case portion 5220 and a rear ink detector aperture portion 5213 of the rear case portion 5210 form an accommodating space through which the ink detection projection 5140 can communicate with the detection device 6014.

A front supply side projection portion 5224*a* and a corresponding structure on the rear case portion 5210 form a supply side projection for positioning the ink cartridge 5001 with respect to the inkjet printer 6000 and for positioning the case 5200 with respect to the cap 5300. Likewise, a front intake side projection portion 5224*b* and a rear intake side projection portion 5214*b* form an intake side projection for positioning the ink cartridge 5001 with respect to the inkjet printer 6000 and for positioning the case 5200 with respect to the cap 5300. The front supply side projection portion 5224*a* includes a front supply side projection outer surface 5224*a*2 for positioning the ink cartridge 5001 with respect to the inkjet printer 6000. The rear supply side projection portion 5214*a* includes a rear supply side projection outer surface 5214*a*2 for positioning the ink cartridge 5001 with respect to the inkjet printer 6000 and a rear supply side projection aperture 5214*a*1 for positioning the case 5200 with respect to the cap 5300. The front intake side projection portion 5224*b* includes a front intake side projection receiving portion 5224*b*2 for positioning the ink cartridge 5001 with respect to the inkjet printer 6000 and a front intake side projection aperture 5224*b*1 for positioning the case 5200 with respect to the cap 5300. The rear intake side projection portion 5214*b* includes a rear intake side projection receiving portion 5214*b*2 for positioning the ink cartridge 5001 with respect to the inkjet printer 6000 and a rear intake side projection aperture 5214*b*1 for positioning the case 5200 with respect to the cap 5300.

The rear case portion 5210 further includes positioning pins 5215*a*, 5215*b*, 5215*c* for positioning the frame 5100. When the ink cartridge 5001 is assembled, the positioning pins 5215*a*, 5215*b*, 5215*c* communicate with respective positioning apertures of the frame 5100.

The front case portion 5220 includes a front supply side outer surface 5226 and the rear case portion 5210 includes a rear supply side outer surface 5216. The front supply side outer surface 5226 and the rear supply side outer surface 5216 assist in positioning the ink cartridge 5001 during mounting of the ink cartridge 5001 to the inkjet printer 6000. The front supply side outer surface 5226 includes a supply side inclined outer surface 5226*a* and a supply side restrictor plate 5226*b*, which, respectively, guide the ink cartridge 5001 during installation and prevent the ink cartridge 5001 from being pressed to deeply into the inkjet printer 6000.

The front case portion 5220 includes a front intake side outer surface 5227 and the rear case portion 5210 includes a rear intake side inner surface 5217. The front intake side outer surface 5227 and the rear intake side inner surface 5217 assist in positioning the ink cartridge 5001 during mounting of the ink cartridge 5001 to the inkjet printer 6000. The front intake side outer surface 5227 includes an intake side inclined outer surface 5227*a* and the rear intake side inner surface 5217 includes an intake side inclined inner surface 5217*a*, which, in cooperation, guide the ink cartridge 5001 during installation and prevent the ink cartridge 5001 from being pressed too deeply into the inkjet printer 6000.

The cap 5300, as discussed above, along with the assembled front case portion 5220 and rear case portion 5210, enclose the frame 5100. The cap 5300 includes an air intake structure 5310 for accommodating a protruding portion of the air intake port 5130 of the frame 5100.

FIG. 58 shows the cap 5300. FIG. 58(*a*) is a top view of the cap, and FIG. 58(*b*) is a cross sectional view of the cap. As discussed above, the cap 5300 includes an air intake structure 5310, which is positioned opposite from the air intake valve mechanism 5510 when the ink cartridge 5001 is assembled. FIGS. 58(*a*) and (*b*) show, in particular, internal structures of the cap 5300 that are used to fix the cap 5300 to the case 5200. The cap includes a cross wall 5321 and edge walls 5322, which define a projection receiving space 5320 for receiving the intake side projection of the case 5200 when the cap 5300 is placed on the case 5200. The cap 5300 also includes engaging projections 5330*a*, 5330*b* for engaging with the projection apertures on the case 5200. Each of the engaging projections 5330*a*, 5330*b* includes an extension member 5330*a*2, 5330*b*2 which extends from the inner surface of the cap 5300 and an engaging tab 5330*a*1, 5330*b*1 provided on the end of the extension member 5330*a*2, 5330*b*2. The inner surface also includes positioning walls 5340*a*, 5340*b* that are located on either side of the ink detection projection 5140 when the ink cartridge 5001 is assembled.

Figure 59:
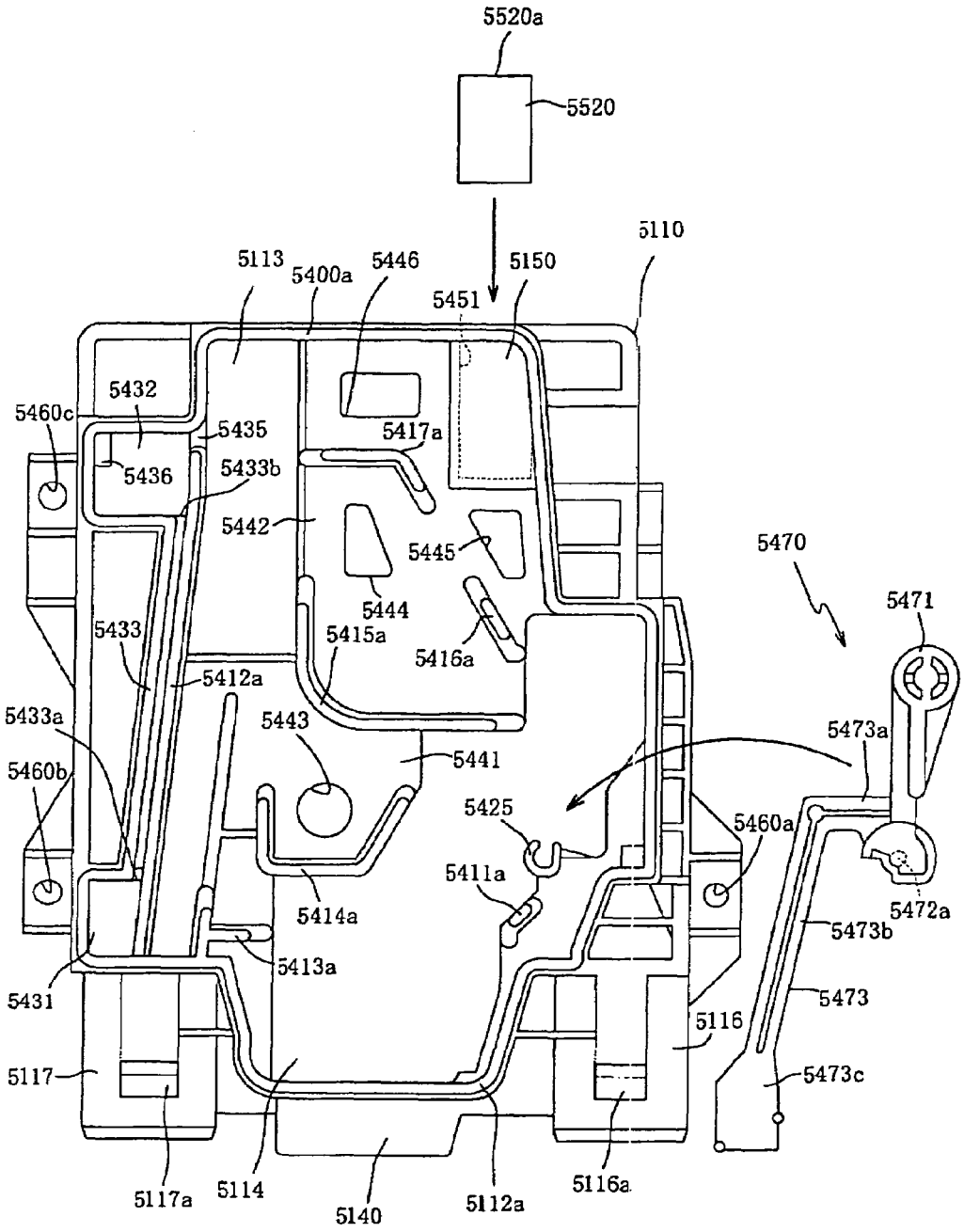
FIG. 59 is a front view of a disassembled frame of an exemplary ink cartridge according to the present invention.

FIG. 59 is a front view of the frame body 5110 disassembled to show its various structures. As can be seen in FIG. 59, the frame body 5110 includes an ink supply chamber 5116 forming the ink supply port 5120 and accommodating the ink supply valve mechanism 5500, and an air intake chamber 5117 forming the air intake port 5130 and accommodating the air intake valve mechanism 5510. In addition, the frame body 5110 includes an ink filling chamber 5150, a detector 5470, and an ink storage space defined by various structures discussed below.

The ink supply chamber 5116 is provided with an ink supply valve fastening rib 5116*a*, and the air intake chamber 5117 is provided with an air intake valve fastening rib 5117*a*. The ink supply valve fastening rib 5116*a* and the air intake valve fastening rib 5117*a* secure the ink supply valve mechanism 5500 and the air intake valve mechanism 5510, respectively, by engaging the tab receiving apertures 5603*a*, 5703*a* of the supply valve jacket 5600 and the intake valve jacket 5700, respectively.

The frame body 5110 includes an ink storage space bounded by sidewalls 5400*a* that extend perpendicularly with respect to the plane of FIG. 59. The sidewalls 5400*a* are provided with film contact surfaces (outer film contact surface 5112*a* and inner film contact surfaces 5411*a*, 5412*a*, 5413*a*, 5414*a*, 5415*a*, 5416*a*, 5417*a*, 5418*a*). The film 5160 is adhered to the frame body 5110 at the film contact surfaces. The film 5160 and the sidewalls 5400*a* enclose the ink storage space.

Structures similar to the structures shown in FIG. 59 are provided on the rear side of the frame body 5110 (not shown in FIG. 59). The front and rear sides of the frame body 5110 are separated by partition walls, including a lower central partition wall 5441 and an upper central partition wall 5442. Ink and/or air are permitted to pass through the partition walls to occupy ink storage spaces on both the front and rear sides of the frame body 5110. Such passage is made possible by a lower air intake aperture 5433*a*, an upper air intake through hole 5436 and partition through holes 5443, 5444, 5445,

5446. Also, open areas 5113 and 5114 permit passage between front and rear sides of the frame body 5110.

The frame body 5110 includes an air intake structure to prevent outflow of ink through the air intake chamber 5117 and to ensure controlled introduction of air into the ink storage space. After air enters the frame body 5110 through the air intake chamber 5117, the air enters the lower air intake chamber 5431. The air then passes through a narrow central air intake passage 5433 to an upper air intake chamber 5432. The air can then pass to a remainder of the ink storage space through the upper air intake aperture 5435.

The frame body 5110 includes an ink filling chamber 5150 including an ink filling chamber wall 5451. The ink filling chamber 5150 is fitted with a stopper 5520 having a top surface 5520*a*. When the stopper 5520 is partially inserted into the ink filling chamber 5150, it is possible to introduce ink into the ink storage space by inserting an ink insertion needle (not shown) through the top surface 5520*a* of the stopper 5520 and into a space below the stopper 5520 in the ink filling portion 5150.

The frame body 5110 further includes a detector 5470 for detecting the presence, absence and/or amount of ink in the ink cartridge 5001. The detector 5470 includes a detector float 5471, a detector mounting pin 5472*a*, and a detector arm 5473. The detector float 5471 is buoyant in ink, permitting the detector 5470 to move in response to a level of ink in the ink storage space. The detector mounting pin 5472*a* is seated on the detector mount 5425 in the ink storage space when the ink cartridge 5001 is assembled. The detector mounting pin 5472*a* and the detector mount 5425 are configured so that the detector 5470 rotates about the detector mount 5425 in response to an amount of ink in the ink storage space. The detector arm 5473 includes a float arm portion 5473*a* adjacent to the detector float 5471, a detector plate 5473*c* at an end of the detector 5470 opposite from the detector float 5471, and a plate arm portion 5473*b* extending between the float arm portion 5473*a* and the detector plate 5473*c*. The detector plate 5473*c* is capable of obstructing a beam of light, and is configured to move into and out of the ink detection projection 5140 in response to the amount of ink in the ink storage space.

Outside of the ink storage space of the frame body 5110, positioning apertures 5460*a*, 5460*b*, 5460*c* are provided. The positioning apertures 5460*a*, 5460*b*, 5460*c* ensure the position of the frame body 5110, when the frame is fitted in the case 5200. In particular, the positioning apertures 5460*a*, 5460*b*, 5460*c* engage the positioning pins 5215*a*, 5215*b*, 5215*c* of the case 5200.

Figure 60:
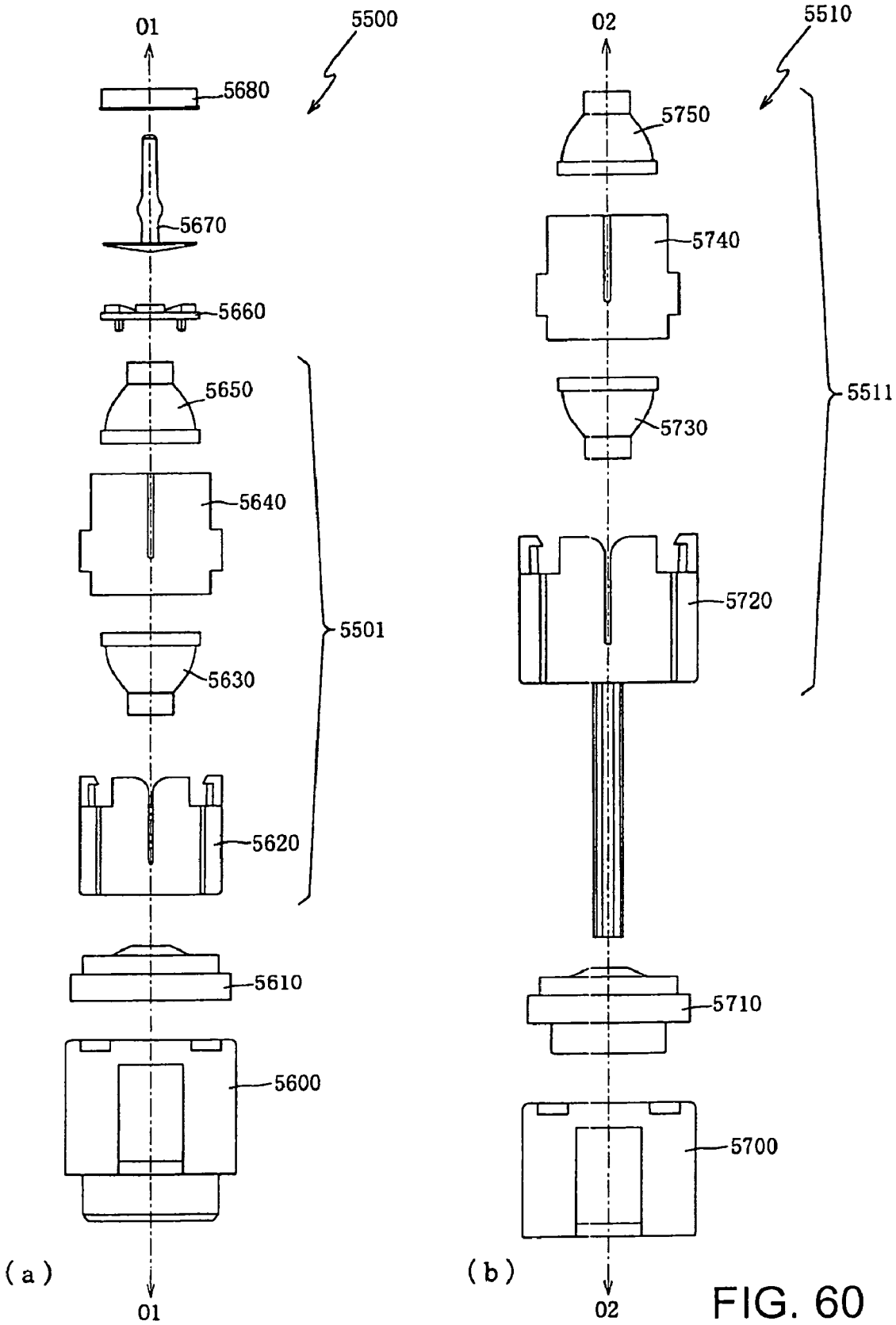
FIG. 60(*a*) is a front/rear view of a disassembled ink supply valve mechanism of an exemplary ink cartridge according to the present invention.

FIGS. 60(*a*) and (*b*) are front/rear views of an ink supply valve mechanism 5500 and an air intake valve mechanism 5510, respectively, of an exemplary ink cartridge according to the present invention, separated into their constituent parts. As shown in FIG. 60(*a*), the ink supply valve mechanism 5500 is provided with an insertion port (the lower end) for the ink extraction tube 6015 of the inkjet printer 6000. The ink supply valve mechanism 5500 includes multiple components. The ink supply valve mechanism 5500 includes a supply valve jacket 5600 and a joint member 5610. The supply valve jacket 5600 surrounds the joint member 5610, receives the ink extraction tube 6015, and protrudes from the frame 5100 when the ink cartridge 5001 is assembled. The joint member 5610 may be formed of a resin material with elasticity, such as rubber. A valve member 5620 is provided above the joint member 5610, and closes an ink flow path when the joint member 5610 contacts a bottom wall of the valve member 5620. A first spring member 5630 is stored in the valve member 5620 and is formed of a resin elastic material. A slider member 5640 covers a release surface of the valve member 5620 and can be moved in a uniaxial direction (axis 01 direction of the ink supply valve mechanism 5500), which is a direction in which the valve member 5620 moves when pressed by the ink extraction tube 6015. A second spring member 5650 is stored within the slider member 5640 and is formed in the same shape and of the same material as the first spring member 5630. A pedestal member 5660 contacts the second spring member 5650 and receives a check valve 5670. A cover member 5680 and the pedestal member 5660 sandwich and cover the check valve 5670. The valve member 5620, the first spring member 5630, the slider member 5640 and the second spring member 5650 constitute an ink supply valve assembly 5501. The various components of the ink supply valve mechanism 5500 can be integrally assembled, so that the operation of assembling the ink supply valve mechanism 5500 in the frame 5100 can be simplified.

As shown in FIG. 60(*b*), the air intake valve mechanism 5510 is provided with an actuator port (the lower end) through which an actuator (discussed below) can contact a surface outside of the ink cartridge 5001. The air intake valve mechanism 5510 includes multiple components. The air intake valve mechanism 5510 includes an intake valve jacket 5700 and a joint member 5710. The intake valve jacket 5700 surrounds the joint member 5710, provides a path for the actuator, and protrudes from the frame 5100 when the ink cartridge 5001 is assembled. The joint member 5710 may be formed of a resin material with elasticity, such as rubber. A valve member/actuator 5720 is provided above the joint member 5710, and closes an air flow path when the joint member 5710 contacts a bottom wall of the valve member/actuator 5720. A first spring member 5730 is stored in the valve member/actuator 5720 and is formed of a resin elastic material. A slider member 5740 covers a release surface of the valve member/actuator 5720 and can be moved in a uniaxial direction (axis 02 direction of the air intake valve mechanism 5510), which is a direction in which the valve member/actuator 5720 moves when pressed by a surface on the exterior of the ink cartridge 5001. A second spring member 5750 is stored within the slider member 5740 and is formed in the same shape and of the same material as the first spring member 5730. The valve member/actuator 5720, the first spring member 5730, the slider member 5740 and the second spring member 5750 constitute an air intake valve assembly 5511. The various components of the air intake valve mechanism 5510 can be integrally assembled, so that the operation of assembling the air intake valve mechanism 5510 in the frame 5100 can be simplified.

Figure 61:
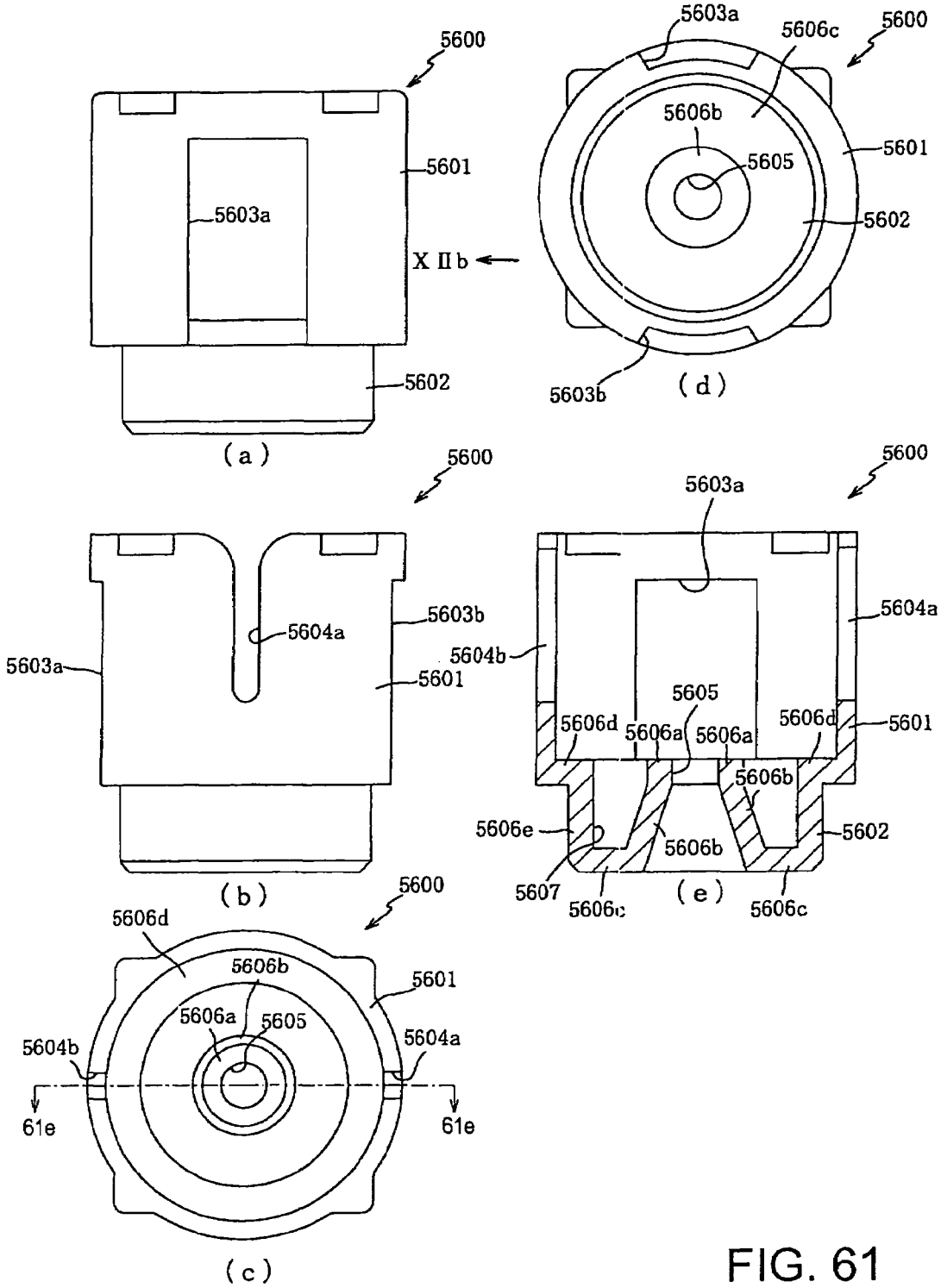
FIG. 61(*a*) is a front/rear view of a supply valve jacket of an exemplary ink cartridge according to the present invention.

FIG. 61 shows the supply valve jacket 5600. FIG. 61(*a*) is a front/rear view of the supply valve jacket 5600, FIG. 61(*b*) is a left side/right side view of the supply valve jacket 5600, FIG. 61(*c*) is a top view of the supply valve jacket 5600, FIG. 61(*d*) is a bottom view of the supply valve jacket 5600, and FIG. 61(*e*) is a cross sectional view of the supply valve jacket 5600.

The supply valve jacket 5600 is formed in a substantially cylindrical shape. As shown in FIG. 61(*a*), the supply valve jacket includes an outer circumferential wall 5601 and an inner circumferential wall 5602 located below the outer circumferential wall 5601. Tab receiving apertures 5603*a*, 5603*b* are formed in the front and rear sides of the outer circumferential wall 5601. When the supply valve jacket 5600 is fitted onto the frame 5100, the tab receiving apertures 5603 receive tabs on the frame 5100 to securely hold the supply valve jacket 5600 in place. As shown in FIG. 61(*b*), positioning slots 5604*a*, 5604*b* are formed in the left and right sides of the outer circumferential wall 5601. The positioning slots 5604*a*, 5604*b* are capable of receiving substantially planar portions of the frame 5100 to ensure that the supply valve jacket 5600 is properly positioned. As can be seen in FIG. 61(*c*), the positioning slots 5604*a*, 5604*b* extend to the upper edge of the outer circumferential wall 5601.

As can be seen in FIGS. 61(*c*), (*d*) and (*e*), in a lower interior portion of the supply valve jacket 5600, several walls define an extraction tube receiving structure 5605. The extraction tube receiving structure includes a horizontal wall 5606*d* that extends horizontally from the outer circumferential wall 5601 to the inner circumferential wall 5602. A bottom wall 5606*c* forms a bottom surface of the supply valve jacket 5600. A vertical wall 5606*e* extends between the horizontal wall 5606*d* and the bottom wall 5606*c*. An inclined wall 5606*b* defines a substantially conical space that is wider near the bottom of the supply valve jacket 5600 and narrows toward the extraction tube receiving aperture 5606*a* to effectively guide the extraction tube into the extraction tube aperture 5606*a*. The walls of the extraction tube receiving structure define a ring-shaped trench 5607 on an interior of the supply valve jacket 5600.

Figure 62:
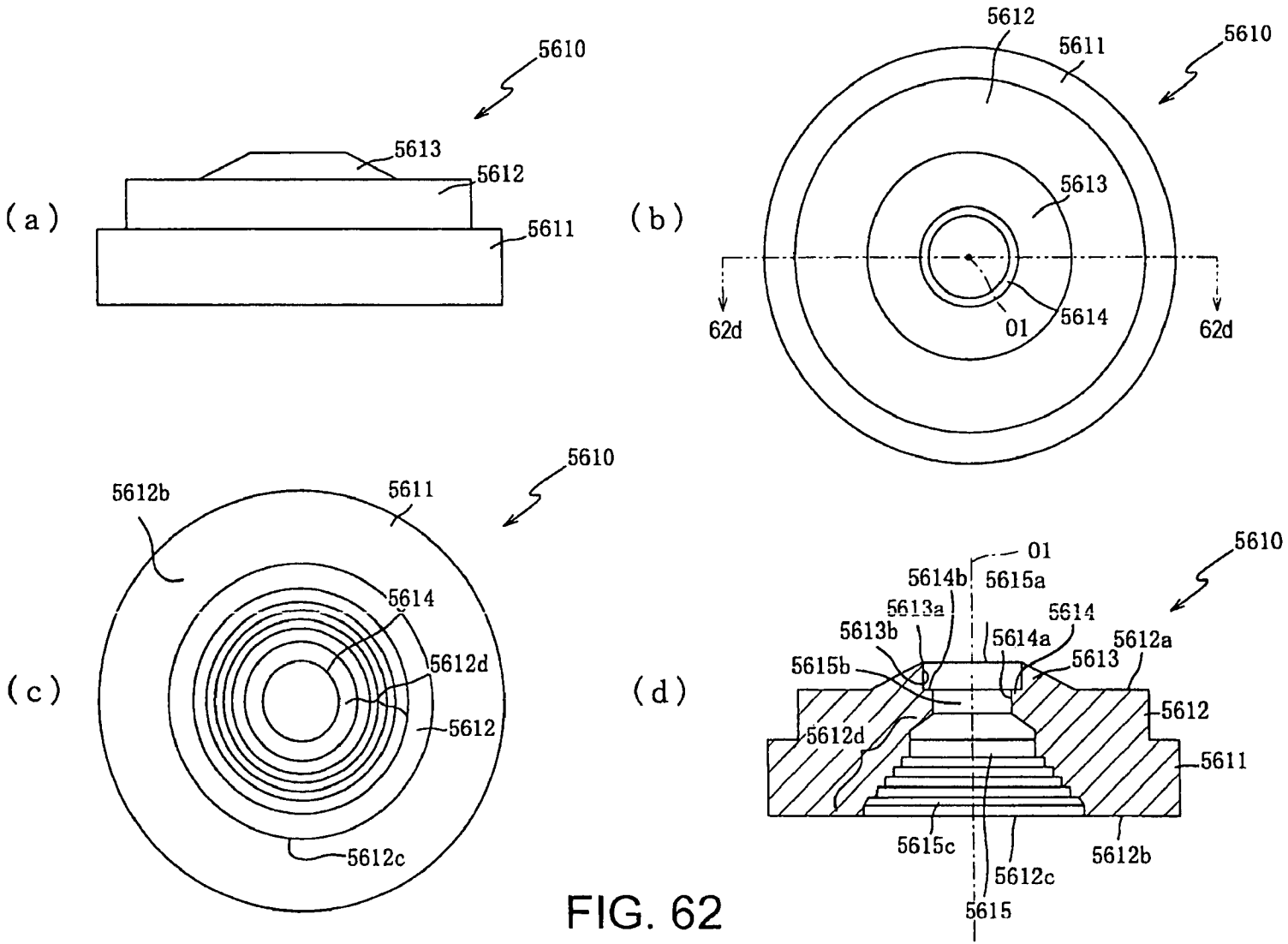
FIG. 62(*a*) is a side view of a joint member of an exemplary ink cartridge according to the present invention.

FIG. 62 shows the joint member 5610. FIG. 62(*a*) is a side view the joint member 5610, FIG. 62(*b*) is a top view of the joint member 5610, FIG. 62(*c*) is a bottom view of the joint member 5610, and FIG. 62(*d*) is a cross sectional view of the joint member 5610 shown in FIG. 62(*b*).

As shown in FIG. 62(*a*), the joint member 5610 includes three levels in a side view (seen from a direction perpendicular to the paper plane of FIG. 62(*c*)). The lowest level portion (lower side of FIG. 62(*c*)) is a joint outer circumferential portion 5611 that forms the outer circumferential portion of the joint member 5610. The portion above the joint outer circumferential portion 5611 is a joint inner circumferential portion 5612 forming the inner circumferential portion of the joint member 5610. The joint outer circumferential portion 5611 and the joint inner circumferential portion 5612 are arranged inside of the supply valve jacket 5600. The portion shown above the joint inner circumferential portion 5612 is a joint contact portion 5613 that contacts the valve member 5620. As shown in FIG. 62(*b*), the axial centers of the joint outer circumferential portion 5611, the joint inner circumferential portion 5612, and the joint contact portion 5613 are positioned on the same axial center as the axis 01 of the ink supply valve mechanism 5500. Furthermore, the joint member 5610 is formed of an elastic material such as a resin rubber.

As shown in FIG. 62(*d*), the joint contact portion 5613 protrudes from a top surface 5612*a* (surface on the side contacting the valve member 5620) of the joint inner circumferential portion 5612. The joint contact portion 5613 is formed to be narrower toward a tip end portion 5613*a* (end portion to the upper side of FIG. 62(*d*)). The tip end portion 5613*a* contacts the bottom surface of the valve member 5620, and closes the ink flow path. In addition, in the joint inner circumferential portion 5612, a joint protruding portion 5614 protrudes toward the axis 01 from an inner circumferential surface 5613*b*, an aperture 5612*c* that becomes an insertion port for the ink extraction tube 6015 is formed on the bottom surface 5612*b* (lower side of FIG. 62(*d*)) of the joint inner circumferential portion 5612, and a step surface 5614*b* is formed between the aperture 5612*c* and the joint protruding portion 5614.

Furthermore, as shown in FIG. 62(*d*), in the joint member 5610, an ink flow path 5615 is formed, which extends through the tip end portion 5613*a* (upper side of FIG. 62(*d*)) of the joint contact portion 5613 from the bottom surface 5612*b* of the joint inner circumferential portion 5612. This ink flow path 5615 includes the aperture 5612*c* formed in the bottom surface 5612*b*, a taper portion flow path 5615*c* formed by stepped surface 5612*d* connected to the aperture 5612*c*, a protruding portion flow path 5615*b* formed by an inner circumferential surface 5614*a* of the joint protruding portion 5614 connected to the stepped surface 5612*d*, a contact portion flow path 5615*a* formed by a step surface 5614*b* connected to the inner circumferential surface 5614*a* of the joint protruding portion 5614, and an inner circumferential surface 5613*b* of the joint contact portion 5613 connected to the step surface 5614*b*. Furthermore, the inner circumferential surface 5614*a* of the joint protruding portion 5614 is parallel to the axis 01, and the step surface 5614*b* is perpendicular to the axis 01.

The taper portion flow path 5615*c* is formed in a substantially hollow conical shape in which the diameter incrementally becomes smaller progressing from the aperture 5612*c* along the stepped surface 5612*d* toward the point of contact with the inner circumferential surface 5614*a* of the joint protruding portion 5614. The protruding portion flow path 5615*b* is formed in a substantially hollow cylindrical shape having the same inner diameter as the minimum inner diameter of the taper portion flow path 5615*c*. The inner diameter of the protruding portion flow path 5615*b* is formed to be slightly smaller than the diameter of the ink extraction tube 6015. The contact portion flow path 5615*a* is formed in a substantially hollow cylindrical shape having an inner diameter larger than that of the protruding portion flow path 5615*b*, and the inner diameter is larger than the diameter of the ink extraction tube 6015. Furthermore, the step surface 5614*b* is formed in the boundary between the protruding portion flow path 5615*b* and the contact portion flow path 5615*a*. Therefore, the inner diameter rapidly changes in the axis 01 direction from the protruding portion flow path 5615*b* to the contact portion flow path 5615*a*. Thus, as shown in FIG. 62(*d*), the joint contact portion 5613 has a structure notched by the inner circumferential surface 5613*b* and the step surface 5614*b* in a pedestal shape, and the tip end portion 5613*a* of the joint contact portion 5613 is positioned surrounding the notch portion.

The ink extraction tube 6015 is inserted into the aperture 5612*c*, guided by the stepped surface 5612*d* of the taper portion flow path 5615*c*, and inserted into the protruding portion flow path 5615*b*. As discussed above, the inner diameter of the protruding portion flow path 5615*b* is slightly smaller than the diameter of the ink extraction tube 6015, so the ink extraction tube 6015 is elastically adhered to the inner circumferential surface 5614*a* of the joint protruding portion 5614 that forms the protruding portion flow path 5615*b*. That is, the joint protruding portion 5614 functions so as to close around the ink extraction tube 6015 inserted into the protruding portion flow path 5615*b*. If an area of the of joint member 5610 elastically adhered to the outer circumference of the ink extraction tube 6015 becomes too large, resistance will increase when the ink cartridge 5001 is mounted to the inkjet printer 6000, and smooth mounting cannot be accomplished. However, in the embodiment shown, e.g., in FIG. 62(*d*), the joint protruding portion 5614 is arranged so that the ink extraction tube 6015 contacts only the inner circumferential surface 5614*a*. Thus, by having a small area of the joint member 5610 in contact with the ink extraction tube 6015, mounting of the ink cartridge 5001 to the inkjet printer 6000 can be smoothly performed. With respect to the ink flow path 5615, when the ink extraction tube 6015 is inserted, the flow path in which ink actually flows is inside the ink extraction tube 6015. Also, as described below, by forming the contact portion flow path 5615*a* in a pedestal shape, displacement of the joint member 5610 in the axis 01 direction can be minimized when the ink extraction tube 6015 is inserted.

Figure 63:
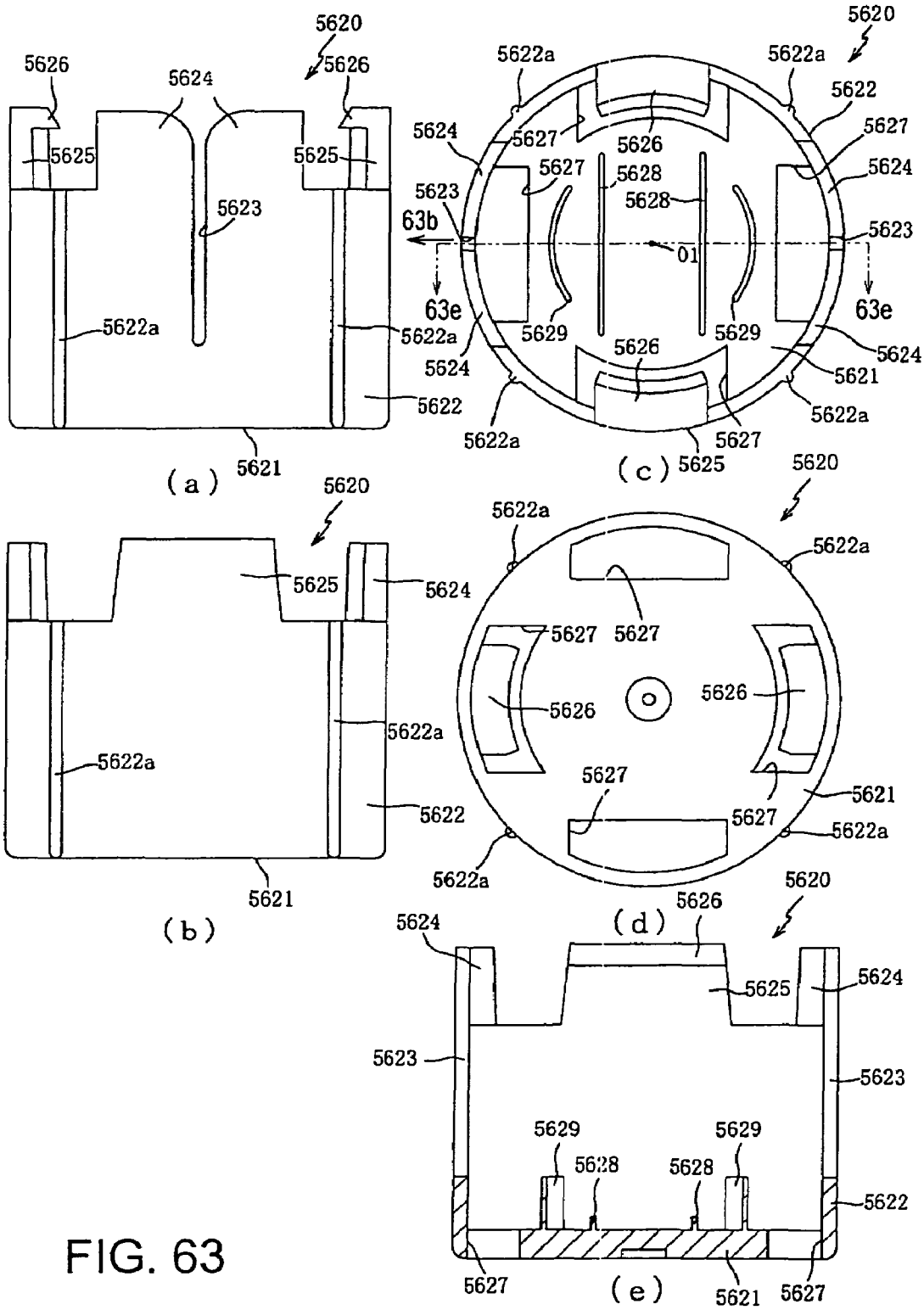
FIG. 63(*a*) is a front/rear view of a valve member of an exemplary ink cartridge according to the present invention.

FIG. 63 shows the valve member 5620. FIG. 63(*a*) is a front/rear view of the valve member 5620, FIG. 63(*b*) is a side view of the valve member 5620, FIG. 63(*c*) is a top view of the valve member 5620, FIG. 63(*d*) is a bottom view of the valve member 5620, and FIG. 63(*e*) is a cross sectional view of the valve member 5620 shown in FIG. 63(*c*).

As shown in FIG. 63(*a*), the valve member 5620 is provided with a valve bottom wall 5621 forming a bottom surface (surface at the lower side in FIG. 63(*a*)) of the valve member 5620, and a valve sidewall 5622 extending from the valve bottom wall 5621 in the axis 01 direction. The valve sidewall 5622 is provided with valve sidewall ribs 5622*a* extending in the axis 01 direction along the valve sidewall 5622. In the valve sidewall 5622, a pair of valve guide grooves 5623 are formed in which a slider loose insertion member of the slider member 5640 is loosely inserted. As shown in FIG. 63(*c*), the pair of valve guide grooves 5623 is symmetrically formed with respect to the axis 01 of the ink supply valve mechanism 5500. Furthermore, as shown in FIG. 63(*a*), the pair of valve guide grooves 5623 is formed along substantially the entire valve sidewall 5622 in the axis 01 direction. A pair of extension portions 5624 protrudes in a direction away from the valve bottom wall 5621 and defines upper edges of the valve guide grooves 5623. A pair of valve restriction portions 5625, which protrude in a direction away from the valve bottom wall 5621 and restrict the movement of the slider member 5640, are connected to the valve sidewall 5622. The respective valve restriction portions 5625 protrude toward the axis 01 at the tip end (upper side of FIG. 63(*a*)) to provide valve hook portions 5626 that engage with the slider member 5640.

As shown in FIG. 63(*b*), in the axis 01 direction of the ink supply valve mechanism 5500, the pair of valve restriction portions 5625 are formed to be shorter than the valve sidewall 5622. The pair of valve restriction portions 5625 are arranged to restrict the slider member 5640 using the valve hook portions 5626, while the valve sidewall 5622 is arranged in order to suppress the slider member 5640 from being shifted in the operation direction using the pair of valve guide grooves 5623, and to store the first spring member 5630. Accordingly, the valve sidewall 5622 is formed to be longer and larger than the pair of valve restriction portions 5625 in the axis 01 direction of the ink supply valve mechanism 5500.

As shown in FIG. 63(*c*), in the axis 01 direction (direction perpendicular to the paper plane of FIG. 63(*c*)) of the ink supply valve mechanism 5500, in the valve bottom wall 5621, at positions corresponding to the pair of valve guide grooves 5623 and the pair of valve restriction portions 5625, four ink flow paths 5627 are formed. The ink flow paths 5627 extend through the valve bottom wall 5621 in the vertical direction (direction perpendicular to the paper plane of FIG. 63(*c*)). Furthermore, valve receiving portions 5628, 5629 are provided on the valve bottom wall 5621 that protrude upwardly (front side of the direction perpendicular to the paper plane of FIG. 63(*c*)) from the valve bottom wall 5621 and form pedestals for receiving a spring top portion 5632 of the first spring member 5630. The valve receiving portions 5628 include two plate-shaped members arranged substantially parallel to each other on the valve bottom wall 5621. The valve receiving portions 5629 include two crescent-shaped members arranged to surround the valve receiving portions 5628 on the valve bottom wall 5621. Furthermore, as shown in FIG. 63(*e*), the height of the valve receiving portions 5628, 5629 in the axis 01 direction is substantially less than the height of the valve sidewall 5622. The valve receiving portions 5628, 5629 are arranged to prevent contact between the first spring member 5630 and the valve bottom wall 5621 when the first spring member 5630 is arranged in the space within the valve sidewall 5622 and to ensure positioning of the first spring member 5630 with respect to the valve member 5620. This arrangement is necessary because if the first spring member 5630 contacts the valve bottom wall 5621, the ink flow path closes and ink does not flow.

Figure 64:
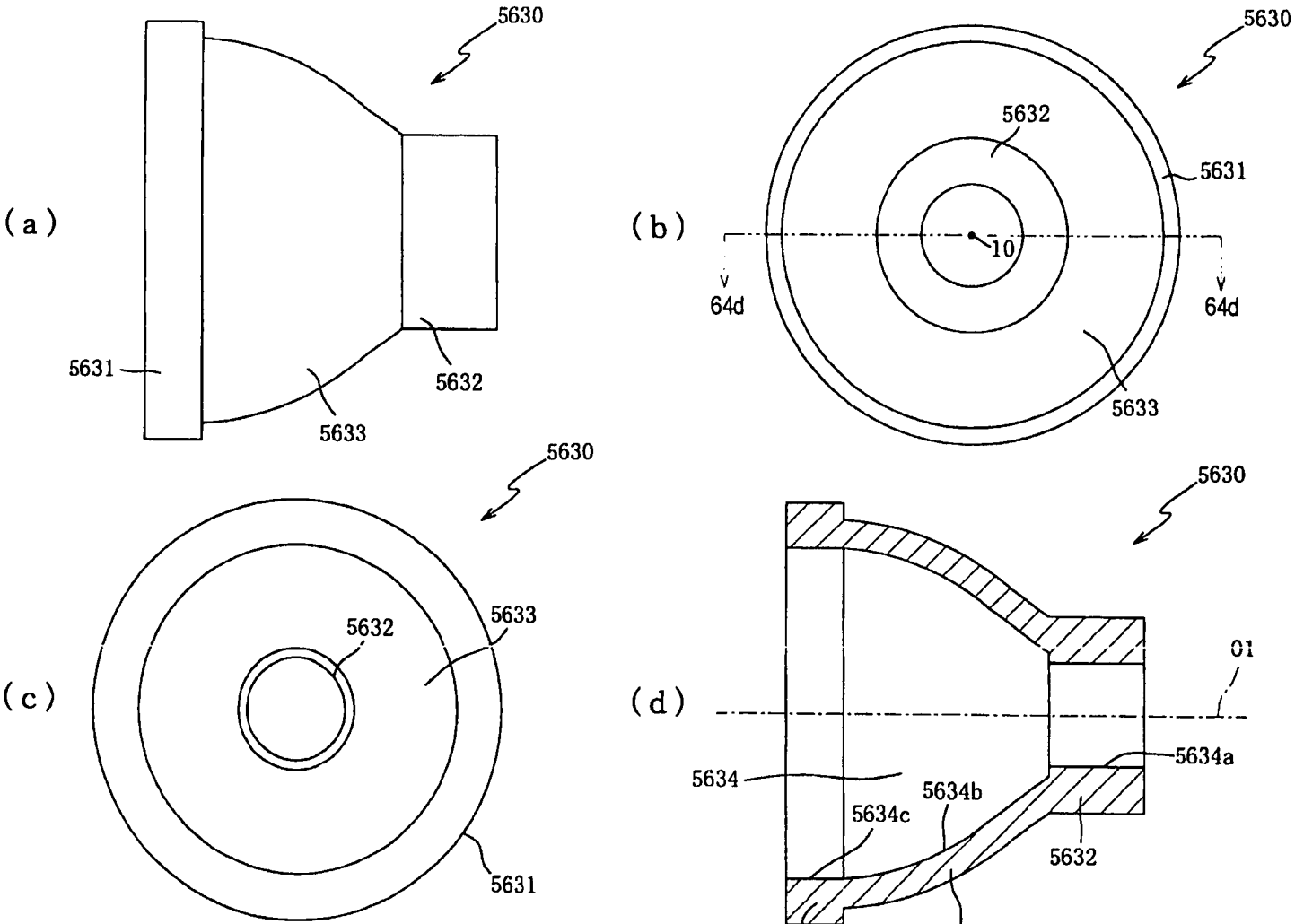
FIG. 64(*a*) is a side view of a first spring member of an exemplary ink cartridge according to the present invention.

FIG. 64 shows the first spring member 5630. FIG. 64(*a*) is a side view of the first spring member 5630, FIG. 64(*b*) is a top view of the first spring member 5630, FIG. 64(*c*) is a bottom view of the first spring member 5630, and FIG. 64(*d*) is a cross sectional view of the first spring member 5630 shown in FIG. 64(*b*).

The first spring member 5630 is formed in a substantially hollow conical/hemispherical shape (or bowl shape), and includes an annular-shaped spring bottom portion 5631 that forms a bottom surface (end portion with the larger diameter) of the first spring member 5630, an annular-shaped spring top portion 5632 that forms a top portion (end portion with the smaller diameter) above the first spring member 5630, and hollow conical spring flexible portion 5633 that is provided between the spring top portion 5632 and the spring bottom portion 5631. The spring flexible portion 5633 is bent and deformed when a load of the ink supply valve mechanism 5500 in the axis 01 direction is applied (e.g., when the valve member 5620 pressed by the ink extraction tube 6015 in an urging direction of the first spring member 5630 and the second spring member 5650). The spring top portion 5632 contacts the valve receiving portions 5628, 5629 of the valve member 5620 and acts as a pressing portion that presses the valve member 5620. Furthermore, the diameter of the spring bottom portion 5631 is larger than the diameter of the spring top portion 5632, so the spring bottom portion 5631 acts as a base portion when the spring flexible portion 5633 is elastically deformed.

As shown in FIG. 64(*d*), in the first spring member 5630, an ink flow path 5634 extends from the bottom surface (end surface of the left side of FIG. 64(*d*)) of the spring bottom portion 5631 to the tip end (end surface of the right side of FIG. 64(*d*)) of the spring top portion 5632. This ink flow path 5634 includes a top portion flow path 5634*a* formed by the inner circumferential surface of the spring top portion 5632, a flexible portion flow path 5634*b* formed by the inner circumferential surface of the spring flexible portion 5633, and a bottom portion flow path 5634*c* formed by the inner circumferential surface of the spring bottom portion 5631. As shown in FIG. 64(*d*), the aperture area of the ink flow path 5634 gradually becomes larger from the tip end of the spring top portion 5632 to the bottom surface of the spring bottom portion 5631.

As shown in FIG. 64(*d*), the spring top portion 5632 is formed in a cylindrical shape, which is relatively thick and extends in the axis 01 direction. The spring top portion 5632 is formed so that the cross sectional shape perpendicular to the axis 01 direction (urging direction of the first spring member 5630) is made uniform. In the same manner, the spring bottom portion 5631 is also formed in a cylindrical shape, which is relatively thick and extends in the axis 01 direction, and the cross sectional shape perpendicular to the axis 01 direction is uniform.

In addition, as shown in FIG. 64(*d*), the spring flexible portion 5633 is formed in a substantially conical/hemispherical shape, which curves with respect to the axis 01 direction, whereby the strength of the spring flexible portion 5633 bearing a load in the axis 01 direction is less than that of the spring bottom portion 5631 and the spring top portion 5632. Furthermore, the thickness of the spring flexible portion 5633 is less than that of the spring bottom portion 5631 and the spring top portion 5632, contributing to the lesser strength of the spring flexible portion 5633. Therefore, when the first spring member 5630 is elastically deformed, the spring flexible portion 5633 is bent and deformed.

The second spring member 5650 is formed in the same shape as the first spring member 5630. The structure of the second spring member 5650 includes the spring bottom portion 5631, the spring top portion 5632, the spring flexible portions 5633, and the ink flow path 5634.

Figure 65:
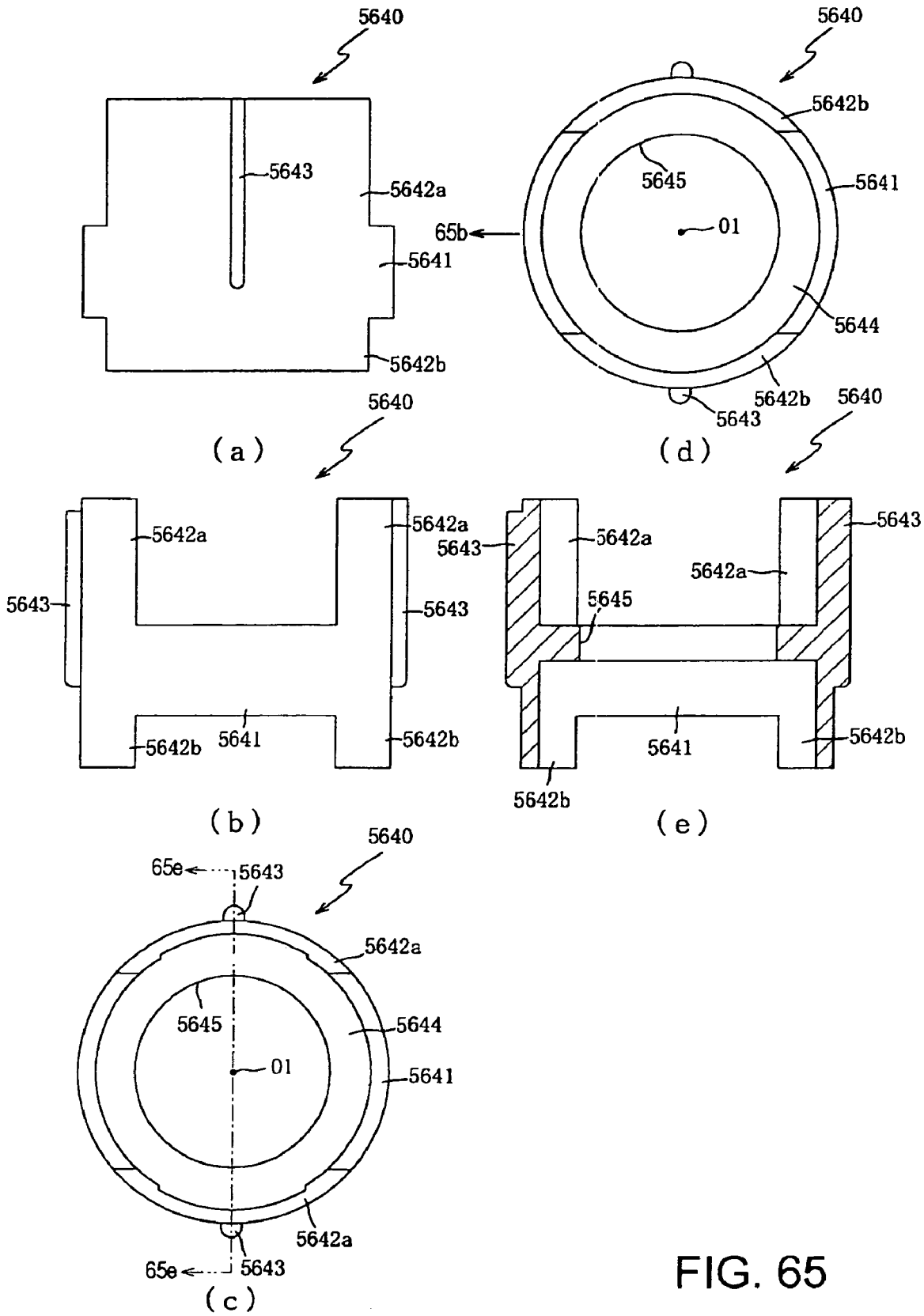

FIG. 65 shows the slider member 5640. FIG. 65(*a*) is a front/rear view of the slider member 5640, FIG. 65(*b*) is a left side/right side view of the slider member 5640, FIG. 65(*c*) is a top view of the slider member 5640, FIG. 65(*d*) is a bottom view of the slider member 5640, and FIG. 65(*e*) is a cross sectional view of the slider member 5640 shown in FIG. 65(*c*).

As shown in FIGS. 65(*a*) and (*b*), the slider member 5640 is formed of resin material that has a greater hardness than the first spring member 5630 and the second spring member 5650, and includes a slider outer circumferential wall 5641 that forms the outer circumference of the slider member 5640, two slider protruding portions 5642*a*, 5642*b* that extend in the axis 01 direction of the ink supply valve mechanism 5500 from the slider outer circumferential wall 5641 and are formed symmetrically about the axis 01, and a pair of slider loose insertion members 5643 that are arranged on and along the slider outer circumferential wall 5641 and the slider protruding portions 5642*a*, are formed symmetrically about the axis 01 and are loosely inserted to the pair of valve guide grooves of the valve member 5620. The slider outer circumferential wall 5641 and the slider protruding portions 5642*a* and 5642*b* are together formed in a substantially cylindrical shape.

The spring members 5630, 5650 are arranged in the inner spaces of the slider member 5640 in the axis 01 direction. Movement of the respective spring members 5630, 5650 in the direction perpendicular to the axis 01 is restricted by the slider protruding portions 5642*a*, 5642*b* and the slider outer circumferential wall 5641.

The slider loose insertion members 5643 extend along the slider member 5640 in the axis 01 direction (formed over the slider outer circumferential wall 5641 and slider protruding portion 5642*a*). Movement of the slider member 5640 in the axis 01 direction occurs smoothly by cooperation between the slider loose insertion member 1030 and the pair of valve guide grooves of the valve member 5620.

As shown in FIGS. 65(*c*) and (*d*), inside of the slider outer circumferential wall 5641, a slider pedestal portion 5644 is provided on which the respective spring members 5630, 5650 are arranged. The slider pedestal portion 5644 contacts the spring bottom portion 5631 of the respective spring members 5630, 5650. The slider pedestal portion 5644 divides two inner spaces that accommodate the respective spring members 5630, 5650 within the slider member 5640. In the center of the slider pedestal portion 5644, a slider through hole 5645 is formed, and the slider through hole 5645 becomes a flow path in which ink flows. As shown in FIG. 65(*e*), in the axis 01 direction of the slider member 5640, the slider pedestal portion 5644 is formed in a substantially intermediate position.

Figure 66:
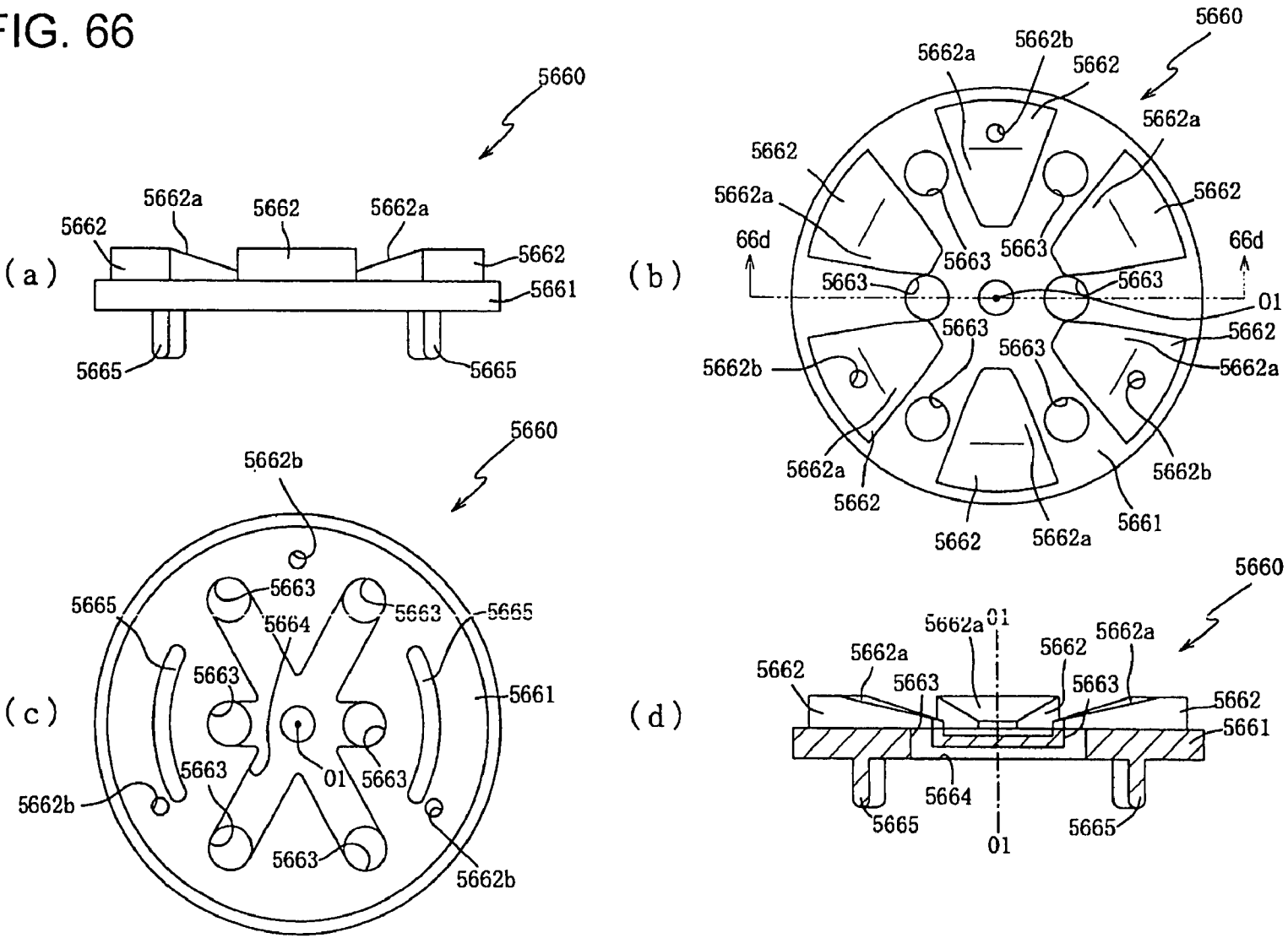

FIG. 66 shows the pedestal member 5660. FIG. 66(*a*) is a side view of the pedestal member 5660, FIG. 66(*b*) is a top view of the pedestal member 5660, FIG. 66(*c*) is a bottom view of the pedestal member 5660, and FIG. 66(*d*) is a cross sectional view of the pedestal member 5660 shown in FIG. 66(*b*).

As shown in FIG. 66(*a*), the pedestal member 5660 is provided with a pedestal bottom portion 5661 that forms a bottom surface of the pedestal member 5660 and contacts the spring top portion 5632 of the second spring member 5650. The pedestal member 5660 is provided with spring positioning protrusions 5665, which ensure proper positioning of the second spring member 5650 with respect to the pedestal member 5660. The pedestal member is further provided with pedestal receiving portions 5662 that are arranged on the top surface (upper side of FIG. 66(*a*)) of the pedestal bottom portion 5661. The pedestal receiving portions 5662 are provided with pedestal inclined surfaces 5662*a* that are downwardly inclined approaching the center of the pedestal member 5660, and the later-described check valve 5670 is received by the pedestal inclined surfaces 5662*a*.

As shown in FIG. 66(*b*), the six pedestal receiving portions 5662 are arranged at a predetermined interval in a circumferential direction about the pedestal member 5660. Furthermore, three of the six pedestal receiving portions 5662 include first pedestal through holes 5662*b* that extend from the front to the back of the pedestal member 5660. The first pedestal through holes 5662*b* are formed in portions (horizontal portions of the pedestal receiving portions 5662) of the pedestal receiving portions 5662 other than the portions at which the pedestal inclined surfaces 5662*a* are provided. Thus, the first pedestal through holes 662*b* are formed in portions other than the portions that receive the check valve 5670. This configuration prevents suppression of ink flow.

Furthermore, between the pedestal receiving portions 5662 of the pedestal member 5660, second pedestal through holes 5663 are formed, which extend through the pedestal bottom portion 5661. The second pedestal through holes 5663 are formed between the pedestal receiving portions 5662, so that six second pedestal through holes 5663 are formed in a circumferential direction about the pedestal member 5660. The second pedestal through holes 5663 form ink flow paths through which ink flows.

As shown in FIG. 66(*c*), on the bottom surface of the pedestal bottom portion 5661, concave-shaped pedestal through grooves 5664 are formed, which connect the respective second pedestal through holes 5663. The pedestal through grooves 5664 connect the second pedestal through holes 5663 in a substantially straight lines that pass through and are symmetrical about the axis 01. Thus, in the pedestal bottom portion 5661, three pedestal through grooves 5664 are formed, which cross each other at the axis 01.

As shown in FIG. 66(*d*), between the pedestal inclined surfaces 5662*a* of the pedestal receiving portions 5662 and the second pedestal through holes 5663, a gap is formed in the axis 01 direction. Thus, even when the check valve 5670 is supported by the pedestal inclined surfaces 5662*a*, ink flow is ensured. Furthermore, with respect to the pedestal through grooves 5664, the end surface of the spring top portion 5632 of the second spring member 5650 is positioned inside of the second pedestal through holes 5663, so even when the end surface of the spring top portion 5632 of the second spring member 5650 contacts the pedestal member 5660, ink flow is ensured by the pedestal through grooves 5664.

FIG. 67 shows the check valve 5670. FIG. 67(*a*) is a side view of a check valve 5670, FIG. 67(*b*) is a cross sectional view of the check valve 5670, FIG. 67(*c*) is a top view of the check valve 5670, and FIG. 67(*d*) is a bottom view of the check valve 5670.

The check valve 5670 is provided with a check valve plate portion 5671 that is formed in a substantially plate shape, a check valve shaft portion 5672 that is formed in a substantially bar shape, and a check valve ball portion 5672*a* that is formed in a substantially spherical shape. An upper surface of the check valve plate portion 5671 includes a thick portion 5671*a* in proximity to the check valve shaft portion 5672 and a thin portion 5671*b* at an outer periphery of the check valve plate portion 5671. The lower surface of the check valve plate portion 5671 is received by pedestal receiving portions 5662 of the pedestal member 5660. Therefore, when the check valve plate portion 5671 of the check valve 5670 is received by the pedestal receiving portions 5662 of the pedestal member 5660, the ink flow path is open, and when the check valve plate portion 5671 of the check valve 5670 contacts the cover member 5680, the ink flow path is closed.

FIG. 68 shows the cover member 5680. FIG. 68(*a*) is a side view of the cover member 5680, FIG. 68(*b*) is a top view of the cover member 5680, FIG. 68(*c*) is a bottom view of the cover member 5680, and FIG. 68(*d*) is a cross sectional view of the cover member 5680 shown in FIG. 68(*b*).

The cover member 5680 is formed in a substantially cylindrical shape in which a lower surface side is open. The cover member 5680 is provided with a cover outer circumferential wall 5681 that forms the outer circumference and a cover top portion 5682 that forms the top surface (upper side of FIG. 68(*a*)) of the cover member 5680, and the lower surface is open. The pedestal member 5660 is engaged with the opening of the lower surface (lower side of FIG. 68(*a*)) of the cover member 5680, and the check valve 5670 is accommodated between the pedestal member 5660 and the cover member 5680. That is, the cover member 5680 and the pedestal member 5660 constitute a case, which accommodates the check valve.

As shown in FIGS. 68(*b*) and (*c*), in the cover top portion 5682, six cover through holes 5683 are formed in circumferential locations through the cover top portion 5682. These cover through holes 5683 become flow paths through which ink flows, and as the check valve 5670 contacts the cover top portion 5682, the cover through holes 5683 are closed, and the ink flow paths are closed. A check valve accommodating hole 5684 through which the check valve shaft portion 5672 of the check valve 5670 passes is also provided in the cover top portion 5682.

FIG. 69 shows the intake valve jacket 5700. FIG. 69(*a*) is a front/rear view of the intake valve jacket 5700, FIG. 69(*b*) is a left side/right side view of the intake valve jacket 5700, FIG. 69(*c*) is a top view of the intake valve jacket 5700, FIG. 69(*d*) is a bottom view of the intake valve jacket 5700, and FIG. 69(*e*) is a cross sectional view of the intake valve jacket 5700.

The intake valve jacket 5700 is formed in a substantially cylindrical shape. As shown in FIG. 69(*a*), the supply valve jacket includes an outer circumferential wall 5701 and a bottom wall 5702 adjoining a bottom edge of the outer circumferential wall 5701. Tab receiving apertures 5703*a*, 5703*b* are formed in the front and rear sides of the outer circumferential wall 5701. When the intake valve jacket 5700 is fitted onto the frame 5100, the tab receiving apertures 5703 receive tabs on the frame 5100 to securely hold the intake valve jacket 5700 in place. As shown in FIG. 69(*b*), positioning slots 5704*a*, 5704*b* are formed in the left and right sides of the outer circumferential wall 5701. The positioning slots 5704*a*, 5704*b* are capable of receiving substantially planar portions of the frame 5100 to ensure that the intake valve jacket 5700 is properly positioned. As can be seen in FIG. 69(*c*), the positioning slots 5704*a*, 5704*b* extend to the upper edge of the outer circumferential wall 5701.

As can be seen in FIGS. 69(*c*), (*d*) and (*e*), the bottom wall 5702 includes a circular aperture 5705. Portions of the joint member 5710 and the valve member/actuator 5720 protrude through the circular aperture 5705 when the ink cartridge 5001 is assembled.

FIG. 70 shows the joint member 5710. FIG. 70(*a*) is a side view the joint member 5710, FIG. 70(*b*) is a top view of the joint member 5710, FIG. 70(*c*) is a bottom view of the joint member 5710, and FIG. 70(*d*) is a cross sectional view of the joint member 5710 shown in FIG. 70(*b*).

As shown in FIG. 70(*a*), the joint member 5710 includes four levels in a side view (seen from a direction perpendicular to the paper plane of FIG. 70(*c*)). The lowest level portion (lower side of FIG. 70(*c*)) is a collar portion 5714. The collar portion 5714 is exposed to the outside of the frame 5100 through the intake valve jacket 5700. Above the collar portion 5714 is a joint outer circumferential portion 5711 that forms the outer circumferential portion of the joint member 5710. The portion above the joint outer circumferential portion 5711 is a joint inner circumferential portion 5712 forming the inner circumferential portion of the joint member 5710. The joint outer circumferential portion 5711 and the joint inner circumferential portion 5712 are arranged inside of the supply valve jacket 5700. The portion shown above the joint inner circumferential portion 5712 is a joint contact portion 5713 that contacts the valve member/actuator 5720. As shown in FIG. 70(*b*), the axial centers of the joint outer circumferential portion 5711, the joint inner circumferential portion 5712, and the joint contact portion 5713 are positioned on the same axial center as the axis 02 of the air intake valve mechanism 5510. Furthermore, the joint member 5710 is formed of an elastic material such as a resin rubber.

As shown in FIG. 70(*d*), the joint contact portion 5713 protrudes from a top surface 5712*a* (surface on the side contacting the valve member/actuator 5720) of the joint inner circumferential portion 5712. The joint contact portion 5713 is formed to be narrower toward a tip end portion 5713*a* (end portion to the upper side of FIG. 70(*d*)). The tip end portion 5713*a* contacts the bottom surface of the valve member/actuator 5720, and closes the air flow path. In the joint member 5710, an air flow path 5715 is formed having a stepped structure that decreases in width as it approaches the tip end portion 5713*a*. When the ink cartridge 5001 is assembled, the actuator 5721*a* of the valve member/actuator 5720 extends through the air flow path 5715.

FIG. 71 shows the valve member/actuator 5720. FIG. 71(*a*) is a front/rear view of the valve member/actuator 5720, and FIG. 71(*b*) is a bottom view of the valve member/actuator 5720.

As shown in FIG. 71(*a*), the valve member/actuator 5720 is provided with a valve bottom wall 5721 forming a bottom surface (surface at the lower side in FIG. 71(*a*)) of the valve member/actuator 5720, and a valve sidewall 5722 extending from the valve bottom wall 5721 in the axis 02 direction. The valve sidewall 5722 is provided with valve sidewall ribs 5722*a* extending in the axis 01 direction along the valve sidewall 5722. In the valve sidewall 5722, a pair of valve guide grooves are formed in which a slider loose insertion member of the slider member 5740 is loosely inserted. The pair of valve guide grooves 5723 is symmetrically formed with respect to the axis 02 of the air intake valve mechanism 5510. The pair of valve guide grooves 5723 is formed along substantially the entire valve sidewall 5722 in the axis 02 direction. A pair of extension portions 5724 protrudes in a direction away from the valve bottom wall 5721 and defines upper edges of the valve guide grooves 5723. A pair of valve restriction portions 5725, which protrude in a direction away from the valve bottom wall 5721 and restrict the movement of the slider member 5740, are connected to the valve sidewall 5722. The respective valve restriction portions 5725 protrude toward the axis 02 at the tip end (upper side of FIG. 71(*a*)) and are provided with valve hook portions 5726 that engage with the slider member 5740.

Extending from the valve bottom wall 5721 of the valve member/actuator 5720, an actuator 5721*a* is provided. The actuator 5721*a* extends away from the valve bottom wall 5721 in the axis 02 direction. The actuator 5721*a* is provided with actuator ribs 5721*b*, which extend vertically along the length of the actuator 5721*a*. When the ink cartridge 5001 is assembled, the actuator 5721*a* extends to the outside of the ink cartridge 5001. When the actuator 5721*a* is pressed by a surface outside of the ink cartridge 5001, the resulting force presses the valve member/actuator 5720 upwardly in the axis 02 direction, operating to open the air intake valve mechanism 5510 and to permit air to flow into the ink cartridge 5001.

In the axis 02 direction of the air intake valve mechanism 5510, the pair of valve restriction portions 5725 are formed to be shorter than the valve sidewall 5722. The pair of valve restriction portions 5725 are arranged to restrict the slider member 5740 using the valve hook portions 5726, while the valve sidewall 5722 is arranged in order to suppress the slider member 5740 from being shifted in the operation direction using the pair of valve guide grooves 5723, and to store the first spring member 5730. Accordingly, the valve sidewall 5722 is formed to be longer and larger than the pair of valve restriction portions 5725 in the axis 02 direction of the air intake valve mechanism 5510.

In the axis 02 direction of the air intake valve mechanism 5510, in the valve bottom wall 5721, at positions corresponding to the pair of valve guide grooves 5723 and the pair of valve restriction portions 5725, four air flow paths 5727 are formed. The air flow paths 5727 extend through the valve bottom wall 5721 in the vertical direction. Valve receiving portions 5728, 5729 (see FIG. 80) are provided on the valve bottom wall 5721 that protrude upwardly from the valve bottom wall 5721 and form pedestals for receiving a spring top portion 5732 of the first spring member 5730.

As shown in FIG. 60, and discussed above, the air intake valve mechanism 5510 also includes the first spring member 5730, the slider member 5740, and the second spring member 5750. The structures of these features are not shown in separate drawings because the structures correspond substantially to the first spring member 5730, the slider member 5740, and the second spring member 5750, respectively, of the ink supply valve mechanism 5510. For example, the first spring member 5730 includes a spring bottom portion 5731, a spring top portion 5732, a spring flexible portion 5733, and an air flow path 5734, that correspond substantially in structure to the spring bottom portion 5631, the spring top portion 5632, the spring flexible portion 5633, and the ink flow path 5634 of the first spring member 5630. Likewise, the slider member 5740 includes slider protruding portions 5742*a*, 5742*b*, slider loose insertion members 5743, a slider pedestal portion 5744, and a slider through hole 5745, that correspond substantially in structure to the slider protruding portions 5742*a*, 5742*b*, the slider loose insertion members 5743, the slider pedestal portion 5744, and the slider through hole 5745 of the slider member 5640. Also, the second spring member 5750 includes a spring bottom portion 5751, a spring top portion 5752, a spring flexible portion 5753, and an air flow path 5754, that correspond substantially in structure to the spring bottom portion 5651, the spring top portion 5652, the spring flexible portion 5653, and the ink flow path 5654 of the second spring member 5630.

FIG. 72 is a partial cross sectional view of the frame body 5110 showing the configurations of the ink supply valve mechanism 5500 and the air intake valve mechanism 5510 assembled in the frame body 5110. As shown in FIG. 72, the ink supply valve mechanism 5500 and the air intake valve mechanism 5510 are separated in the frame body 5110 by the ink detection projection 5140.

The ink supply valve mechanism 5500 is situated in the frame body 5110 so that its constituent elements are arranged in order from the bottom of the frame body 5110 (left side of FIG. 72) as follows: the supply valve jacket 5600 at the bottommost position, the joint member 5610, the valve member 5620, the first spring member 5630, the slider member 5640, the second spring member 5650, the pedestal member 5660, the check valve 5670 and the cover member 5680 at the topmost position. The ink supply valve mechanism 5500 is inserted into an ink supply valve mechanism insertion portion 5800 provided in the ink supply chamber 5116 of the frame body 5110. Above the ink supply valve mechanism insertion portion 5800 (to the right side of FIG. 72), an ink supply chamber 5801 is provided. Ink is supplied to the ink supply valve mechanism insertion portion 5800 of the frame body 5110 from an ink supply aperture 5423 via the ink supply chamber 5801, a stepped portion 5801*a* that holds the cover member 5680, and an ink supply chamber aperture 5421 that separates the ink supply chamber 5801 and the stepped portion 5801*a*.

The air intake valve mechanism 5510 is situated in the frame body 5110 so that its constituent elements are arranged in order from the bottom of the frame body 5110 (left side of FIG. 72) as follows: the intake valve jacket 5700 at the bottommost position, the joint member 5710, the valve member/actuator 5720, the first spring member 5730, the slider member 5740, and the second spring member 5750 at the topmost position. The air intake valve mechanism 5510 is inserted into is inserted into an air intake valve mechanism insertion portion 5810 provided in an air intake chamber 5117 of the frame body 5110. The air intake valve mechanism insertion portion 5810 communicates with a lower air intake chamber 4431 of the frame body 5110 via a lower air intake chamber aperture 5434. The air intake valve insertion portion is provided with spring member receiving portions 5811 for receiving the second spring member 5750.

FIG. 73 shows how the film 5160 is affixed to the frame body 5110. FIG. 73(*a*) is a right side view of the frame body 5110 prior to application of the film 5110, and FIG. 73(*b*) is a front view of the frame body 5110 prior to application of the film 5160.

As shown in FIG. 73(*a*), prior to application of films 5160 to the frame body 5110, the films are placed in proximity to the outer film contact surface 5112*a* of the front side of the frame body 5110 and an outer film contact surface 5112*b* of the rear side of the frame body 5110. As indicated by the arrows H, the films 5160 are affixed to the outer film contact surface 5112*a* and the outer film contact surface 5112*b* by application of heat and pressure (e.g., heat welding). As shown in FIG. 73(*b*), the films 5160 include a contact portion 5900, which is applied to the frame body 5110. A remainder of the films 5160 may be cut away and discarded, after the films 5160 have been affixed to the frame body 5110.

FIG. 74 shows a process by which the frame body 5110 is filled with ink. FIG. 74(*a*) is a front view of the frame body 5110 prior to installation of the ink supply valve mechanism 5500 and the air intake valve mechanism 5510, FIG. 74(*b*) is a front view of the frame body 5110 prior to addition of ink to the frame 5110, and FIG. 74(*c*) is a front view of the frame body 5110 after to addition of ink to the frame body 5110.

FIG. 74(*a*) shows the frame body 5110 after the film 5160 has been affixed to its front side. The bold lines in FIGS. 74(*a*), (*b*) and (*c*) show the locations where the film 5160 is sealed on the frame body 5110. When the components of the ink supply valve mechanism 5500 and the air intake valve mechanism 5510, shown in FIG. 74(*a*), are brought into contact with the ink supply chamber 5116 and the air intake chamber 5117 in the direction of the shown arrows, the ink supply valve fastening rib 5116*a* of the ink supply chamber 5116, and the air intake valve fastening rib 5117*a* of the air intake chamber 5117 engage the tab receiving apertures 5603*a*, 5703*a* of the supply valve jacket 5600 and the intake valve jacket 5700, respectively (also, a rear side ink supply valve fastening rib (not shown) and a rear side air intake valve fastening rib (not shown) engage the tab receiving apertures 5603*b*, 5703*b*, respectively).

FIG. 74(*b*) shows communication between a pressure reducing device 5910 and the frame body 5110 after the ink supply valve mechanism 5500 and the air intake valve mechanism 5510 are assembled to the frame body 5110. The pressure reducing device 5910 includes a vacuum pump 5912 and an extraction tube 5911. The extraction tube 5911 is inserted into the ink supply port 5120 and air in the ink storage space of the frame body 5110 is extracted from the frame body 5110. As a result, the ink storage space has a lower pressure than an area outside of the ink storage space (e.g., atmospheric pressure). In FIG. 74(*c*), an ink insertion needle 5920 is inserted into the frame body 5110 (e.g., through the stopper 5520), and the frame body 5110 is filled with ink. Preferably, after filling, an ink level I is lower than a location of the upper air intake aperture 5435 and the upper air intake through hole 5436, when the frame body 5110 is in an upright position.

FIG. 75 shows assembly of the frame body 5110 and the case 5200. FIG. 75(*a*) is a perspective view of the frame body 5110, the rear case portion 5210, and the front case portion 5220 prior to assembly, and FIG. 75(*b*) is a front view of the ink cartridge 5001 after assembly of the frame body 5110 and the case 5200. As shown in FIG. 75(*a*), the ink cartridge 5001 is assembled by bringing the front case portion 5200*b* and the rear case portion 5200*a* together so that the ink supply port 5120, the air intake port 5130, and the ink detection projection 5140 are seated in the rear supply aperture portion 5211, the rear air intake aperture portion 5212, and the rear ink detector aperture portion 5213, respectively. Also, the positioning apertures 5460*a*, 5460*b*, 5460*c* are brought into contact with the positioning pins 5215*a*, 5215*b*, 5215*c* so as achieve engagement. The assembled cartridge 5001 is shown in FIG. 75(*b*).

FIG. 76 shows preparation and packaging of the ink cartridge 5001. FIG. 76(*a*) is a perspective view of the cap 5300 and the case 5200 prior to assembly, and FIG. 76(*b*) is a perspective view of the ink cartridge 5001 during packaging.

As shown in FIG. 76(*a*), the cap 5300 is assembled to the case 5200 in the direction of the shown arrows. During assembly, the engaging projections 5330*a*, 5330*b* for engaging with the projection apertures on the case 5200 (e.g., the projection aperture formed by the rear intake side projection aperture 5214*b*1 and a front intake side projection aperture 5224*b*1). As shown in FIG. 76(*b*), the ink cartridge 5001 is placed into a resin bag 5930. The resin bag 5930 is prepared for shipping, etc., using a pressure reducing device 5940. The pressure reducing device 5940 includes a vacuum pump 5942 and an extraction tube 5941. The extraction tube 5911 is inserted an aperture 5931 in the resin bag 5930, and air in the resin bag 5930 is extracted. As a result, after sealing the aperture 5931, the resin bag 5930 has a lower pressure than an area outside of the ink storage space (e.g., atmospheric pressure).

FIG. 77 shows the operation of mounting the ink cartridge 5001 to the inkjet printer 6000. FIG. 77(*a*) is a cross sectional view of the ink cartridge 5001 and the inkjet printer 6000 prior to mounting, FIG. 77(*b*) is a cross sectional view of the ink cartridge 5001 and the inkjet printer 6000 during mounting, and FIG. 77(*c*) is a cross sectional view of the ink cartridge 5001 and the inkjet printer 6000 after mounting.

As shown in FIG. 77(*a*), the inkjet printer 6000 includes a cartridge mounting assembly 6010 for mounting the ink cartridge 5001. The cartridge mounting assembly 6010 includes receiving walls 6011 for receiving the sides of the ink cartridge 5001. The receiving wall 6011 on the side of the cartridge mounting assembly 6010 corresponding to the intake side of the ink cartridge 5001 includes an intake side engaging protrusion 6011*a*. The ink cartridge mounting assembly 6010 also includes a mounting base 6013 for receiving a bottom portion of the ink cartridge 5001. The mounting base 6013 includes an ink passage 6013*a* for supplying ink to a print head (not shown). An ink extraction tube 6015 is connected to the ink passage 6013*a* and extends horizontally away from the mounting base 6013. The mounting base 6013 further includes an air passage 6013*b* through which air can be provided to the ink cartridge 5001.

A detection device 6014 is provided on the mounting base 6013. The detection device includes a light emitting portion 6014*a* and a light receiving portion (not shown). The detection device 6014 is configured to receive the ink detection projection 5140 between the light emitting portion 6014*a* and the light receiving portion.

At the locations where the mounting base 6013 intersects with the receiving walls 6011, a supply side recess 6016*a* and an intake side recess 6016*b* are provided. An intake side displacement projection 6016*b*1 is provided along the intake side receiving wall 6011 adjacent to the intake side recess 6016*b*.

A cover 6017 is provided at an edge (right edge in FIG. 77) of the supply side receiving wall 6011. The cover includes a cover hinge projection 6017*a*, a cover hinge 6017*b* and a cover upper surface 6017*c*. The cover 6017 is further provided with a cover end projection 6017*d* that engages a cover receiving recess 6018 of the cartridge mounting assembly 6010.

As shown in FIG. 77(*a*), prior to mounting, the cover 6017 of the cartridge mounting assembly 6010 is opened, and the ink cartridge 5001 is positioned so that a bottom surface of the ink cartridge 5001 (after the cap 5300 is removed) will be inserted first into the inkjet printer 6000. The mounting procedure begins by moving the ink cartridge 5001 in the direction shown by the arrow E. As shown in FIG. 77(*b*), the ink cartridge 5001 is horizontally inserted into the space defined by the mounting base 6013 and the receiving walls 6011. As the ink cartridge 5001 is inserted into the space, the front intake side projection portion 5224*b* of the ink cartridge 5001 contacts the intake side displacement projection 6016*b*1, causing the intake side receiving wall 6011 to be moved outwardly away from front intake side outer surface 5227 of the ink cartridge 5001.

When the ink cartridge 5001 is fully inserted into the cartridge mounting assembly 6010, the intake side receiving wall 6011 returns toward the intake side outer surface 5227 of the ink cartridge 5001, and the intake side engaging protrusion 6011*a* engages the intake side recess 5227*b* of the ink cartridge 5001. The supply side restrictor plate 5226*b* engages the cover hinge projection 6017*a*, and the cover 6017 is closed over the top surface of the ink cartridge 5001 in the direction of the arrow F. The ink extraction tube 6015 is inserted into the ink supply port 5120, the air intake port 5130 is moved into proximity with the air passage 6013*b*, and the ink detection projection 5140 is located between the light emitting portion 6014*a* and the light receiving portion. When the ink cartridge 5001 is positioned as shown in FIG. 77(*c*), the inkjet printer 6000 can perform printing operations.

FIG. 78 shows the operation of dismounting the ink cartridge 5001 from the inkjet printer 6000. FIG. 78(*a*) is a cross sectional view of the ink cartridge 5001 and the inkjet printer 6000 prior to dismounting, FIG. 78(*b*) is a cross sectional view of the ink cartridge 5001 and the inkjet printer 6000 during dismounting, and FIG. 78(*c*) is a cross sectional view of the ink cartridge 5001 and the inkjet printer 6000 after dismounting.

In FIG. 78(*a*), the ink cartridge 5001 is positioned as shown in FIG. 77(*c*). The dismounting procedure begins by moving the cover 6017 in the direction shown with the arrow S. As the cover 6017 is further moved as shown by the arrow T, the cover hinge projection 6017*a* engages and pulls the supply side restrictor plate 5226*b* of the ink cartridge 5001. The force created by the engagement of the cover hinge projection 6017*a* and the supply side restrictor plate 5226*b* causes disengagement of other portions of the ink cartridge 5001 and the cartridge mounting assembly 6010. The intake side engaging protrusion 6011*a* disengages from the intake side recess 5227*b*. The front supply side projection portion 5224*a* and the front intake side projection portion 5224*b* disengage from the supply side recess 6016*a* and the intake side recess 6016*b*, respectively. The ink supply port 5120 disengages from the ink extraction tube 6015, and the ink detection projection 5140 disengages from the detection device 6014.

After the various features of the ink cartridge 5001 disengage from the various features of the cartridge mounting assembly 6010, as discussed above, dismounting is completed by completely removing the ink cartridge 5001, as shown by the arrow U.

FIG. 79 shows opposite sides of the frame body 5110. FIG. 79(*a*) is a front view of the frame body 5110, and FIG. 79(*b*) is a rear view of the frame body 5110.

The features of the frame body 5110 are discussed above in detail with reference to FIG. 59. FIG. 79 shows an opening 5111*a/b* and a lower central partition wall 5440, which are not shown in FIG. 59. As to the remaining features, various corresponding features are provided on both the front side (FIG. 79(*a*)) and the rear side (FIG. 79(*b*)) of the frame body 5110. A description of those features appearing in both FIG. 59 and FIG. 79 is provided above with reference to FIG. 59. The following features appear only on the rear side of the frame body 5110 (see FIG. 79(*b*)): the outer film contact surface 5112*b* corresponds to the outer film contact surface 5112*a* ; the sidewalls 5400*b* correspond to the sidewalls 5400*a*; an inner film contact surface 5411*b* corresponds to the inner film contact surface 5411*a*; inner film contact surfaces 5412*b*1, 5412*b*2 correspond to inner film contact surface 5412*a*; inner film contact surface 5413*b* corresponds to inner film contact surface 5413*a*; inner film contact surface 5414*b* corresponds to inner film contact surface 5414*a*; inner film contact surface 5415*b* corresponds to inner film contact surface 5415*a*; inner film contact surface 5416*b* corresponds to inner film contact surface 5416*a*; inner film contact surface 5417*b* corresponds to inner film contact surface 5417*a*; and inner film contact surface 5418*b* corresponds to inner film contact surface 5418*a*. As these structures correspond to the structures described in FIG. 59, further description is not provided.

FIG. 80 is a partial cross sectional view of the frame 5015, showing the direction of ink flow out of the cartridge and the direction of air flow through into the cartridge. As shown in FIG. 80, ink flows out of the frame 5015 along the ink flow path shown by the arrow K when the ink extraction tube 6015 is inserted into the ink supply valve mechanism insertion portion 5800. Ink enters the ink supply chamber 5801 through the ink supply aperture 5423, and then flows through the ink supply chamber aperture 5421 into the ink supply valve mechanism insertion portion 5800. In the ink supply valve mechanism insertion portion 5800, the ink flows, in order, through the cover through holes 5683 of the cover member 5680, the first pedestal through holes 5662*b* and second pedestal through holes 5663, the pedestal through grooves 5664, the ink flow path 5634 of the second spring member 5650, the slider through hole 5645, the ink flow path 5634 of the first spring member 5630, a flow path formed between the first spring member 5630 and the valve receiving portions 5628, 5629, ink flow paths 5627 of the valve member 5620, and the ink extraction tube 6015. Ink also flows downwardly around a circumferential edge of the ink supply valve assembly 5501.

Air flows into the frame 5015 along the air flow path shown by the arrow L when the actuator 5721*a* contacts the mounting base 6013 of the inkjet printer 6000. As shown in FIG. 80, when the actuator 5721*a* is actuated, air flows, in order, through the intake valve jacket 5700, the air flow path 5715 of the joint member 5710, the air flow paths 5727 of the valve member/actuator 5720, the air flow path 5734 of the first spring member 5730, the slider through hole 5745 of the slider member 5740, the air flow path 5754 of the second spring member 5750, the lower air intake chamber aperture 5434, and into the lower air intake chamber 5431. Air also flows upwardly around a circumferential edge of the air intake valve assembly 5511.

FIG. 81 shows an ink dispensing portion 5420 of the frame body 5110. FIG. 81(*a*) is a rear view of the ink dispensing portion 5420, FIG. 81(*b*) is a cross sectional view of the ink dispensing portion 5420, FIG. 81(*c*) is a rear view of the ink dispensing portion 5420, and FIG. 81(*d*) is a rear view of the ink dispensing portion 5420.

The ink dispensing portion includes an ink dispensing portion base wall 5424 that encloses an ink dispensing portion chamber 5424*a*, and an ink dispensing portion semi-conical wall 5422 that encloses ink supply semi-conical chamber 5426. The ink dispensing portion chamber 5424*a* and the ink supply semi-conical chamber 5426 are joined through the ink supply aperture 5423, and the ink supply semi-conical chamber 5426 is joined to the ink supply chamber 5116 through the ink supply chamber aperture 5421. As can be seen in FIG. 81(*a*), the ink dispensing portion chamber 5424*a* and the ink supply aperture 5423 are located in a position lower than the sidewall 400*b* when the ink cartridge 5001 is installed in the inkjet printer 6000. Accordingly, as shown in FIG. 81(*c*), ink accumulates in the ink dispensing portion chamber 5424*a* when the ink cartridge 5001 is installed in the inkjet printer 6000, and is dispensed out of the ink cartridge 5001 through the ink supply aperture 5423 and the ink supply chamber aperture 5421 as shown by the arrow C. Because of the position of the ink dispensing portion chamber 5424*a* when the ink cartridge 5001 is installed in the inkjet printer 6000 (lower than a remainder of the frame body 5110), only the smallest amount of ink D may be remaining in the ink cartridge 5001 before the ink cartridge 5001 is no longer able to dispense ink. As a result, the ink cartridge 5001 can efficiently dispense a large proportion of stored ink.

FIG. 82 shows an air intake portion 5430 of the frame body 5110. FIG. 82(*a*) is a perspective view of the air intake portion 5430, FIG. 82(*b*) is a rear view of the air intake portion 5430, and FIG. 82(*c*) is a front view of the air intake portion 5430.

As shown in FIG. 82(*a*), the air intake portion 5430 includes the lower air intake chamber 5431, the upper air intake chamber 5432, and the central air intake passage 5433 extending between the lower air intake chamber 5431 and the upper air intake chamber 5432. The lower air intake chamber 5431 is defined by a lower air intake chamber wall 5431*a*, and the upper air intake chamber 5432 is defined by an upper air intake chamber wall 5432*a*. The lower air intake chamber aperture 5434 is provided near a rear surface 5437*b* of the air intake portion 5430 and connects the lower air intake chamber 5431 to the air intake chamber 5117. The lower air intake aperture 5433*a* connects the lower air intake chamber 5431 to the central air intake passage 5433. The middle air intake aperture 5433*b* connects the central air intake passage 5433 to the upper air intake chamber 5432. The upper air intake aperture 5435 is provided at a front surface 5437*a* of the air intake portion 5430 and connects the air intake portion 5430 to a remainder of the front side of the frame body 5110, and the upper air intake through hole 5436 connects the air intake portion 5430 to the rear side of the frame body 5110. As shown in FIGS. 82(*b*) and (*c*), the features of the air intake portion 5430 are arranged so that, even when the ink cartridge 5001 is filled to capacity with ink, air can enter into the ink cartridge 5001 from the air intake chamber 5117, and ink will not leak out of the ink cartridge 5001 through the air intake chamber 5117.

FIG. 83 shows an ink filling portion 5450 of the frame body 5110. FIG. 83(*a*) is a rear view of the ink filling portion 5450, and FIG. 83(*b*) is cross sectional view of the ink filling portion 5450.

As shown in FIG. 83(*a*), the ink filling portion 5450 includes the ink filling chamber wall 5451, the ink filling aperture 5452, and the ink filling structure 5453. The ink filling chamber wall 5451 has an open end (ink filling chamber opening 5451*a*) and a closed end (ink filling chamber base wall 5451*b*). As discussed above, the stopper 5520 can be inserted into the ink filling portion 5450 via the ink filling chamber opening 5451*a*. The ink filling structure 5453 includes an inverted horseshoe-shaped ink filling structure wall 5453*a* and ink filling structure tips 5454. The ink filling structure 5453 is provided on an outer surface of the ink filling chamber wall 5451, and the ink filling aperture 5452 protrudes through the ink filling chamber wall 5451 to a location near the base of the ink filling structure 5453. By virtue of this structure ink can exit the ink filling aperture 5452 at a relatively low position and enter the ink storage space at a relatively high position. That is, the ink filling structure 5453 is configured so that the ink cartridge 5001 can be filled with ink to a level higher than the ink filling aperture 5452, when the ink cartridge 5001 is in an upright position. Thus, it is possible to more efficiently use the space of the ink storage space of the frame body 5110.

FIG. 84 shows operation of the detector 5470. FIG. 84(*a*) is a front view of the frame body 5110 filled with ink, and FIG. 84(*b*) is a front view of the frame body 5110 emptied of ink. As shown FIG. 84(*a*), when the frame body 5110 is filled with ink, the detector plate 5473*c* of the detector 5470 is located within the ink detection projection 5140 at a location between the light emitting portion 6014*a* and the light receiving portion of the detection device 6014 of the inkjet printer 6000. In this state, the detector plate 5473*c* prevents light emitted by the light emitting portion 6014*a* from reaching the light receiving portion. When this obstruction takes place, the detection device 6014 determines that there is sufficient ink in the frame body 5110 to conduct printing operations. As shown in FIG. 84(*b*), when the frame body 5110 is emptied of ink, the detector plate 5473*c* has moved out of the location between the light emitting portion 6014*a* and the light receiving portion of the detection device 6014. In this state, light emitted by the light emitting portion 6014*a* reaches the light receiving portion, and the detection device 6014 determines that there is not sufficient ink in the frame body 5110 to conduct printing operations.

The detector 5470 (and thus the detector plate 5473*c* ) moves in response to changes in an amount of ink in the frame body 5110. In particular, the detector float 5471 is buoyant in ink. Accordingly, as the level of ink rises, the detector float 5471 rises also. The detector 5470 is rotatably mounted to the frame body 5110, and the detector plate 5473*c* is located on an opposite end of the detector 5470 from the detector float 5471. Accordingly, as the detector float 5471 rises with the level of ink, the detector plate 5473*c* is rotated downwardly into the location between the light emitting portion 6014*a* and the light receiving portion of the detection device 6014. Likewise, as the detector float 5471 sinks with the level of ink, the detector plate 5473*c* is rotated upwardly out of the location between the light emitting portion 6014*a* and the light receiving portion of the detection device 6014. Thus, movement of the detector plate 5473*c* with the level of ink in the frame body 5110 allows detection of the presence, absence and/or amount of ink in the frame body 5110, when the ink cartridge 5001 is installed in the inkjet printer 6000.

FIG. 85 shows the ink detection projection 5140 of the frame body 5110. FIG. 85(*a*) is a front view of the ink detection projection 5140, and FIGS. 85(*b*) and (*c*) are cross sectional views of the ink detection projection 5140.

As shown in FIG. 85(*a*), the ink detection projection 5140 includes an ink detection recess 5141 bounded by an ink detection supply wall 5141*a* and an ink detection intake sidewall 5141*b*. Within the ink detection recess 5141, ink detection restricting wall 5142 is provided. In proximity to the ink detection projection, a detector area sidewall 5143*a* and a detector area partition 5143 are provided.

As can be seen in FIGS. 85(*b*) and (*c*), when the ink cartridge 5001 is sufficiently full of ink, the detector plate 5473*c* of the detector 5470 is positioned within the ink detection recess 5141. The detector plate 5473*c* is seated on the ink detection restricting wall 5142. These structures ensure that, when the ink cartridge 5001 is sufficiently full of ink, the detector plate 5473*c* is positioned such that the detector plate 5473*c* is positioned between the light emitting portion 6014*a* and the light receiving portion of the detection device 6014 of the inkjet printer 6000.

FIG. 86 shows the detector 5470. FIG. 86(*a*) is a side view of the detector 5470, and FIG. 86(*b*) is an end view of the detector 5470. The various features of the detector 5470, discussed above, are shown in FIG. 86. In particular, the detector 5470 includes the detector float 5471, a detector mounting portion 5472 including the detector mounting pin 5472*a*, and the detector arm 5473. The detector arm 5473 includes the float arm portion 5473*a* adjacent to the detector float 5471, the detector plate 5473*c* at an end of the detector 5470 opposite from the detector float 5471, and the plate arm portion 5473*b* extending between the float arm portion 5473*a* and the detector plate 5473*c*. The detector arm 5473 is further provided with detector ribs 5473*d* protruding from lateral surfaces of the detector arm 5473 to improve the structural stability of the detector arm 5473.

FIG. 86 further shows the detector plate pins 5473*e*1, 5473*e*2. The detector plate pins 5473*e*1, 5473*e*2 extend outwardly from each face of the detector plate 5473*c*, and thus prevent the relatively large flat surface of the detector plate 5473*c* from "sticking" to similarly flat surfaces of the inner surface of the ink detection recess 5141 due to the presence of ink between the flat surfaces. The pins 5473*e*1, 5473*e*2 thus prevent the potential erroneous ink detection that could result if the detector plate 5473*c* adheres to an inner surface of the ink detection recess 5141 as the ink level in the ink cartridge 5001 declines.

While this invention has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. An ink cartridge, comprising:

a cartridge case enclosing an ink chamber;

a path extending from the ink chamber to an exterior of the ink cartridge;

a valve member provided in the path, the valve member having a first state in which communication between the ink chamber and the exterior of the ink cartridge along the path is permitted and a second state in which communication between the ink chamber and the exterior of the ink cartridge along the path is prevented; and a first urging member provided on an ink chamber-side of the valve member in the path, the first urging member being capable of urging the valve member along the path toward the exterior of the cartridge and comprising an ink chamber-side portion, an exterior-side portion and an intermediate portion provided between the ink chamber-side portion and the exterior-side portion, the ink chamber-side portion and the exterior-side portion each having greater structural strength than the intermediate portion;

wherein:

the first urging member is formed of a resin or rubber material having elasticity; and when the valve member is in the first state, the first urging member is compressed in a direction of the path.

2. The ink cartridge according to claim 1, further comprising a second urging member, wherein when the valve member is in the second state, the second urging member is compressed in the direction of the path.

3. The ink cartridge according to claim 1, further comprising a second urging member, wherein the first urging member and the second urging member are aligned in a direction in which the valve member is urged by the first urging member.

4. The ink cartridge according to claim 1, further comprising a second urging member wherein:

the first urging member has a first shape and the second urging member has a second shape; and the first shape and the second shape are substantially symmetrical about a plane situated between the first urging member and the second urging member, the plane being substantially perpendicular to a direction in which the valve member is urged by the first urging member.

5. The ink cartridge according to claim 1, wherein an entirety of the first urging member is provided on the ink chamber-side of the valve member on the path.

6. The ink cartridge according to claim 1, wherein the first urging member has a hollow portion, and when the valve member is in the first state, the ink chamber and the exterior of the cartridge communicate through the hollow portion.

7. The ink cartridge according to claim 6, wherein:

the hollow portion has a width in a direction transverse to a direction in which the valve member is urged by the first urging member; and the width increases toward at least one of an ink chamber-side and an exterior-side of the first urging member.

8. The ink cartridge according to claim 6, wherein:

the hollow portion is bounded by a wall; and a first thickness of the wall in the ink chamber-side portion and a second thickness of the wall in the exterior-side portion are each greater than a third thickness of the wall in the intermediate portion.

9. The ink cartridge according to claim 6, wherein:

the hollow portion is bounded by a wall;

a first section of the wall in the ink chamber-side portion extends in a first direction substantially parallel to a direction in which the valve member is urged by the first urging member;

a second section of the wall in the exterior-side portion extends in the first direction; and a third section of the wall in the intermediate portion extends in a second direction different from the first direction.

10. The ink cartridge according to claim 1, wherein the resin or rubber material is combustible.

11. The ink cartridge according to claim 1, further comprising an insertion port for receiving a hollow ink extraction member of an inkjet recording device when the ink cartridge is installed in the inkjet recording device, wherein when the insertion port receives the ink extraction member, the valve member is moved from the second state to the first state.

12. The ink cartridge according to claim 11, wherein:

the cartridge case comprises a hollow cylindrical member;

the path extends through the hollow cylindrical member;

at least a portion of each of the first urging member and the valve member is situated in the cylindrical member;

the first urging member is on an ink chamber-side of the valve member in the cylindrical member; and the valve member is on an ink chamber-side of the insertion port in the cylindrical member.

13. The ink cartridge of claim 1, wherein when the valve member is in the first state, at least one of ink and air is permitted to pass between the ink chamber and the exterior of the cartridge.

14. An ink cartridge, comprising:

a cartridge case enclosing an ink chamber;

a path extending from the ink chamber to an exterior of the ink cartridge;

a valve member provided in the path, the valve member having a first state in which communication between the ink chamber and the exterior of the ink cartridge along the path is permitted and a second state in which communication between the ink chamber and the exterior of the ink cartridge along the path is prevented; and a first urging member provided on an ink chamber-side of the valve member in the path, the first urging member being capable of urging the valve member along the path toward the exterior of the cartridge;

wherein:

the first urging member is formed of a resin or rubber material having elasticity;

an entirety of the first urging member is provided on the ink chamber-side of the valve member on the path;

the first urging member comprises an ink chamber-side portion, an exterior-side portion and an intermediate portion provided between the ink chamber-side portion and the exterior-side portion; and the ink chamber-side portion and the exterior-side portion each has greater structural strength than the intermediate portion.

15. The ink cartridge according to claim 14, further comprising a second urging member, wherein when the valve member is in the second state, the second urging member is compressed in the direction of the path.

16. The ink cartridge according to claim 14, further comprising a second urging member, wherein the first urging member and the second urging member are aligned in a direction in which the valve member is urged by the first urging member.

17. The ink cartridge according to claim 14, further comprising a second urging member, wherein:

the first urging member has a first shape and the second urging member has a second shape; and the first shape and the second shape are substantially symmetrical about a plane situated between the first urging member and the second urging member, the plane being substantially perpendicular to a direction in which the valve member is urged by the first urging member.

18. The ink cartridge according to claim 14, wherein when the valve member is in the first state, the first urging member is compressed in a direction of the path.

19. The ink cartridge according to claim 14, wherein the first urging member has a hollow portion, and when the valve member is in the first state, the ink chamber and the exterior of the cartridge communicate through the hollow portion.

20. The ink cartridge according to,claim 19, wherein:

the hollow portion is bounded by a wall; and a first thickness of the wall in the ink chamber-side portion and a second thickness of the wall in the exterior-side portion are each greater than a third thickness of the wall in the intermediate portion.

21. The ink cartridge according to claim 19, wherein:

the hollow portion is bounded by a wall;

a first section of the wall in the ink chamber-side portion extends in a first direction substantially parallel to a direction in which the valve member is urged by the first urging member;

a second section of the wall in the exterior-side portion extends in the first direction; and a third section of the wall in the intermediate portion extends in a second direction different from the first direction.

22. The ink cartridge according to claim 19, wherein:

the hollow portion has a width in a direction transverse to a direction in which the valve member is urged by the first urging member; and the width increases toward at least one of an ink chamber-side and an exterior-side of the first urging member.

23. The ink cartridge according to claim 14, wherein the resin or rubber material is combustible.

24. The ink cartridge according to claim 14, further comprising an insertion port for receiving a hollow ink extraction member of an inkjet recording device when the ink cartridge is installed in the inkjet recording device, wherein when the insertion port receives the ink extraction member, the valve member is moved from the second state to the first state.

25. The ink cartridge according to claim 24, wherein:

the cartridge case comprises a hollow cylindrical member;

the path extends through the hollow cylindrical member;

at least a portion of each of the first urging member and the valve member is situated in the cylindrical member;

the first urging member is on an ink chamber-side of the valve member in the cylindrical member; and the valve member is on an ink chamber-side of the insertion port in the cylindrical member.

26. The ink cartridge of claim 14, wherein when the valve member is in the first state, at least one of ink and air is permitted to pass between the ink chamber and the exterior of the cartridge.

* * * * *